US010843837B2

(12) United States Patent
Sanfilippo et al.

(10) Patent No.: US 10,843,837 B2
(45) Date of Patent: Nov. 24, 2020

(54) APPARATUS AND METHOD FOR MAKING A FLEXIBLE PACKAGE

(71) Applicant: PRIMAPAK, LLC, Elgin, IL (US)

(72) Inventors: John E. Sanfilippo, Barrington Hills, IL (US); James J. Sanfilippo, Barrington Hills, IL (US); Francisco Javier Soria, West Chicago, IL (US)

(73) Assignee: PRIMAPAK, LLC, Elgin, IL (US)

( * ) Notice: Subject to any disclaimer, the term of this patent is extended or adjusted under 35 U.S.C. 154(b) by 236 days.

(21) Appl. No.: 15/759,669

(22) PCT Filed: Sep. 13, 2016

(86) PCT No.: PCT/US2016/051445
§ 371 (c)(1),
(2) Date: Mar. 13, 2018

(87) PCT Pub. No.: WO2017/048676
PCT Pub. Date: Mar. 23, 2017

(65) Prior Publication Data

US 2019/0039767 A1 Feb. 7, 2019

Related U.S. Application Data

(60) Provisional application No. 62/220,941, filed on Sep. 18, 2015.

(51) Int. Cl.
*B65B 61/24* (2006.01)
*B65B 9/207* (2012.01)
(Continued)

(52) U.S. Cl.
CPC ..... *B65B 61/24* (2013.01); *B65B 9/20* (2013.01); *B65B 9/207* (2013.01); *B65B 1/24* (2013.01); *B65B 43/10* (2013.01)

(58) Field of Classification Search
CPC ..... B65B 61/24; B65B 43/10; B65B 43/185; B65B 43/285; B65B 1/24; B65B 9/207;
(Continued)

(56) References Cited

U.S. PATENT DOCUMENTS 724,316 A 3/1903 Staples
1,102,750 A 7/1914 Hawkins
(Continued)

FOREIGN PATENT DOCUMENTS

CH 614903 A5 12/1979
DE 1913258 U * 4/1965
(Continued)

OTHER PUBLICATIONS

International Application No. PCT/US2016/051445, Invitation to Pay Additional Fees, mailed Dec. 16, 2016.
(Continued)

*Primary Examiner* — Robert F Long
*Assistant Examiner* — Eduardo R Ferrero
(74) *Attorney, Agent, or Firm* — Marshall, Gerstein & Borun LLP

(57) ABSTRACT

An apparatus for forming a package can include a first station for receiving a package from a packaging machine, the package having a trailing seal extending outwardly from a panel of the package. At the first station, the package is received in a forming box, which is rotated about the apparatus. The forming box with the package is rotated to a second station in which a flap folding plate extends to fold the trailing seal and apply a pressure to the panel of the package to flatten the panel of the package against an internal pressure of the package. The forming box then optionally rotates to a third station in which a holding plate maintains the pressure to the panel of the package for an additional dwell time. Finally the forming box rotates to a
(Continued)

fourth position in which the package is released from the forming box.

25 Claims, 104 Drawing Sheets

(51) Int. Cl.
*B65B 9/20* (2012.01)
*B65B 1/24* (2006.01)
*B65B 43/10* (2006.01)

(58) Field of Classification Search
CPC .. B65B 9/20; B65B 9/06; B65B 19/00; B65B 19/24; B65B 5/06; B65B 5/105; B65B 35/44; B65B 57/04; B65D 5/48014; B65D 71/10; B31B 50/00; B31B 50/80; B31B 50/802; B31B 50/004; B31B 50/0044; B31B 2100/00; B31B 2120/30
USPC ..... 53/449, 234, 173, 238, 531; 493/164, 493/252, 264, 31, 123, 313, 326
See application file for complete search history.

(56) References Cited

U.S. PATENT DOCUMENTS 1,389,197 A 8/1921 Kusterer
1,395,229 A 10/1921 Inman et al.
1,747,618 A 2/1930 Burns
1,930,285 A 10/1933 Robinson
2,017,176 A 10/1935 Andrews
2,041,227 A 5/1936 Chalmers
2,048,122 A 7/1936 Howard
2,092,858 A 9/1937 Richard
2,106,907 A 2/1938 Brunt et al.
2,113,431 A 4/1938 Milliken
2,153,310 A 4/1939 Newman
2,180,841 A 11/1939 Vogt
2,239,398 A 4/1941 Palmer
2,251,283 A 8/1941 Johnson
2,259,866 A 10/1941 Stokes
2,260,064 A 10/1941 Stokes
2,291,063 A 7/1942 Staude et al.
2,311,857 A 2/1943 Noah
2,328,579 A 9/1943 Pelosi
2,330,015 A 9/1943 Stokes
2,339,156 A 1/1944 Duane
2,352,766 A 7/1944 Bogue
2,365,159 A 12/1944 Walton
2,385,898 A 10/1945 Waters
2,416,332 A 2/1947 Lehman
2,495,807 A 1/1950 Buttery
2,508,962 A 5/1950 Moore
2,524,766 A 10/1950 Carroll
2,619,226 A 11/1952 Adams
2,684,807 A 7/1954 Gerrish
2,695,847 A 11/1954 Fisher
2,719,663 A 10/1955 Meyer-Jagenberg
2,737,338 A 3/1956 Moore
2,749,245 A 6/1956 Peters
2,750,093 A 6/1956 Moore
2,758,775 A 8/1956 Moore
2,787,410 A 4/1957 Moore
2,819,831 A 1/1958 Polarek et al.
2,823,795 A 2/1958 Moore
2,864,710 A 12/1958 Pottle et al.
2,936,940 A 5/1960 Berghgracht
2,970,735 A 2/1961 Jacke
3,006,257 A 10/1961 Orsini
3,054,550 A 9/1962 Comstock
3,091,902 A 6/1963 Grafingholt
3,093,292 A 6/1963 Ahlbor
3,111,223 A 11/1963 Jacobi
3,116,153 A 12/1963 Seiferth et al.
3,125,275 A 3/1964 Ehe
3,127,082 A 3/1964 Meyer-Jagenberg
3,143,276 A 8/1964 Nichols
3,155,304 A 11/1964 Beerend
3,172,769 A 3/1965 Horan
3,185,379 A 5/1965 Kohlhaas
3,206,094 A 9/1965 Humphrey
3,228,584 A 1/1966 Ashton
3,228,587 A 1/1966 Segebrecht
3,235,168 A 2/1966 Nichols
3,249,286 A 5/1966 Palmer
3,259,303 A 7/1966 Repko
3,259,507 A 7/1966 Smith
3,272,423 A 9/1966 Bjarno
3,275,214 A 9/1966 Carangelo
3,282,024 A * 11/1966 Anderson ..... B65B 5/105 53/247
3,299,611 A 1/1967 Hendrick et al.
3,314,591 A 4/1967 Cheeley
3,318,204 A 5/1967 Crane
3,325,077 A 6/1967 Boegershausen
3,326,097 A 6/1967 Lokey
3,339,721 A 9/1967 Goldstein
3,349,959 A 10/1967 Watkins
3,373,917 A 3/1968 Cox
3,380,646 A 4/1968 Doyen et al.
3,385,176 A * 5/1968 Whitaker ..... B65B 19/24 493/207
3,416,410 A * 12/1968 Whitaker ..... B65B 19/24 493/31
3,423,007 A 1/1969 Christensson
3,426,499 A 2/1969 Paige
3,434,652 A 3/1969 Shore
3,437,258 A 4/1969 Kugler
3,462,067 A 8/1969 Shore
3,505,779 A 4/1970 Kopp
3,515,270 A 6/1970 Yang et al.
3,521,807 A 7/1970 Weisberg
3,562,392 A 2/1971 Mylius
3,599,387 A 8/1971 James
3,604,491 A 9/1971 Spiess
3,621,637 A 11/1971 Sternau
3,738,567 A 6/1973 Ruda
3,739,977 A 6/1973 Shapiro et al.
3,785,112 A 1/1974 Leasure et al.
3,788,033 A * 1/1974 Martensson ..... B29O 65/7882 53/565
3,838,787 A 10/1974 McCloskey
3,917,158 A 11/1975 Dorofachuk et al.
3,935,993 A 2/1976 Doyen et al.
3,940,054 A 2/1976 Goebel et al.
3,968,921 A 7/1976 Jewell
3,980,225 A 9/1976 Kan
4,004,398 A 1/1977 Larsson et al.
4,041,851 A 8/1977 Jentsch
4,069,348 A 1/1978 Bush
4,082,214 A 4/1978 Baker
4,082,216 A 4/1978 Clarke
4,084,393 A * 4/1978 Focke ..... B65B 19/226 493/164
4,101,051 A 7/1978 Reil
4,129,976 A 12/1978 Grundler et al.
4,185,754 A 1/1980 Julius
4,192,420 A 3/1980 Worrell, Sr. et al.
4,197,949 A 4/1980 Carlsson
4,260,061 A 4/1981 Jacobs
4,291,826 A 9/1981 Swanson
4,308,679 A 1/1982 Ray, III et al.
4,338,766 A 7/1982 Hamilton
D265,777 S 8/1982 Elzea et al.
4,345,133 A 8/1982 Cherney et al.
4,345,393 A 8/1982 Price et al.
D266,049 S 9/1982 Conti
4,353,497 A 10/1982 Bustin
4,361,266 A 11/1982 Killy
4,367,842 A 1/1983 Rausing
4,420,080 A 12/1983 Nakamura
4,441,648 A 4/1984 Portsmouth
4,442,656 A 4/1984 Wylie, Sr.

(56) References Cited

U.S. PATENT DOCUMENTS 4,531,668 A 7/1985 Forbes, Jr.
4,552,269 A 11/1985 Chang
4,554,190 A 11/1985 McHenry et al.
4,576,309 A 3/1986 Tzifkansky et al.
4,589,145 A 5/1986 Van Erden et al.
D286,745 S 11/1986 Forbes, Jr.
4,621,000 A 11/1986 Frick
4,651,874 A 3/1987 Nakamura
4,663,915 A 5/1987 Van Erden et al.
4,674,129 A 6/1987 Janhonen
4,679,693 A 7/1987 Forman
4,679,701 A 7/1987 Ackermann et al.
4,687,104 A 8/1987 Ielmini
4,696,404 A 9/1987 Corella
4,738,365 A 4/1988 Prater
D297,214 S 8/1988 Forbes, Jr.
4,776,830 A * 10/1988 Fujikawa ..... B65B 3/025 493/122
4,786,192 A 11/1988 Graves et al.
4,790,436 A 12/1988 Nakamura
4,798,295 A 1/1989 Rausing
4,804,137 A 2/1989 Harby
4,808,421 A 2/1989 Mendenhall et al.
4,811,848 A 3/1989 Jud
4,837,849 A 6/1989 Erickson et al.
4,840,270 A 6/1989 Caputo et al.
4,848,575 A 7/1989 Nakamura et al.
4,851,246 A 7/1989 Maxwell et al.
D304,016 S 10/1989 Forbes, Jr.
4,881,360 A 11/1989 Konzal et al.
4,886,373 A 12/1989 Corella
4,909,017 A 3/1990 McMahon et al.
4,954,124 A 9/1990 Erickson et al.
4,986,054 A 1/1991 McMahon
D315,099 S 3/1991 Alizard
4,997,416 A 3/1991 Mitchell et al.
5,031,826 A 7/1991 Seufert
5,036,997 A 8/1991 May et al.
5,044,777 A 9/1991 Watkins et al.
5,046,300 A 9/1991 Custer et al.
5,059,036 A 10/1991 Richison et al.
5,062,527 A 11/1991 Westerman
5,065,887 A 11/1991 Schuh et al.
5,078,509 A 1/1992 Center et al.
5,080,643 A 1/1992 Mitchell et al.
5,092,831 A 3/1992 James et al.
5,120,292 A * 6/1992 Ueda ..... B31B 50/00 493/124
5,127,208 A 7/1992 Custer et al.
5,158,371 A 10/1992 Moravek
5,158,499 A 10/1992 Guckenberger
D332,399 S 1/1993 Neff
5,195,829 A 3/1993 Watkins et al.
5,205,651 A 4/1993 Decottignies et al.
5,215,380 A 6/1993 Custer et al.
5,251,809 A 10/1993 Drummond et al.
5,254,073 A 10/1993 Richison et al.
5,255,497 A 10/1993 Zoromski et al.
5,350,240 A 9/1994 Billman et al.
D351,090 S 10/1994 Narsutis
5,352,466 A 10/1994 Delonis
5,353,946 A 10/1994 Behrend
5,356,069 A 10/1994 Bochet et al.
5,366,104 A 11/1994 Armstrong
D354,436 S 1/1995 Krupa
5,417,035 A 5/1995 English
D364,563 S 11/1995 Miller et al.
5,463,851 A 11/1995 Nagai
5,484,101 A 1/1996 Hedberg
5,498,080 A 3/1996 Dalea et al.
5,505,040 A 4/1996 Janssen et al.
5,505,305 A 4/1996 Scholz et al.
5,542,902 A 8/1996 Richison et al.
5,545,420 A 8/1996 Lipinski et al.
5,556,026 A 9/1996 Blankitny
D374,774 S 10/1996 Cassel
5,561,966 A 10/1996 English
5,577,612 A 11/1996 Chesson et al.
5,611,452 A 3/1997 Bonora et al.
5,613,608 A 3/1997 Tronchetti et al.
5,655,706 A 8/1997 Vandiver
D386,001 S 11/1997 Saffran
5,687,848 A 11/1997 Scholz et al.
5,704,480 A 1/1998 Scholz et al.
5,704,541 A 1/1998 Mogard
5,729,957 A * 3/1998 Spada ..... B65B 11/32 53/234
D394,606 S 5/1998 Zorn et al.
5,749,512 A 5/1998 Gingras-Taylor
5,770,839 A 6/1998 Ruebush et al.
5,772,332 A 6/1998 Geller
D395,952 S 7/1998 Buczwinski et al.
5,785,179 A 7/1998 Buczwinski et al.
5,788,121 A 8/1998 Sasaki et al.
5,788,378 A 8/1998 Thomas
5,789,049 A 8/1998 Randles
5,791,465 A 8/1998 Niki et al.
D398,526 S 9/1998 Schwarz et al.
D398,844 S 9/1998 Oberloier
5,799,863 A 9/1998 Capy et al.
5,818,016 A 10/1998 Lorence et al.
5,820,017 A 10/1998 Eliovson et al.
5,826,401 A 10/1998 Bois
5,832,701 A 11/1998 Hauers et al.
5,842,790 A 12/1998 Imer
5,857,613 A 1/1999 Drummond et al.
5,858,543 A 1/1999 Futter et al.
5,862,652 A 1/1999 Schoeler
5,882,749 A 3/1999 Jones et al.
5,882,789 A 3/1999 Jones et al.
5,897,050 A 4/1999 Barnes
D409,484 S 5/1999 Tasker
5,908,246 A 6/1999 Arimura et al.
D412,439 S 8/1999 Cormack
5,937,615 A 8/1999 Forman
5,944,425 A 8/1999 Forman
5,972,396 A 10/1999 Jurgovan et al.
5,983,594 A 11/1999 Forman
5,993,593 A 11/1999 Swartz et al.
5,996,797 A 12/1999 Flaig
6,005,234 A 12/1999 Moseley et al.
6,021,624 A 2/2000 Richison et al.
6,023,914 A 2/2000 Richison et al.
6,026,953 A 2/2000 Nakamura et al.
D421,901 S 3/2000 Hill
D421,902 S 3/2000 Hill
6,036,365 A 3/2000 Imer
6,038,839 A 3/2000 Linkiewicz
6,056,141 A 5/2000 Navarini et al.
6,060,096 A 5/2000 Hanson et al.
D427,056 S 6/2000 Irace et al.
6,088,998 A 7/2000 Malin et al.
6,113,271 A 9/2000 Scott et al.
6,120,183 A 9/2000 Buchanan et al.
D431,464 S 10/2000 Collins et al.
6,132,351 A 10/2000 Lotto et al.
6,137,098 A 10/2000 Moseley et al.
6,139,662 A 10/2000 Forman
6,149,304 A 11/2000 Hamilton et al.
D437,686 S 2/2001 Balzar et al.
6,182,887 B1 2/2001 Ljunstrom et al.
6,229,061 B1 5/2001 Dragoo et al.
6,231,237 B1 5/2001 Geller
6,234,676 B1 5/2001 Galomb et al.
6,245,367 B1 6/2001 Galomb
6,250,048 B1 6/2001 Linkiewicz
6,253,993 B1 7/2001 Lloyd et al.
6,254,907 B1 7/2001 Galomb
6,261,215 B1 7/2001 Imer
D446,014 S 8/2001 Adkins
6,273,610 B1 8/2001 Koyama et al.
6,274,181 B1 8/2001 Richison et al.
6,309,105 B1 10/2001 Palumbo
D450,960 S 11/2001 Boyea et al.

(56) References Cited

U.S. PATENT DOCUMENTS 6,319,184 B1 11/2001 DeMatteis et al.
D452,374 S 12/2001 Kim
6,325,239 B2 12/2001 Randall et al.
6,350,057 B1 2/2002 Forman
6,354,062 B1 3/2002 Haughton et al.
6,361,212 B1 3/2002 Sprehe et al.
6,412,634 B1 7/2002 Telesca et al.
6,420,006 B1 7/2002 Scott
6,423,356 B2 7/2002 Richison et al.
D461,403 S 8/2002 Chomik et al.
6,428,867 B1 8/2002 Scott et al.
6,430,899 B1 8/2002 Cicha
6,431,434 B1 8/2002 Haughton et al.
D463,276 S 9/2002 Piscopo et al.
6,446,796 B1 9/2002 Schmidt
D464,884 S 10/2002 Sumpmann et al.
D464,894 S 10/2002 Mittersinker et al.
6,481,183 B1 11/2002 Schmidt
D466,807 S 12/2002 Buck et al.
6,488,556 B2 12/2002 Galomb
6,502,986 B1 1/2003 Bensur et al.
6,510,673 B1 1/2003 Visona' et al.
6,513,308 B1 2/2003 Meeuwesen et al.
D471,804 S 3/2003 Staples
6,533,456 B1 3/2003 Buchman
D473,461 S 4/2003 Joubert
6,568,150 B2 5/2003 Forman
6,589,622 B1 7/2003 Scott
6,615,567 B2 9/2003 Kuhn et al.
6,659,645 B1 12/2003 Schulz
D485,461 S 1/2004 Sams et al.
6,679,034 B2 1/2004 Kohl et al.
6,695,757 B2 2/2004 Edwards et al.
D487,192 S 3/2004 Farnham et al.
6,702,109 B1 3/2004 Tabuchi
6,719,140 B1 4/2004 Rinsler
6,719,678 B1 4/2004 Stern
D489,530 S 5/2004 Lindsay
6,729,112 B2 5/2004 Kuss et al.
6,736,309 B1 5/2004 Westerman et al.
6,746,388 B2 6/2004 Edwards et al.
6,755,927 B2 6/2004 Forman
6,761,279 B1 7/2004 Martin et al.
6,783,277 B2 8/2004 Edwards et al.
6,817,160 B2 11/2004 Schmidt
6,820,391 B2 11/2004 Barmore et al.
D501,134 S 1/2005 Takahashi et al.
6,845,602 B2 1/2005 Drut
D502,095 S 2/2005 Tucker et al.
D503,336 S 3/2005 Tucker et al.
D504,622 S 5/2005 Takahashi et al.
6,886,313 B2 5/2005 Knoerzer et al.
6,913,389 B2 7/2005 Kannankeril et al.
6,918,532 B2 7/2005 Sierra-Gomez et al.
6,935,086 B2 8/2005 Brenkus et al.
6,953,069 B2 10/2005 Galomb
D513,870 S 1/2006 Rosine et al.
6,986,920 B2 1/2006 Forman et al.
D514,439 S 2/2006 Snedden et al.
7,051,877 B2 5/2006 Lin
7,059,466 B2 6/2006 Lees et al.
7,077,259 B2 7/2006 Breidenbach
7,080,726 B2 7/2006 Breidenbach et al.
D528,010 S 9/2006 Yashima et al.
7,108,441 B2 9/2006 Altonen et al.
7,128,200 B2 10/2006 Lees et al.
D531,894 S 11/2006 Ramirez et al.
7,153,026 B2 12/2006 Galomb
7,156,556 B2 1/2007 Takahashi et al.
D536,608 S 2/2007 Arkins
RE39,505 E 3/2007 Thomas et al.
7,205,016 B2 4/2007 Garwood
7,207,717 B2 4/2007 Steele
7,213,710 B2 5/2007 Cotert
D544,762 S 6/2007 Zimmerman
D545,186 S 6/2007 Liebe et al.
D548,080 S 8/2007 Brown et al.
D551,508 S 9/2007 Friedland et al.
D552,468 S 10/2007 Seum et al.
7,299,608 B2 11/2007 Kohl et al.
7,350,688 B2 4/2008 Sierra-Gomez et al.
D569,719 S 5/2008 Ross
7,371,008 B2 5/2008 Bonenfant
D571,146 S 6/2008 Sanfilippo et al.
D571,197 S 6/2008 Sanfilippo et al.
7,475,781 B2 1/2009 Kobayashi et al.
D591,555 S 5/2009 Sanfilippo et al.
D593,369 S 6/2009 Green et al.
D608,193 S 1/2010 Sanfilippo et al.
7,665,629 B2 2/2010 Julius et al.
7,665,895 B2 2/2010 Takita et al.
7,717,620 B2 5/2010 Hebert et al.
7,744,517 B2 6/2010 Bonenfant
7,780,006 B2 8/2010 Clark, Jr. et al.
D629,296 S 12/2010 De Muynck
D637,577 S 5/2011 Han et al.
7,993,256 B2 8/2011 Takita et al.
8,006,833 B2 8/2011 Clark, Jr. et al.
8,038,349 B2 10/2011 Andersson et al.
D648,302 S 11/2011 Park et al.
8,066,137 B2 11/2011 Sanfilippo et al.
8,074,803 B2 12/2011 Motsch et al.
8,114,451 B2 2/2012 Sierra-Gomez et al.
8,132,395 B2 3/2012 Gehring et al.
8,182,891 B2 5/2012 Scott et al.
8,231,024 B2 7/2012 Sanfilippo et al.
8,245,865 B2 8/2012 Damaghi et al.
8,276,353 B2 10/2012 Reaves et al.
D671,000 S 11/2012 O'Neill et al.
8,308,363 B2 11/2012 Vogt et al.
D676,014 S 2/2013 Chung
D682,244 S 5/2013 Park et al.
D686,181 S 7/2013 Jeong
D689,767 S 9/2013 Clark et al.
8,523,441 B2 9/2013 Goglio et al.
D696,107 S 12/2013 Kimple et al.
8,602,242 B2 12/2013 Sanfilippo et al.
8,602,244 B2 12/2013 Sanfilippo et al.
8,746,483 B2 6/2014 Sierra-Gomez et al.
8,951,591 B2 2/2015 Vogt et al.
2001/0005979 A1 7/2001 Kuss et al.
2001/0010253 A1 8/2001 Forman
2002/0009575 A1 1/2002 DeMatteis
2002/0090879 A1 7/2002 Galomb
2002/0094922 A1 7/2002 Edwards et al.
2002/0112982 A1 8/2002 Stagray et al.
2002/0118896 A1 8/2002 Forman
2002/0144998 A1 10/2002 Lees et al.
2002/0147088 A1 10/2002 Edwards
2003/0001002 A1 1/2003 Haughton et al.
2003/0041564 A1 3/2003 Schmidt
2003/0054929 A1 3/2003 Post et al.
2003/0059130 A1 3/2003 Yoneyama et al.
2003/0063820 A1 4/2003 Buchman
2003/0085265 A1 5/2003 Haim
2003/0100424 A1 5/2003 Barmore et al.
2003/0111523 A1 6/2003 Haugan
2003/0113042 A1 6/2003 Yeager
2003/0152679 A1 8/2003 Garwood
2003/0165602 A1 9/2003 Garwood
2003/0170357 A1 9/2003 Garwood
2003/0170359 A1 9/2003 Garwood
2003/0175392 A1 9/2003 Garwood
2003/0185937 A1 10/2003 Garwood
2003/0185948 A1 10/2003 Garwood
2003/0230504 A1 12/2003 Hamming
2004/0000121 A1* 1/2004 Ichikawa ..... B65B 5/06 53/173
2004/0025476 A1 2/2004 Oliverio et al.
2004/0031244 A1 2/2004 Steele
2004/0040261 A1 3/2004 Troyer et al.
2004/0058103 A1 3/2004 Anderson et al.
2004/0081729 A1 4/2004 Garwood
2004/0089578 A1 5/2004 Lin

(56) References Cited

U.S. PATENT DOCUMENTS

| | | | |
|---|---|---|---|
| 2004/0099570 | A1 | 5/2004 | Cargile |
| 2004/0105600 | A1 | 6/2004 | Floyd |
| 2004/0114838 | A1 | 6/2004 | McGregor |
| 2004/0120611 | A1 | 6/2004 | Kannankeril et al. |
| 2004/0141664 | A1 | 7/2004 | Olsen et al. |
| 2004/0146602 | A1 | 7/2004 | Garwood et al. |
| 2004/0185154 | A1 | 9/2004 | Garwood |
| 2004/0185155 | A1 | 9/2004 | Garwood |
| 2004/0185156 | A1 | 9/2004 | Garwood |
| 2004/0188457 | A1 | 9/2004 | Galomb |
| 2004/0226625 | A1 | 11/2004 | Galomb |
| 2004/0226849 | A1 | 11/2004 | Brenkus et al. |
| 2004/0232029 | A1 | 11/2004 | Cotert |
| 2004/0251163 | A1 | 12/2004 | Conde et al. |
| 2004/0262322 | A1 | 12/2004 | Middleton et al. |
| 2005/0011906 | A1 | 1/2005 | Buck et al. |
| 2005/0031233 | A1 | 2/2005 | Varanese et al. |
| 2005/0053315 | A1 | 3/2005 | Aasen |
| 2005/0069227 | A1 | 3/2005 | Steele |
| 2005/0069230 | A1 | 3/2005 | Takahashi et al. |
| 2005/0084186 | A1 | 4/2005 | Canis |
| 2005/0139645 | A1 | 6/2005 | Shean et al. |
| 2005/0150785 | A1 | 7/2005 | Julius et al. |
| 2005/0189367 | A1 | 9/2005 | Chasid et al. |
| 2005/0208188 | A1 | 9/2005 | Garwood |
| 2005/0238766 | A1 | 10/2005 | Henderson et al. |
| 2005/0265636 | A1 | 12/2005 | Michalsky |
| 2005/0276525 | A1 | 12/2005 | Hebert et al. |
| 2005/0284776 | A1 | 12/2005 | Kobayashi et al. |
| 2006/0006049 | A1 | 1/2006 | Breidenbach et al. |
| 2006/0016865 | A1 | 1/2006 | Berglin et al. |
| 2006/0076352 | A1 | 4/2006 | Peterson et al. |
| 2006/0080944 | A1 | 4/2006 | Annehed et al. |
| 2006/0113212 | A1 | 6/2006 | Steele |
| 2006/0126970 | A1 | 6/2006 | Perell |
| 2006/0169691 | A1 | 8/2006 | Rothschild et al. |
| 2006/0210202 | A1 | 9/2006 | Plourde |
| 2006/0283750 | A1 | 12/2006 | Villars et al. |
| 2006/0285777 | A1 | 12/2006 | Howell et al. |
| 2007/0080078 | A1 | 4/2007 | Hansen et al. |
| 2007/0082096 | A1 | 4/2007 | Dougherty et al. |
| 2007/0084142 | A1 | 4/2007 | Matthews |
| 2007/0151887 | A1 | 7/2007 | Clark et al. |
| 2008/0053860 | A1 | 3/2008 | McDonald |
| 2008/0274686 | A1 | 11/2008 | Kupferberg et al. |
| 2009/0039078 | A1 | 2/2009 | Sanfilippo et al. |
| 2009/0120828 | A1 | 5/2009 | Sanfilippo et al. |
| 2009/0232425 | A1 | 9/2009 | Tai et al. |
| 2009/0273179 | A1 | 11/2009 | Scott et al. |
| 2010/0002963 | A1 | 1/2010 | Holbert et al. |
| 2010/0040311 | A1 | 2/2010 | Plate |
| 2010/0092112 | A1 | 4/2010 | Goglio et al. |
| 2010/0113240 | A1 | 5/2010 | Takita et al. |
| 2010/0140129 | A1 | 6/2010 | Sanfilippo et al. |
| 2010/0154264 | A1 | 6/2010 | Scott et al. |
| 2010/0278454 | A1 | 11/2010 | Huffer |
| 2011/0058755 | A1 | 3/2011 | Guibert |
| 2011/0297690 | A1 | 12/2011 | Teys et al. |
| 2012/0008884 | A1 | 1/2012 | Murray |
| 2012/0125937 | A1 | 5/2012 | Ahlstrom et al. |
| 2012/0128835 | A1 | 5/2012 | Lyzenga et al. |
| 2012/0177307 | A1 | 7/2012 | Duan et al. |
| 2012/0275727 | A1 | 11/2012 | Chang |
| 2012/0321229 | A1 | 12/2012 | Surdziel et al. |
| 2013/0004626 | A1 | 1/2013 | Renders et al. |
| 2013/0011527 | A1 | 1/2013 | Renders et al. |
| 2013/0114918 | A1 | 5/2013 | Lyzenga et al. |
| 2013/0266244 | A1 | 10/2013 | Doll et al. |
| 2014/0083897 | A1 | 3/2014 | Sanfilippo et al. |
| 2014/0102936 | A1 | 4/2014 | Sanfilippo et al. |
| 2014/0109522 | A1 | 4/2014 | Sanfilippo et al. |
| 2014/0185962 | A1 | 7/2014 | Sanfilippo et al. |
| 2014/0196406 | A1 | 7/2014 | Sanfilippo et al. |
| 2014/0301674 | A1 | 10/2014 | Sanfilippo et al. |
| 2014/0307985 | A1 | 10/2014 | Sanfilippo et al. |
| 2014/0328552 | A1 | 11/2014 | Sanfilippo et al. |
| 2015/0001234 | A1 | 1/2015 | Sanfilippo et al. |

FOREIGN PATENT DOCUMENTS

| | | | |
|---|---|---|---|
| DE | 1913258 | U | 4/1965 |
| DE | 102010019867 | A1 | 9/2011 |
| EP | 0822142 | A1 | 2/1998 |
| EP | 0879767 | A1 | 11/1998 |
| EP | 1106508 | A1 | 6/2001 |
| EP | 1437311 | A1 | 7/2004 |
| EP | 1508531 | A1 | 2/2005 |
| EP | 1547924 | A1 | 6/2005 |
| EP | 1637472 | A1 | 3/2006 |
| EP | 1749756 | A2 | 2/2007 |
| EP | 2347971 | A1 | 7/2011 |
| EP | 2586716 | A1 | 5/2013 |
| FR | 2766794 | A1 | 2/1999 |
| FR | 2772009 | A1 | 6/1999 |
| GB | 1311447 | A | 3/1973 |
| GB | 2399331 | A | 9/2004 |
| IT | 1274100 | B | 7/1997 |
| JP | 01167084 | | 6/1989 |
| JP | 01226579 | | 9/1989 |
| JP | 01267182 | | 10/1989 |
| JP | 09142551 | | 6/1997 |
| JP | 10-203560 | | 8/1998 |
| JP | 2005320032 | A | 11/2005 |
| WO | WO-86/06344 | A1 | 11/1986 |
| WO | WO-94/11270 | A1 | 5/1994 |
| WO | WO-00/12407 | A1 | 3/2000 |
| WO | WO-02/085726 | A1 | 10/2002 |
| WO | WO-2004/024588 | A1 | 3/2004 |
| WO | WO-2004/110885 | | 12/2004 |
| WO | WO-2006/091821 | A2 | 8/2006 |
| WO | WO-2007/058689 | A1 | 5/2007 |
| WO | WO-2009/061959 | A1 | 5/2009 |

OTHER PUBLICATIONS

International Application No. PCT/US2016/051445, International Search Report and Written Opinion, dated Feb. 17, 2017.

International Application No. PCT/US2016/051445, International Preliminary Report on Patentability, dated Mar. 20, 2018.

Brody et al., *Encyclopedia of Packaging Technology*, 2nd ed., New York, NY: John Wiley & Sons (1993).

Photographs of flexible container packaging, "Minibrick Pack", from Sonoco (Hartsville, South Carolina, USA) (became aware of in Dec. 2007).

SBS Special Top Design Machine, product sheet from Rovema Packaging Machines L.P. (Lawrenceville, Georgia, USA) (1 pg.) (2005).

* cited by examiner

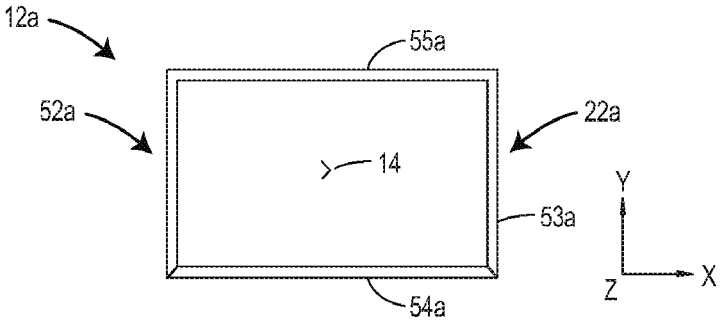
FIG. 3A
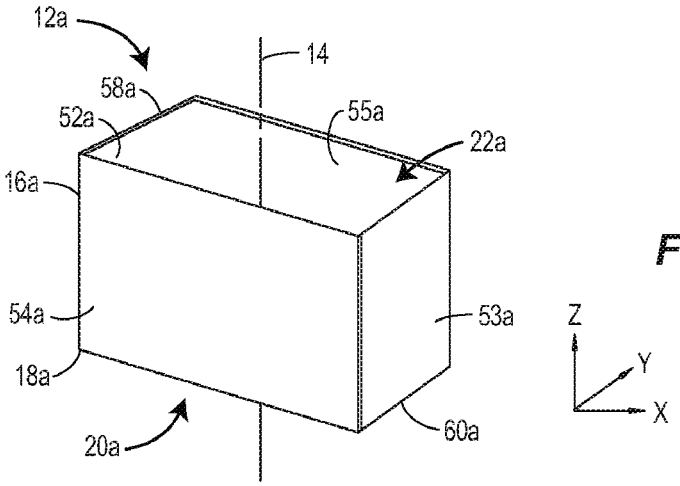
FIG. 3B
FIG. 7A
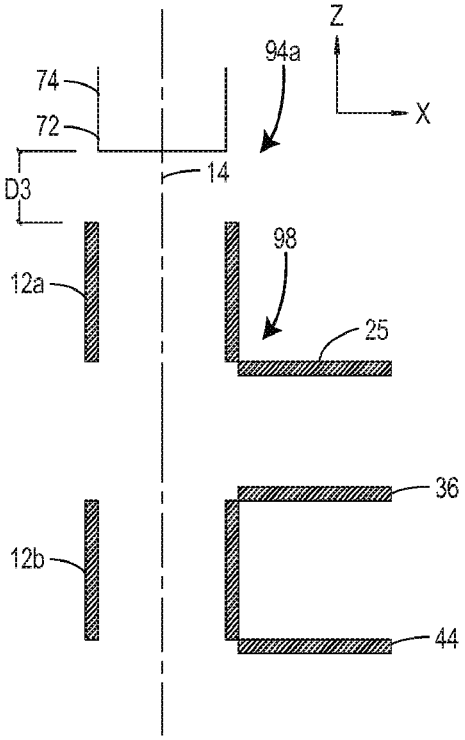
FIG. 7B
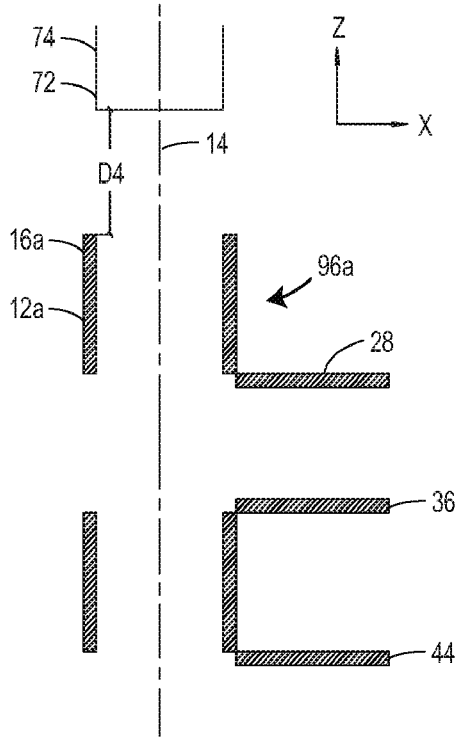

FIG. 5A
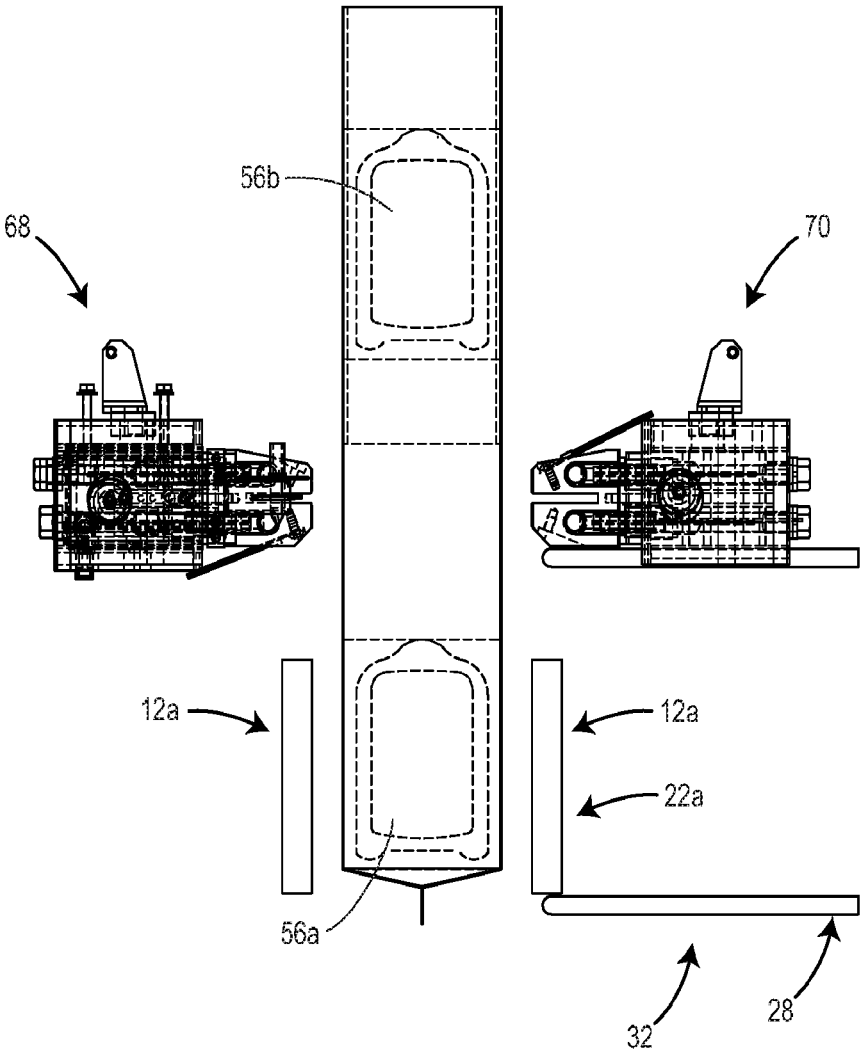
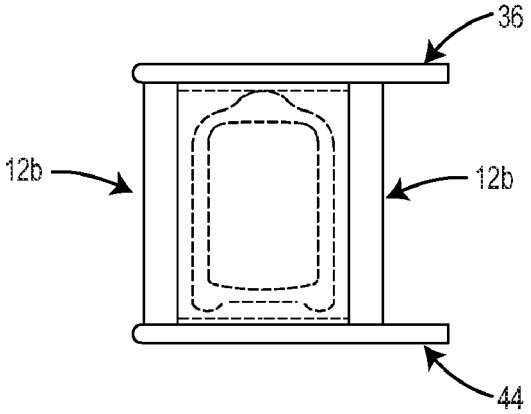

FIG. 5C
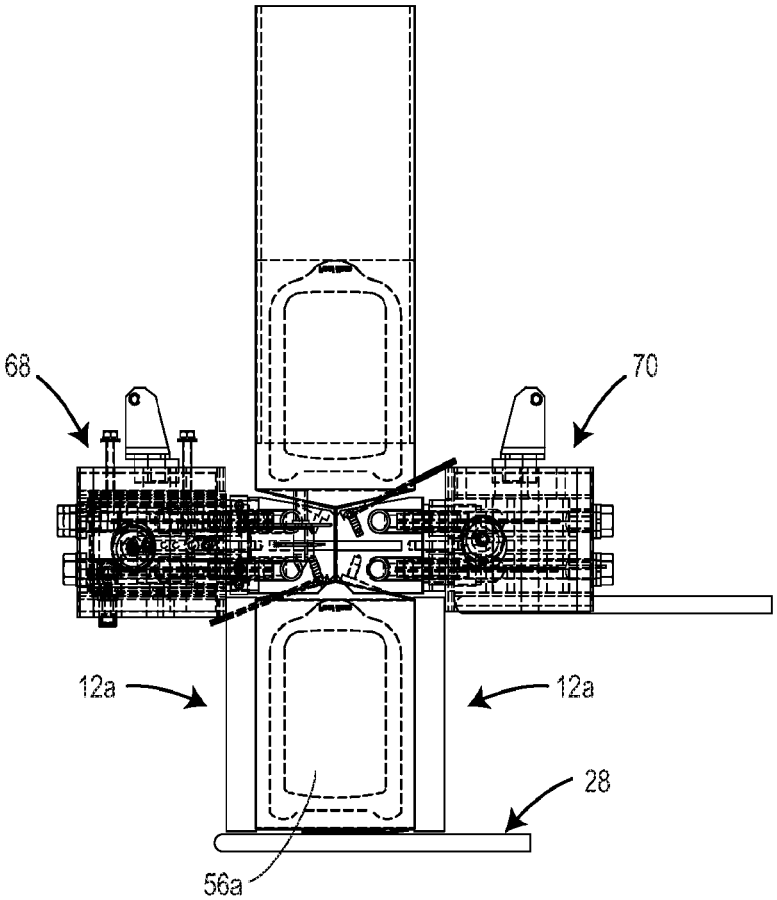
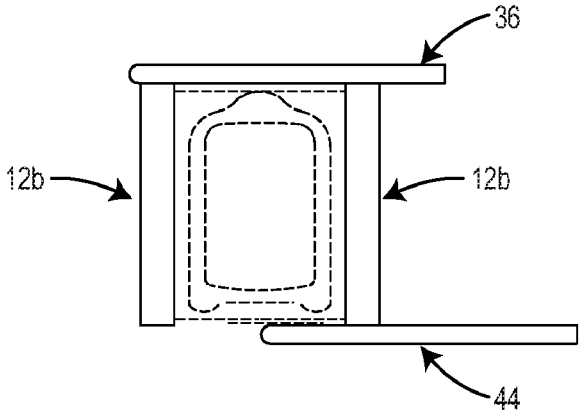

FIG. 5D
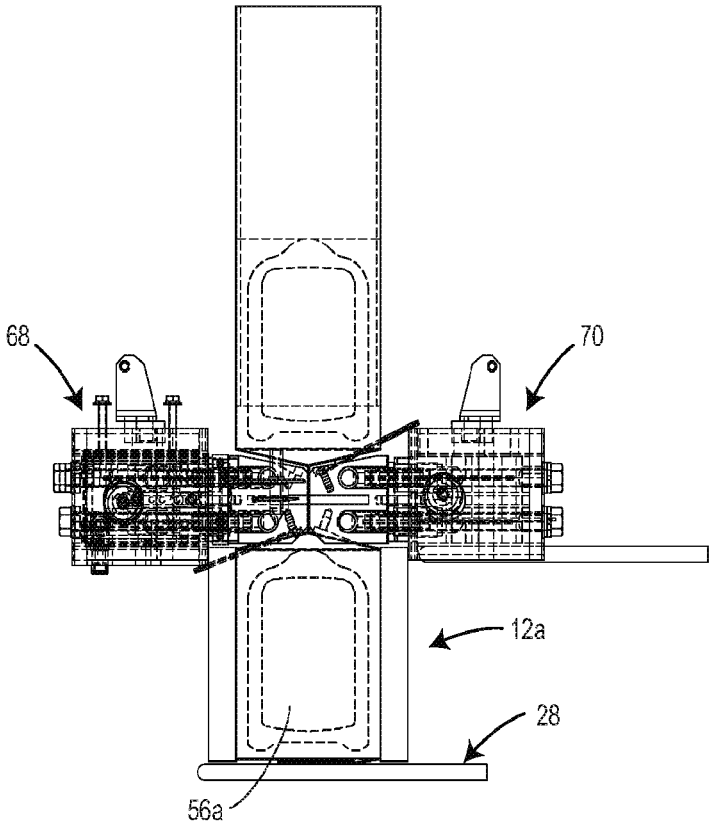
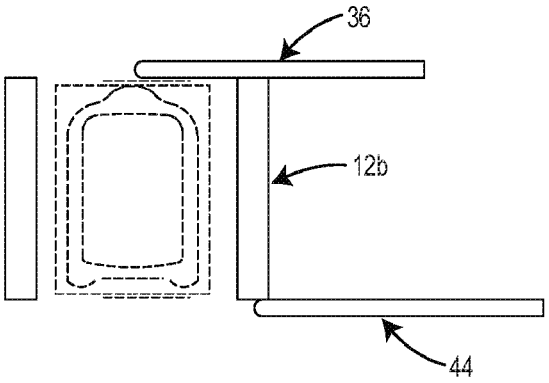

FIG. 5E
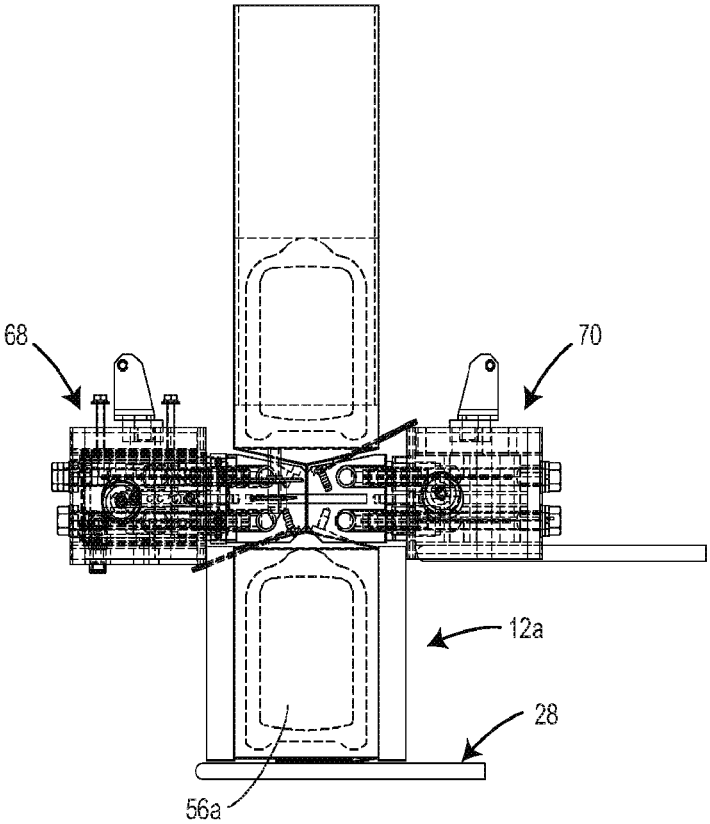
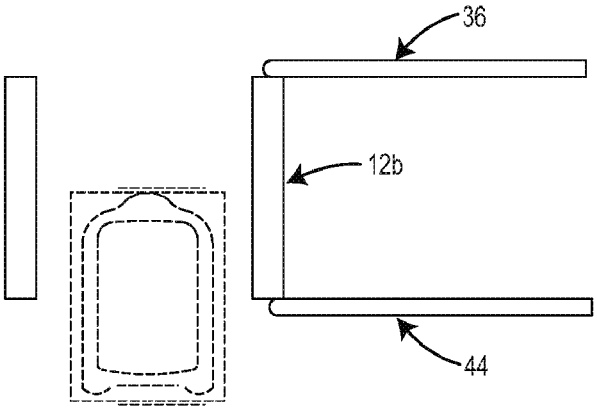

FIG. 5L
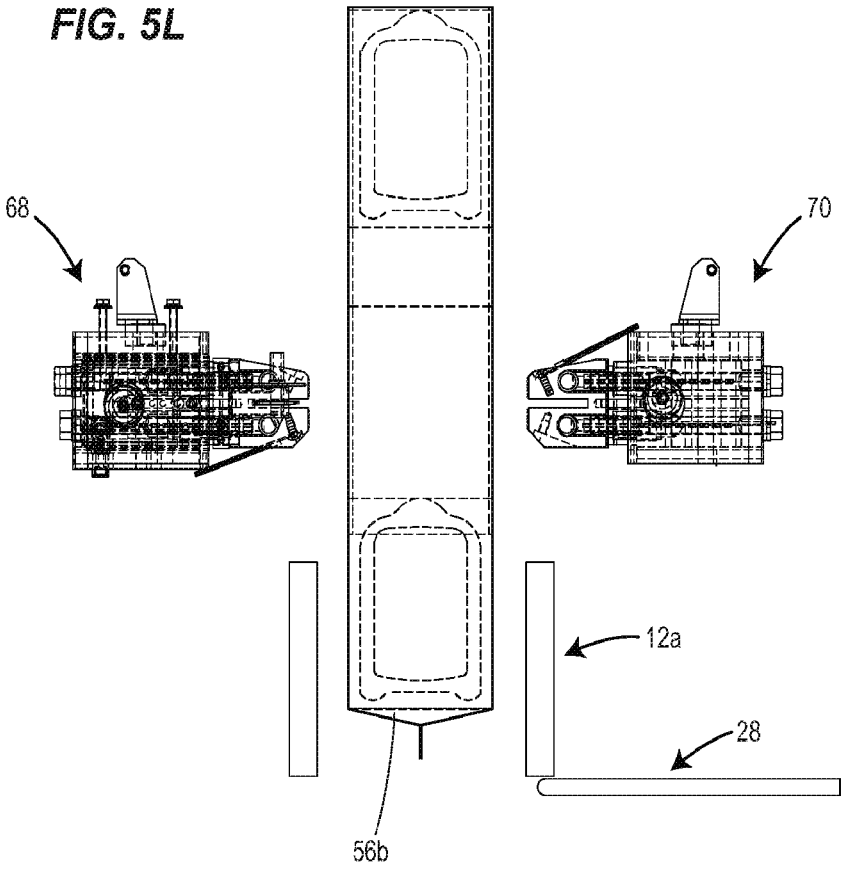
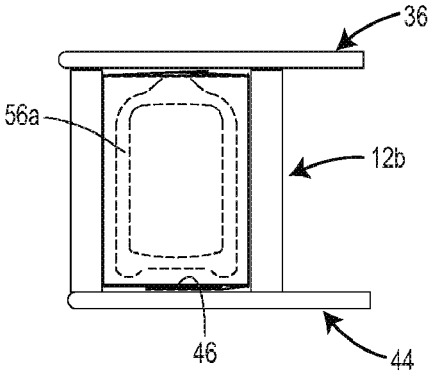

FIG. 5M
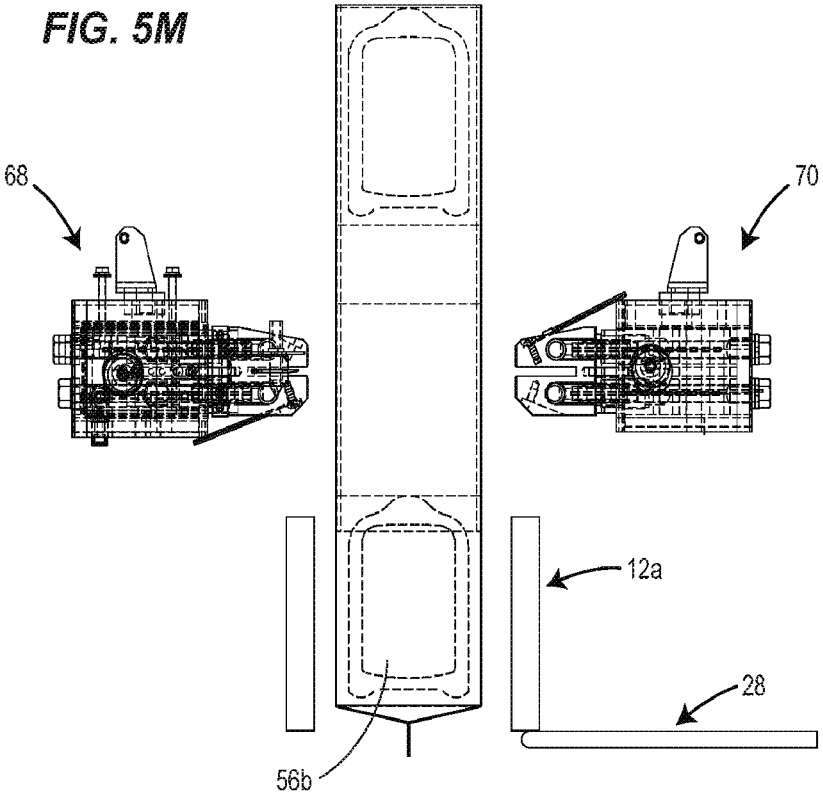
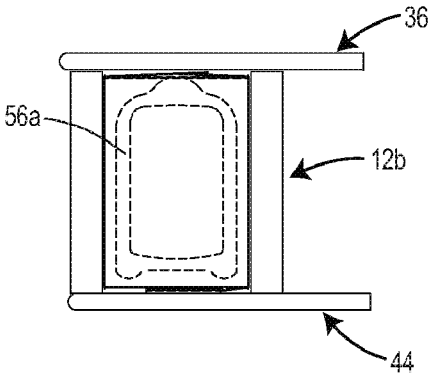

FIG. 8A
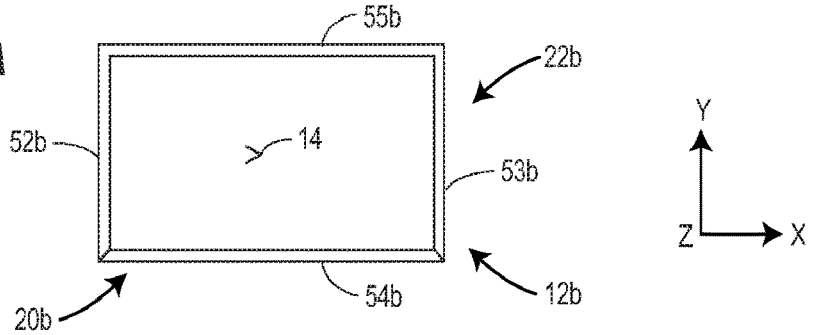
FIG. 8B
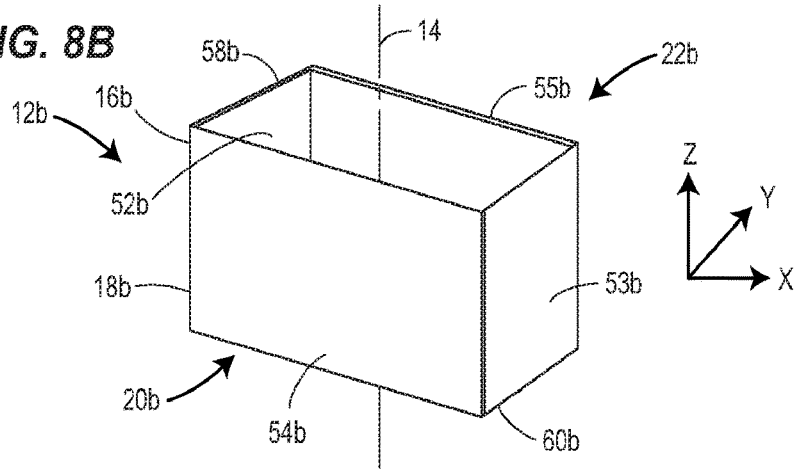
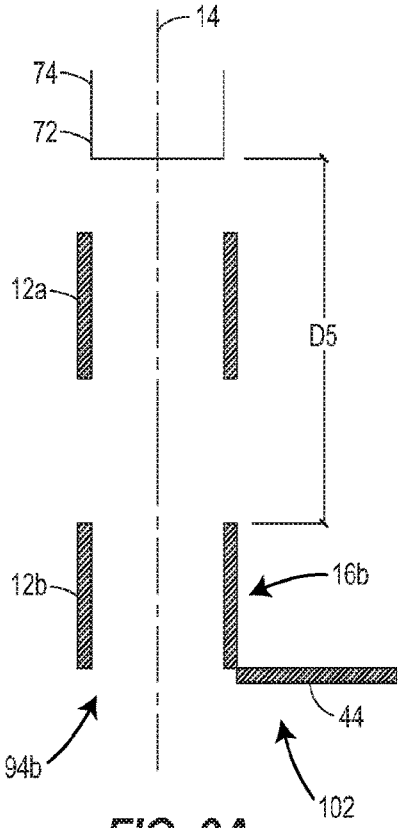
FIG. 9A
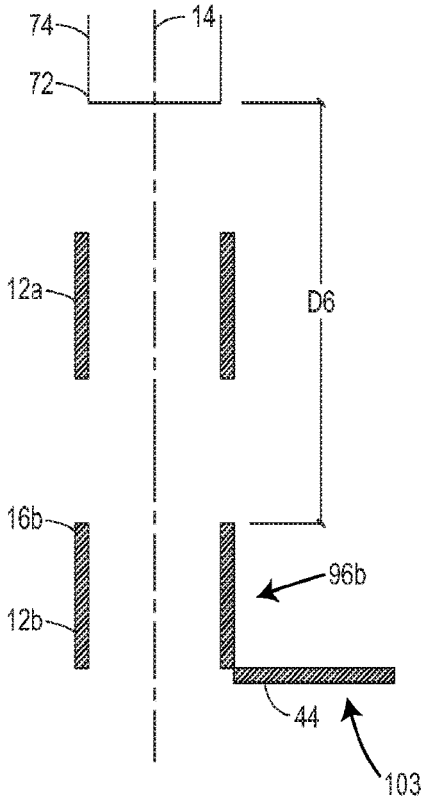
FIG. 9B

Estimated Optimum Settings using Servo Motors:

*(Rotary Turret with Bottom Folder on Seal Jaws)*

*Continuous Motion Machine Timing - with Bottom Folder on Seal Jaws*

Bagger Speed set to ?? PPM

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 1 | Starting Point, (Seal Jaws at Top, Film Momentarily Stopped) | 0 | 0 | 0 | 0 | 0 | | |
| 2 | Seal Jaws Close | 0 | 0 | 0 | 125 | 125 | Beginning | |
| 3 | Bottom Flap Folder Actuates In and Up | 0 | 20 | 20 | 450 | 470 | At Beginning of Seal Jaws Close | Figures being able to Lift Package and Fold Flap |
| 4 | Film and Seal Jaws Start Moving Down at Film Speed | 125 | 0 | 125 | 375 | 500 | When Seal Jaws are Closed | Includes Estimated Accel |
| 5 | Seal Time | 125 | 0 | 125 | 350 | 475 | When Seal Jaws are Closed | |
| 6 | Bottom Flap Folder Actuates Down and Out | 470 | 0 | 470 | 125 | 595 | | Should be Down and Out before Seal Jaws Open |
| 7 | Seal Jaws Open | 475 | 0 | 475 | 125 | 600 | At End of Seal Time | |
| 8 | Seal Jaws Stop Moving Down | 600 | 0 | 600 | 75 | 675 | At End of Seal Jaws Open | This is the Estimated Decel |
| 9 | Seal Jaws Start Moving Up Fast | 675 | 0 | 675 | 275 | 950 | | Includes Estimated Accel |
| 10 | Seal Jaws Stop Moving Up / Film Pauses | 950 | 0 | 950 | 75 | 1,025 | | This is the Estimated Decel |
| 11 | Ready for Next Cycle | 1,025 | 0 | 1,025 | 0 | 1,025 | | |
| | | | | Total Estimated Time, (mS) = | | 1,025 | | |
| | | | | Maximum Speed, (Ppm) = | | 58.54 | | |

FIG. 23A-1

*CM Top Flap Folder Timing - Rotary Turret*

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 20 | Starting Point, (Forming Box Open and Positioned under Seal Jaws, Top Folder Extended and Down) | 600 | 0 | 600 | 0 | 600 | From Step 6 above | |
| 21 | Package Drops from Seal Jaws onto Deadplate, (minimum) | 600 | 0 | 600 | 221.14 | 821 | | |
| 22 | Turret Rotates and Forming Box Closes | 821 | 100 | 921 | 350 | 1,271 | After Package Drop | Figured 100 mS Delay to allow for package settling. Ready to receive next package when finished. |
| 23 | Turret Ready for Next Cycle | 1,271 | 0 | 1,271 | 0 | 1,271 | | |
| 24 | Move Top Folder Right, (Retracted) | 921 | 50 | 971 | 150 | 1,121 | When Turret Starts to Rotate | |
| 25 | Move Top Folder Up | 921 | 50 | 971 | 150 | 1,121 | When Turret Starts to Rotate | |
| 26 | Move Top Folder Left, (Extended) | 1,271 | 0 | 1,271 | 150 | 1,421 | After Turret Rotates | |
| 27 | Move Top Folder Down | 1,421 | 50 | 1,471 | 150 | 1,621 | After Top Folder is Forward | Figure a little lead time, 50 mS |
| 28 | Top Folder Ready for Next Cycle | 1,621 | 0 | 1,621 | 0 | 1,621 | | |
| 29 | Package Drop to Clear Deadplate, (minimum) | 1,271 | 75 | 1,196 | 176.32 | 1,372 | After Turret Rotates | Figure a little lead time, 75 mS |
| 30 | Package Drop Ready for Next Cycle | 1,372 | 0 | 1,372 | 0 | 1,372 | | |
| | | | | Estimated Index Time, (mS) = | | 671 | | |
| | | | | Maximum Speed, (Ppm) = | | 89.40 | | |
| | | | | Estimated Folding Time, (mS) = | | 600 | | |
| | | | | Maximum Speed, (Ppm) = | | 100.00 | | |
| | | | | Total Estimated Time, (mS) = | | 671 | | |
| | | | | Maximum Speed, (Ppm) = | | 89.40 | | |

FIG. 23A-2

Estimated Optimum Settings Using Linear Motors.

Serial Timing with Top Folder moving with Seal Jaws and Vertical Motion on Forming Box and Bottom Folder.

Continuous Motion Machine Timing using Top Folder moving with Seal Jaws and Vertical Motion on Forming Box and Bottom Folder, (Serial Timing)

Bagger Speed set to 77 FPM

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 0 | Starting Point, (Seal Jaws at Top, Film Momentarily Stopped, Top Folder Retracted, Forming Box Open and Down, Bottom Folder Retracted and Down) | 0 | 0 | 0 | 0 | 0 | | |
| 2A | Seal Jaws Close | 0 | 0 | 0 | 125 | 125 | Beginning | |
| 2B | Forming Box Closes as it moves Up. | 0 | 0 | 30 | 110 | 140 | At Beginning of Seal Jaws Close | |
| 2C | Bottom Folder Extends, (In) as it moves Up | 0 | 0 | 20 | 150 | 170 | At Beginning of Seal Jaws Close | Figures being able to Lift Package and Fold Flap |
| 2D | Seal Time Starts | 125 | 0 | 125 | 150 | 475 | When Seal Jaws are Closed | |
| 2E - 10C | Film and Seal Jaws Moving Down at Film Speed | 125 | 0 | 125 | 980 | 1,105 | When Seal Jaws are Closed | Includes Estimated Accel |
| 8A | Seal Time Finishes | 475 | 0 | 475 | 0 | 475 | At End of Seal Time | |
| 8B | Seal Jaws Open | 475 | 0 | 475 | 105 | 600 | At End of Seal Time | |
| 8C | Forming Box and Bottom Folder Move Down to position Top Flap | 475 | 15 | 485 | 75 | 560 | At End of Seal Time | Slight Delay for jaws to Open Slightly |
| 8D | Top Folder Extends In | 475 | 30 | 505 | 150 | 655 | At End of Seal Time | Small Delay for Forming Box and Bottom Folder to Position the Package |
| 7A | Forming Box and Bottom Folder Move Up to Fully Fold Top Flap | 655 | 30 | 685 | 75 | 680 | At End of Top Folder Extends In | Slight Lead Time for coordinated motion |
| 7B | Top Folder Time Starts | 680 | 10 | 690 | 340 | 1,030 | | |
| 7C | Film Pauses when In Position | 680 | 0 | 680 | 0 | 680 | Anytime after Seal Jaws Open | |
| 10A | Top Folder Time Finishes | 1,030 | 0 | 1,030 | 0 | 1,030 | At End of Top Folder Time | |
| 10B | Top Folder Retracts, (Out) | 1,030 | 0 | 1,030 | 90 | 1,120 | At End of Top Folder Time | |
| 10C | Bottom Folder Retracts, (Out) | 1,030 | 0 | 1,030 | 90 | 1,120 | At End of Top Folder Time | |
| 11A | Seal Jaws Stop Moving Down | 1,030 | 0 | 1,030 | 75 | 1,105 | At End of Top Folder Time | This is the Estimated Decel |
| 11B | Forming Box Opens | 1,030 | 30 | 1,060 | 90 | 1,150 | At End of Top Folder Time | |
| 11C | Package Drops | 1,180 | 0 | 1,180 | 226.92 | 1,407 | At End of Forming Box Open | Timing shown is for Stationary, will be faster for moving. |
| 12 - 13B | Seal Jaws Start Moving Up Fast | 1,105 | 0 | 1,105 | 175 | 1,280 | After Seal Jaws are Stopped | Includes Estimated Accel |
| 13 | Forming Box and Bottom Folder Move Down to Prepare for Next Cycle | 1,180 | 0 | 1,180 | 75 | 1,255 | After Forming Box is Open | |
| 13A | Seal Jaws Stop Moving Up | 1,280 | 0 | 1,280 | 75 | 1,355 | | This is the Estimated Decel |
| 13B | Ready for Next Cycle | 1,355 | 0 | 1,355 | 0 | 1,355 | | |
| | | | | Total Estimated Time, (mS) = | | 1,459 | | |
| | | | | Maximum Speed, (Fpm) = | | 41.24 | | |

FIG. 24B-1

| | | | | | | | | |
|---|---|---|---|---|---|---|---|---|
| *KM Top Flap Folder Timing - Included above* | | | | | | | | |
| | Machine | Start | Delay | Actual Start | Duration | Finished | | |
| Step # | Operation | Time, (mS) | Time, (mS) | Time, (mS) | Time, (mS) | Time, (mS) | Starts From | Comments |
| 20 | Starting Point | 0 | 0 | 0 | 0 | 0 | | |
| 21 | | 0 | 0 | 0 | 0 | 0 | | |
| 22 | | 0 | 0 | 0 | 0 | 0 | | |
| 23 | | 0 | 0 | 0 | 0 | 0 | | |
| 33 | Ready for Next Cycle | 0 | 0 | 0 | 0 | 0 | | |
| | | | | | | | | |
| | | | | Total Estimated Time, (mS) = | | 0 | | |
| | | | | Maximum Speed, (Ppm) = | | --- | | |

FIG. 24B-2

Using Linear Motors.

*(Combiet Timing with 1st Forming Box + 1st Bottom Folder under Seal Jaws and Independent Top Folder, 2nd Forming Box, and 2nd Bottom Folder)*

*Continuous Motion Machine Timing, with 1st Forming Box + 1st Bottom Folder under Seal Jaws, (Parallel Timing)*

*Bagger Speed set to ?? PPM*

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 0 | Starting Point, (Seal Jaws at Top, Film Momentarily Stopped, 1st Forming Box Open and Down, 1st Bottom Folder Retracted and Down) | 0 | 0 | 0 | 0 | 0 | | |
| 2A | Seal Jaws Close | 0 | 0 | 0 | 125 | 125 | Beginning | |
| 2B | 1st Forming Box Closes as it Moves Up | 0 | 20 | 20 | 120 | 140 | At Beginning of Seal Jaws Close | Figures being able to Lift Package and Fold Flap |
| 2C | 1st Bottom Folder Extends, (In) as it moves Up | 0 | 20 | 20 | 150 | 170 | At Beginning of Seal Jaws Close | Figures being able to Lift Package and Fold Flap |
| 2D | Seal Time Starts | 125 | 0 | 125 | 350 | 475 | When Seal Jaws are Closed | |
| 2E - 6D | Film and Seal Jaws Start Moving Down at Film Speed | 125 | 0 | 125 | 550 | 675 | When Seal Jaws are Closed | Includes Estimated Accel |
| 6A | Seal Time Finishes | 475 | 0 | 475 | 0 | 475 | At End of Seal Time | |
| 6B | Seal Jaws Open | 475 | 0 | 475 | 125 | 600 | At End of Seal Time | |
| 6C | 1st Forming Box and 1st Bottom Folder Move Down to create Gap | 475 | 10 | 485 | 75 | 560 | At End of Seal Time | |
| 6D | 1st Bottom Folder Retracts, (Out) | 475 | 0 | 475 | 150 | 625 | At End of Seal Time | Maybe we can Lead??? |
| 7A | Seal Jaws Stop Moving Down | 600 | 0 | 600 | 75 | 675 | At End of Seal Jaws Open | This is the Estimated Decel |
| 7B | 1st Forming Box Opens | 600 | 0 | 600 | 120 | 720 | At End of Seal Jaws Open | |
| 7C | Start of Independent Folder Timing | 720 | 0 | 720 | 0 | 720 | At End of Forming Box Open | Timing shown is for Stationary, will be faster for moving. |
| 7D | Package Drops from 1st to 2nd Bottom Folder | 720 | 0 | 720 | 126.53 | 847 | At End of Forming Box Open | |
| 8A - 12 | Seal Jaws Start Moving Up Fast | 675 | 0 | 675 | 175 | 850 | After Seal Jaws are Stopped | Includes Estimated Accel |
| 8B | 1st Forming Box and 1st Bottom Folder Move Down rest of the way to prepare for next cycle | 675 | 0 | 675 | 75 | 750 | After Seal Jaws are Stopped | |
| 9 - 13 | Film Pauses when in Position | 850 | 0 | 850 | 0 | 850 | | |
| 13A | Seal Jaws Stop Moving Up | 850 | 0 | 850 | 75 | 1,025 | | This is the Estimated Decel |
| 13B | Ready for Next Cycle | 1,025 | 0 | 1,025 | 0 | 1,025 | | |
| | | | | Total Estimated Time, (mS) = | | 1,025 | | |
| | | | | Maximum Speed, (Ppm) = | | 58.53 | | |

FIG. 25B-1

CM Top Flap Folder Timing - Independent Top Folder, 2nd Forming Box, and 2nd Bottom Folder, (Parallel Timing)

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 7C | Starting Point, (2nd Forming Box Open, Top Folder Retracted and Up, 2nd Bottom Folder Extended or Extending) | 720 | 0 | 720 | 0 | 720 | From Step 7C above | 2nd Forming Box and 2nd Bottom Folder Move together with Seal Jaws. |
| 7G - 10 | Package Drops from 1st to 2nd Bottom Folder | 720 | 0 | 720 | 226.92 | 947 | | Timing shown is for Stationary, will take less time for moving. |
| 11A | Close 2nd Forming Box | 947 | 0 | 947 | 120 | 1,067 | End of Package Drop | |
| 11B | Move Top Folder Forward, (Extended) | 947 | 50 | 997 | 150 | 1,147 | End of Package Drop | Figured 100 mS Delay to allow for package clearance |
| 11C | Move Top Folder Down | 1,147 | 50 | 1,097 | 75 | 1,172 | After Top Folder is Forward | Slight Lead Time for coordinated motion. |
| 12 | Top Folder Time Starts | 1,172 | 0 | 1,172 | 350 | 1,522 | After Top Folder is Down | |
| 3A | Top Folder Time Finishes | 1,522 | 0 | 1,522 | 0 | 1,522 | At End of Top Folder Time | |
| 3B | Open 2nd Bottom Folder, (Retracted) | 1,522 | 0 | 1,522 | 150 | 1,672 | At End of Top Folder Time | |
| 4A | Open 2nd Forming Box | 1,522 | 50 | 1,572 | 75 | 1,647 | At Open 2nd Bottom Folder | |
| 4B | Move Top Folder Back, (Retracted) | 1,522 | 75 | 1,597 | 150 | 1,747 | At Open 2nd Bottom Folder | Slight Delay to allow Top Folder to give Package a Downward push. |
| 4C - 6 | Package Drops to Clear 2nd Bottom Folder, (minimum) | 1,672 | 0 | 1,672 | 176.32 | 1,848 | After 2nd Bottom Folder is Open | Timing shown is for Stationary, will take more time for moving. |
| 5 or 6 | Move Top Folder Up | 1,597 | 0 | 1,597 | 75 | 1,672 | After Top Folder Starts moving Back | Lead Time OK because Package is gone. |
| 7E | Close 2nd Bottom Folder, (Extended) | 1,848 | 50 | 1,898 | 150 | 2,048 | End of Package Drop | Delay to allow for package clearance |
| 7F | Ready for Next Cycle | 2,048 | 150 | 1,898 | 0 | 1,898 | | Lead Time OK because next Package has to make the Drop. |
| | | | | Total Estimated Time, (mS) = | | 1,178 | | |
| | | | | Maximum Speed, (Ppm) = | | 50.92 | | |

FIG. 25B-2

Estimated Optimum Savings using Linear Motors.

(Parallel Timing with 1st Forming Box + 1st Bottom Folder under Seal Jaws and Independent and Stationary Top Folder, 2nd Forming Box, and 2nd Bottom Folder)

Continuous Motion Machine Timing, with 1st Forming Box + 1st Bottom Folder under Seal Jaws, (Parallel Timing)

Bagger Speed set to 22 PPM

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 0 | Starting Point, (Seal Jaws at Top, Film Momentarily Stopped, 1st Forming Box Open and Down, 1st Bottom Folder Retracted and Down) | 0 | 0 | 0 | 0 | 0 | | |
| 2A | Seal Jaws Close | 0 | 0 | 0 | 125 | 125 | Beginning | |
| 2B | 1st Forming Box Closes as it moves Up | 0 | 20 | 20 | 120 | 140 | At Beginning of Seal Jaws Close | Figures being able to Lift Package and Fold Flap |
| 2C | 1st Bottom Folder Extends, (in) as it moves Up | 0 | 20 | 20 | 150 | 170 | At Beginning of Seal Jaws Close | Figures being able to Lift Package and Fold Flap |
| 2D | Seal Time Starts | 125 | 0 | 125 | 350 | 475 | When Seal Jaws are Closed | |
| 2E - 6B | Film and Seal Jaws Start Moving Down at Film Speed | 125 | 0 | 125 | 550 | 675 | When Seal Jaws are Closed | Includes Estimated Accel |
| 6A | Seal Time Finishes | 475 | 0 | 475 | 0 | 475 | At End of Seal Time | |
| 6B | Seal Jaws Open | 475 | 0 | 475 | 125 | 600 | At End of Seal Time | |
| 6C | 1st Forming Box and 1st Bottom Folder Move Down to create Gap | 475 | 10 | 485 | 75 | 560 | At End of Seal Time | |
| 6D | 1st Bottom Folder Retracts, (Out) | 475 | 0 | 475 | 150 | 625 | At End of Seal Time | Maybe we can lead??? |
| 7A | Seal Jaws Stop Moving Down | 600 | 0 | 600 | 75 | 675 | At End of Seal Jaws Open | This is the Estimated Decel |
| 7B | 1st Forming Box Opens | 600 | 0 | 600 | 120 | 720 | At End of Seal Jaws Open | |
| 7C | Start of Independent Folder Timing | 720 | 0 | 720 | 0 | 720 | At End of Forming Box Open | Timing shown is for Stationary, will be faster for moving. |
| 7D | Package Drops from 1st to 2nd Bottom Folder | 720 | 0 | 720 | 226.42 | 947 | At End of Forming Box Open | |
| 8A - 13 | Seal Jaws Start Moving Up Fast | 675 | 0 | 675 | 275 | 950 | After Seal Jaws are Stopped | Includes Estimated Accel |
| 8B | 1st Forming Box and 1st Bottom Folder Move Down rest of the way to prepare for next cycle | 675 | 0 | 675 | 75 | 750 | After Seal Jaws are Stopped | |
| 9 - 13 | Film Pauses when in Position | 950 | 0 | 950 | 0 | 950 | | |
| 13A | Seal Jaws Stop Moving Up | 950 | 0 | 950 | 75 | 1,025 | | This is the Estimated Decel |
| 13B | Ready for Next Cycle | 1,025 | 0 | 1,025 | 0 | 1,025 | | |
| | | | | Total Estimated Time, (mS) = | | 1,025 | | |
| | | | | Maximum Speed, (Ppm) = | | 58.53 | | |

FIG. 26B-1

CM Top Flap Folder Timing - Independent and Stationary Top Folder, 2nd Forming Box, and 2nd Bottom Folder, (Parallel Timing)

| Step # | Machine Operation | Start Time, (mS) | Delay Time, (mS) | Actual Start Time, (mS) | Duration Time, (mS) | Finished Time, (mS) | Starts From | Comments |
|---|---|---|---|---|---|---|---|---|
| 7C | Starting Point, (2nd Forming Box Open, Top Folder Retracted and Up, 2nd Bottom Folder Extended or Extending) | 720 | 0 | 720 | 0 | 720 | From Step 7C above | 2nd Forming Box and 2nd Bottom Folder are Stationary. |
| 7D - 10 | Package Drops from 1st to 2nd Bottom Folder | 720 | 0 | 720 | 176.92 | 947 | | Timing shown is for Stationary. |
| 11A | Close 2nd Forming Box | 947 | 0 | 947 | 136 | 1,083 | End of Package Drop | |
| 11B | Move Top Folder Forward, (Extended) | 947 | 100 | 947 | 196 | 1,143 | End of Package Drop | Figured 100 mS Delay to allow for package clearance. |
| 11C | Move Top Folder Down | 1,147 | 25 | 1,047 | 25 | 1,172 | After Top Folder is Forward | Slight Lead Time for coordinated motion. |
| 12 | Top Folder Time Starts | 1,172 | 0 | 1,172 | 350 | 1,522 | After Top Folder is Down | |
| 3A | Top Folder Time Finishes | 1,522 | 0 | 1,522 | 0 | 1,522 | At End of Top Folder Time | |
| 3B | Open 2nd Bottom Folder, (Retracted) | 1,522 | 0 | 1,522 | 150 | 1,672 | At End of Top Folder Time | |
| 4A | Open 2nd Forming Box | 1,522 | 50 | 1,572 | 75 | 1,647 | At Open 2nd Bottom Folder | |
| 4B | Move Top Folder Back, (Retracted) | 1,522 | 75 | 1,597 | 150 | 1,747 | At Open 2nd Bottom Folder | Slight Delay to allow Top Folder to give Package a Downward push. |
| 4C - 6 | Package Drops to Clear 2nd Bottom Folder, (Continuous) | 1,572 | 0 | 1,572 | 176.92 | 1,848 | After 2nd Bottom Folder is Open | Timing shown is for Stationary. |
| 5 or 6 | Move Top Folder Up | 1,597 | 0 | 1,597 | 75 | 1,672 | After Top Folder starts moving back | Lead Time OK because Package is gone. |
| 7E | Close 2nd Bottom Folder, (Extended) | 1,848 | 50 | 1,898 | 150 | 2,048 | End of Package Drop | Delay to allow for package clearance. |
| 7F | Ready for Next Cycle | 2,048 | 250 | 1,898 | 0 | 1,898 | | Lead Time OK because next Package has to make the Drop. |
| | | | | Total Estimated Time, (mS) = | | 1,178 | | |
| | | | | Maximum Speed, (Ppm) = | | 50.92 | | |

FIG. 26B-2

APPARATUS AND METHOD FOR MAKING A FLEXIBLE PACKAGE

CROSS-REFERENCE TO RELATED APPLICATION

This application is a U.S. National Stage of International Patent Application No. PCT/US2016/0051445 filed Sep. 13, 2016, which claims the benefit of priority of U.S. Provisional Patent Application No. 62/220,941 filed Sep. 18, 2015, the respective disclosures of which are each incorporated herein by reference in their entireties.

BACKGROUND

Field of the Disclosure

The disclosure relates to apparatus, systems, and methods for making a flexible package.

Brief Description of Related Technology

Vertical form, fill, and seal (VFFS) packaging machines are commonly used in the snack food industry for forming, filling, and sealing bags of products (e.g., nuts, chips, crackers, etc.). Such packaging machines take a packaging film or flexible material from a roll and form the flexible material into a vertical tube around a product delivery cylinder. The packaging film is typically longitudinally sealed and a transverse bottom seal is formed. The package is next filled with the desired product, and a transverse bottom seal is formed. The top and bottom transverse seals each typically extend perpendicularly or obliquely from a top portion and bottom portion of the package. So disposed, the top and bottom transverse seals are subject to damage when being boxed for shipment, and may lead to irregular spacing within the package, thereby reducing packaging efficiency and increasing shipping costs.

BRIEF DESCRIPTION OF THE DRAWINGS

FIG. 7A is a front view of an embodiment of a first forming box in a first position;

FIG. 7B is a front view of the embodiment of the first forming box of FIG. 7A in a second position;

FIG. 8A is a plan view of an embodiment of a second forming box of an embodiment of the apparatus of FIG. 1;

FIG. 8B is a perspective view of the embodiment of the second forming box of FIG. 3A;

FIG. 9A is a front view of an embodiment of a second forming box in a first position;

FIG. 9B is a front view of the embodiment of the second forming box of FIG. 9A in a second position;

FIG. 23A is a chart outlining timing for a method of forming a package using an interface in accordance with an embodiment of the disclosure;

FIG. 24B is a chart of the timing of step illustrated in FIG. 24A;

FIG. 25B is a chart of the timing of step illustrated in FIG. 25A;

FIG. 26B is a chart of the timing of step illustrated in FIG. 26A; and

DETAILED DESCRIPTION

Figure 1:
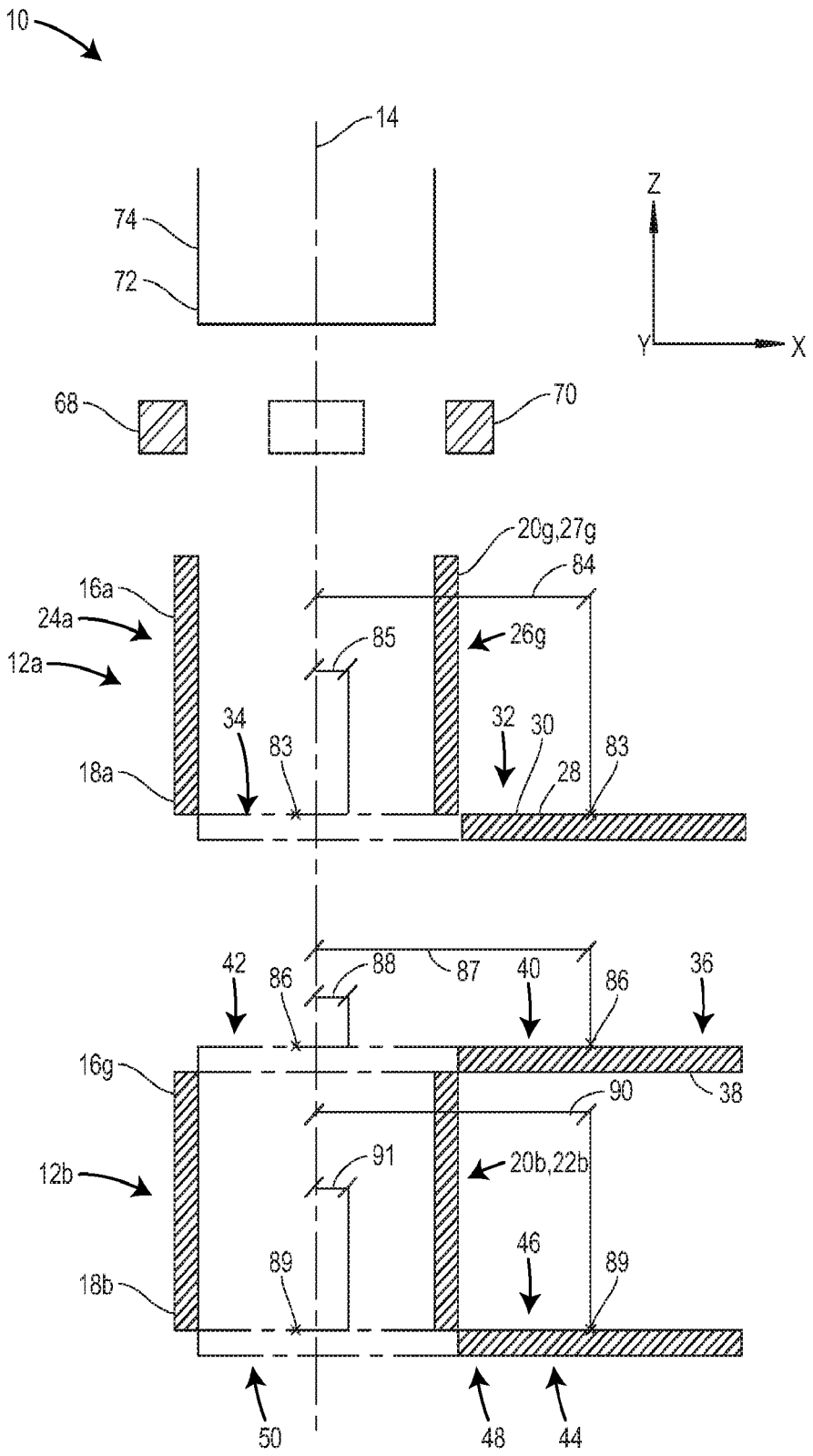
FIG. 1 is a schematic front view of an embodiment of an apparatus for forming a flexible package.

Flexible stackable packages and equipment for making such packages having a generally cubed shape have been disclosed in, for example, U.S. Pat. No. 8,602,244, the disclosure of which is incorporated herein by reference. The apparatus, systems, and methods of various embodiments of the disclosure can advantageously allow for formation of such flexible stackable packages with improved rigidity and/or improved shape, for example, a cubed shaped.

As described in detail below, the apparatus, systems, and methods of the disclosure can produce a flexible package in which first and second seals (also referred to as leading and trailing seals) are folded over and disposed generally in the same plane of the panel of the package from which they extend. The disclosed apparatuses can also advantageously allow for significantly increased processing speeds in forming such products, as well as the ability to convert conventional packaging machines into machines capable of forming such flexible packages.

The film is processed on the machine with a layout configured to provide a package having a cuboid shape and a predetermined internal package volume. The predetermined internal package volume is a theoretical internal volume of the package if formed without deformation and ideal filling. Processing variations on the machine can result in the actual package being formed to have a different internal package volume within a tolerance range. For example, an acceptable package can be formed if the actual package is about 85% to about 150% of the predetermined internal package volume. Other suitable tolerances include about 120% to about 130%, about 100% to about 120%, about 85% to about 130%, and other such suitable ranges. A number of factors can be used to determine an acceptable package, including for example, customer perception, shipping factors, and stability of the package including how well the package resists deformation during shipping and use. As described in detail below, the forming boxes used in any of the described embodiments can have an internal volume selected based on the predetermined internal package volume. For example, the forming box can have an internal volume that is about 70% to about 120% of the predetermined internal package volume. Other suitable ranges include about 80% to about 90%, about 80% to about 95%, about 80% to about 100%, about 90% to about 110%, and other such suitable ranges. As described in detail below, proper sizing of the forming box as well as filling of the package to be within the tolerance range of the predetermined package volume can aid in obtaining a cuboid shape to the package by providing a sufficient internal pressure generated when the package is compressed by a forming bar or plate to act against the force of the forming bar or plate to flatten the panel of the package.

The apparatus 10 in accordance with an embodiment of the disclosure can be adapted to function with known packaging machines, including, but not limited to vertical form fill seal (VFFS) packaging machines, horizontal form, fill and seal (HFFS) machines, sequential assembly machines and the like. As used herein, a "transport path" refers to the path of the flexible material as it is transported through the conventional packaging machine during operation for making a flexible package. Also as used herein, a "transport axis" refers to the axis that extends along the transport path of the flexible material as it is transported through the conventional packaging machine during operation for making a flexible package. FIGS. 24-26 illustrate graphical flow charts of various methods of forming a package using embodiments of the apparatus 10 disclosed herein.

In various embodiments, the apparatus 10 can be provided on a frame assembly that is portable, allowing the apparatus 10 to be moved into and out of configuration with the conventional packaging machine, which may include a forming tube or a portion of a forming tube. The frame assembly and/or components of the apparatus 10 can be adjustable to accommodate different packaging machine configurations and heights. In other embodiments, the apparatus 10 may be a permanent and non-adjustable component of the packaging machine.

Figure 4A:
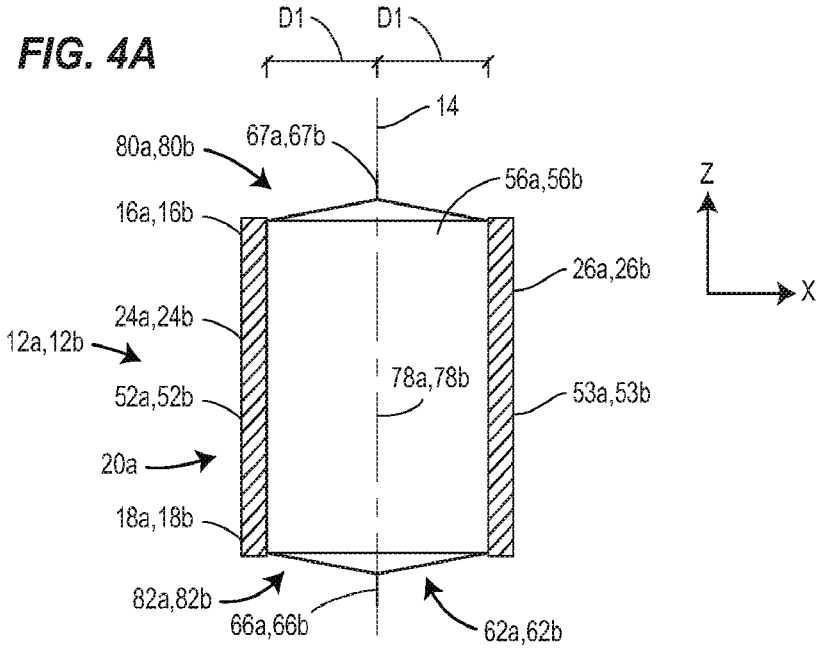
FIG. 4A is a front view of an embodiment of a first forming box in a first position.

As will be described in more detail, the apparatus 10 will use at least one folding bar (e.g., a first downstream folding bar 28, a first upstream folding bar 36, and/or a second downstream folding bar 44 illustrated in FIG. 1) to apply pressure to a package (e.g., the package 56*a* of FIG. 4A) on or adjacent to one or more transverse seals (e.g., a first transverse seal 66 and/or a second transverse seal 67 as illustrated in FIG. 4A). The first transverse seal 66 is also referred to herein as the leading seal and the second transverse seal 67 is also referred to herein as the trailing seal. This pressure folds the first transverse seal 66*a* and/or the second transverse seal 67*a* towards the respective panel from which it extends and can attached the seal 66*a*, 67*a* to the material of the corresponding panel of the first package 56*a*. Additionally, residual heat can remain in the material of the first transverse seal 66*a* and/or the second transverse seal 67*a* resulting from the heat imparted to the material by first and second seal bars 68, 70 during the sealing of the first and/or second transverse seal 66, 67. This residual heat can aid in heat sealing the material of the seals 66, 67 to the material of the corresponding panel from which it extends during operation of the folding bars. In various embodiments, the apparatus can utilize multiple folding bars. By simultaneously using multiple folding bars (e.g., the first downstream folding bar 28, the first upstream folding bar 36, and optionally the second downstream folding bar 44 illustrated in FIG. 1) and multiple package retaining structure (e.g., retaining structure 12*a* and the second forming box 12*b* of FIG. 1), the apparatus 10 can provide an efficient way to quickly transversely seal a plurality of packages while folding over and optionally sealing the transverse seals 66*a*, 67*a* to the body of the package 56*a*. Because the transverse seals 66*a*, 67*a* are folded over and, in some embodiments, secured to the body of the package 56*a*, the transverse seals 66*a*, 67*a* lie substantially flat or flat on—and not perpendicular or oblique to—the body of the package 56*a*. Consequently, the top and bottom transverse seals 66*a*, 67*a* are not damaged or deformed when being boxed for shipment and do not cause spacing issues while being boxed.

Turning to the apparatus 10 in more detail, and with reference to FIG. 1, an embodiment of the apparatus 10 for making a flexible package may include a retaining structure 12*a* that extends along the transport axis 14 from a first end

16*a* to a second end 18*a* opposite the first end 16*a*. The retaining structure 12*a* comprises two or more walls 20*a* that cooperate to form a lateral enclosure 22*a*, and each of the two or more walls 20*a* extend from the first end 16*a* to the second end 18*a* of the retaining structure 12*a*. At least a first one 24*a* of the two or more walls 20*a* displaces relative to a second one 26*a* of the two or more walls 20*a*. In an embodiment, the retaining structure 12*a* can be provided as a first forming box having opposed opened ends that allow the film to be received into the structure from one end and the folding bar 22 to interact with the transverse seal at the opposed end. In some embodiments, the retaining structure 12*a*, can include a volume adjusting plate that actuates from one of the walls of the retaining structure in a direction perpendicular to the transport direct to define a pre-set internal volume of the package during gas filling and/or sealing of the second transverse seal.

The apparatus 10 includes a first downstream folding bar 28 disposed downstream (i.e., in a direction along the transport path of the flexible material) of the retaining structure. Embodiments in which the interface is disposed beneath the packaging machine advantageously allow for the package to be dropped seamlessly from the last stage of the packaging machine into the interface without the need for additional transporting or conveying devices. The first downstream folding bar 28 has a contact portion 30, and the first downstream folding bar 28 is displaceable between a first position 32 in which the contact portion 30 is disposed remote from the second end 18*a* of the retaining structure 12*a* and a second position 34 in which the contact portion 30 is disposed at or adjacent to the second end 18*a* of the retaining structure 12*a*.

The apparatus 10 also includes a second forming box 12*b* longitudinally-offset (i.e., offset along the longitudinal transport axis 14) from the retaining structure 12*a* and downstream of both the retaining structure 12*a* and the first downstream folding bar 28. The second forming box 12*b* extends along the transport axis 14 from a first end 16*b* to a second end 18*b* opposite the first end 16*b*. The second forming box 12*b* includes two or more walls 20*b* that cooperate to form a lateral enclosure 22*b*. In various embodiments, the second forming box 12*b* can restrain the package about the entire circumference of the package. The second forming box 12*b* can be sized to be about 70% to about 120%, about 80% to about 90%, about 80% to about 95%, about 70% to about 110%, about 80% to about 100%, and other suitable ranges therein, of the pre-determined internal volume of the package. As described in detail below, sizing of the second forming box 12*b* (and other forming box structures of various other embodiments) to tightly restrain the package to allow for only expansion of the film to the pre-determined internal volume can allow the internal pressure within the package to act against the force of the first upstream folding bar 36 when it actuates to fold the second transverse seal 67 over toward the respective panel of the package.

The apparatus 10 further includes a first upstream folding bar 36 disposed upstream (i.e., in a direction opposite to the direction of the transport path of the flexible material) of the second forming box 12*b* and adjacent the first end 16*b* of the second forming box 12*b*. The first upstream folding bar 36 may have a contact portion 38 and may be displaceable between a first position 40 in which the contact portion 38 is disposed remote from the second forming box 12*b* and a second position 42 in which the contact portion 38 is disposed at or adjacent to the first end 16*b* of the second forming box 12*b*.

The apparatus 10 additionally includes a second downstream folding bar 44 disposed downstream of the second forming box 12*b* and adjacent the second end 18*b* of the second forming box 12*b*. The second downstream folding bar 44 includes a contact portion 46 and is displaceable between a first position 48 in which the contact portion 46 is disposed remote from the second forming box 12*b* and a second position 50 in which the contact portion 46 is disposed at or adjacent to the second end 18*b* of the second forming box 12*b*.

Figures 1, 24A:
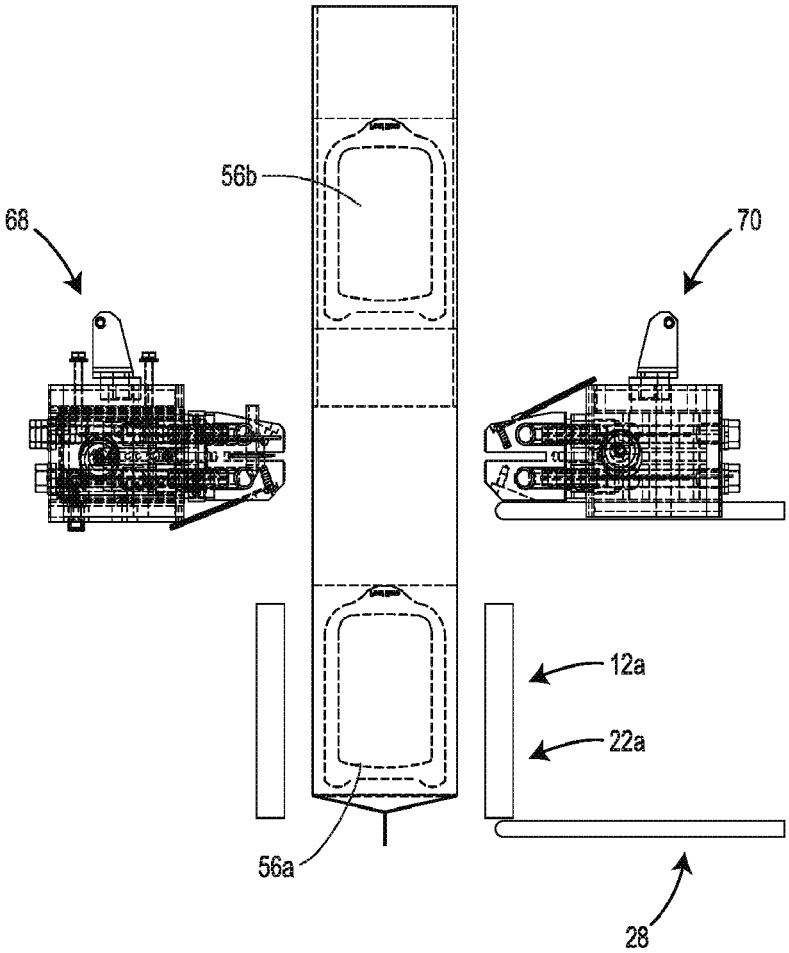
FIG. 24A is a graphical flow chart of a method of forming a package in accordance with an embodiment of the disclosure.
Figures 2, 24A:
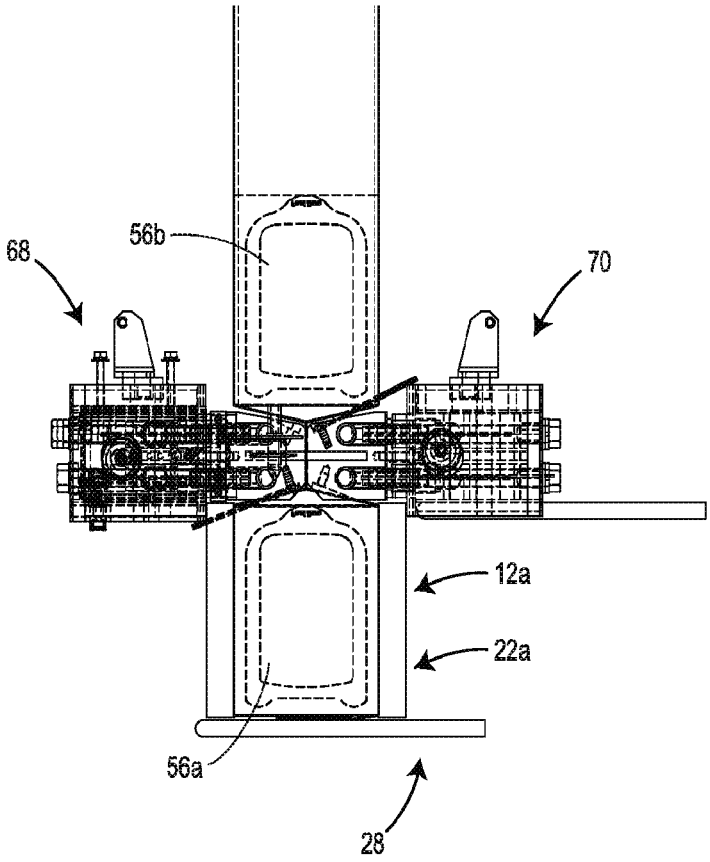
Figures 3, 24A:
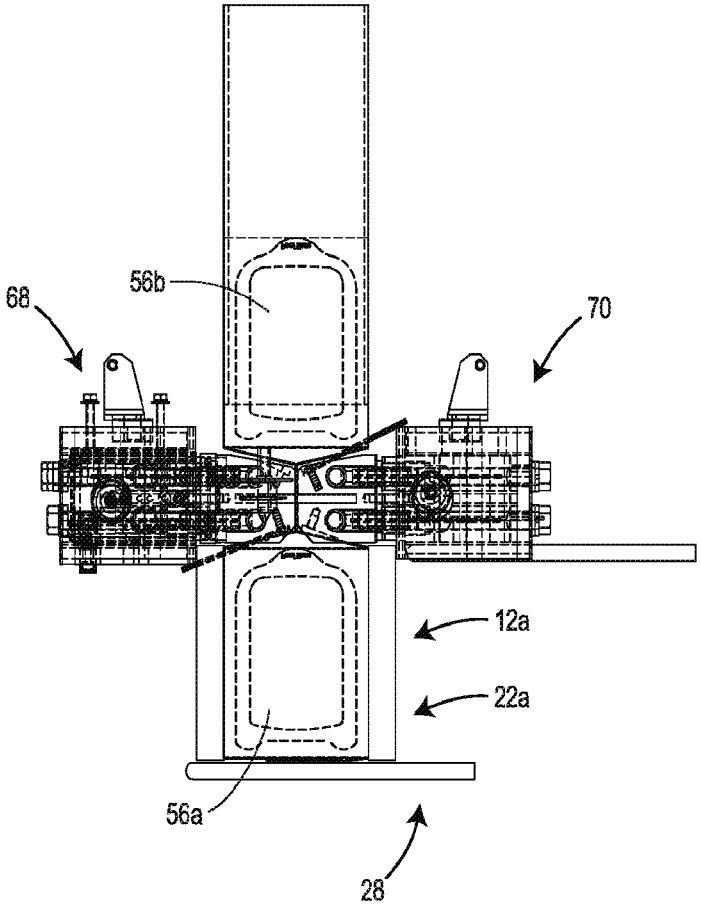
Figures 4, 24A:
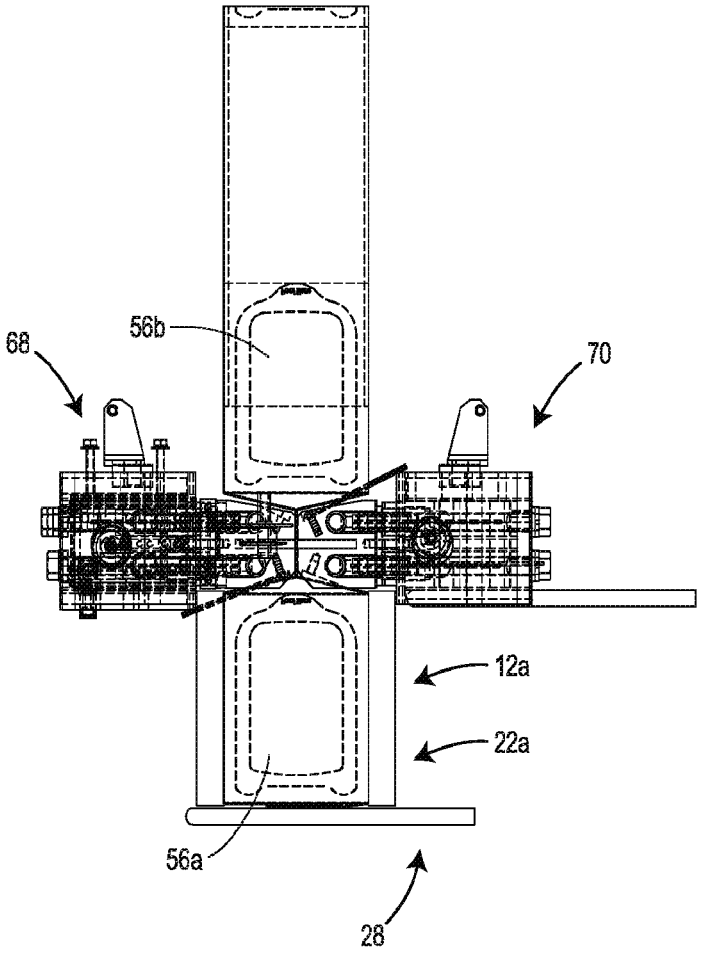
Figures 5, 24A:
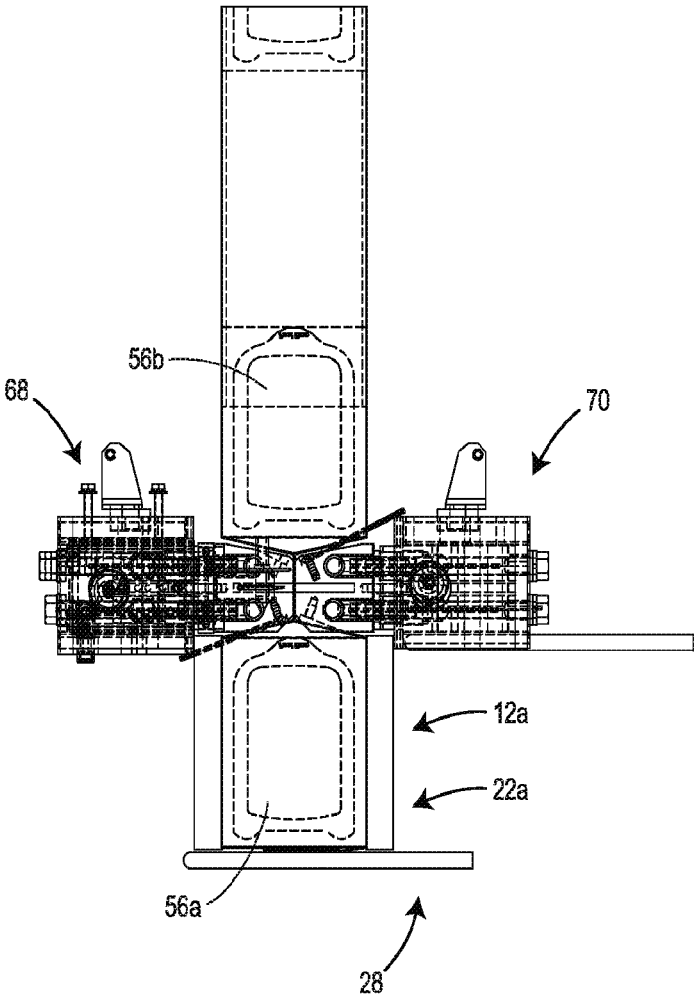
Figures 6, 24A:
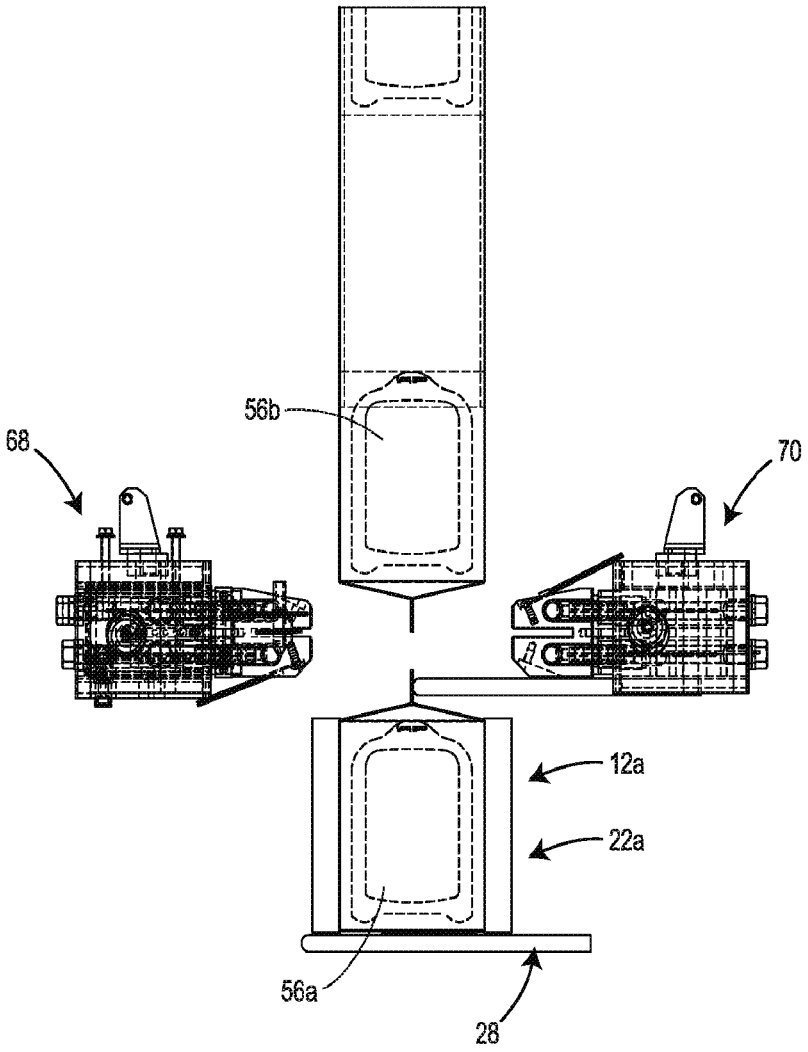

Turning to the apparatus 10 for making a flexible package in more detail, the retaining structure 12*a*, which is illustrated in FIG. 3B, extends along the transport axis 14 from the first end 16*a* to the second end 18*a* opposite the first end 16*a*. The retaining structure 12*a* may have any suitable shape or combination of shapes. For example, the retaining structure 12*a* may include two or more walls 20*a* that cooperate to form the lateral enclosure 22*a*, and the lateral enclosure 22*a* may be adapted to at least partially enclose a package 56, as illustrated in FIG. 4A. In another embodiment, for example, and as illustrated in FIGS. 3A and 3B, the retaining structure 12*a* may include four walls—i.e., a first wall 52*a*, a second wall 53*a*, a third wall 54*a*, and a fourth wall 55*a*—that cooperate to form the lateral enclosure 22*a*, and the first wall 52*a*, the second wall 53*a*, the third wall 54*a*, and the fourth wall 55*a* may cooperate to completely surround a lateral or circumferential portion of the package 56. The first wall 52*a*, the second wall 53*a*, the third wall 54*a*, and the fourth wall 55*a* may all be planar or substantially planar and may be aligned with the transport axis 14. In addition, the first wall 52*a* may be parallel to the second wall 53*a* and offset from the second wall 53*a* in a direction normal to the transport axis 14 and along the X-axis of the Reference Coordinate System of FIG. 3B. The third wall 54*a* may extend from a first end portion of the first wall 52*a* and a first end portion of the second wall 53*a* and the fourth wall 55*a* may extend from a second end portion of the first wall 52*a* and a second end portion of the second wall 53*a*. So configured, the third wall 54*a* may be parallel to the fourth wall 55*a* and offset from the fourth wall 55*a* in a direction normal to the transport axis 14 and along the Y-axis of the Reference Coordinate System of FIG. 3B.

As illustrated in FIG. 3B, each of the first wall 52*a*, the second wall 53*a*, the third wall 54*a*, and the fourth wall 55*a* may form a top perimeter edge 58*a* at the first end 16*a* of the retaining structure 12*a*. The top perimeter edge 58*a* may be disposed in a plane normal to the transport axis 14 (i.e., a plane parallel to the X-Y plane of the Reference Coordinate System of FIG. 3B). In addition, each of the first wall 52*a*, the second wall 53*a*, the third wall 54*a*, and the fourth wall 55*a* may form a bottom perimeter edge 58 at the second end 18*a* of the retaining structure 12*a*. The bottom perimeter edge 60*a* may be disposed in a plane normal to the transport axis 14 (i.e., a plane parallel to the X-Y plane of the Reference Coordinate System of FIG. 3B) and may be longitudinally offset (i.e., offset in a direction along the transport axis 14) from the plane of the top perimeter edge 58*a*.

Figure 4B:
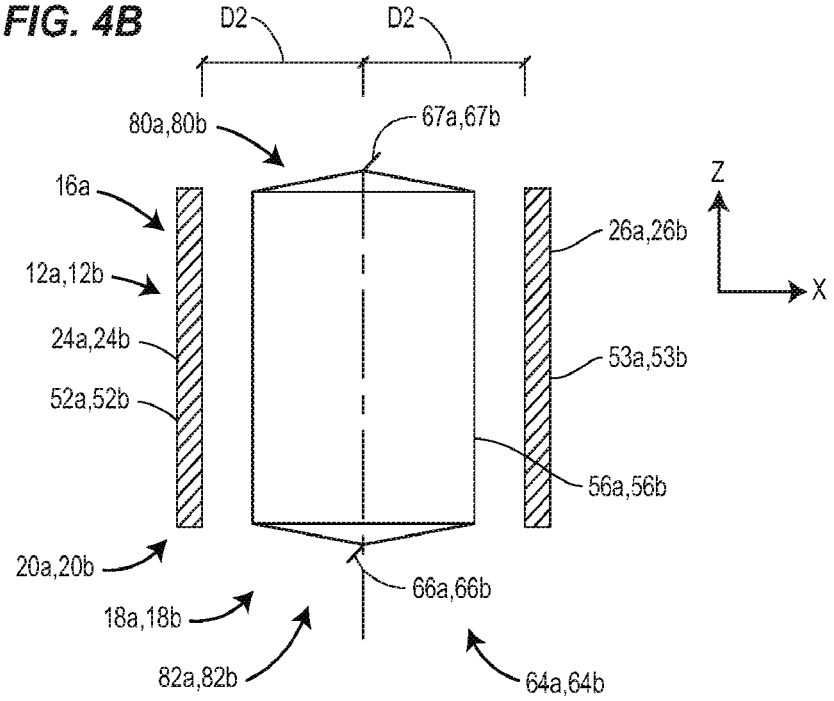
FIG. 4B is a front view of the embodiment of the first forming box of FIG. 4A in a second position.

As illustrated in FIGS. 4A and 4B, at least a first one 24*a* of the two or more walls 20*a* may displace relative to a second one 26*a* of the two or more walls. For example, the first wall 52*a* may displace relative to the second wall 53*a* (or to the transport axis 14), the second wall 53*a* may displace relative to the first wall 53*a* (or to the transport axis 14), or both the first wall 52*a* and the second wall 53*a* may displace relative to each other (or to the transport axis 14). More specifically, the first wall 52*a* and/or the second wall

53*a* may displace from a first position 62*a* (an example of which illustrated in FIG. 4A) to a second position 64*a* (an example of which is illustrated in FIG. 4B). In the first position 62*a*, the first wall 52*a* and the second wall 53*a* may each be a first transverse distance D1 (i.e., a distance normal to the transport axis 14) from the transport axis 14. In the first position 62*a*, the first wall 52*a* and the second wall 53*a* may be parallel or may be disposed at an angle (e.g., an oblique angle) to each other. In the second position 64*a*, the first wall 52*a* and the second wall 53*a* may each be a second transverse distance D2 from the transport axis 14, and the second transverse D2 distance may be greater than the first transverse distance D1. In addition, the first wall 52*a* and the second wall 53*a* may be parallel or may be disposed at an angle (e.g., an oblique angle) to each other.

In the first position 62*a*, as illustrated in FIG. 4A, at least one of the two or more walls 20*a* (e.g., at least one of the first wall 52*a* and the second wall 53*a*) contacts a portion of the package 56, such as a circumferential and/or lateral portion of the package 56. In some embodiments, at least two of the two or more walls 20*a* (e.g., each of the first wall 52*a* and the second wall 53*a*) contact corresponding portions of the package 56, such as a first circumferential and/or lateral portion of the package 56 and a second circumferential and/or lateral portion of the package 56. In some embodiments, each of the first wall 52*a*, the second wall 53*a*, the third wall 54*a*, and the fourth wall 55*a* contacts corresponding portions of the package 56, such as a first circumferential and/or lateral portion of the package 56, a second circumferential and/or lateral portion of the package 56, a third circumferential and/or lateral portion of the package 56, and a fourth circumferential and/or lateral portion of the package 56, respectively.

In the second position 64*a*, at least one of the two or more walls 20*a* (e.g., at least one of the first wall 52*a* and the second wall 53*a*) transversely displaces away from the transport axis 14 (e.g., in a direction parallel to the X-axis or Y-axis of the Reference Coordinate System of FIG. 3B), and in the second position 64*a*, the at least one of the two or more walls 20*a* may displace out of contact with (i.e., disengages) the portion of the package 56, such as the circumferential and/or lateral portion of the package 56. In some embodiments in the second portion 64*a*, at least two of the two or more walls 20*a* (e.g., each of the first wall 52*a* and the second wall 53*a*) transversely displaces away from the transport axis 14, and in the second position 64*a*, the at least two of the two or more walls 20*a* may displaces out of contact with (i.e., disengages) the corresponding portions of the package 56, such as the first circumferential and/or lateral portion of the package 56 and the second circumferential and/or lateral portion of the package 56. In other embodiments in the second position 64*a*, each of the first wall 52*a*, the second wall 53*a*, the third wall 54*a*, and the fourth wall 55*a* transversely displaces away from the transport axis 14, and each of the first wall 52*a*, the second wall 53*a*, the third wall 54*a*, and the fourth wall 55*a* may displace out of contact with (i.e., disengage) the corresponding portions of the package 56, such as a first circumferential and/or lateral portion of the package 56, a second circumferential and/or lateral portion of the package 56, a third circumferential and/or lateral portion of the package 56, and a fourth circumferential and/or lateral portion of the package 56, respectively.

Figures 7, 24A:
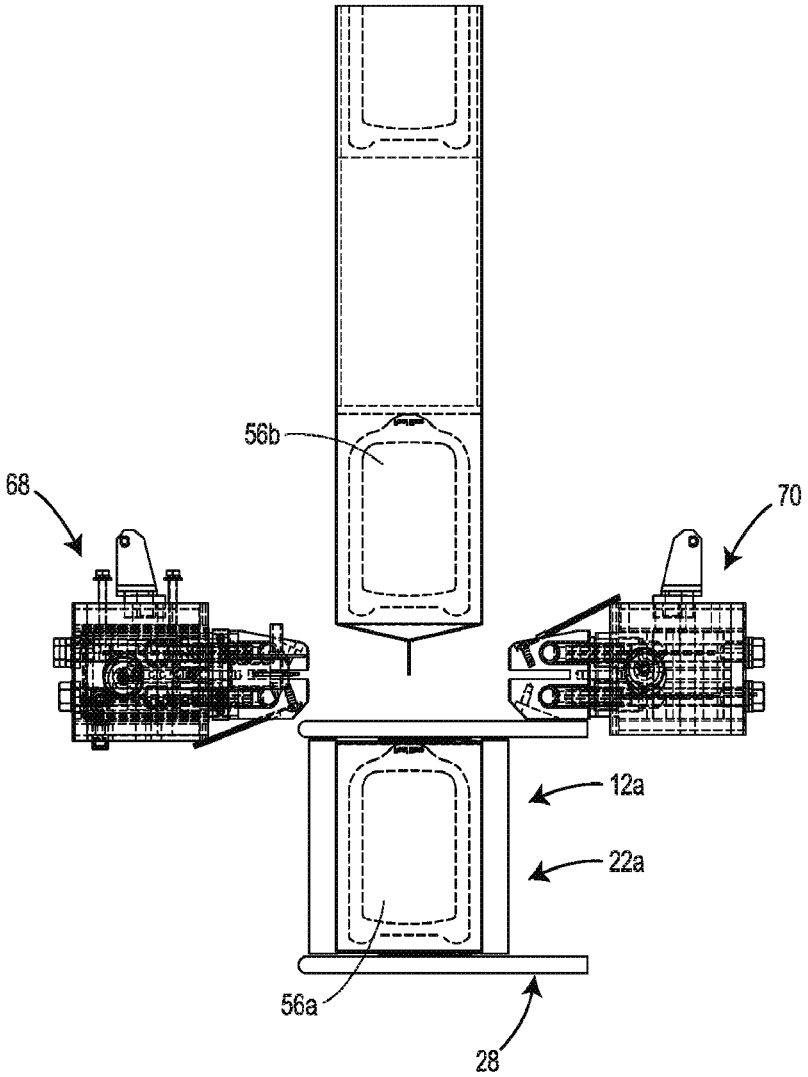

As illustrated in FIGS. 7A and 7B, the retaining structure 12*a* may also translate longitudinally (i.e., along the transport axis 14) relative to a second end 72 of a forming tube 74 and/or to the second forming box 12*b*. For example, the retaining structure 12*a* may longitudinally translate towards or away from the second end 72 of the forming tube 74 and/or towards or away from (e.g., upstream or downstream of) the second forming box 12*b*. In some embodiments, the first end 16*a* of the retaining structure 12*a* may be a first longitudinal distance D3 from the second end 72 of the forming tube 74 (or a transverse fixed reference axis upstream of the retaining structure 12*a*) in a first position 94*a*, as illustrated in FIG. 7A. In a second position 96*a* illustrated in FIG. 7B, the first end 16*a* of the retaining structure 12*a* may be a second longitudinal distance D4 from the second end 72 of the forming tube 74 (or the transverse fixed reference axis upstream of the retaining structure 12*a*), and the second longitudinal distance D4 may be greater than the first longitudinal distance D3.

Referring to FIGS. 3A and 3B, the at least one of the two or more walls 20*a* may be a single, unitary part or may be a segmented wall comprising two or more component parts. More specifically, all of the first wall 52*a*, the second wall 53*a*, the third wall 54*a*, and the fourth wall 55*a* may be a single unitary part, or at least one of the first wall 52*a*, the second wall 53*a*, the third wall 54*a*, and the fourth wall 55*a* may be a segmented wall comprising two or more component parts. For example, in the second position 64*a* (illustrated in FIG. 4B) of an embodiment of the retaining structure 12*a* of FIG. 3B, a first portion of the third wall 54*a* was coupled to the first wall 52*a* and a second portion of the third wall 54*a* was coupled to the second wall 53*a*. So configured, the first portion of the third wall 54*a* and the first wall 52*a* rotationally displaces from the first position 62*a* to and from the second position 64*a* and the second portion of the third wall 54*a* and the second wall 53*a* rotationally displaces from the first position 62*a* to and from the second position 64*a*.

Figure 2:
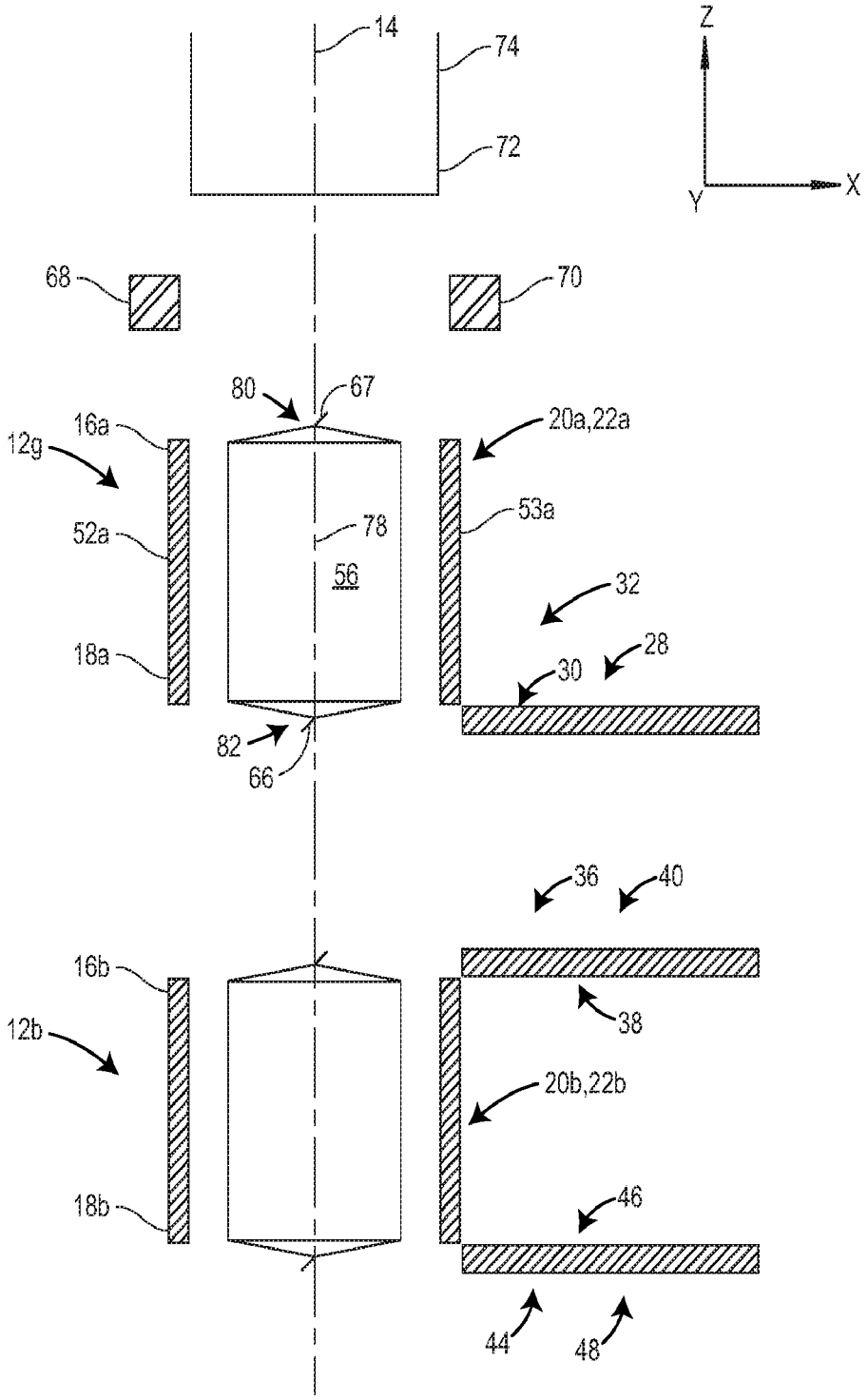
FIG. 2 is a further schematic front view of the embodiment of FIG. 1.

Referring to FIGS. 1 and 2, the apparatus 10 further includes the first downstream folding bar 28 disposed downstream of the retaining structure 12*a*, and the first downstream folding bar 28 may be elongated in a transverse direction. The first downstream folding bar 28 may have the contact portion 30 that is adapted to contact an upper or lower (relative to the circumferential and/or lateral) portion of the package 56. For example, the contact portion 30 may be adapted to contact at least a portion of a transverse seal (or flap) formed on an upper or lower portion of the package 56.

The first downstream folding bar 28 may be transversely displaceable between a first position 32 (illustrated in solid lines in FIG. 1) and a second position 34 (illustrated in dashed lines in FIG. 1). In the first position 32, the contact portion 30 is disposed remote from the second end 18*a* of the retaining structure 12*a*. More specifically, in the first position 32, a reference point 83 of the contact portion 30 may not intersect the transport axis 14 or may be a first transverse distance 84 from the transport axis 14. In the second position 34, the contact portion 30 is disposed at or adjacent to the second end 18*a* of the retaining structure 12*a* such that the contact portion 30 (or the reference point 83 of the contact portion 30) contacts or engages the portion of the transverse seal (or flap) formed on an upper or lower portion of the package 56. For example, in the second position 34, the contact portion 30 (or the reference point 83 of the contact portion 30) contacts or engages a portion of a first transverse seal 66 (or flap) formed on a lower portion of the package 56. In some embodiments, in the second position 34, the reference point 83 of the contact portion 30 may be a second transverse distance 85 from the transport axis 14 that is less than the first transverse distance 84. If the reference point 83 of the contact portion 30 intersects or is aligned with the transport axis 14 in the second position 34, the second transverse distance 85 from the transport axis 14 may be zero.

The first downstream folding bar 28 may extend transversely across the entire second end 18*a* of the retaining structure 12*a* when in the second position 34. In other embodiments, the first downstream folding bar 28 may extend transversely across a portion of the second end 18*a* of the retaining structure 12*a*. The first downstream folding bar 28 may extend from the first position 32 to the second position 34 (and vice versa) in any manner known in the art. For example, the first downstream folding bar 28 may be planar or substantially planar and may linearly translate from the first position 32 to the second position 34 (and vice versa) within a plane normal to the transport axis 14. In other embodiments, the first downstream folding bar 28 may rotate from the first position 32 to the second position 34 (and vice versa) within a plane normal to the transport axis 14. In still other embodiments, the first downstream folding bar 28 may include two or more plates (not shown) having transverse edges that are hinged such that in the second position 34, the two or more plates cooperate to form a planar shape and in the first position 32, adjacent plates of the two or more plates rotate about the hinged transverse edges to form an angle of less than 180 degrees (e.g., 45 degrees).

As illustrated in FIGS. 7A and 7B, the first downstream folding bar 28 may also longitudinally translate relative to the second end 72 of a forming tube 74 and/or to the second forming box 12*b*. For example, the first downstream folding bar 28 may longitudinally translate longitudinally towards or away from the second end 72 of the forming tube 74 and/or towards or way from the second forming box 12*b*. In some embodiments, the first downstream folding bar 28 may be longitudinally fixed relative to the retaining structure 12*a* such that the first downstream folding bar 28 longitudinally translates from a first position 98 (when, e.g., the retaining structure 12*a* is in the first position 94*a*) illustrated in FIG. 7A and a second position 99 (when, e.g., the retaining structure 12*a* is in the second position 96*a*) illustrated in FIG. 7B. However, the first downstream folding bar 28 may longitudinally translate towards or away from the retaining structure 12*a*.

Figure 6:
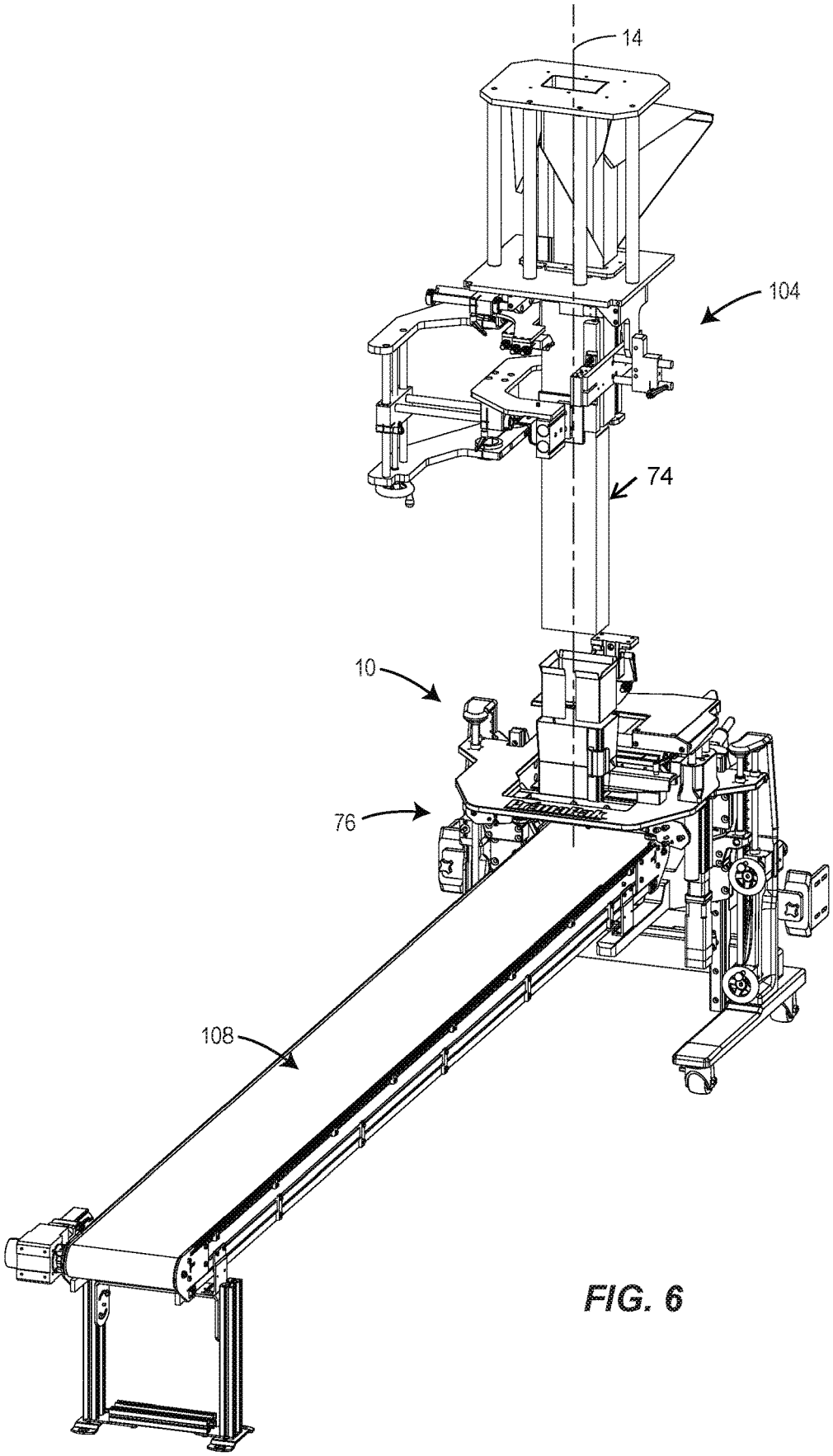
FIG. 6 is a schematic front view of an embodiment of a system including an embodiment of an apparatus for forming a flexible package.

Referring again to FIG. 1, the apparatus 10 may include first and second seal bars 68, 70, and the first and second seal bars 68, 70 are disposed upstream of the first end 16*a* of the retaining structure 12*a*. The first and second seal bars 68, 70 may also be disposed downstream of the second end 72 of the forming tube 74 such that the first and second seal bars 68, 70 are disposed between the second end 72 of the forming tube 74 and the first end 16*a* of the retaining structure 12*a*. As known in the art, and as illustrated in FIG. 6, the forming tube 74 may extend along the transport axis 14, and film used to form one of a plurality of packages (e.g., the package 56) may be shaped around the forming tube 74 in known manner. In addition, as is known in the art, product that is to be enclosed in the package 56 may be transported from a hopper (not shown) through an interior passageway through the forming tube 74 and out of the second end in a known manner.

The first and second seal bars 68, 70 may each be elongated and extend along a linear axis that may extend in a transverse direction (e.g., along the Y-axis of the Reference Coordinate System provided in FIG. 1) and each of the first and second seal bars 68, 70 may be parallel. Each of the first and second seal bars 68, 70 may be disposed on opposing sides of the transport axis 14 and each of the first and second seal bars 68, 70 may translate in a transverse direction (e.g., in a direction parallel to the X-axis of the Reference Coordinate System provided in FIG. 1) towards the transport axis 14.

The first and second seal bars 68, 70 may cooperate to form the transverse seal (or flap) formed on an upper or lower portion of the package 56. For example, the first and second seal bars 68, 70 may cooperate to form the first transverse seal 66 (or flap) formed on a lower portion of the package 56. The first and second seal bars 68, 70 may also cooperate to form a second transverse seal 67 (or flap) formed on an upper portion of the package 56. The first and second seal bars 68, 70 may form the transverse seal (e.g., the first and/or second transverse seal 66, 67) in any known manner, such as by heat sealing. The first and second seal bars 68, 70 may also longitudinally translate with a package 56 (as illustrated in FIGS. 5B to 5E, for example) while forming the first and/or second transverse seal 66, 67. For example, the first and second seal bars 68, 70 may translate longitudinally upwards or downwards relative to the second end 72 of the forming tube 74 and/or to the first end 16*a* of the retaining structure 12*a*.

Figures 8, 24A:
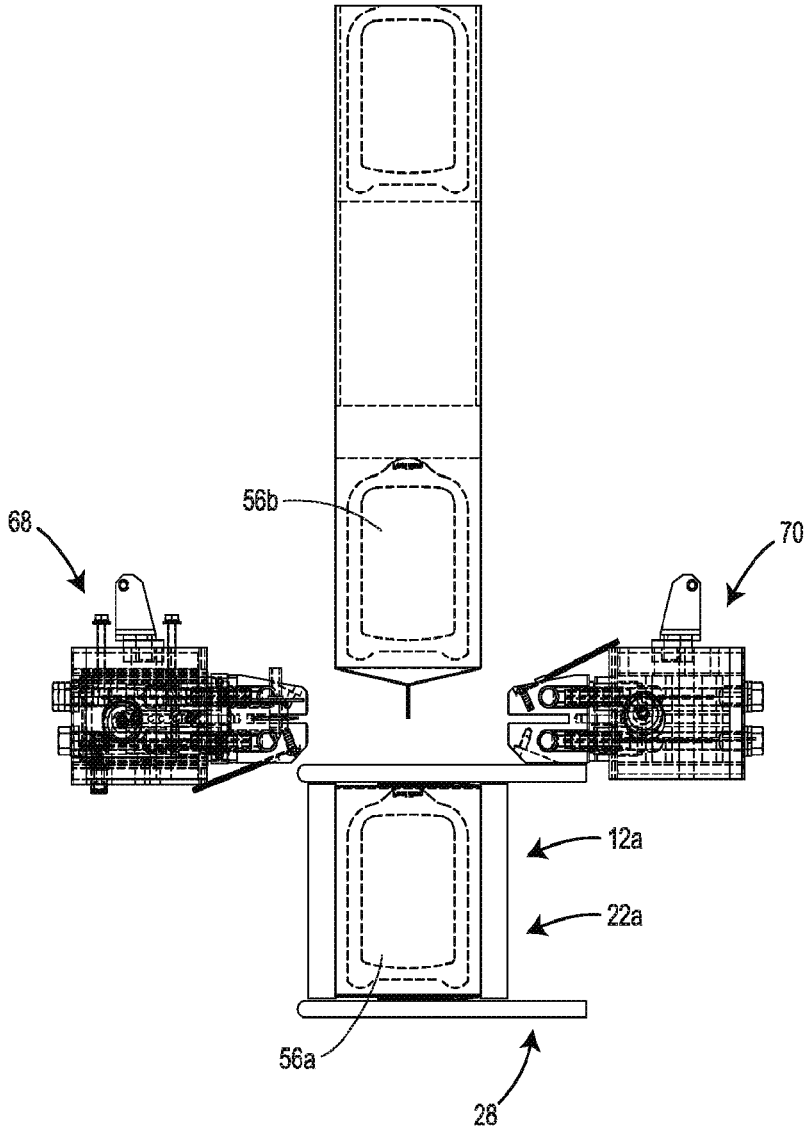

Referring again to FIGS. 1, 8A, and 8B the apparatus 10 may also include the second forming box 12*b* that extends along the transport axis 14 from the first end 16*b* to the second end 18*b* opposite the first end 16*b*. The second forming box 12*b* may have any suitable shape or combination of shapes, and the second forming box 12*b* may be identical physically and functionally to the retaining structure 12*a*. For example, the second forming box 12*b* may include two or more walls 20*b* that cooperate to form the lateral enclosure 22*b*, and the lateral enclosure 22*b* may be adapted to at least partially enclose the package 56. As illustrated in FIG. 8B, the second forming box 12*b* may include four walls—i.e., a first wall 52*b*, a second wall 53*b*, a third wall 54*b*, and a fourth wall 55*b*—that cooperate to form the lateral enclosure 22*b*, and the first wall 52*b*, the second wall 53*b*, the third wall 54*b*, and the fourth wall 55*b* may cooperate to completely surround a lateral or circumferential portion of the package 56. The first wall 52*b*, the second wall 53*b*, the third wall 54*a*, and the fourth wall 55*b* may all be planar or substantially planar and may be aligned with the transport axis 14. In addition, the first wall 52*b* may be parallel to the second wall 53*b* and offset from the second wall 53*b* in a direction normal to the transport axis 14 and along the X-axis of the Reference Coordinate System of FIG. 8B. The third wall 54*b* may extend from a first end portion of the first wall 52*b* and a first end portion of the second wall 53*b* and the fourth wall 55*b* may extend from a second end portion of the first wall 52*b* and a second end portion of the second wall 53*b*. So configured, the third wall 54*b* may be parallel to the fourth wall 55*b* and offset from the fourth wall 55*b* in a direction normal to the transport axis 14 and along the Y-axis of the Reference Coordinate System of FIG. 8B.

Still referring to FIG. 8B, each of the first wall 52*b*, the second wall 53*b*, the third wall 54*b*, and the fourth wall 55*b* may form a top perimeter edge 58*b* at the first end 16*b* of the second forming box 12*b*. The top perimeter edge 58*b* may be disposed in a plane normal to the transport axis 14 (i.e., a plane parallel to the X-Y plane of the Reference Coordinate System of FIG. 8B). In addition, each of the first wall 52*b*, the second wall 53*b*, the third wall 54*b*, and the fourth wall 55*ab* may form a bottom perimeter edge 58*b* at the second end 18*b* of the second forming box 12*b*. The bottom perimeter edge 60*b* may be disposed in a plane normal to the transport axis 14 (i.e., a plane parallel to the X-Y plane of the Reference Coordinate System of FIG. 8B) and may be longitudinally offset (i.e., offset in a direction along the transport axis 14) from the plane of the top perimeter edge 58*b*.

As illustrated in FIGS. 4A and 4B, at least a first one of the two or more walls 20*b* displaces relative to a second one of the two or more walls. That is, the first wall 52*ba* may displace relative to the second wall 53*b*, the second wall 53*b* may displace relative to the first wall 53*b*, or both the first wall 52*b* and the second wall 53*b* may displace relative to each other (or to the transport axis 14). More specifically, the first wall 52*b* and/or the second wall 53*b* may displace from a first position 62*b* (an example of which illustrated in FIG. 4A) to a second position 64*b* (an example of which is illustrated in FIG. 4B). In the first position 62*b*, the first wall 52*b* and the second wall 53*b* may each be a first transverse distance D1 (i.e., a distance normal to the transport axis 14) from the transport axis 14. In the first position 62*b*, the first wall 52*b* and the second wall 53*b* may be parallel or may be disposed at an angle (e.g., an oblique angle) to each other. In the second position 64*b*, the first wall 52*b* and the second wall 53*b* may each be a second transverse D2 distance from the transport axis 14, and the second transverse distance D2 may be greater than the first transverse distance D1. The first wall 52*b* and the second wall 53*b* can move symmetrically such that the first and second transverse distances D1, D2 are symmetrical about the transport axis 14. Alternatively, the first wall 52*b* and the second wall 53*b* can move different distances such that the first and second transverse distances D1 and D2 are asymmetrical about the transport axis 14. In still further embodiments, only one of the walls can move while the other is stationary. In addition, the first wall 52*b* and the second wall 53*b* may be parallel or may be disposed at an angle (e.g., an oblique angle) to each other.

In the first position 62*b* illustrated in FIG. 4A, at least one of the two or more walls 20*b* (e.g., at least one of the first wall 52*b* and the second wall 53*b*) contacts a portion of the package 56, such as a circumferential and/or lateral portion of the package 56. In some embodiments, at least two of the two or more walls 20*b* (e.g., each of the first wall 52*b* and the second wall 53*b*) contact corresponding portions of the package 56, such as a first circumferential and/or lateral portion of the package 56 and a second circumferential and/or lateral portion of the package 56. In some embodiments, each of the first wall 52*b*, the second wall 53*b*, the third wall 54*b*, and the fourth wall 55*b* contacts corresponding portions of the package 56, such as a first circumferential and/or lateral portion of the package 56, a second circumferential and/or lateral portion of the package 56, a third circumferential and/or lateral portion of the package 56, and a fourth circumferential and/or lateral portion of the package 56, respectively.

In the second position 64*b* illustrated in FIG. 4B, at least one of the two or more walls 20*b* (e.g., at least one of the first wall 52*b* and the second wall 53*b*) transversely displaces away from the transport axis 14 (e.g., in a direction parallel to the X-axis or Y-axis of the Reference Coordinate System of FIG. 2A), and in the second position 64*b*, the at least one of the two or more walls 20*b* may displace out of contact with (i.e., disengages) the portion of the package 56, such as the circumferential and/or lateral portion of the package 56. In some embodiments in the second portion 64*b*, at least two of the two or more walls 20*b* (e.g., each of the first wall 52*b* and the second wall 53*b*) transversely displaces away from the transport axis 14, and in the second position 64*b*, the at least two of the two or more walls 20*b* may displace out of contact with (i.e., disengages) the corresponding portions of the package 56, such as the first circumferential and/or lateral portion of the package 56 and the second circumferential and/or lateral portion of the package 56. In other embodiments in the second position 64*b*, each of the first wall 52*b*, the second wall 53*b*, the third wall 54*b*, and the fourth wall 55*b* transversely displaces away from the transport axis 14, and each of the first wall 52*b*, the second wall 53*b*, the third wall 54*b*, and the fourth wall 55*b* may displace out of contact with (i.e., disengage) the corresponding portions of the package 56, such as a first circumferential and/or lateral portion of the package 56, a second circumferential and/or lateral portion of the package 56, a third circumferential and/or lateral portion of the package 56, and a fourth circumferential and/or lateral portion of the package 56, respectively.

Figures 9, 24A:
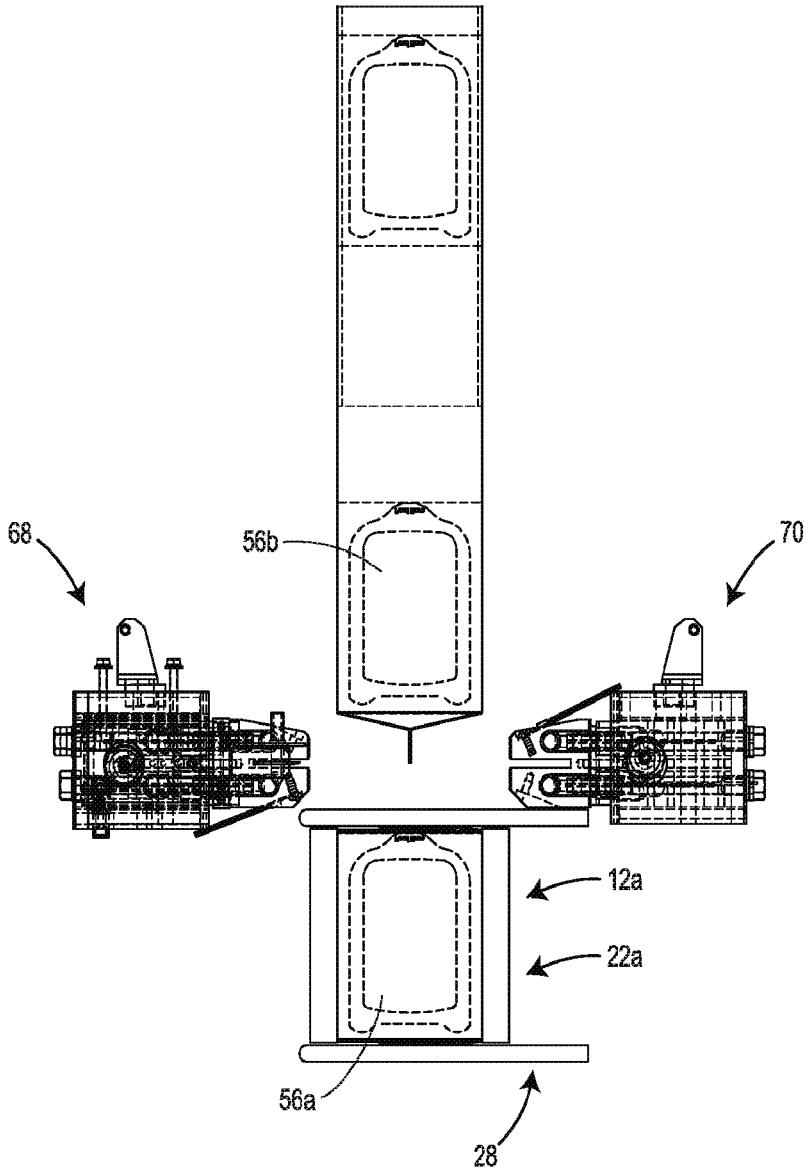
Figures 10, 24A:
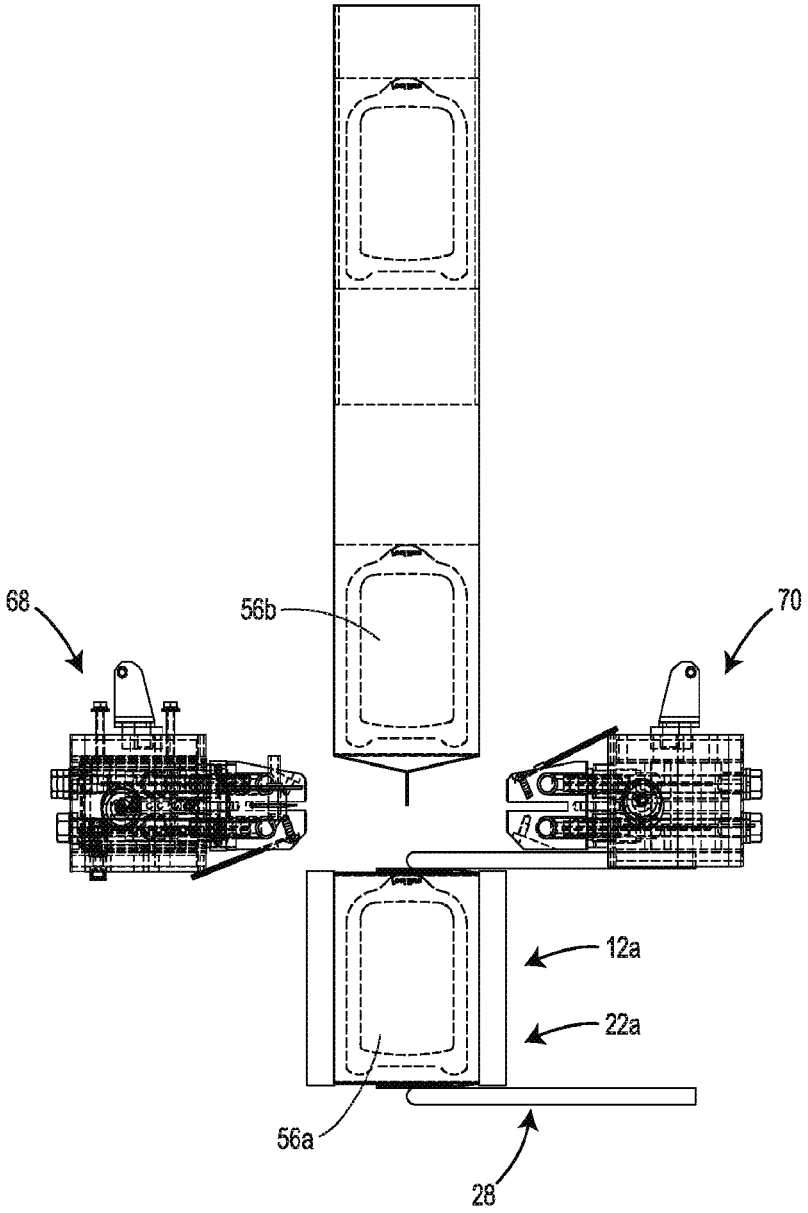
Figures 11, 24A:
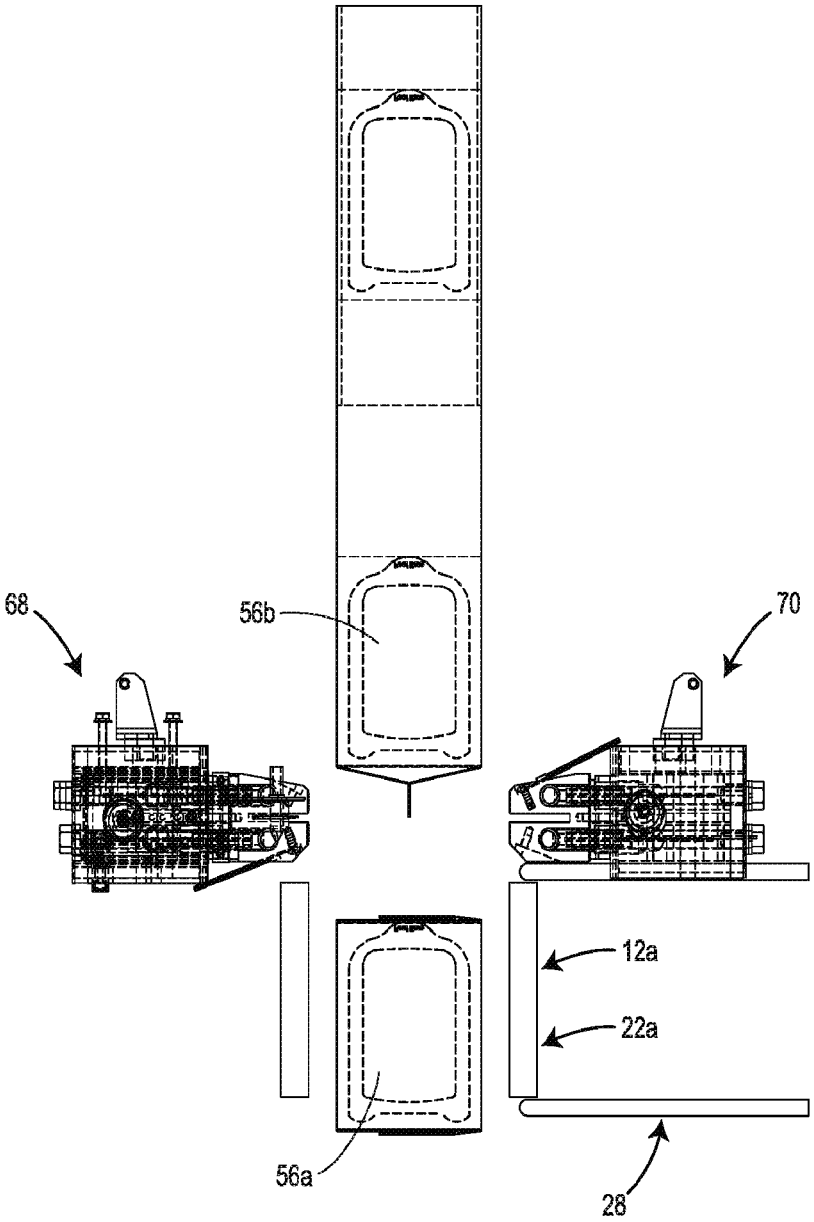
Figures 12, 24A:
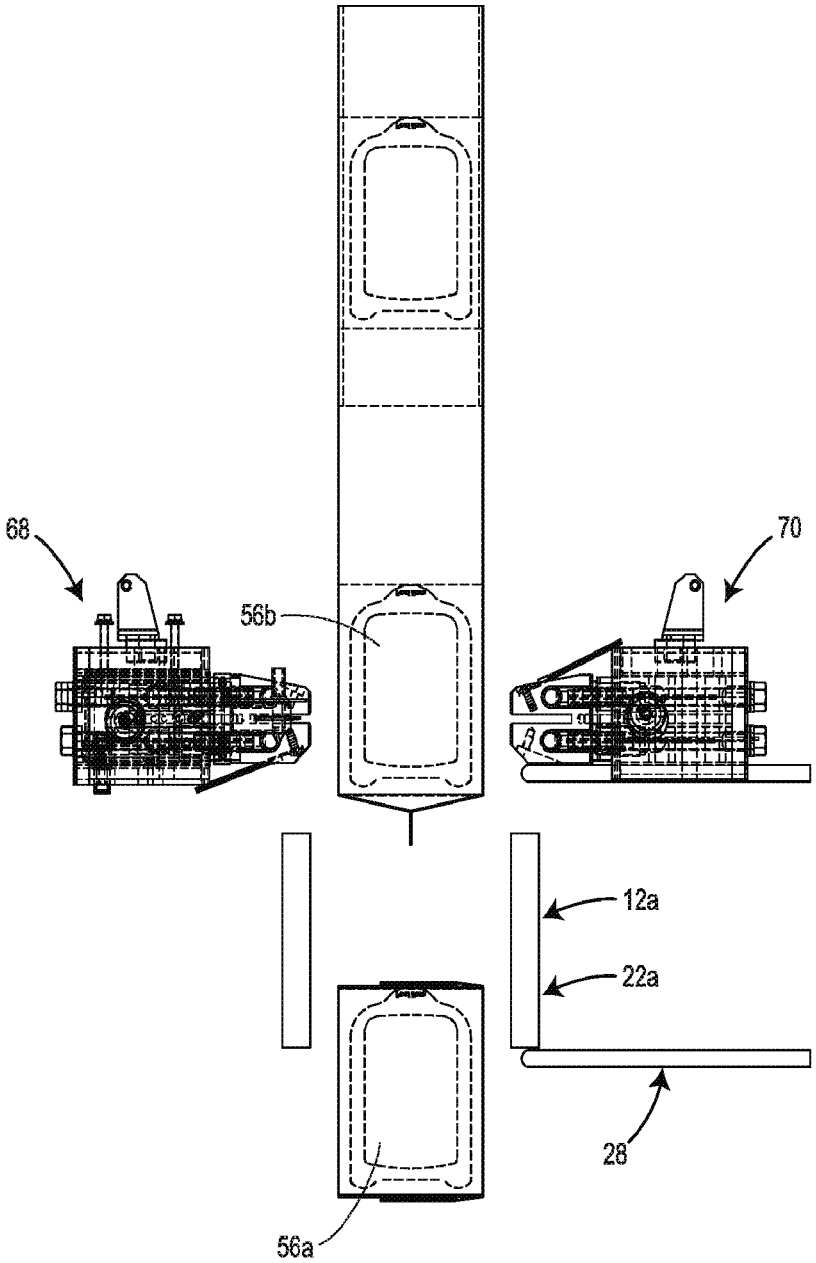
Figures 13, 24A:
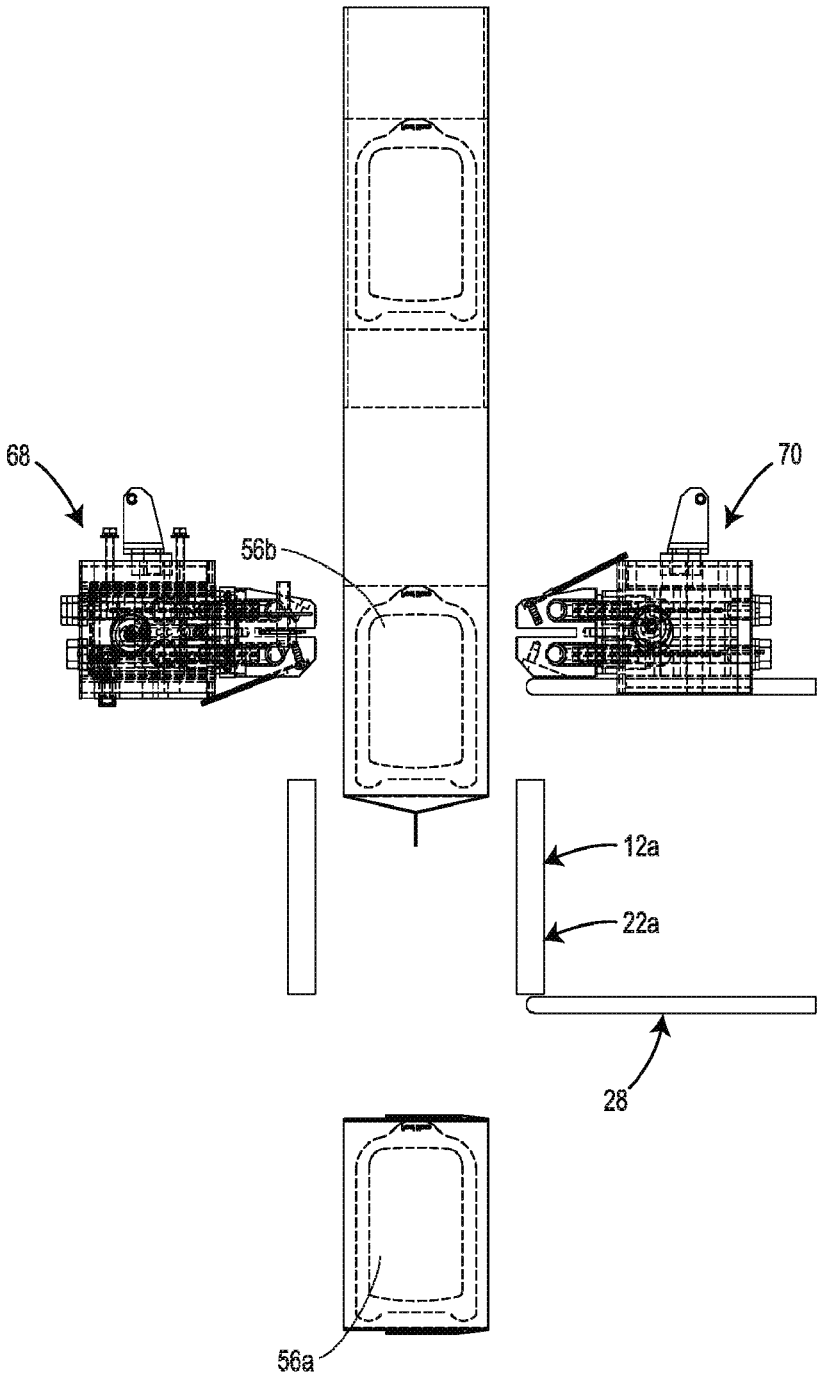
Figures 14, 24A:
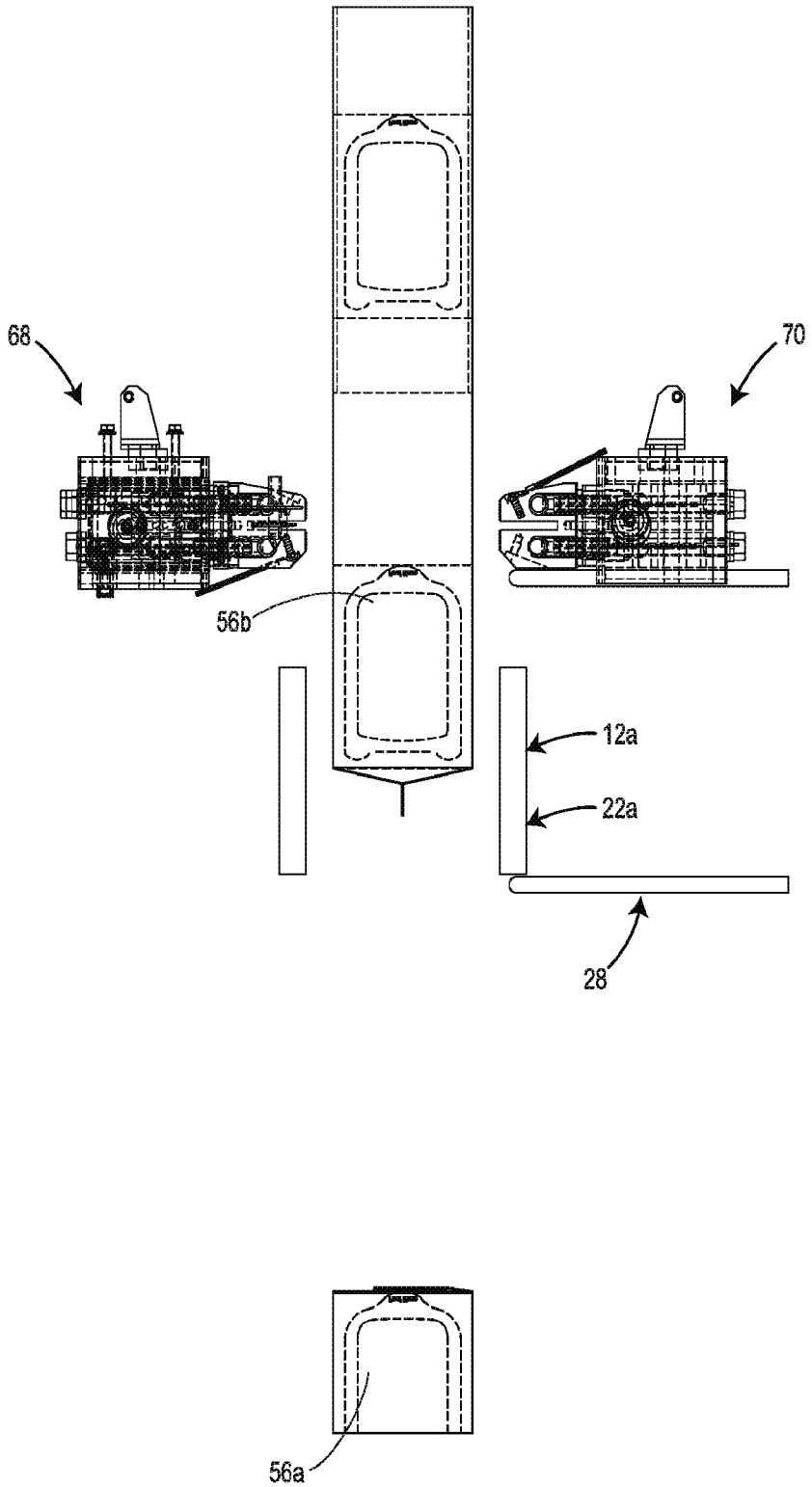
Figures 15, 24A:
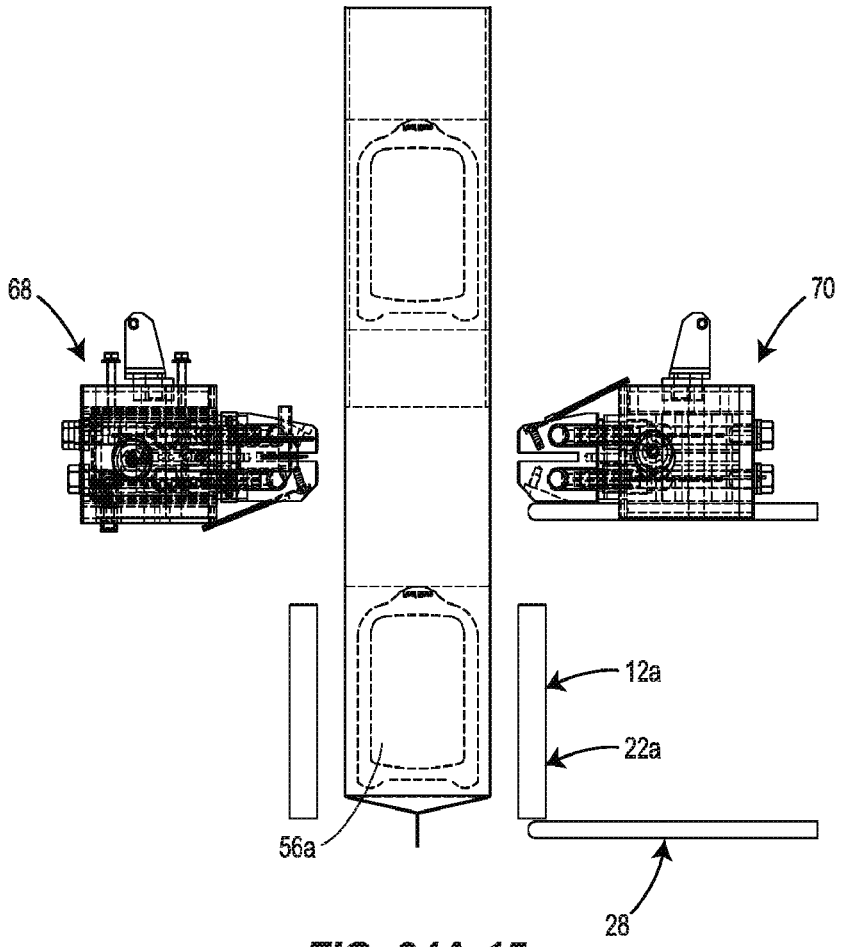
Figure 24C:
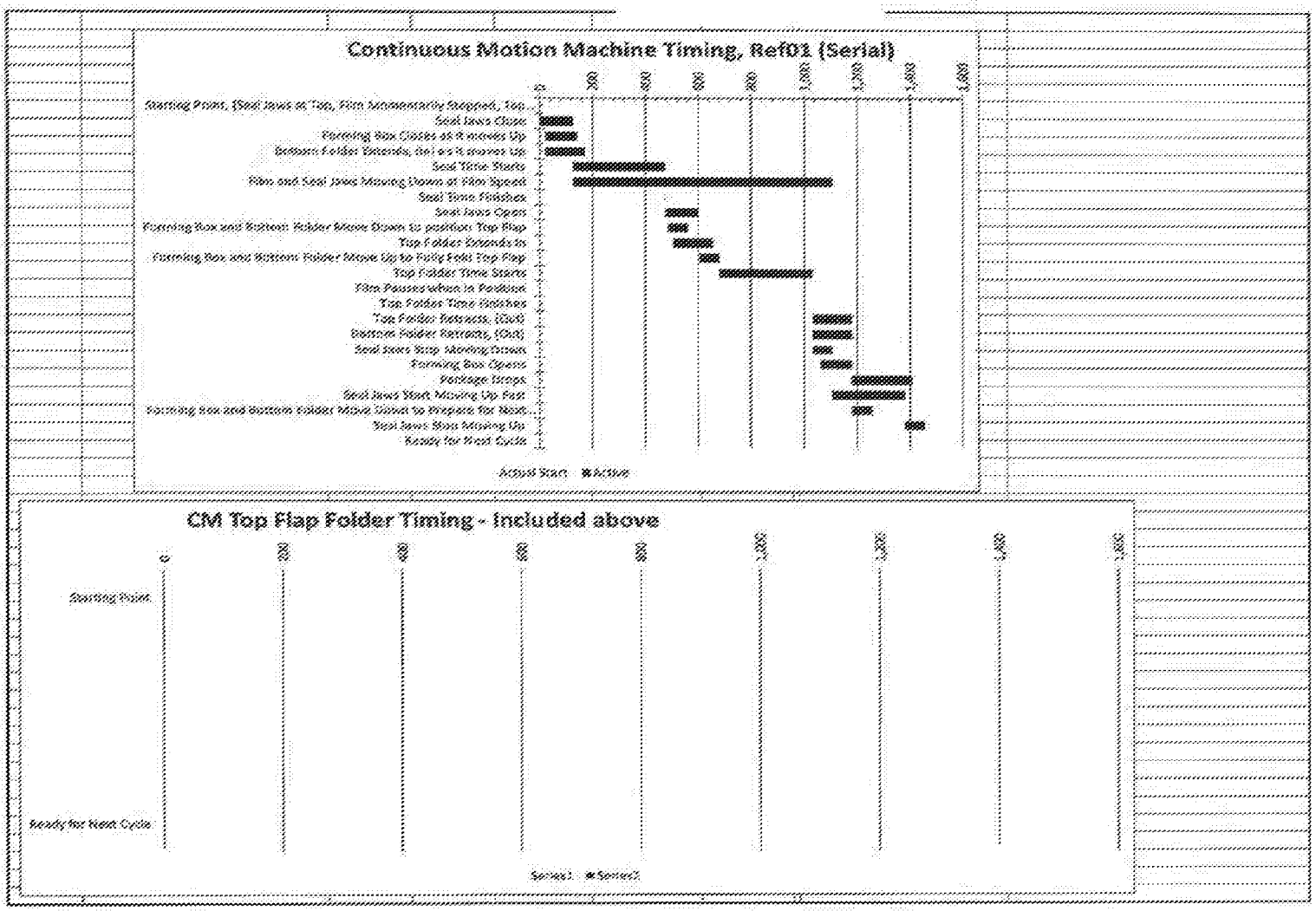
FIG. 24C is a graphical representation of the chart of FIG. 24B.
Figures 1, 25A:
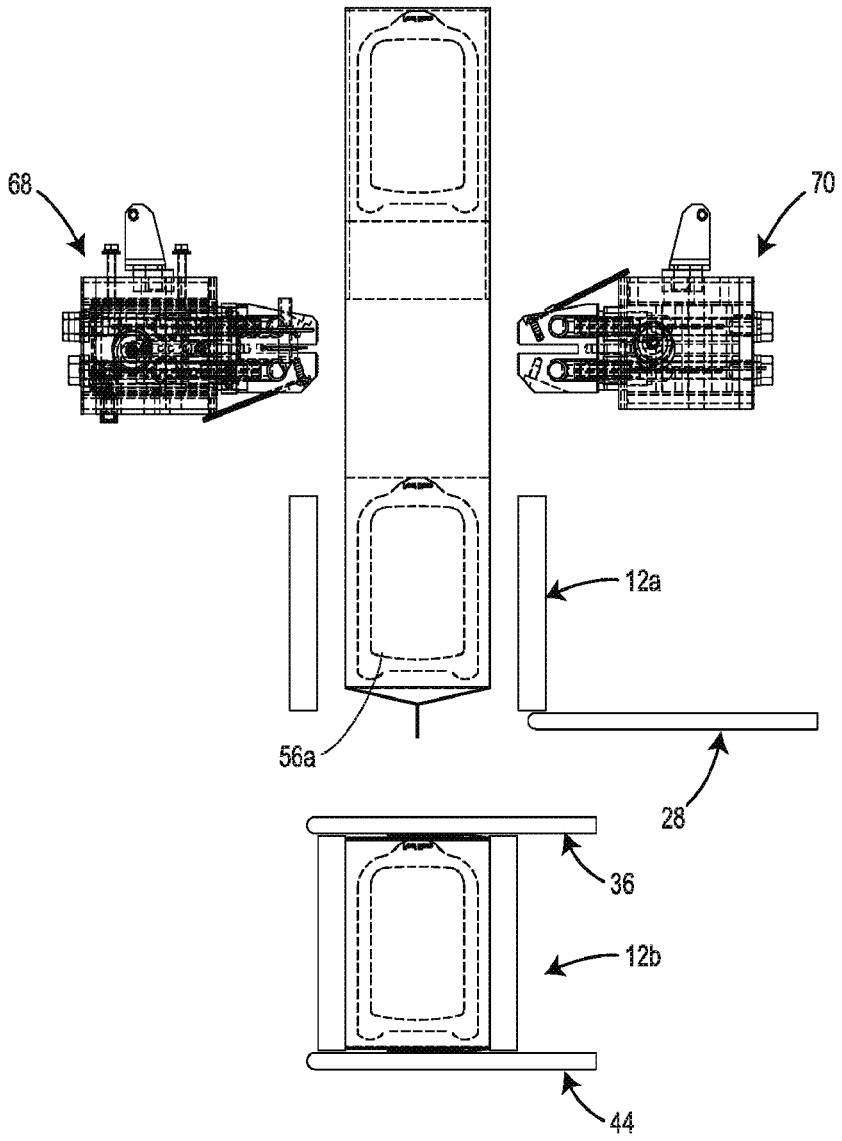
FIG. 25A is a graphical flow chart of a method of forming a package in accordance with another embodiment of the disclosure.
Figures 2, 25A:
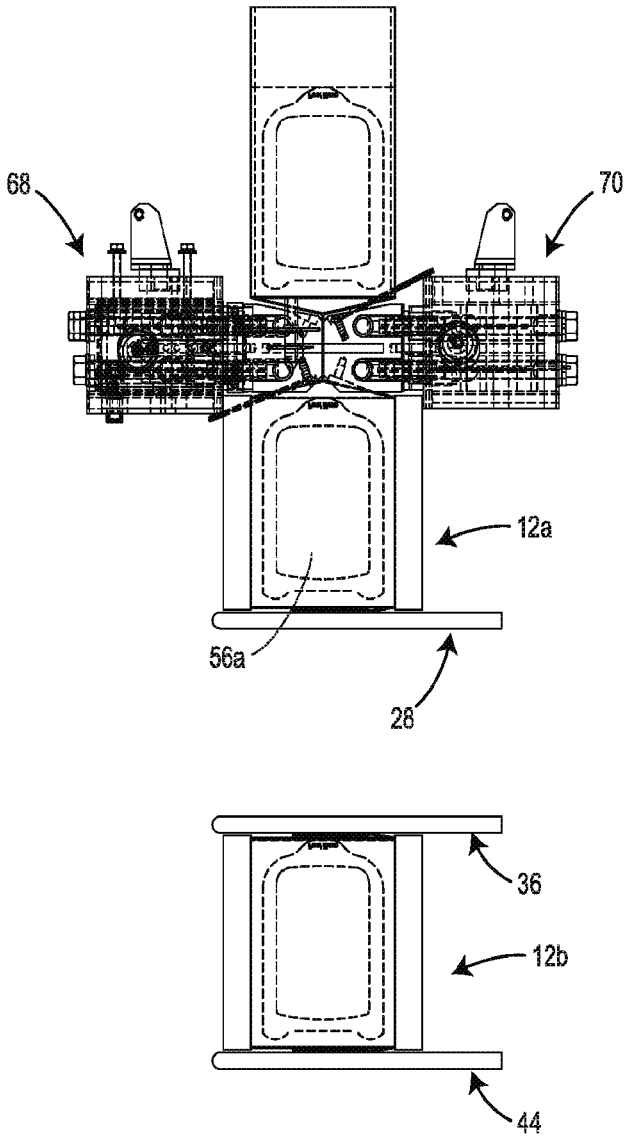
Figures 3, 25A:
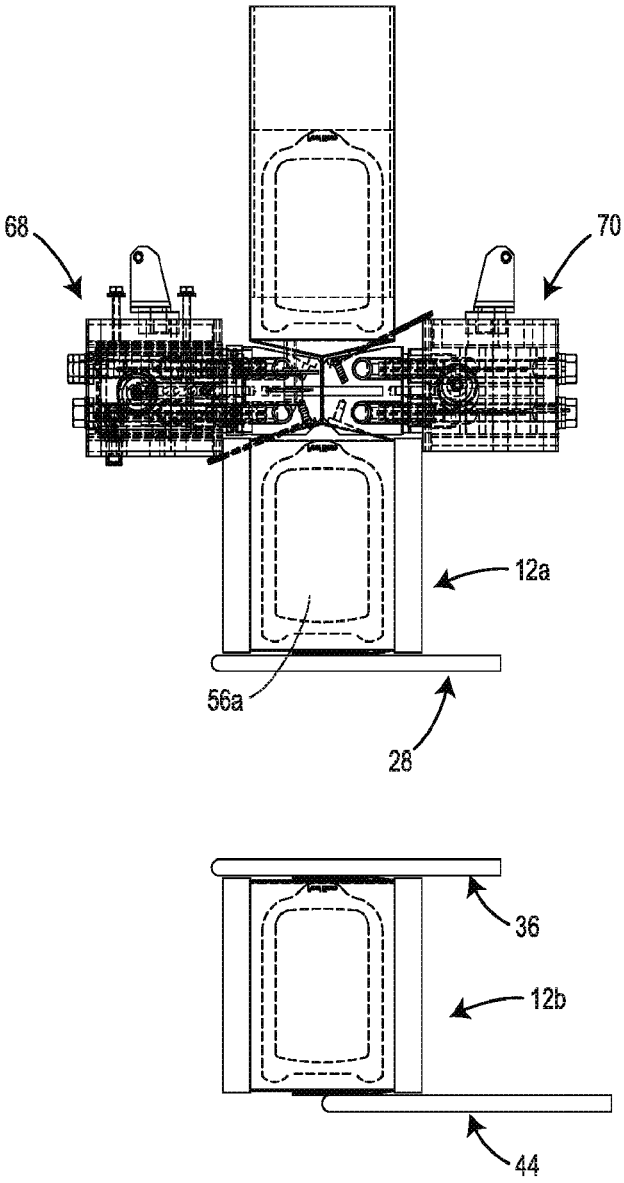
Figures 4, 25A:
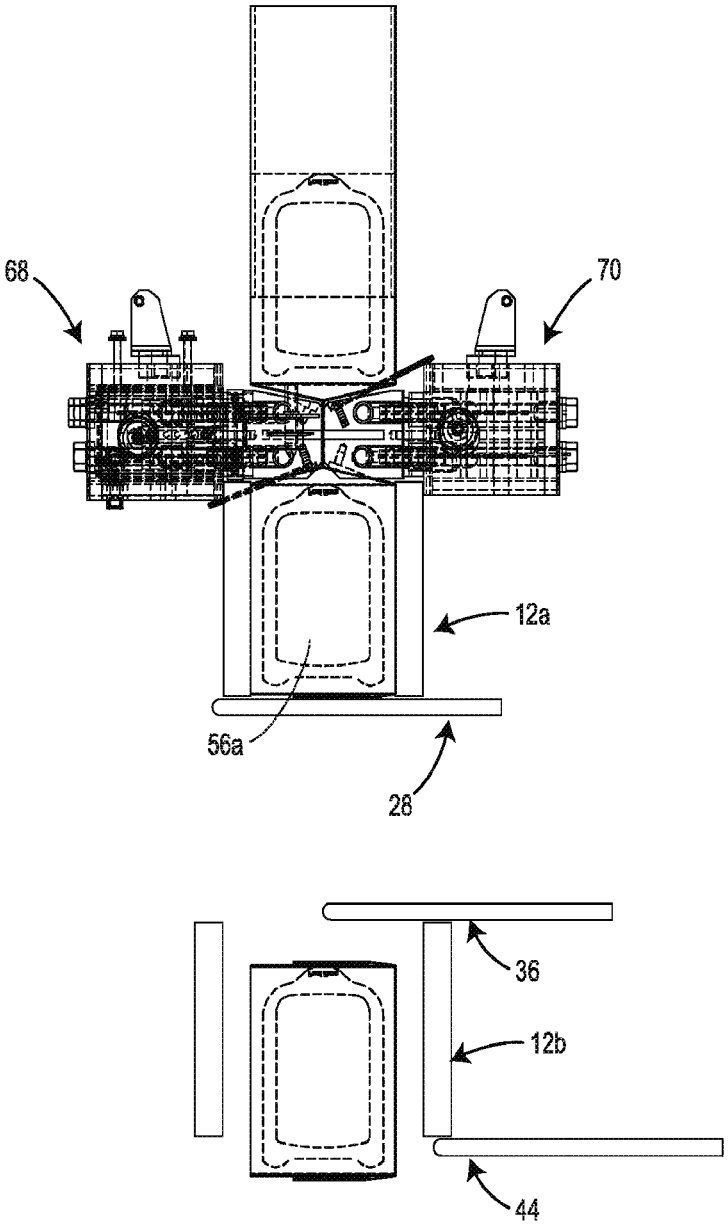
Figures 5, 25A:
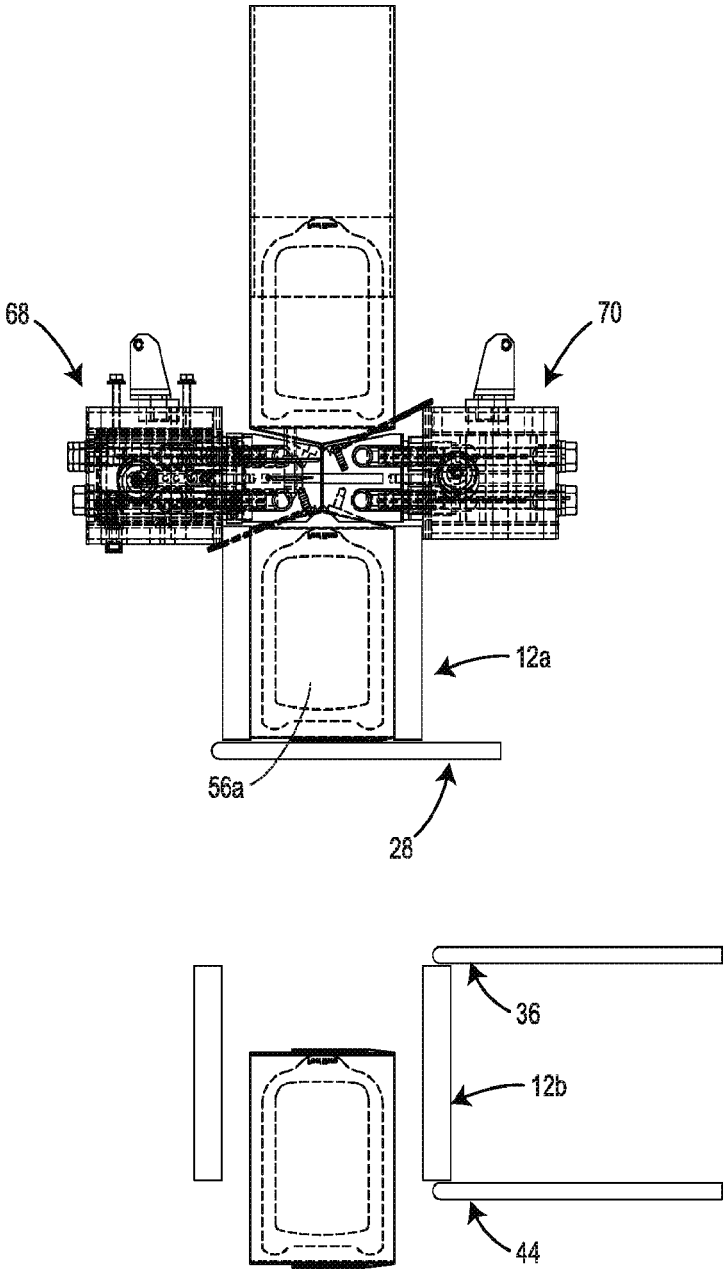
Figures 6, 25A:
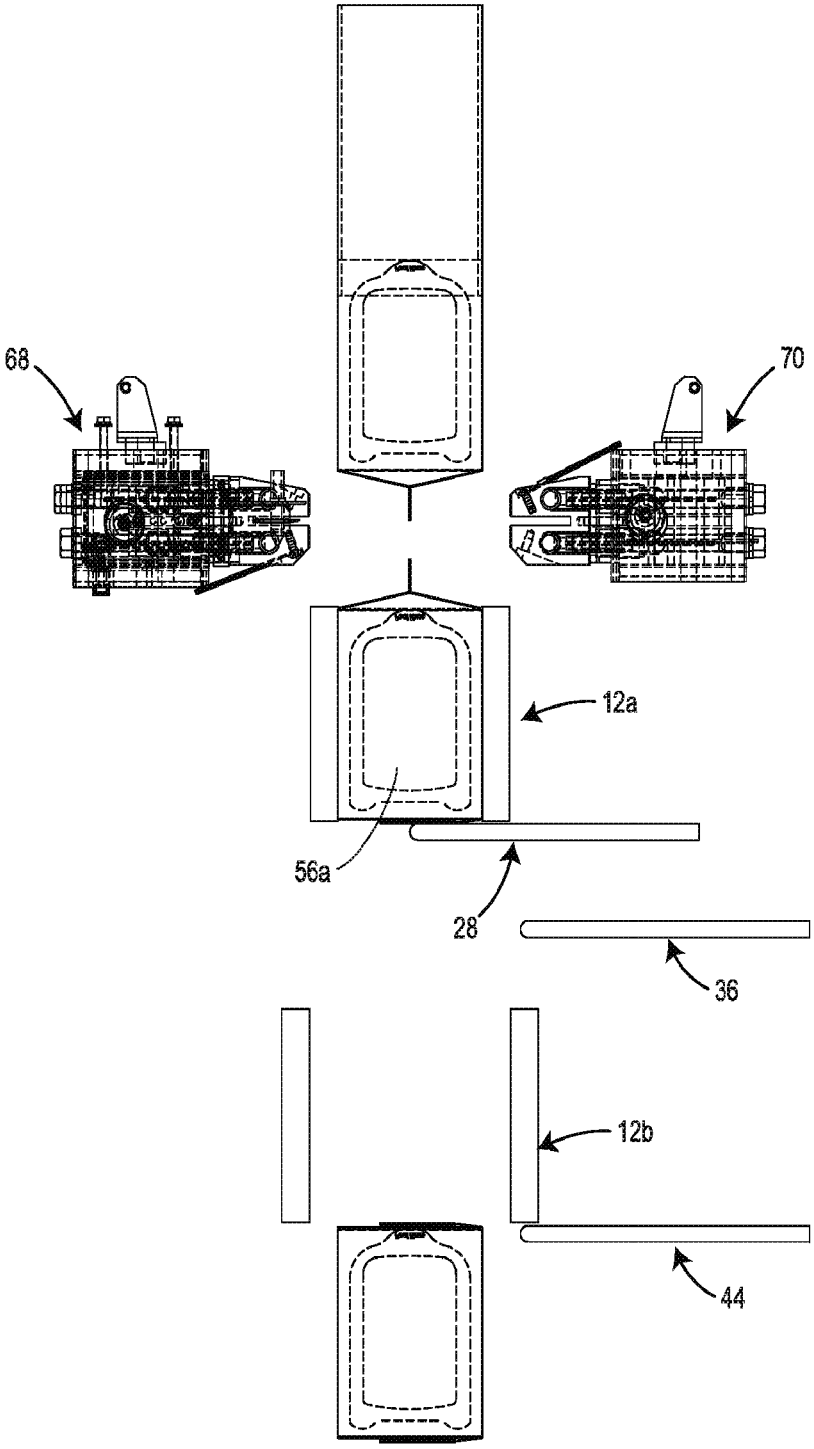
Figures 7, 25A:
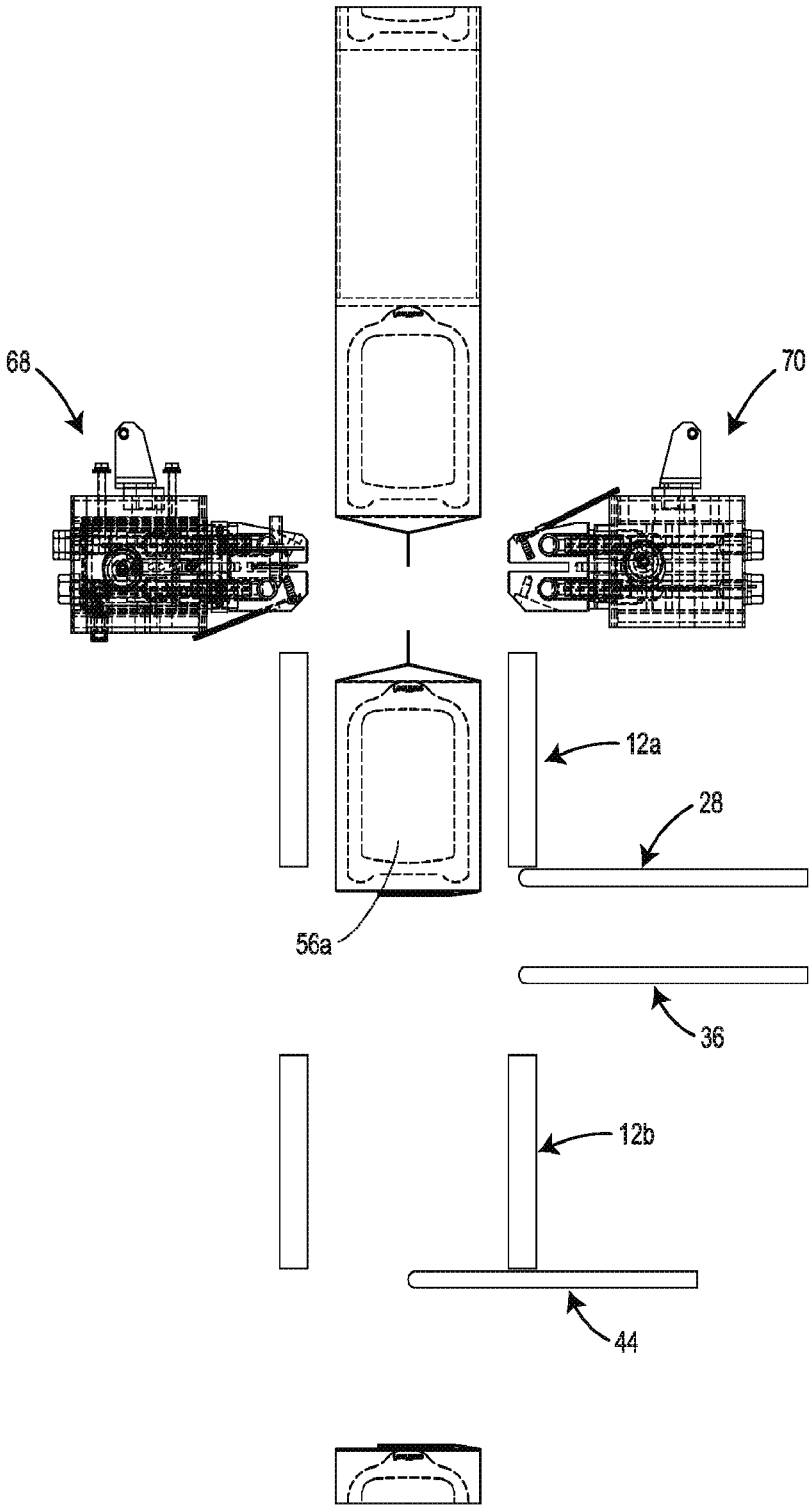
Figures 8, 25A:
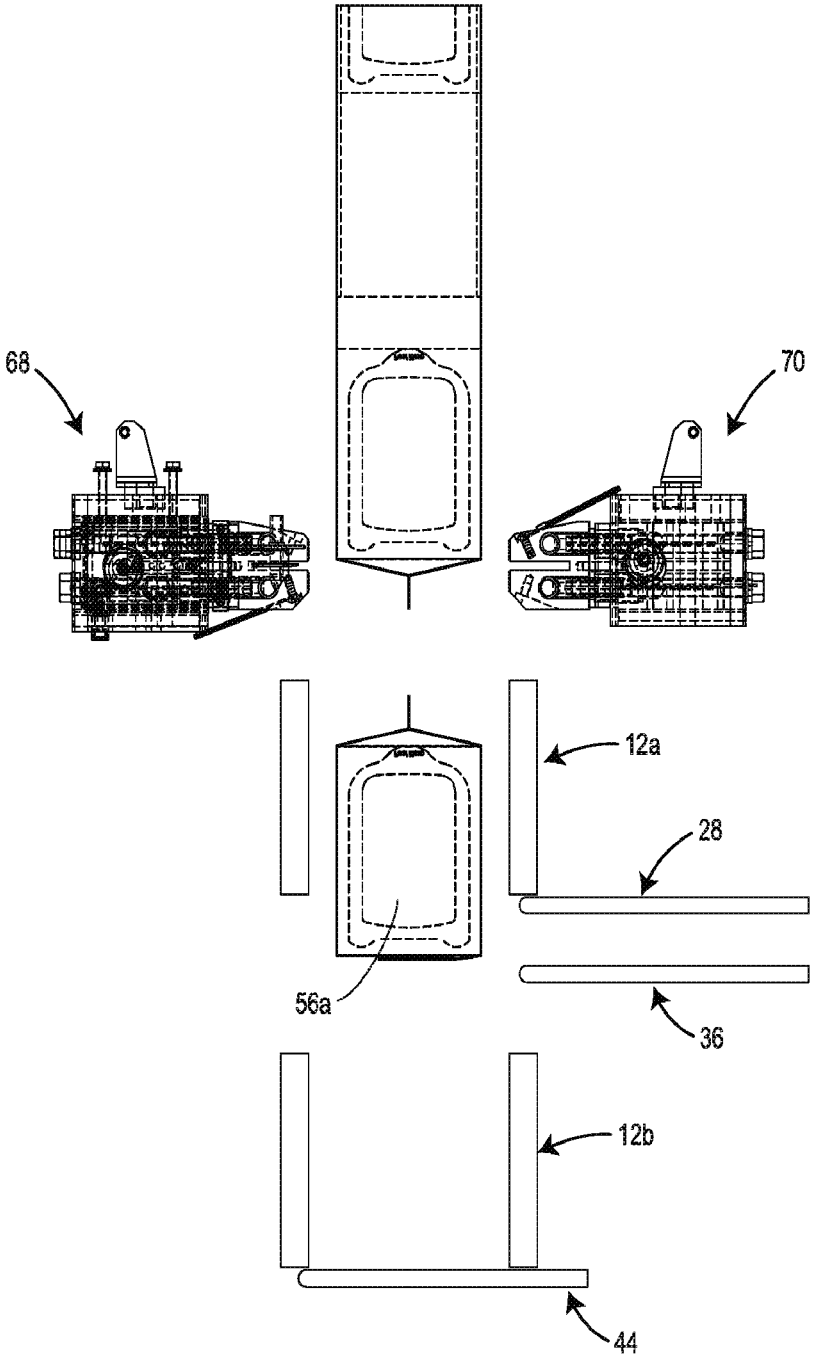
Figures 9, 25A:
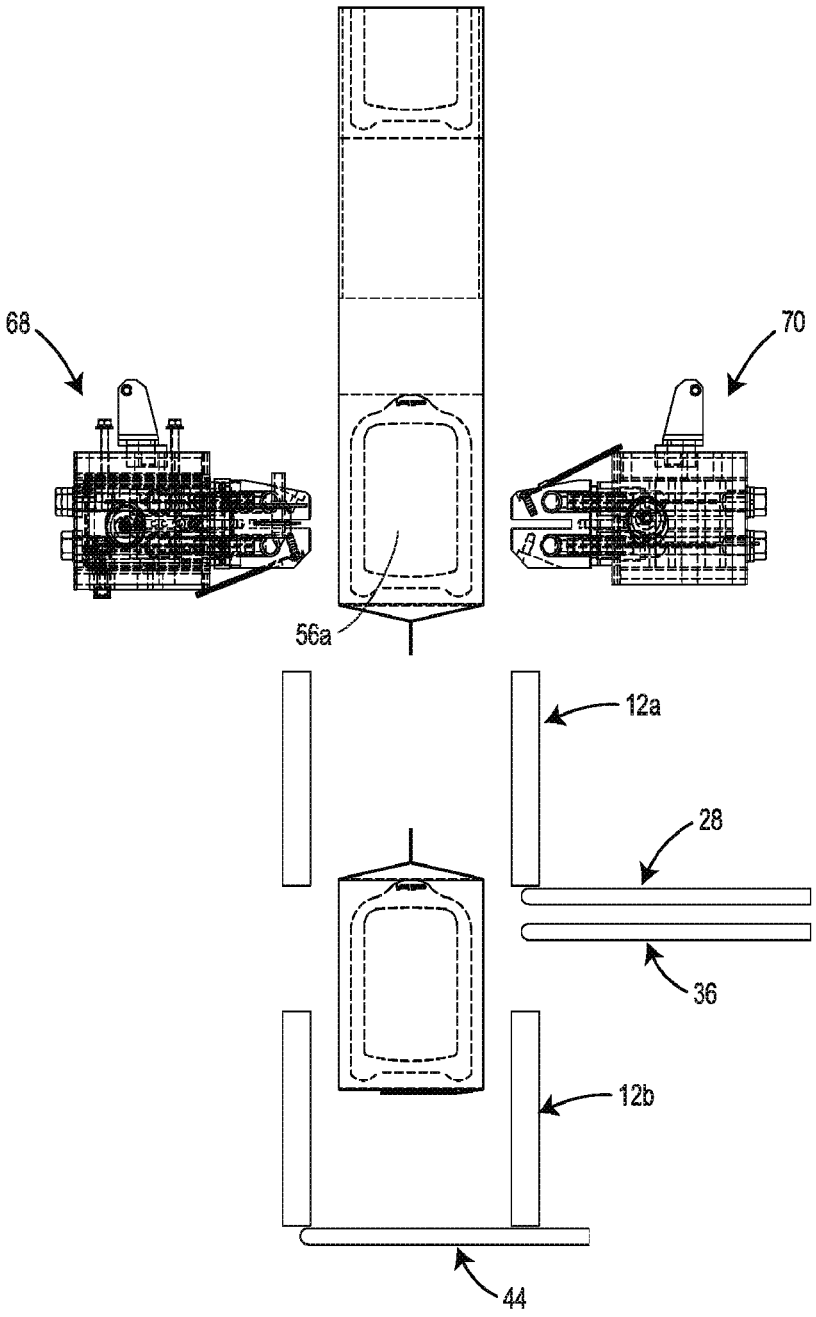
Figures 10, 25A:
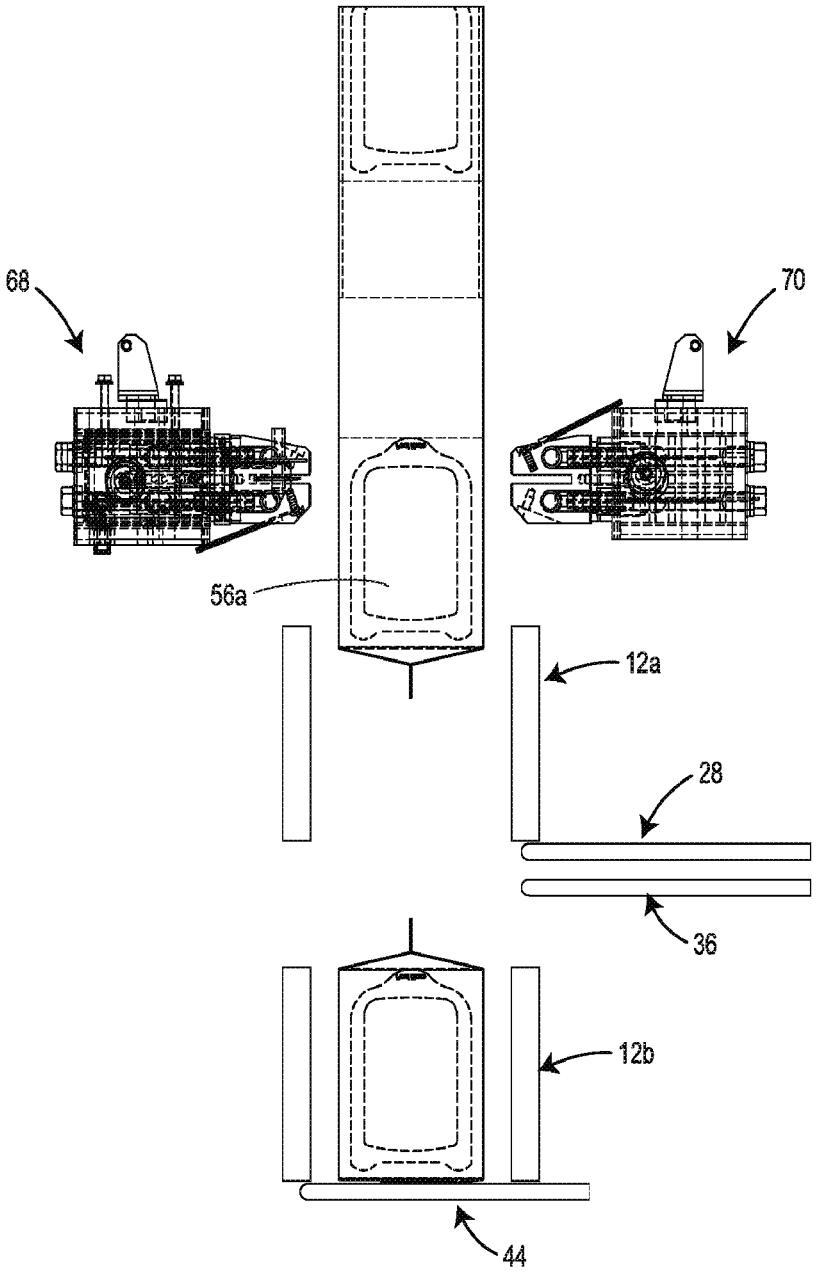
Figures 11, 25A:
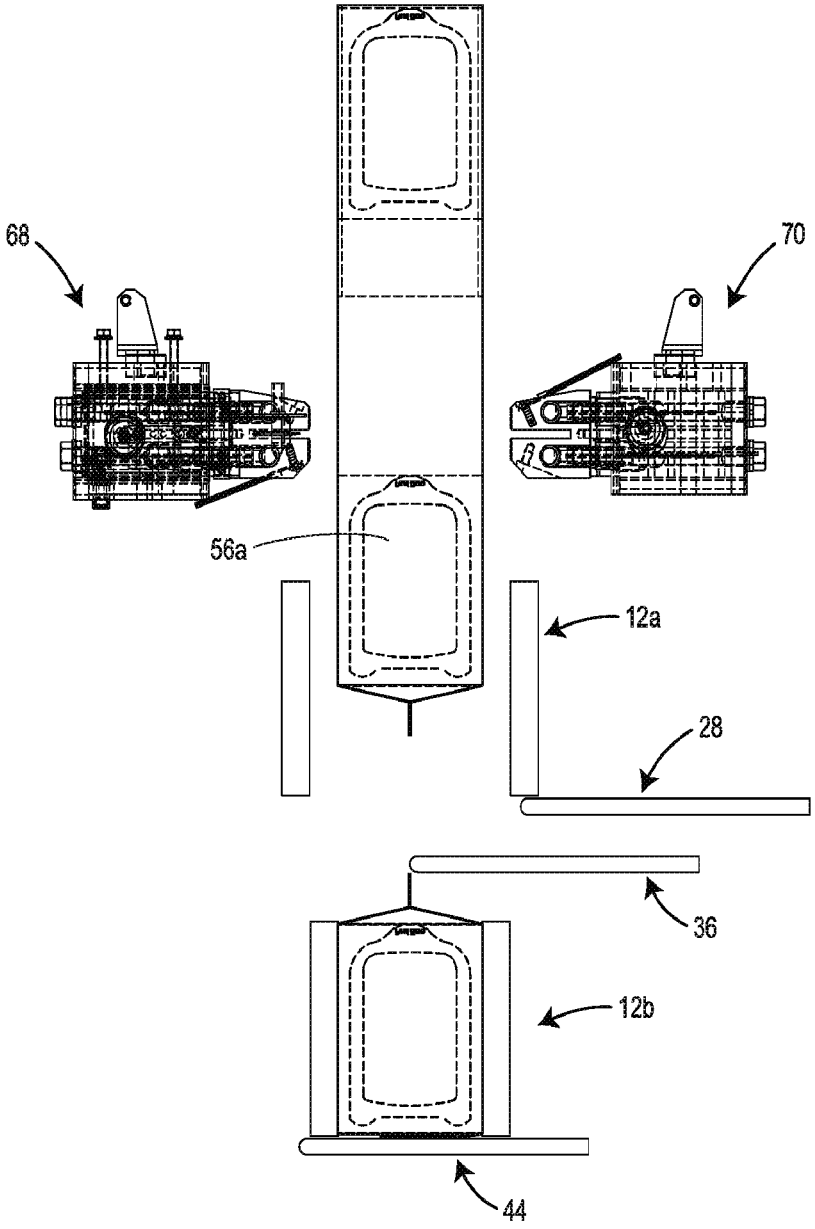
Figures 12, 25A:
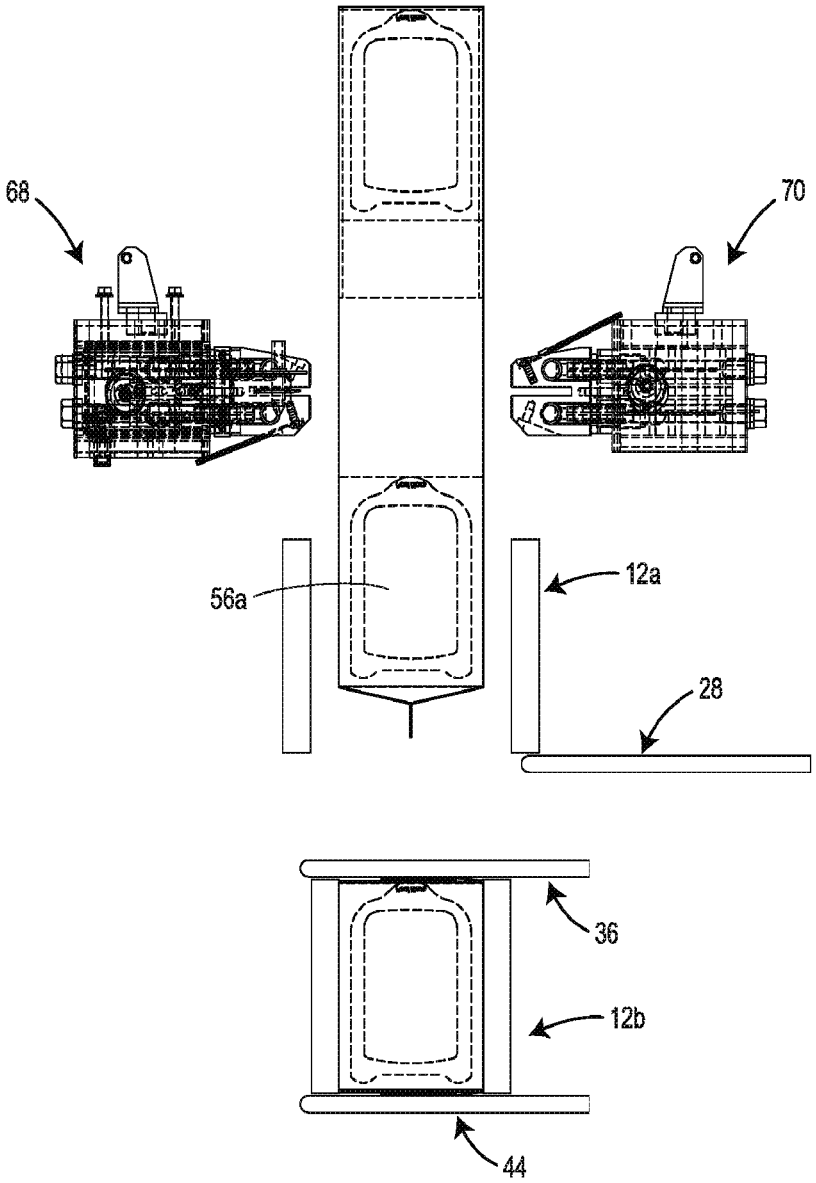
Figures 13, 25A:
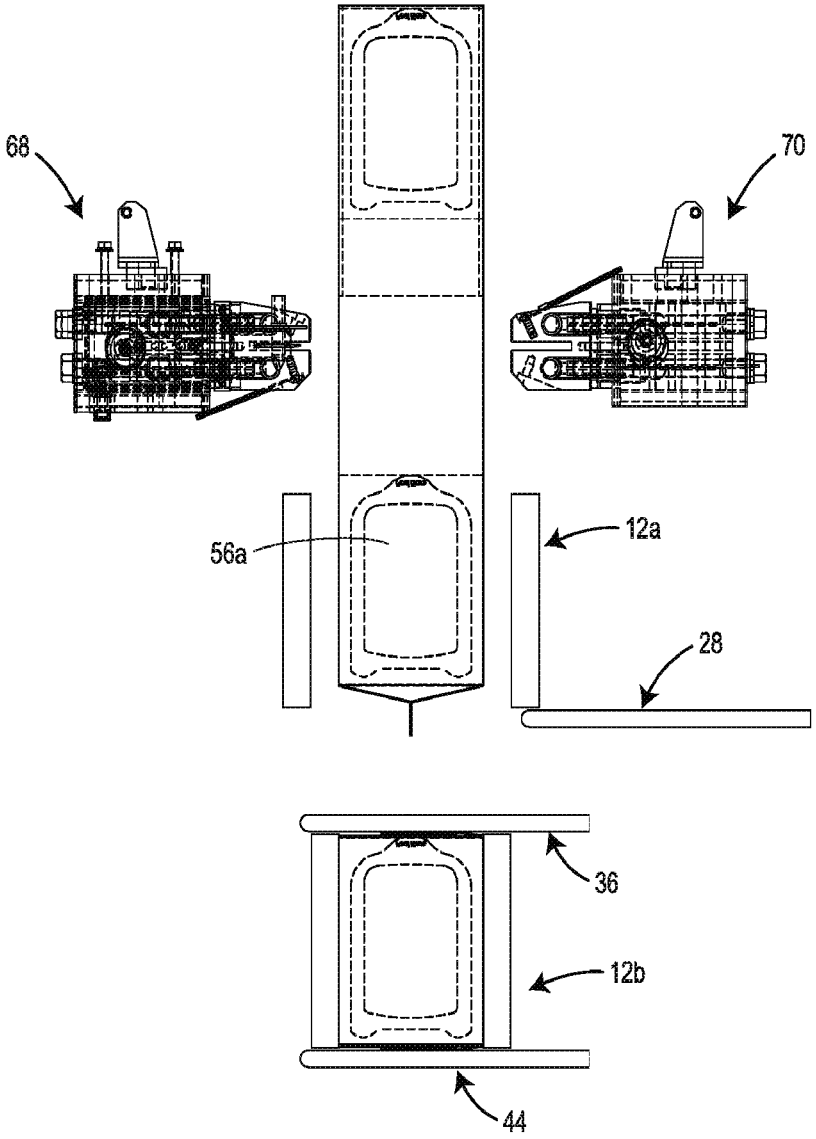
Figure 25C:
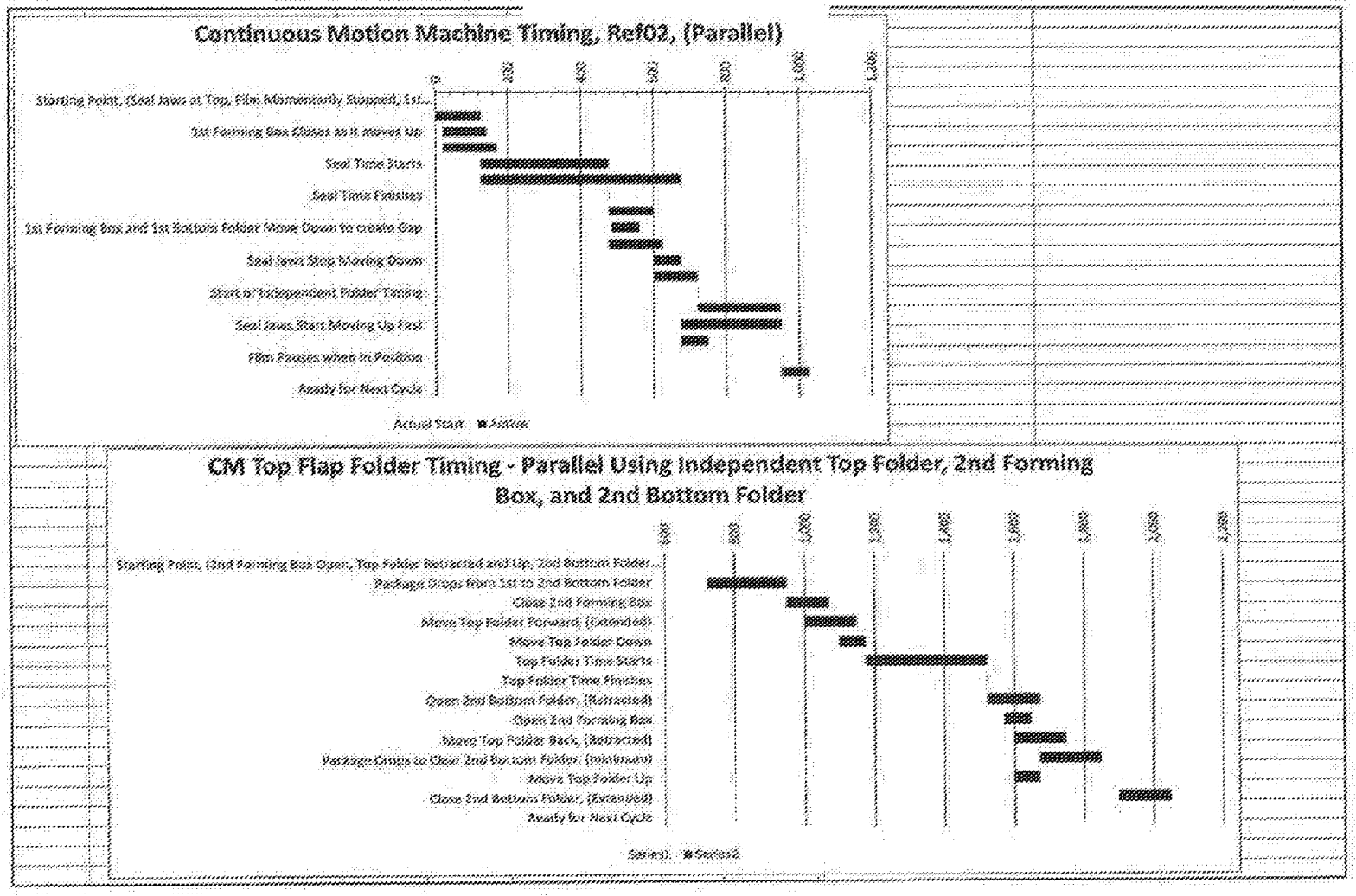
FIG. 25C is a graphical representation of the chart of FIG. 25B.
Figure 26A:
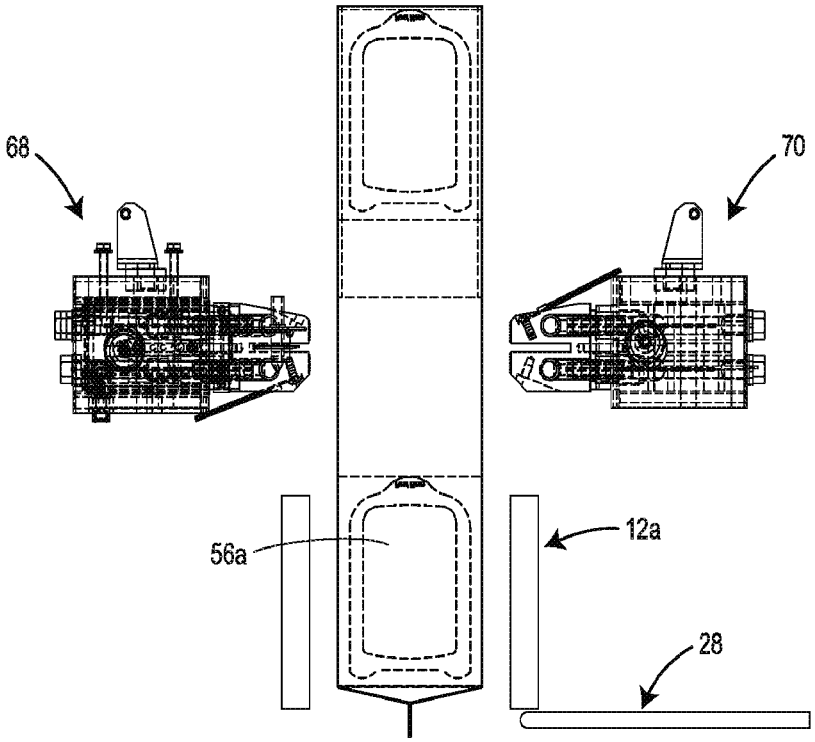
FIG. 26A is a graphical flow chart of a method of forming a package in accordance with yet another embodiment of the disclosure.
Figure 1:
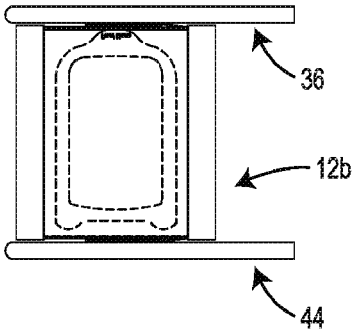
Figure 26A:
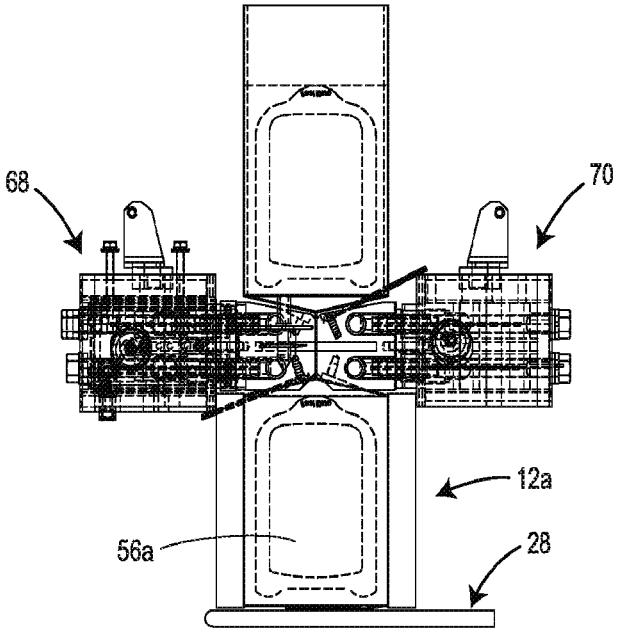
Figure 2:
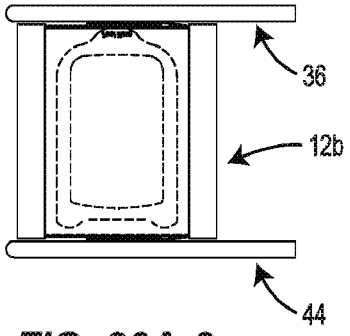
Figure 26A:
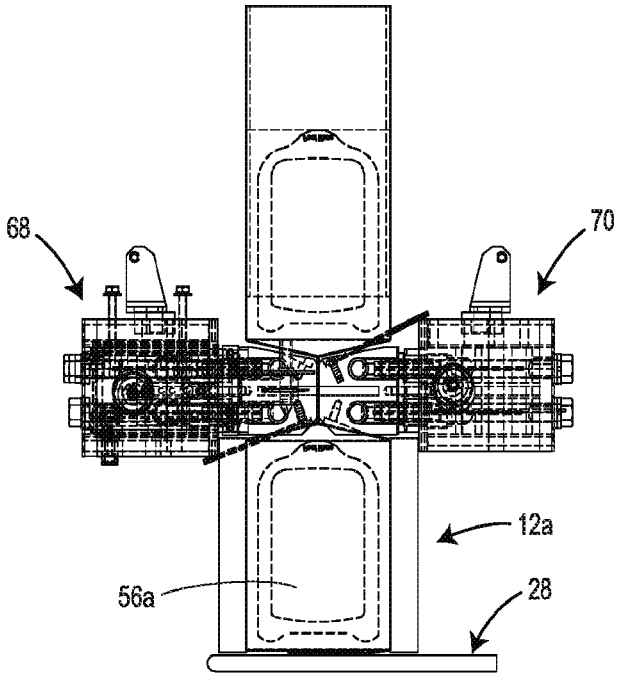
Figure 3:
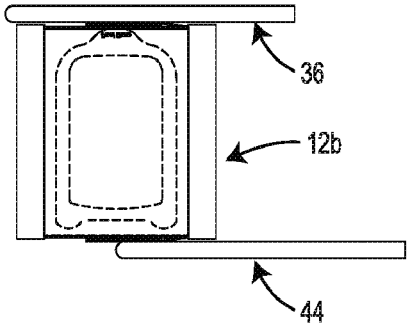
FIG. 3A is a plan view of an embodiment of a first forming box of an embodiment of the apparatus of FIG. 1.
FIG. 3B is a perspective view of the embodiment of the first forming box of FIG. 3A.
Figure 26A:
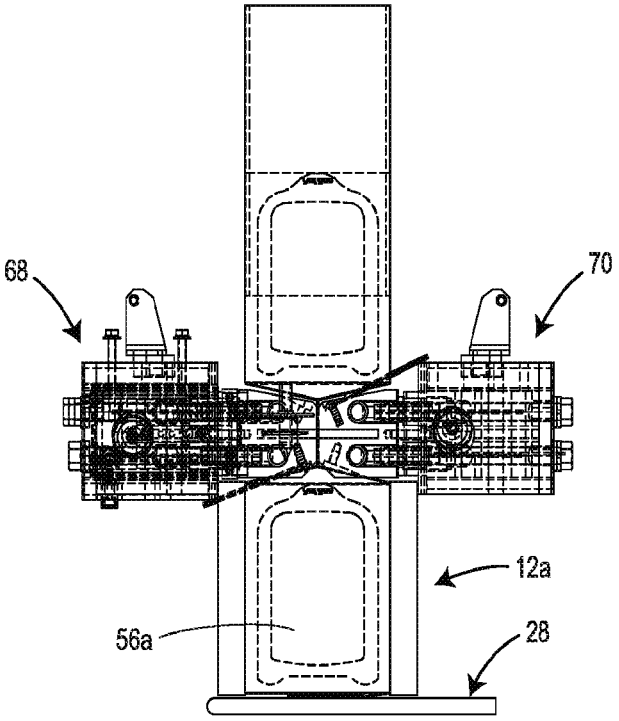
Figure 4:
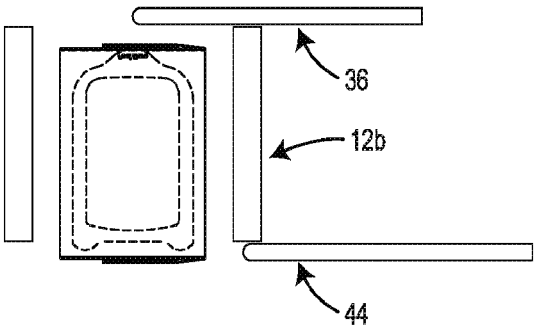
Figure 26A:
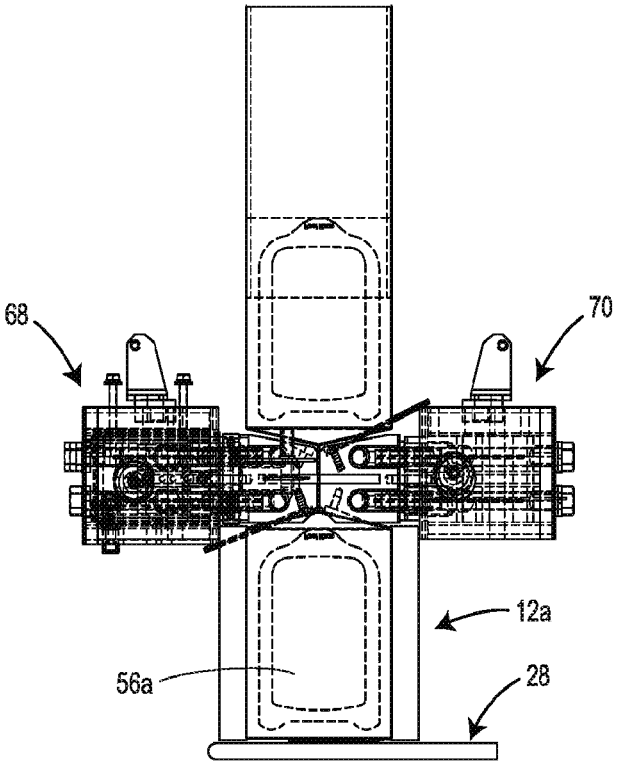
Figure 5:
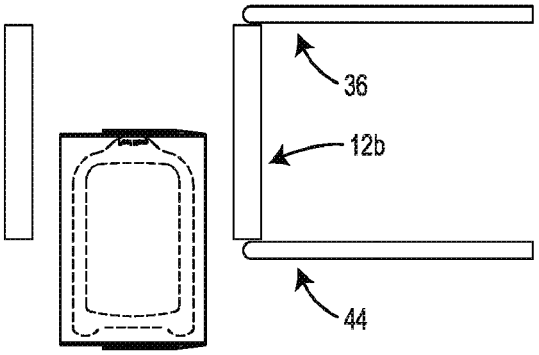
Figures 6, 26A:
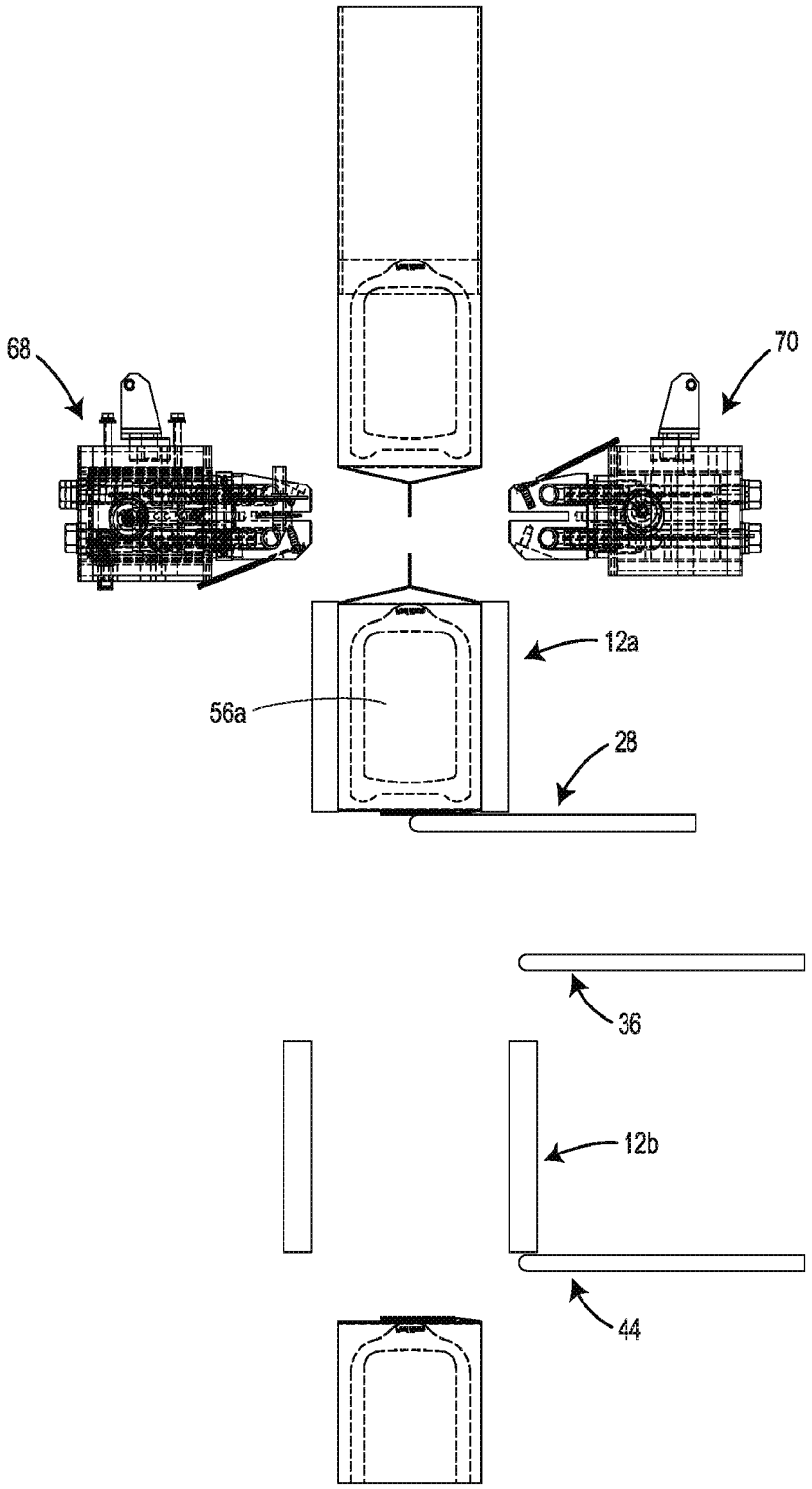
Figures 7, 26A:
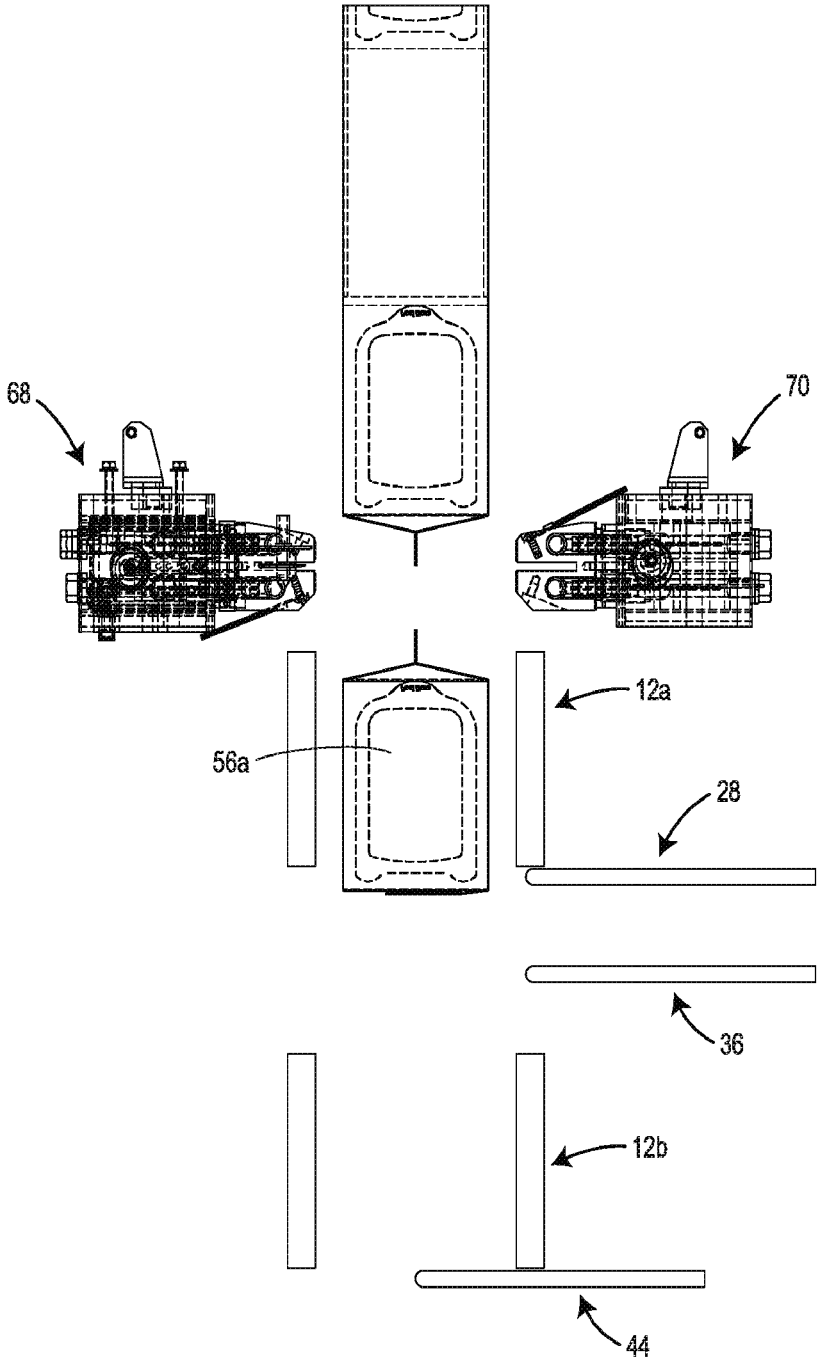
Figures 8, 26A:
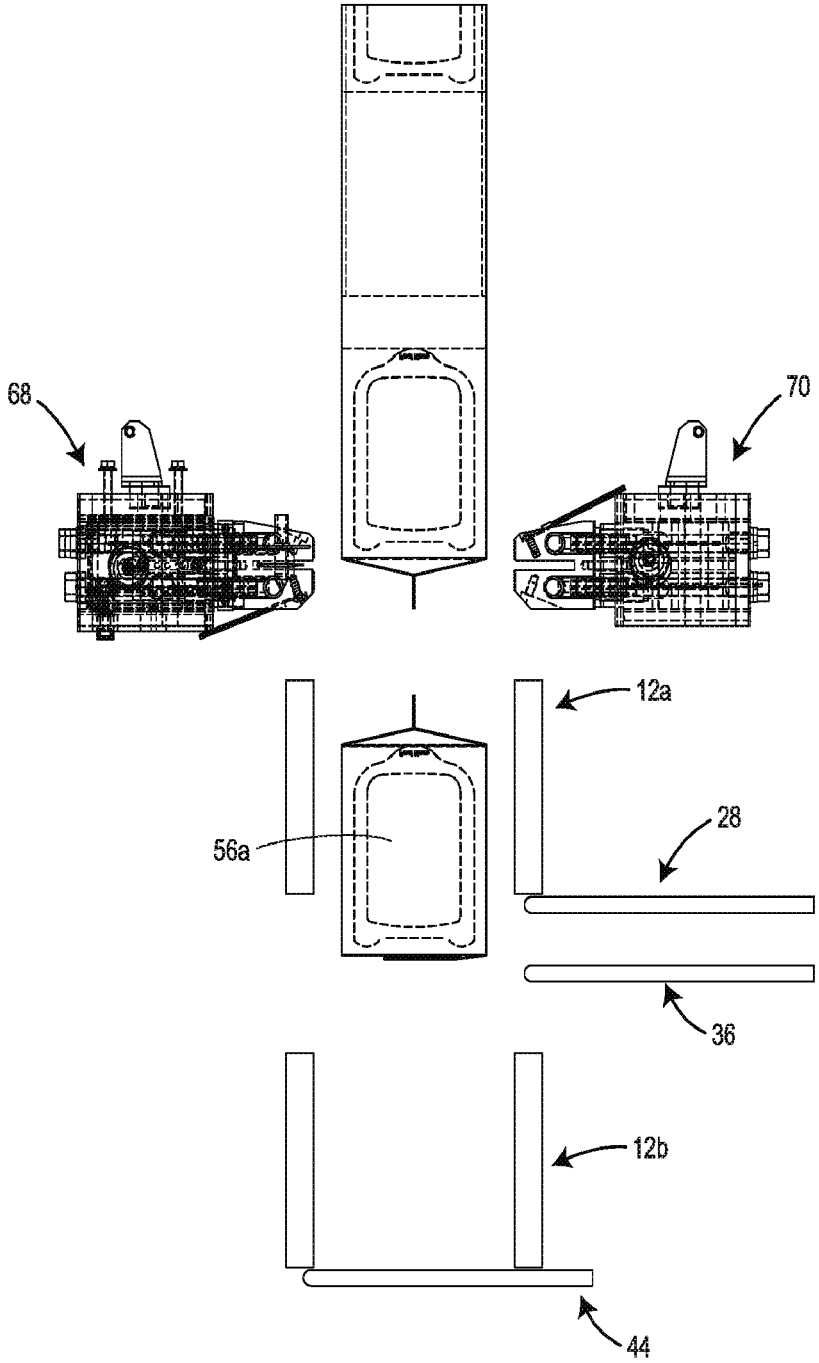
Figures 9, 26A:
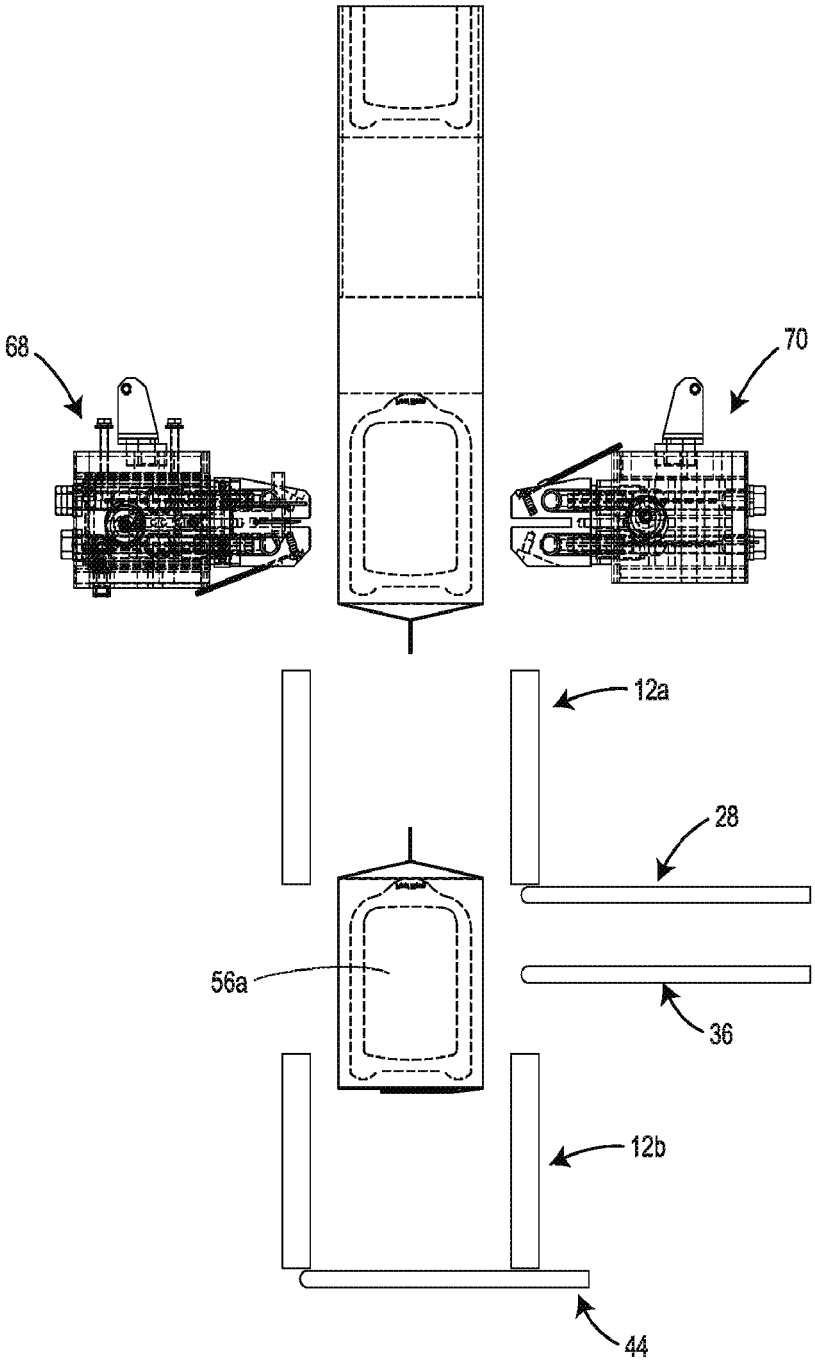
Figures 10, 26A:
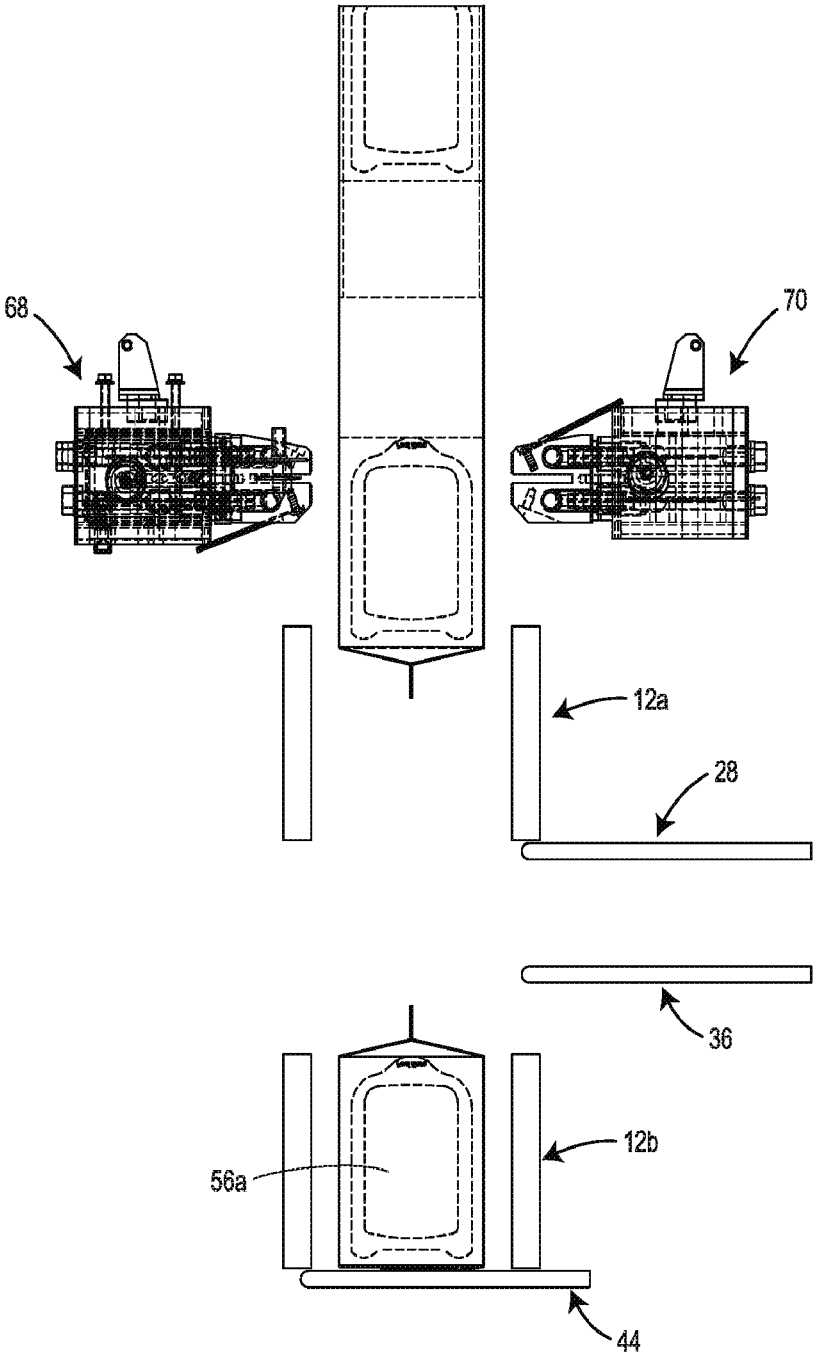
Figures 11, 26A:
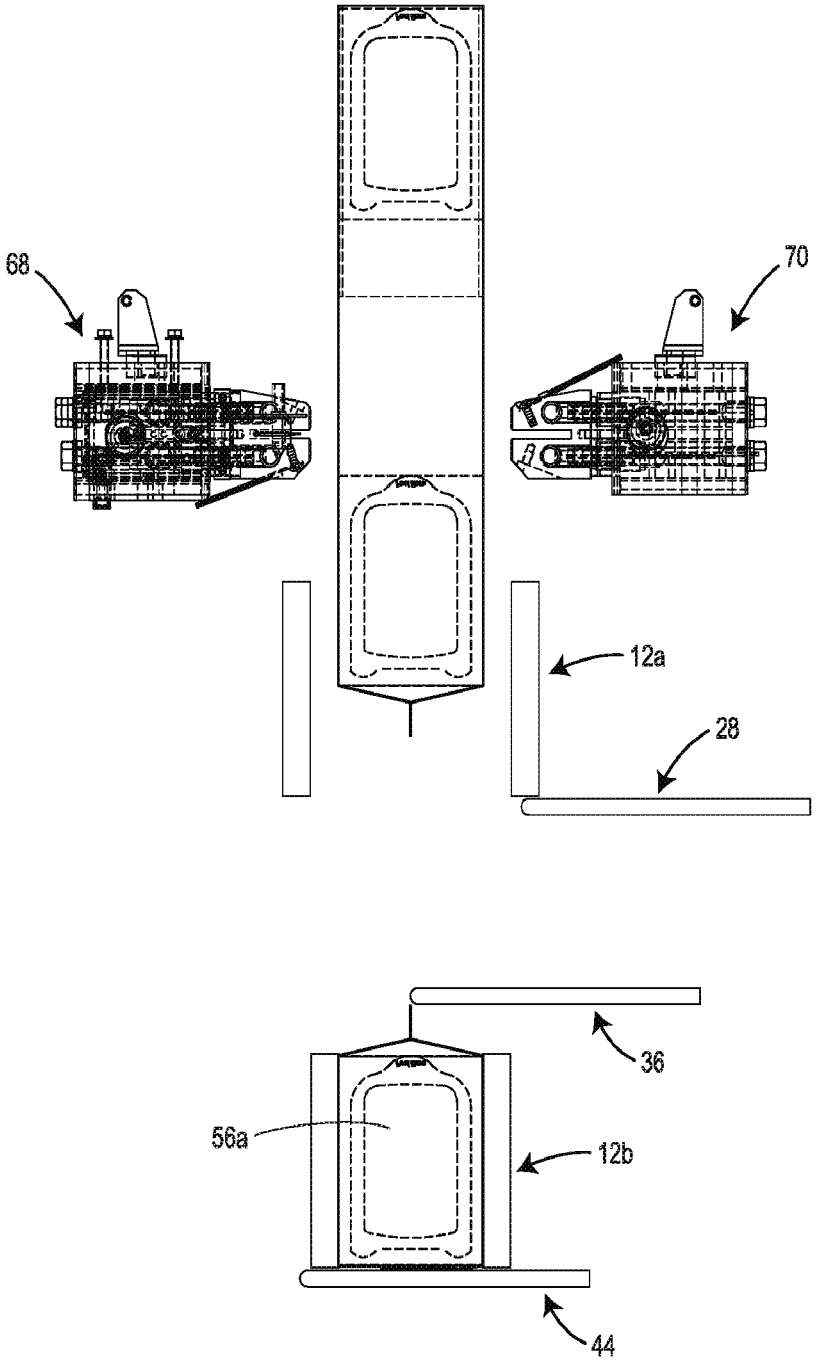
Figure 26A:
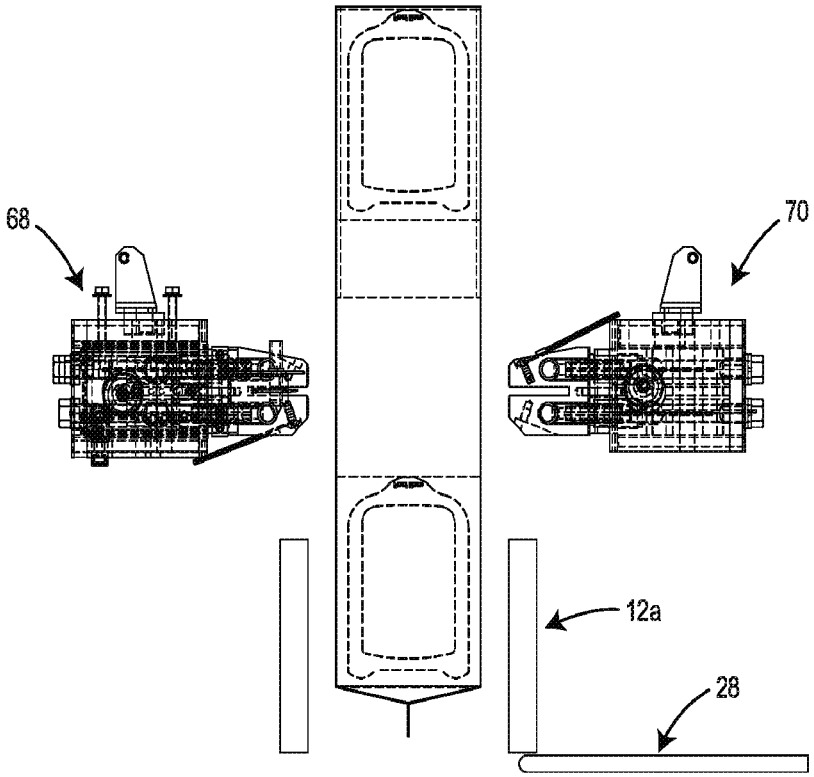
Figure 12:
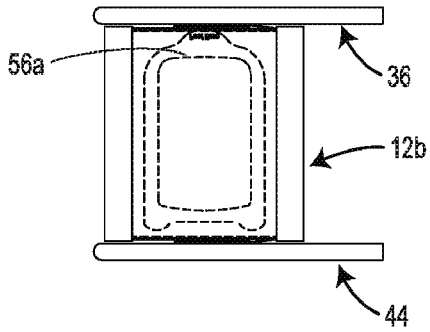
Figure 26A:
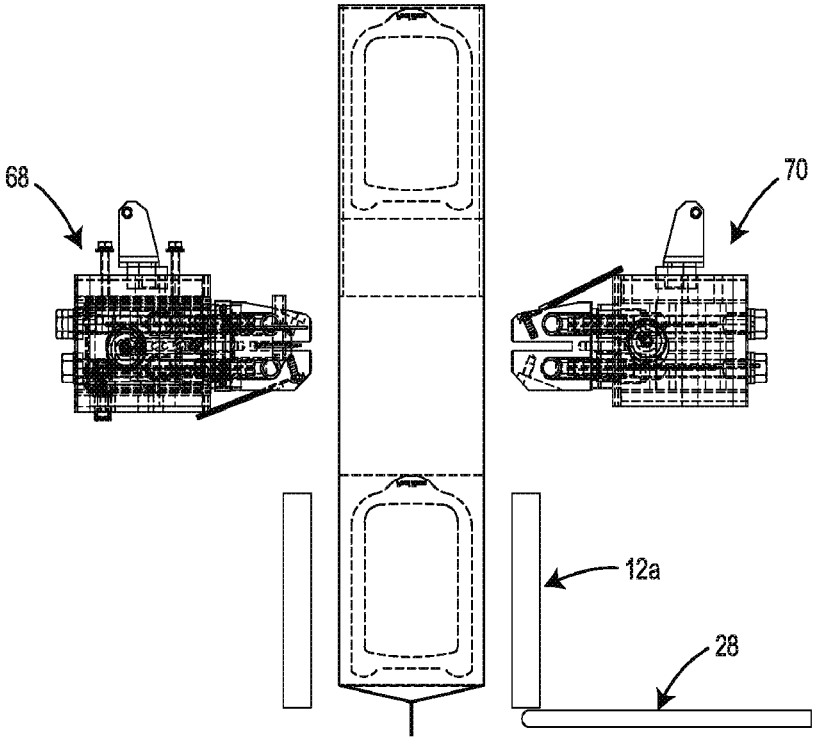
Figure 13:
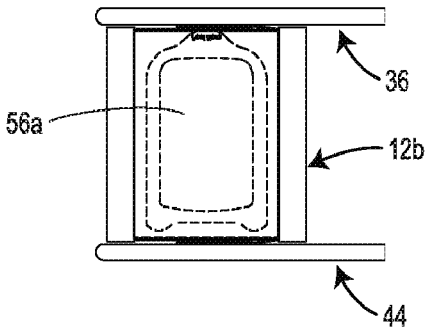
Figure 26C:
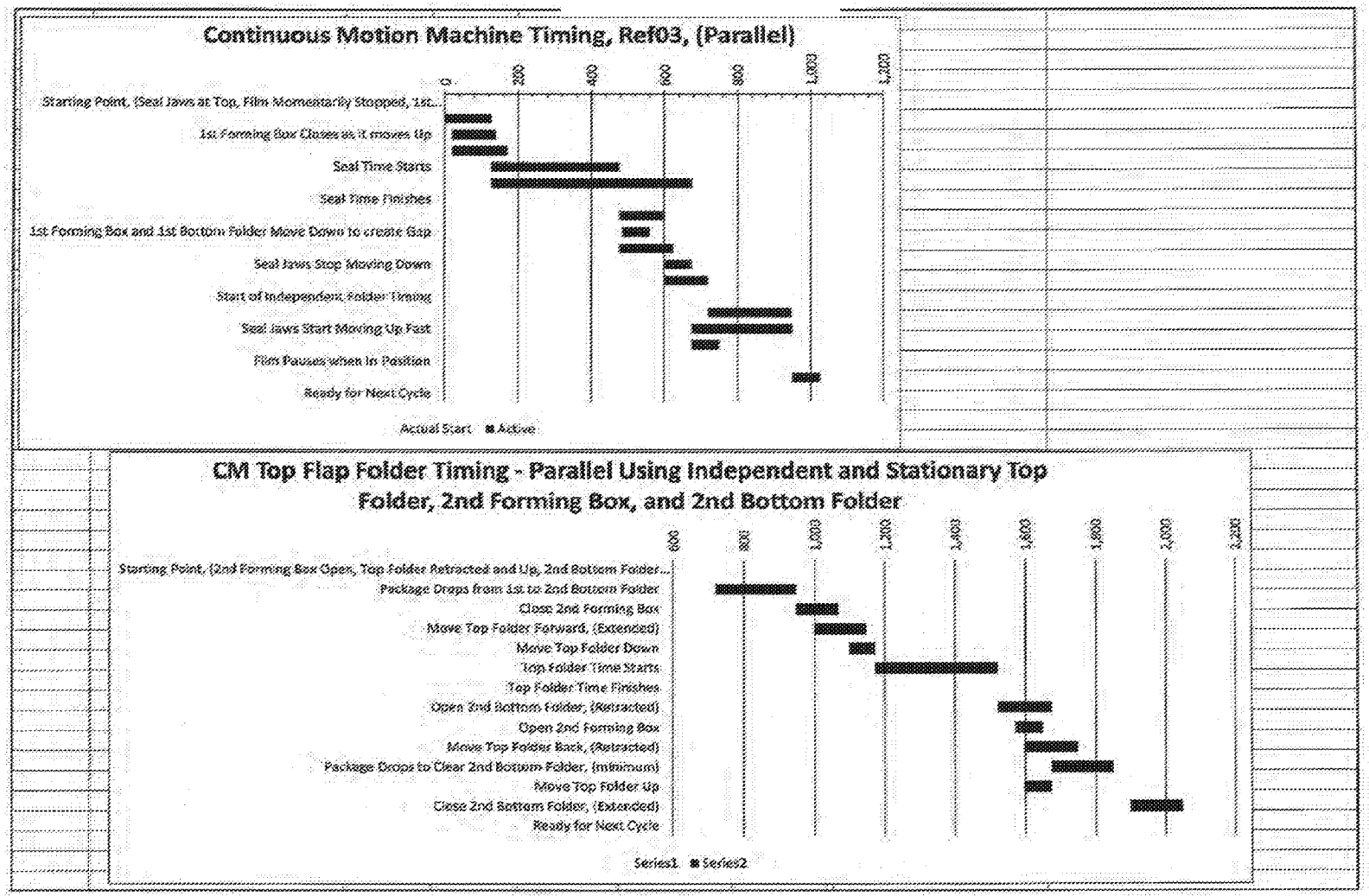
FIG. 26C is a graphical representation of the chart of FIG. 26B.

The second forming box 12*b* may be longitudinally fixed relative to the second end 72 of a forming tube 74 and/or to the retaining structure 12*a*. However, as illustrated in FIGS. 9A and 9B, the second forming box 12*b* may translate longitudinally relative to the second end 72 of a forming tube 74 and/or to the retaining structure 12*a*. For example, the second forming box 12*b* may longitudinally translate towards or away from the second end 72 of the forming tube 74 and/or towards or away from the retaining structure 12*a*. In some embodiments, the first end 16*b* of the second forming box 12*b* may be a first longitudinal distance D5 from the second end 72 of the forming tube 74 (or a transverse fixed reference axis upstream of the retaining structure 12*a*) in a first position 94*b*, as illustrated in FIG. 9A. In a second position 96*b* illustrated in FIG. 9B, the first end 16*a* of the second forming box 12*b* may be a second longitudinal distance D6 from the second end 72 of the forming tube 74 (or the transverse fixed reference axis upstream of the retaining structure 12*a*), and the second longitudinal distance D6 may be greater than the first longitudinal distance D4.

Referring to FIGS. 8A and 8B, the at least one of the two or more walls 20*b* may be a single, unitary part or may be a segmented wall comprising two or more component parts. More specifically, all of the first wall 52*b*, the second wall 53*b*, the third wall 54*b*, and the fourth wall 55*b* may be a single unitary part, or at least one of the first wall 52*b*, the second wall 53*b*, the third wall 54*b*, and the fourth wall 55*b* may be a segmented wall comprising two or more component parts. For example, in the second position 64*b* of an embodiment of the second forming box 12*b* of FIG. 4B, a first portion of the third wall 54*b* was coupled to the first wall 52*b* and a second portion of the third wall 54*b* was coupled to the second wall 53*b*. So configured, the first portion of the third wall 54*b* and the first wall 52*b* rotationally or laterally displaces from the first position 62*b* to and from the second position 64*b* and the second portion of the third wall 54*b* and the second wall 53*b* rotationally or laterally displaces from the first position 62*b* to and from the second position 64*b*.

Referring to FIG. 1, the apparatus 10 further includes the first upstream folding bar 36 that may be identical in structure and function to the first downstream folding bar 28. The first upstream folding bar 36 may be disposed downstream of the first downstream folding bar 28 and may be upstream of the first end 16*b* of the second forming body 12*b*. The first upstream folding bar 36 may be elongated in a transverse direction. The first upstream folding bar 36 may have the contact portion 38 that is adapted to contact an upper or lower (relative to the circumferential and/or lateral) portion of the package 56. For example, the contact portion 38 may be adapted to contact at least a portion of a transverse seal (or flap) formed on an upper or lower portion of the package 56.

The first upstream folding bar 36 may be transversely displaceable between a first position 40 and a second position 42, as illustrated in FIG. 1. In the first position 40, the contact portion 38 is disposed remote from the first end 16*b* of the second forming box 12*b*. More specifically, in the first position 40, a reference point 86 of the contact portion 38 may not intersect the transport axis 14 or may be a first transverse distance 87 from the transport axis 14. In the second position 42, the contact portion 38 is disposed at or adjacent to the first end 16*b* of the second forming box 12*b* such that the contact portion 38 (or the reference point 86 of the contact portion 38) contacts or engages the portion of the transverse seal (or flap) formed on an upper or lower portion of the package 56. For example, in the second position 42, the contact portion 38 (or the reference point 83 of the contact portion 38) contacts or engages a portion of the second transverse seal 67 (or flap) formed on an upper portion of the package 56. In some embodiments, in the second position 42, the reference point 86 of the contact portion 38 may be a second transverse distance 88 from the transport axis 14 that is less than the first transverse distance 87. If the reference point 86 of the contact portion 38 intersects or is aligned with the transport axis 14 in the second position 42, the second transverse distance 87 from the transport axis 14 may be zero.

The first upstream folding bar 36 may extend transversely across the entire first end 16*b* of the second forming box 12*b* when in the second position 42. In other embodiments, the first upstream folding bar 36 may extend transversely across a portion of the first end 16*b* of the second forming box 12*b*. The first upstream folding bar 36 may extend from the first position 40 to the second position 42 (and vice versa) in any manner known in the art. For example, the first upstream folding bar 36 may be planar or substantially planar and may linearly translate from the first position 40 to the second position 42 (and vice versa) within a plane normal to the transport axis 14. In other embodiments, the first upstream folding bar 36 may rotate from the first position 40 to the second position 42 (and vice versa) within a plane normal to the transport axis 14. In other embodiments, the first upstream folding bar 36 may include two or more plates having transverse edges that are hinged such that in the second position 42, the two or more plates cooperate to form a planar shape and in the first position 40, adjacent plates of the two or more plates rotate about the hinged transverse edges to form an angle of less than 180 degrees (e.g., 45 degrees).

Figure 10A:
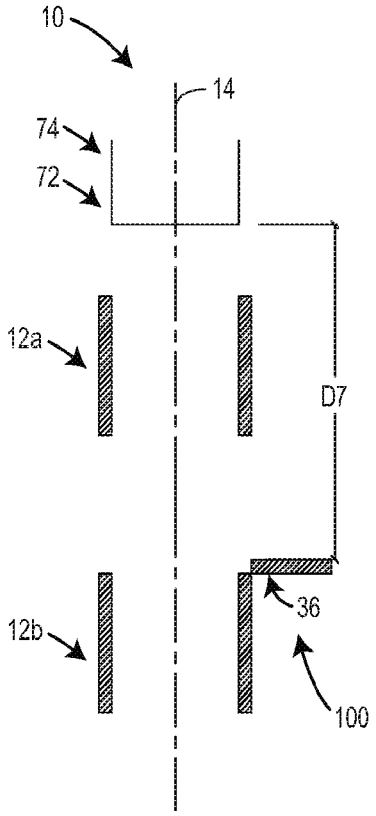
FIG. 10A is a front view of an embodiment of a first upstream folding bar in a first position.
Figure 10B:
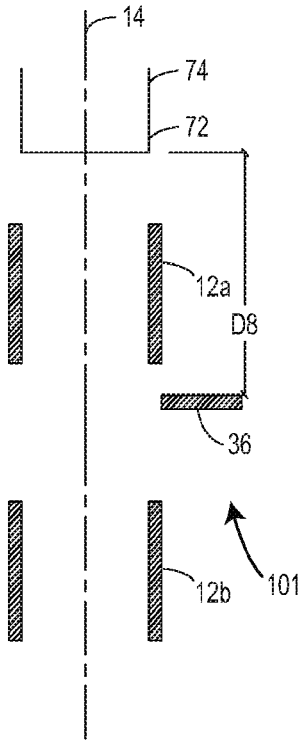
FIG. 10B is a front view of the embodiment of the first upstream folding bar of FIG. 10A in a second position.

As illustrated in FIGS. 10A and 10B, the first downstream folding bar 36 may also longitudinally translate relative to the second end 72 of a forming tube 74 and/or to the retaining structure 12*a* and/or the second forming box 12*b*. For example, the first downstream folding bar 36 may longitudinally translate longitudinally towards or away from the second end 72 of the forming tube 74 and/or towards or away from the retaining structure 12*a* and/or the second forming box 12*b*. In some embodiments, a portion of the first downstream folding bar 36 may be a first longitudinal distance D7 from the second end 72 of the forming tube 74 (or a transverse fixed reference axis upstream of the retaining structure 12*a*) in a first position 100, as illustrated in FIG. 10A. In a second position 101 illustrated in FIG. 10B, a portion of the first downstream folding bar 36 may be a second longitudinal distance D8 from the second end 72 of the forming tube 74 (or the transverse fixed reference axis upstream of the retaining structure 12*a*), and the second distance D8 may be less than the first distance D7.

Referring once more to FIG. 1, the apparatus 10 further includes the second downstream folding bar 44 that may be identical in structure and function to the first downstream folding bar 28 and/or the first upstream folding bar 36. The second downstream folding bar 44 may be disposed downstream of the second end 18*b* of the second forming body 12*b*. The second downstream folding bar 44 may be elongated in a transverse direction. The second downstream folding bar 44 may have the contact portion 46 that is adapted to contact an upper or lower (relative to the circumferential and/or lateral) portion of the package 56. For example, the contact portion 46 may be adapted to contact at least a portion of a transverse seal (or flap) formed on an upper or lower portion of the package 56.

The second downstream folding bar 44 may be transversely displaceable between a first position 48 and a second position 50, illustrated in FIG. 1. In the first position 48, the contact portion 46 is disposed remote from the second end 18*b* of the second forming box 12*b*. More specifically, in the first position 48, a reference point 89 of the contact portion 46 may not intersect the transport axis 14 or may be a first transverse distance 90 from the transport axis 14. In the second position 50, the contact portion 46 is disposed at or adjacent to the second end 18*b* of the second forming box 12*b* such that the contact portion 46 (or the reference point 89 of the contact portion 46) contacts or engages the portion of the transverse seal (or flap) formed on an upper or lower portion of the package 56. For example, in the second position 50, the contact portion 46 (or the reference point of the contact portion 46) contacts or engages a portion of the first transverse seal 66 (or flap) formed on a lower portion of the package 56. In some embodiments, in the second position 50, the reference point 89 of the contact portion 46 may be a second transverse distance 91 from the transport axis 14 that is less than the first transverse distance 90. If the reference point 89 of the contact portion 46 intersects or is aligned with the transport axis 14 in the second position 50, the second transverse distance 91 from the transport axis 14 may be zero.

The second downstream folding bar 44 may extend transversely across the entire second end 18*b* of the second forming box 12*b* when in the second position 50. In other embodiments, the second downstream folding bar 44 may extend transversely across a portion of the second end 18*b* of the second forming box 12*b*. The second downstream folding bar 44 may extend from the first position 48 to the second position 50 (and vice versa) in any manner known in the art. For example, the second downstream folding bar 44 may be planar or substantially planar and may linearly translate from the first position 48 to the second position 50 (and vice versa) within a plane normal to the transport axis 14. In other embodiments, the second downstream folding bar 44 rotate from the first position 48 to the second position 50 (and vice versa) within a plane normal to the transport axis 14. In other embodiments, the second downstream folding bar 44 may include two or more plates having transverse edges that are hinged such that in the second position 50, the two or more plates cooperate to form a planar shape and in the first position 48, adjacent plates of the two or more plates rotate about the hinged transverse edges to form an angle of less than 180 degrees (e.g., 45 degrees).

As illustrated in FIGS. 9A and 9B, the second downstream folding bar 44 may also longitudinally translate relative to the second end 72 of a forming tube 74 and/or to the retaining structure 12*a* and/or to the second forming box 12*b*. For example, the second downstream folding bar 44 may longitudinally translate longitudinally towards or away from the second end 72 of the forming tube 74 and/or towards or away from the retaining structure 12*a*. In some embodiments, the second downstream folding bar 44 may be longitudinally fixed relative to the second forming box 12*b* such that the second downstream folding bar 44 longitudinally translates from a first position 102 (when, e.g., the second forming box 12*b* is in the first position 94*b*) illustrated in FIG. 9A and a second position 103 (when, e.g., the second forming box 12*b* is in the second position 96*b*) illustrated in FIG. 9B. However, the first downstream folding bar 28 may longitudinally translate towards or away from the second forming box 12*b*.

Figure 11A:
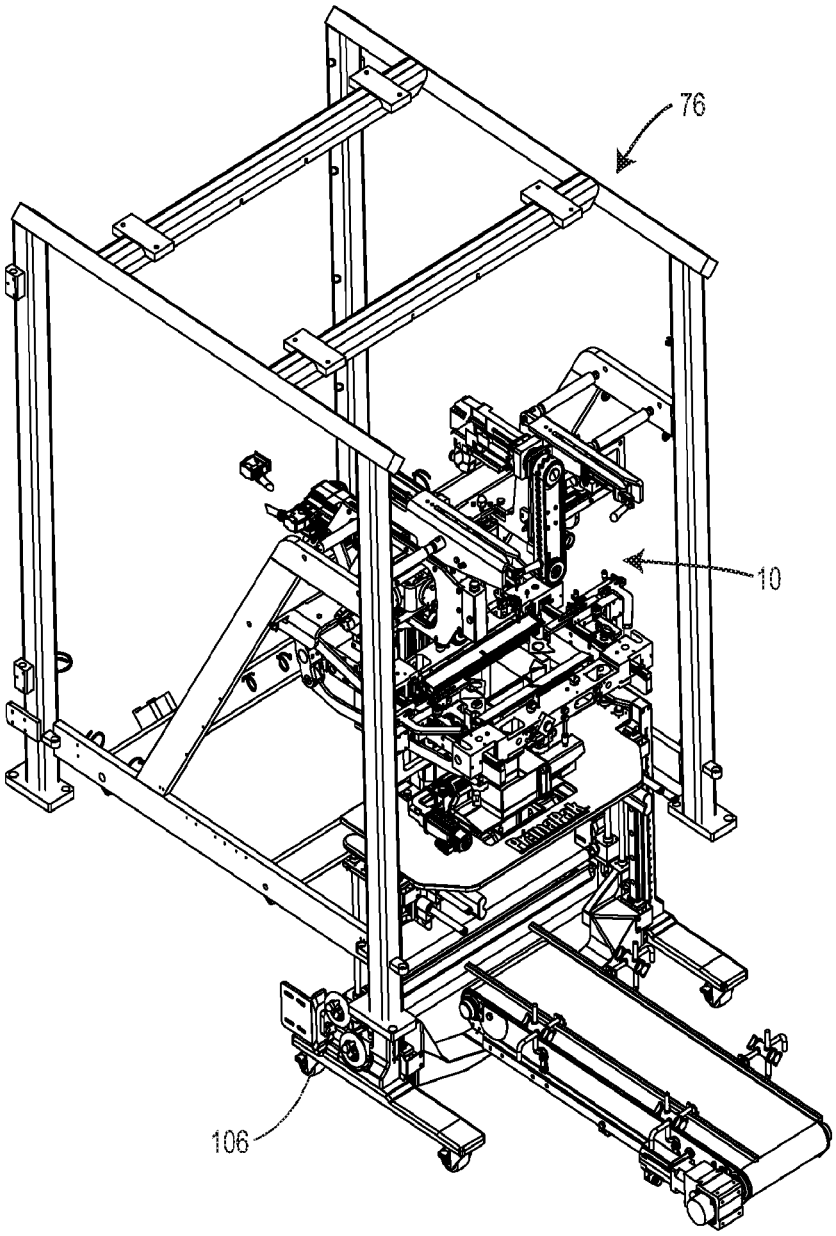
FIGS. 11A to 11R are various views of embodiments of portions of an apparatus for forming a flexible package.
Figure 11B:
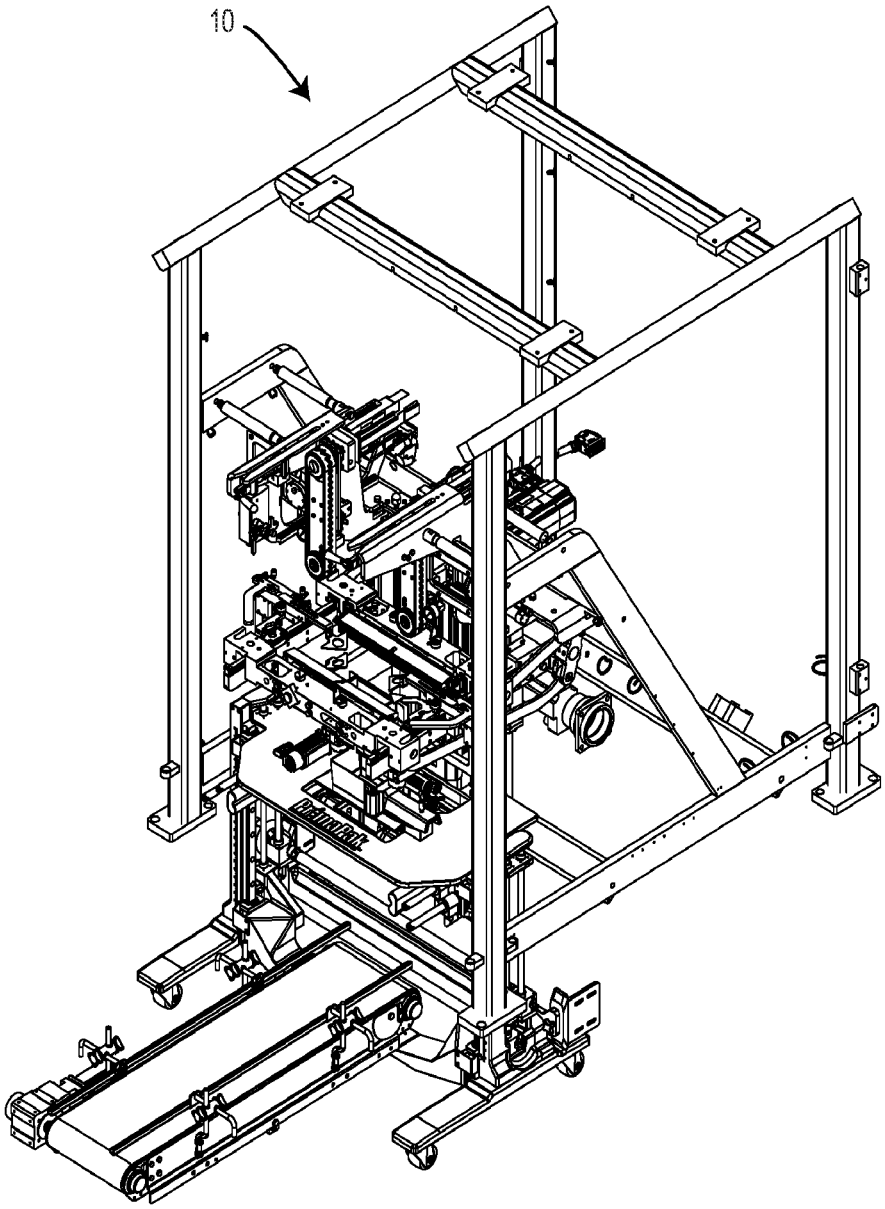
Figure 11C:
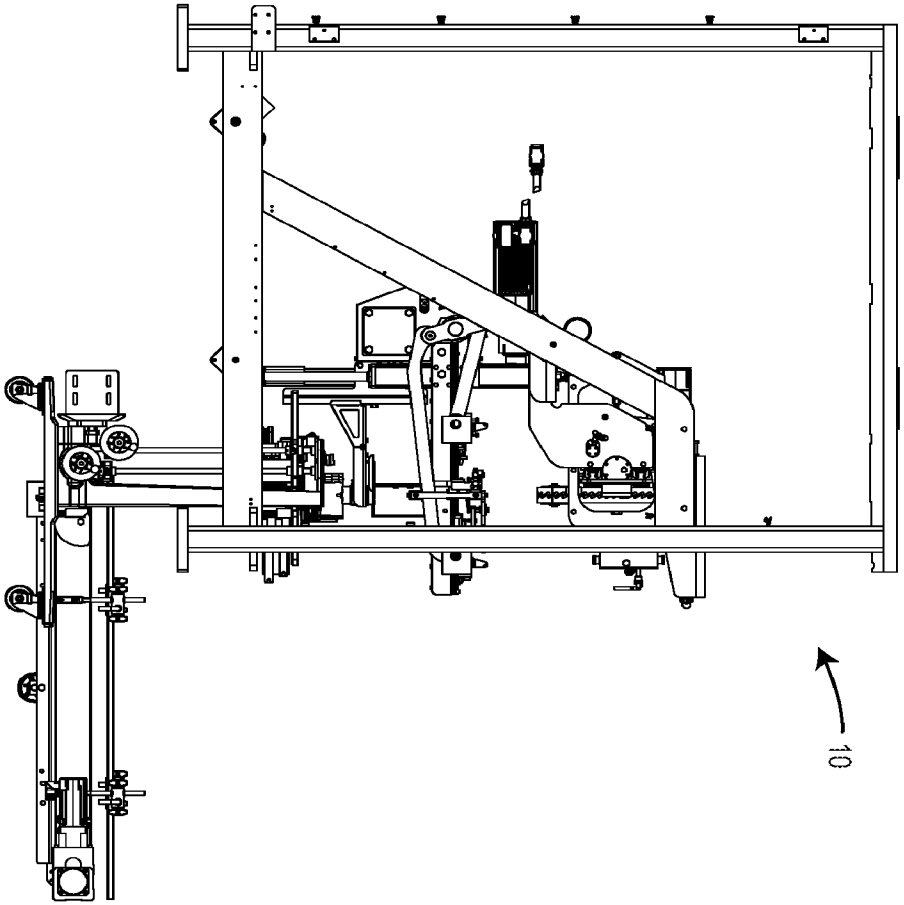
Figure 11D:
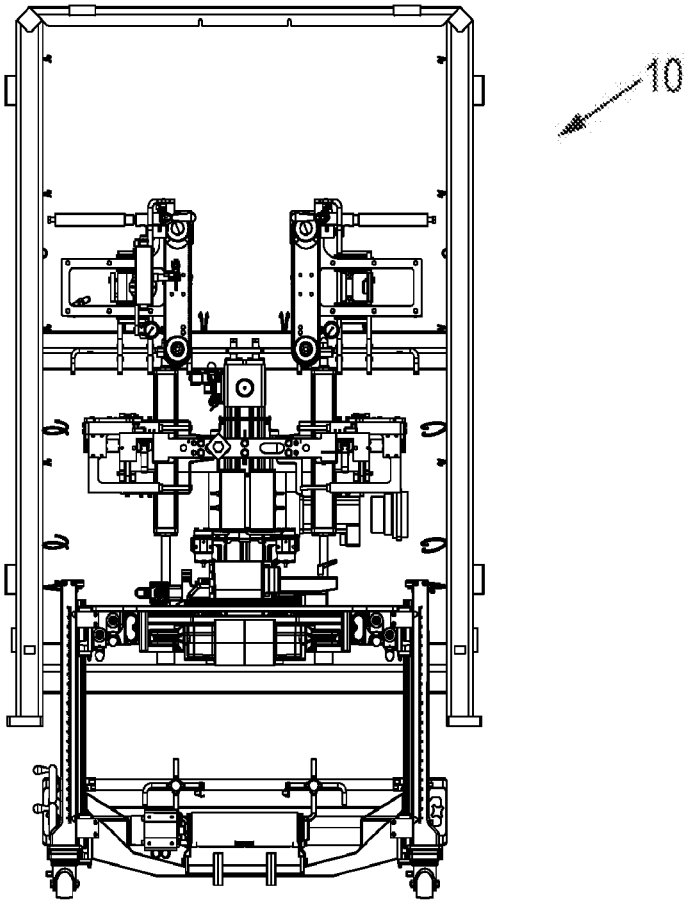
Figure 11E:
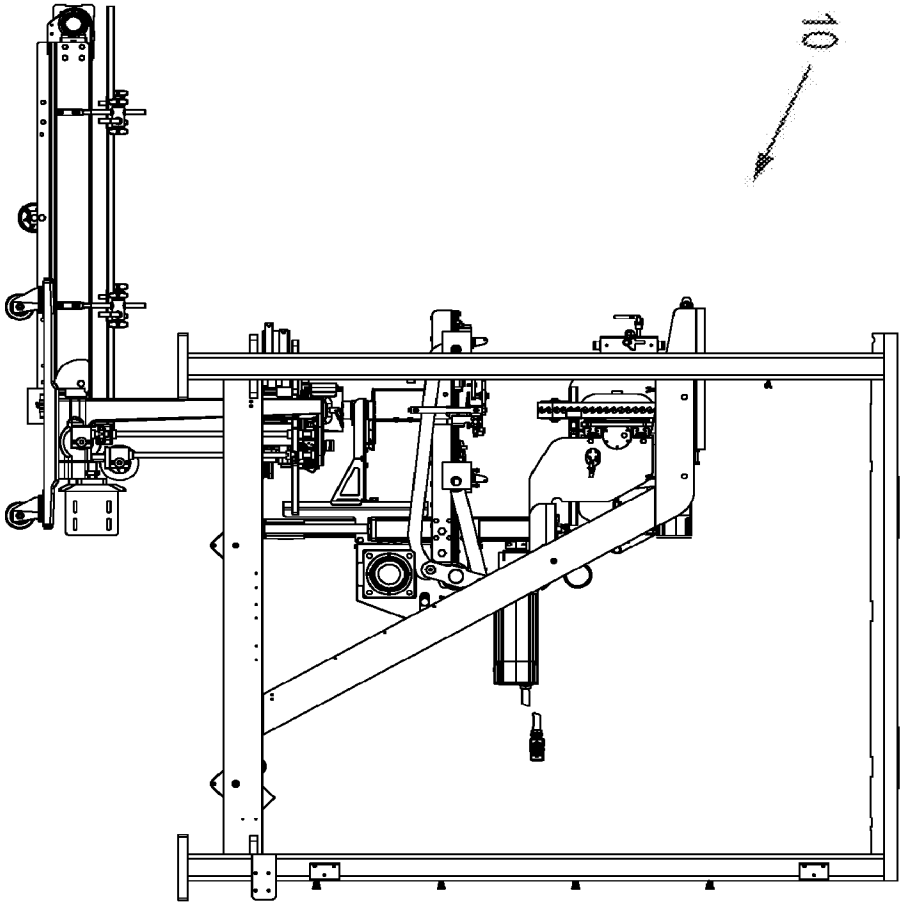
Figure 11F:
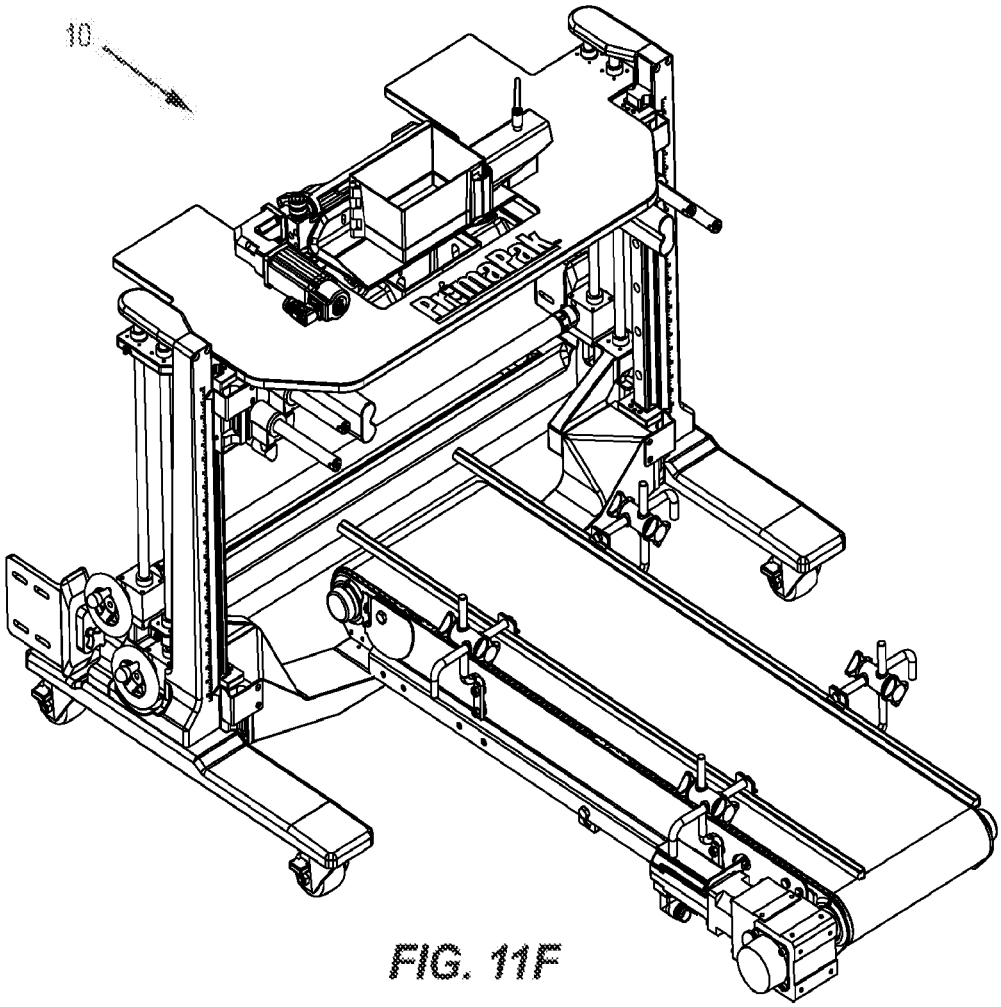
Figure 11G:
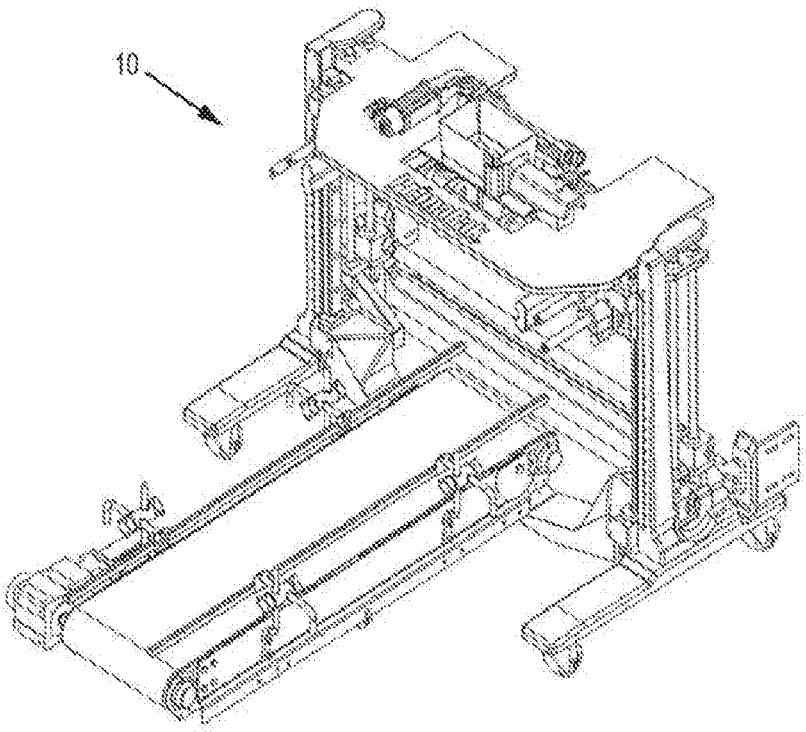
Figure 11H:
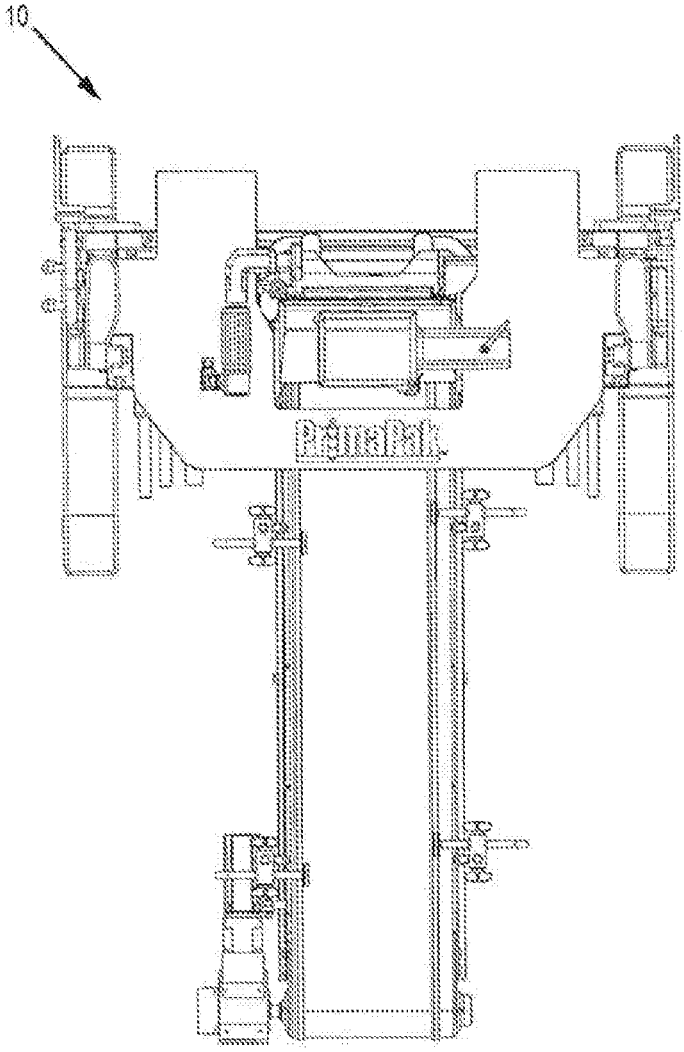
Figure 11I:
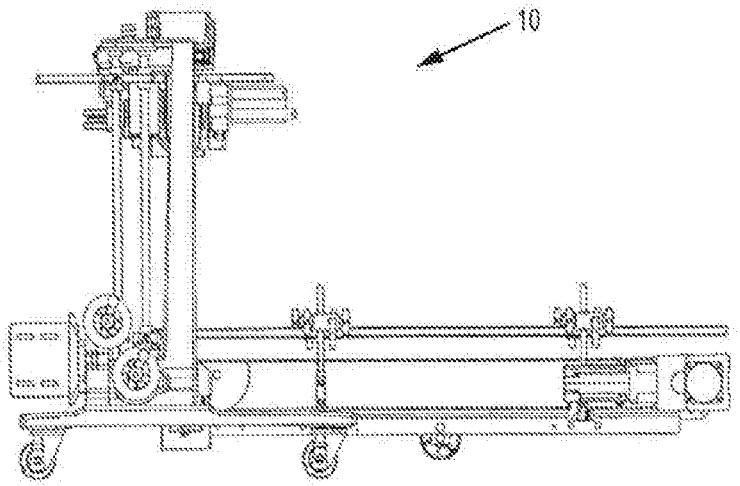
Figure 11J:
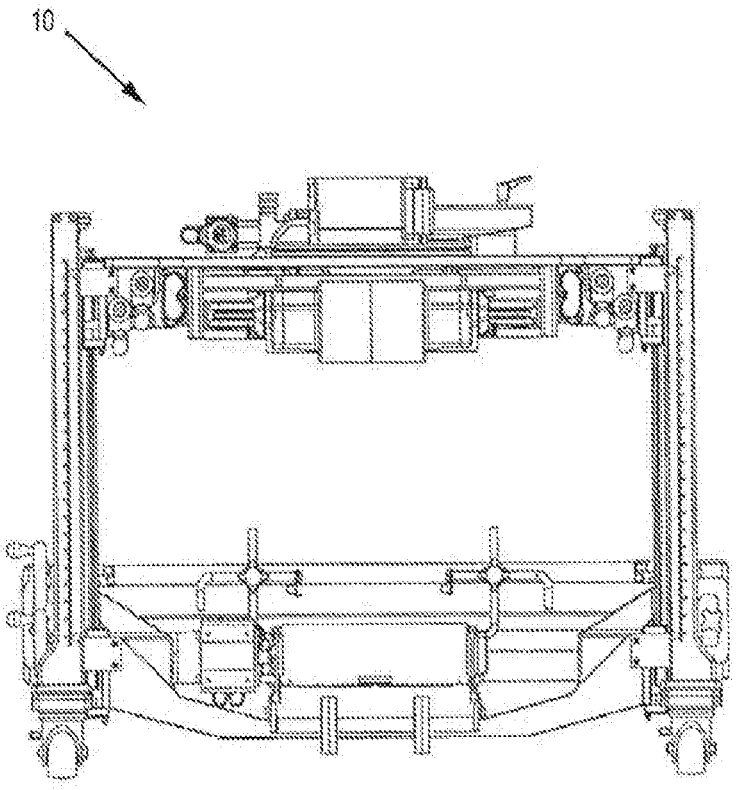
Figure 11K:
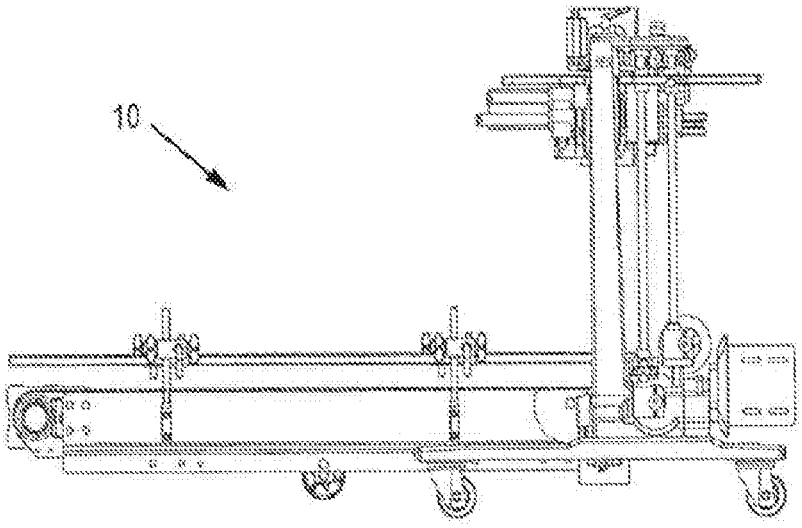
Figure 11L:
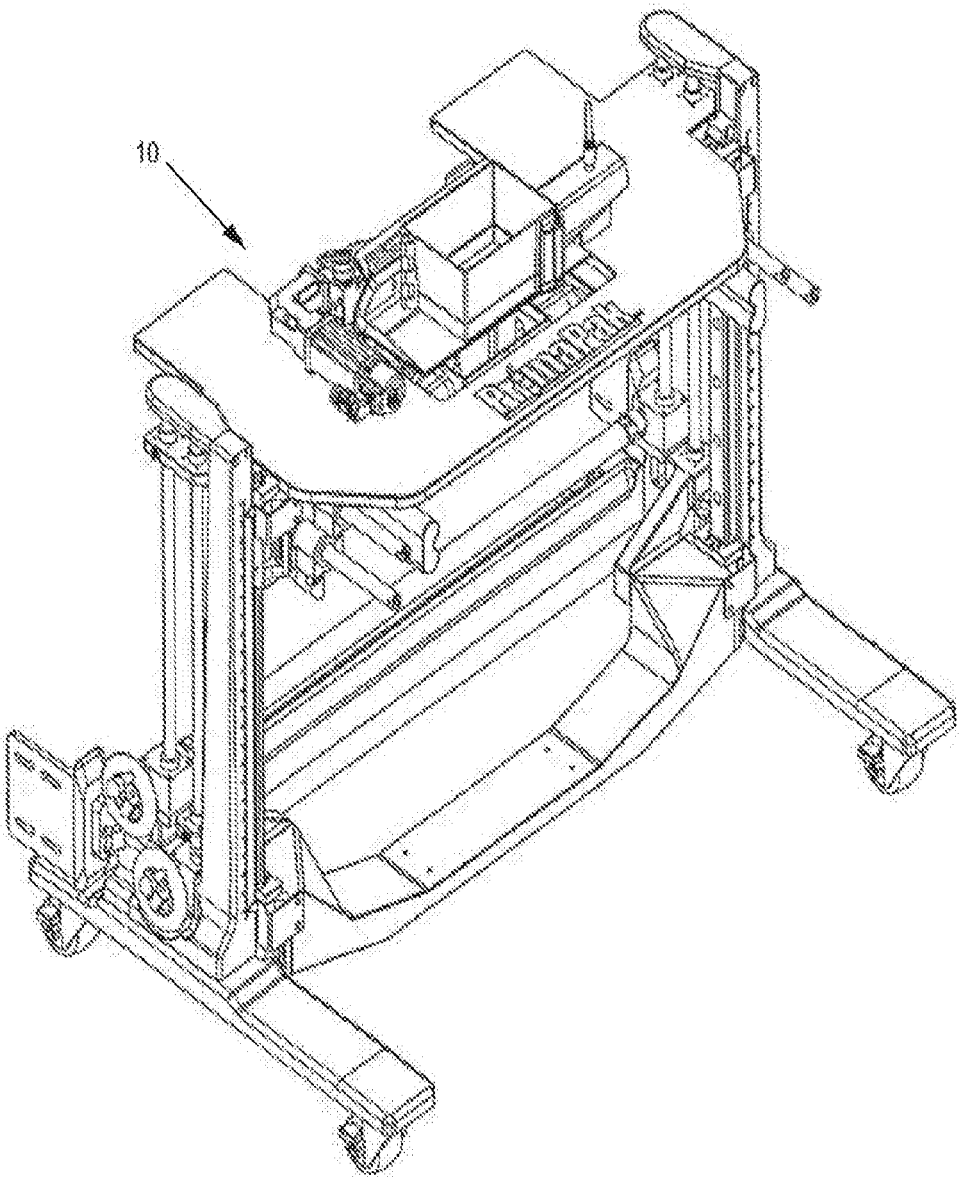
Figure 11M:
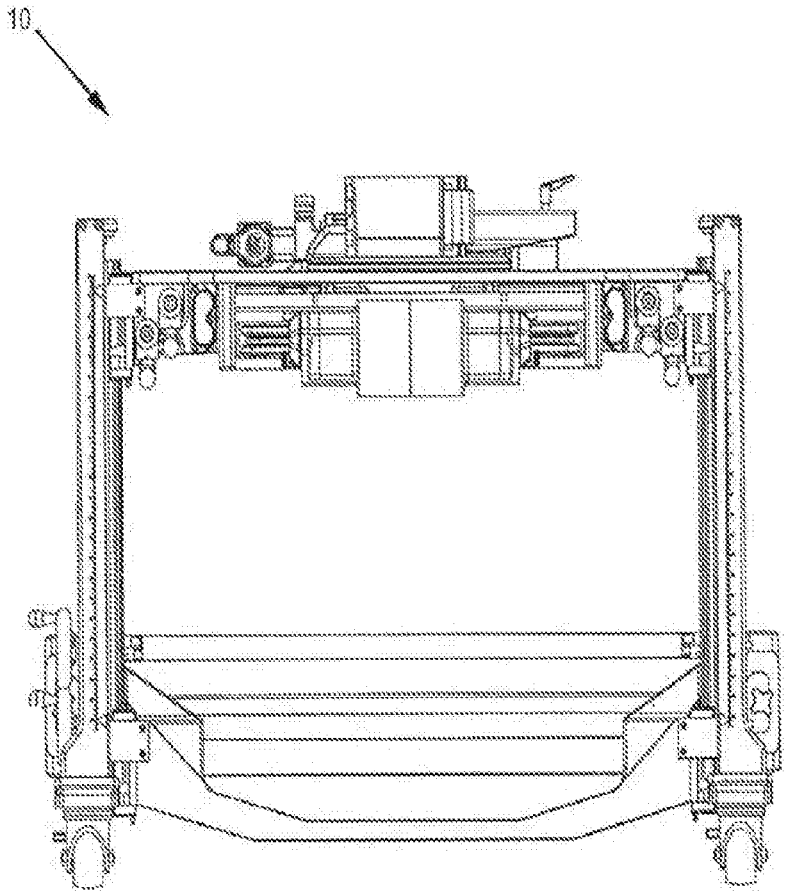
Figure 11N:
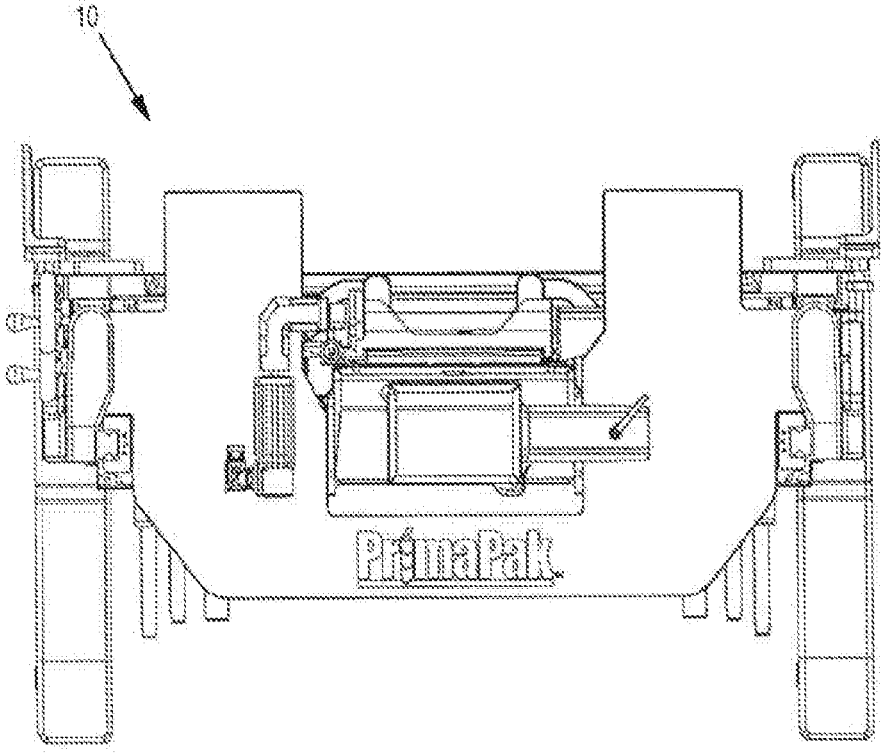
Figure 110:
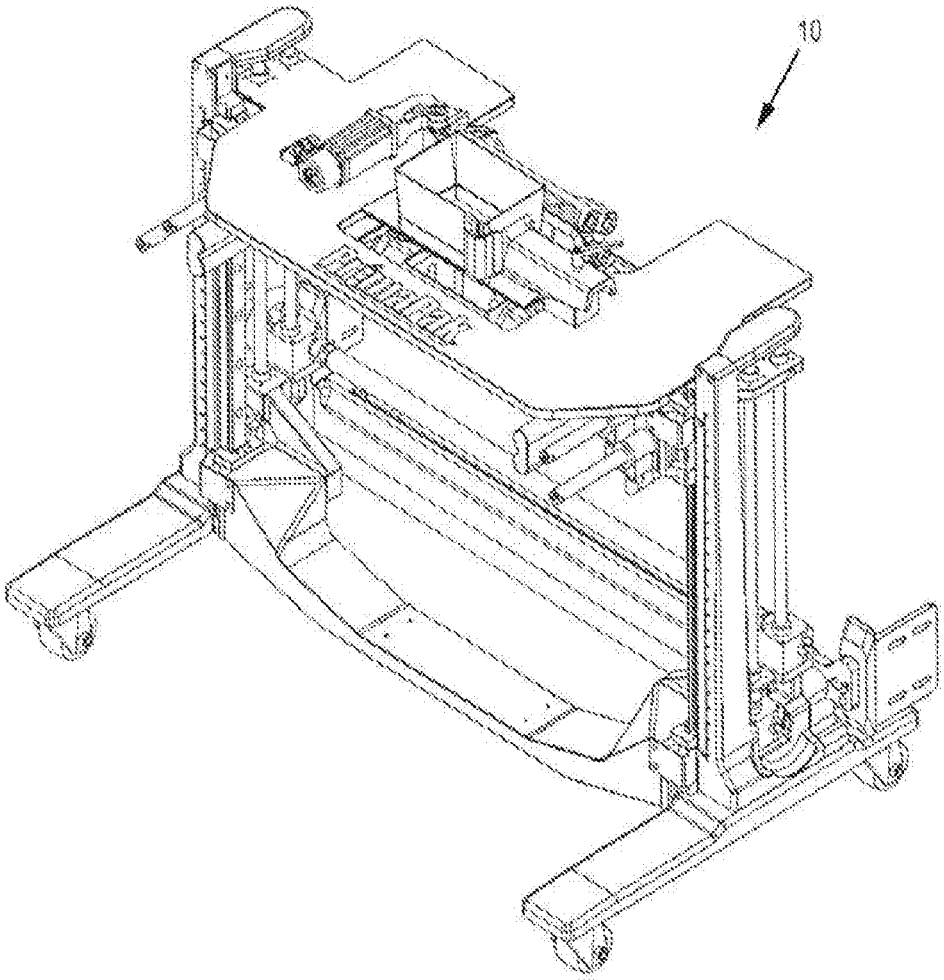
Figure 11P:
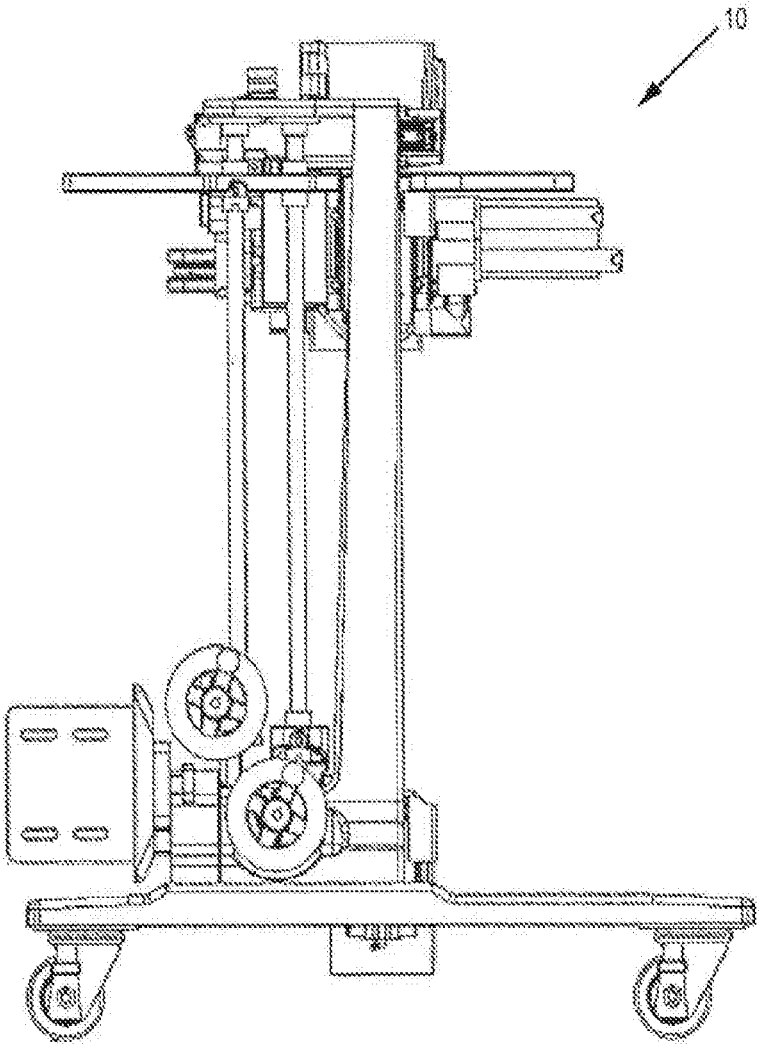
Figure 11Q:
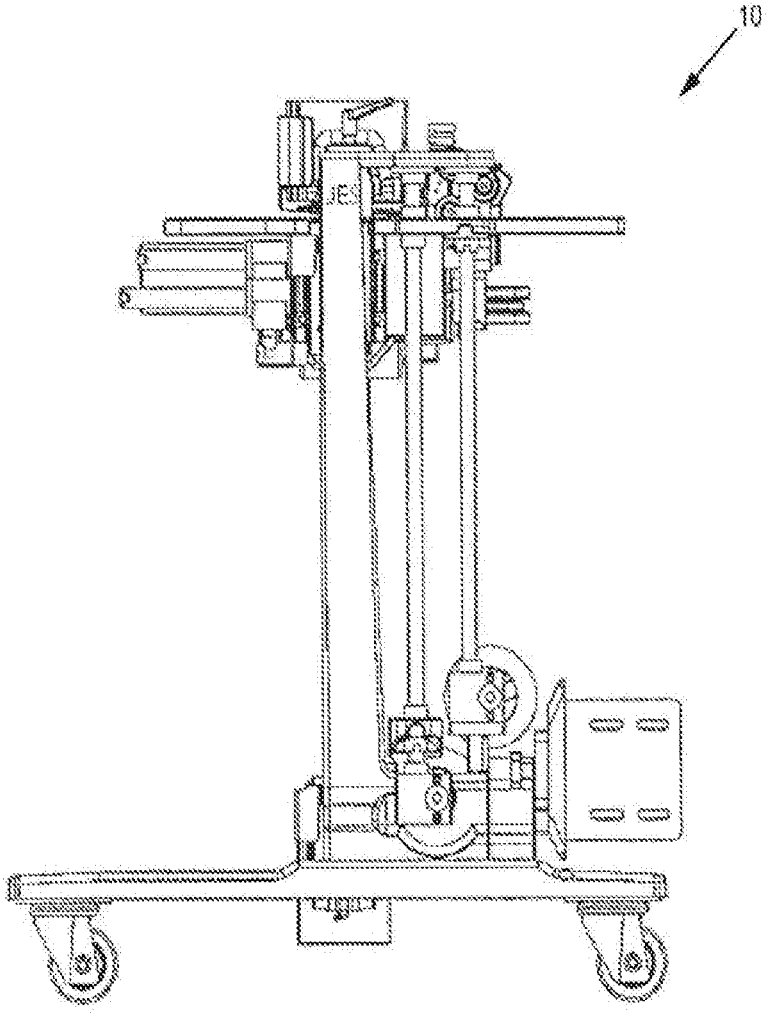
Figure 11R:
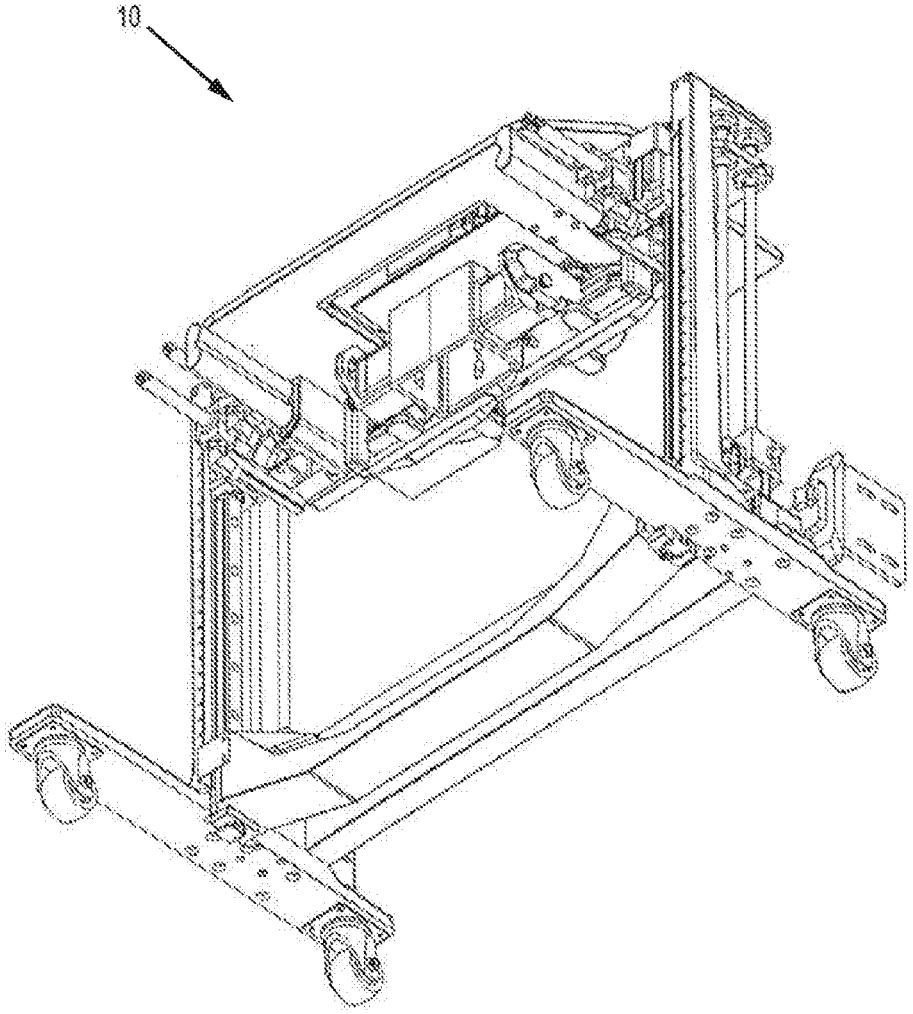

As previously discussed, the apparatus 10 can be provided on a frame assembly 76 illustrated in FIG. 11A that is portable, allowing the apparatus 10 to be moved into and out of configuration with the conventional packaging machine 104 illustrated in FIG. 6, which may include the forming tube 74 and other known forming features that cooperate to at least partially form the package 56 from a roll of film. The frame assembly 76 may include two or more rollers or casters 106 to facilitate mobility. Various views of various embodiments are illustrated in FIGS. 11A to 11R. FIGS. 11A to 11R illustrate the frame assembly and portions of the apparatus in absence of conventional packaging machine 104 elements such as the forming tube to illustrate the apparatus and portability thereof.

In use, the apparatus 10 may be used to form a plurality of packages 56, such as a first package 56*a* and a subsequently-formed second package 56*b*, which can be identical and are illustrated in FIGS. 4A and 4B. Specifically, the first package 56*a*, which may be formed in a known manner, may be at least partially disposed within the lateral enclosure 22*a* of the retaining structure 12*a*, as illustrated in FIGS. 2, 4A, and 4B. However, the first package 56*a* may be at least partially formed and may be at least partially disposed within the lateral enclosure 22*a* of the retaining structure 12*a*. The partially-formed first package 56*a* may include the formed lateral or circumferential portion of the first package 56*a* (which may be formed and longitudinally-sealed sealed along the forming tube 74 in a known manner) as well as the first transverse seal 66*a* (or flap) formed on the lower portion of the package 56*a*, as illustrated in FIG. 4A. The first transverse seal 66*a* (or flap) of the first package 56*a* may be formed by the first and second seal bars 68, 70. The first package 56*a* may extend along a first package axis 78*a* from a first end 80*a* to a second end 82*a* opposite to the first end 80*a*, and the first transverse seal 66*a* (or flap) may be disposed at or adjacent to the second end 82*a*. When the first package 56*a* is at least partially disposed within the lateral enclosure 22*a*, the second end 82*a* of the first package 56*a* may be adjacent to the second end 18*a* of the retaining structure 12*a*. In some embodiments, the first package axis 78*a* may be parallel to or aligned with the transport axis 14.

Figure 5B:
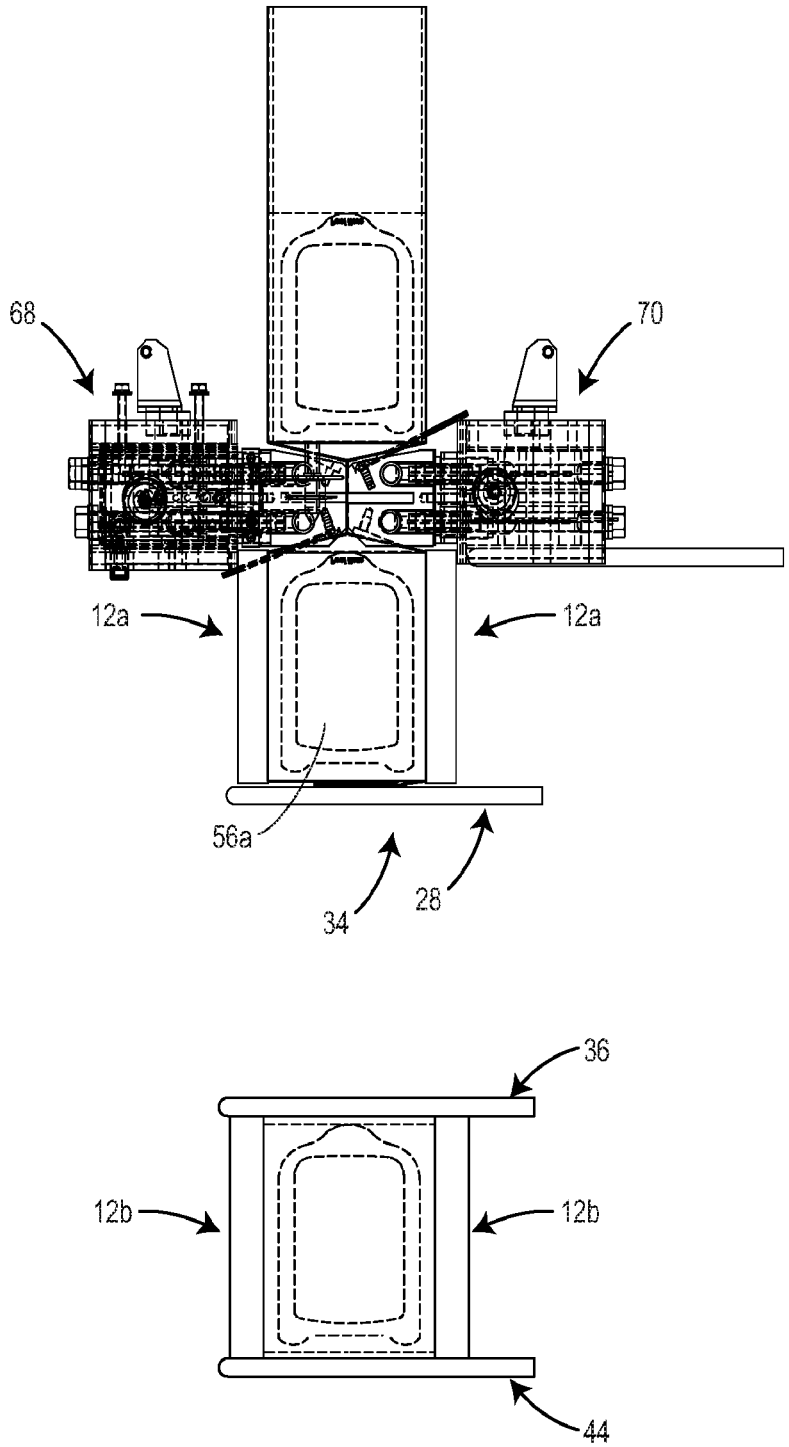
FIGS. 5A to 5M are various views of an apparatus for forming a flexible package.

Prior to or as the first package 56*a* is at least partially disposed within the lateral enclosure 22*a*, the first downstream folding bar 28 may be displaced in a transverse direction (i.e., normal to the transport axis 14) from the first position 32 in which the contact portion 30 of the first downstream folding bar 28 (or in which the reference point 83 of the contact portion 30 of the first downstream folding bar 28) is the first transverse distance 84 from the transport axis 14 to the second position 34 in which the contact surface 30 of the first downstream folding bar 28 (or in which the reference point 83 of contact portion 30 of the first downstream folding bar 28) is the second transverse distance 85 from the transport axis 14 and may be adjacent to the second end 18*a* of the retaining structure 12*a*, as illustrated in FIGS. 5A and 5B. In the second position 34, the contact portion 30 (at or adjacent to the reference point 83) applies pressure to the bottom flap 66*a* disposed at the second end of the first package. This pressure, in conjunction with residual heat in the material of the first transverse seal 66 transferred by the first and second seal bars 68, 70, folds the seal over and seals the first transverse seal 66 to the material of the lower portion of the first package 56*a*.

After (or as) the first downstream folding bar 28 translates from the first position 32 to the second position 34, at least one of the two or more walls 20*a* that cooperate to form the lateral enclosure 22*a* of the retaining structure 12*a* displaces towards the transport axis 14 such that the at least one of the two or more walls 20 contacts a lateral portion of the first package 56*a*, as illustrated in FIGS. 5A and 5B. In some embodiments, at least two of the two or more walls 20*a* (e.g., each of the first wall 52*a* and the second wall 53*a*) contact corresponding portions of the package 56*a*, such as a first circumferential and/or lateral portion of the package 56 and a second circumferential and/or lateral portion of the package 56. In some embodiments, each of the first wall 52*a*, the second wall 53*a*, the third wall 54*a*, and the fourth wall 55*a* contacts corresponding portions of the package 56, such as a first circumferential and/or lateral portion of the package 56, a second circumferential and/or lateral portion of the package 56, a third circumferential and/or lateral portion of the package 56, and a fourth circumferential and/or lateral portion of the package 56, respectively.

Figure 5F:
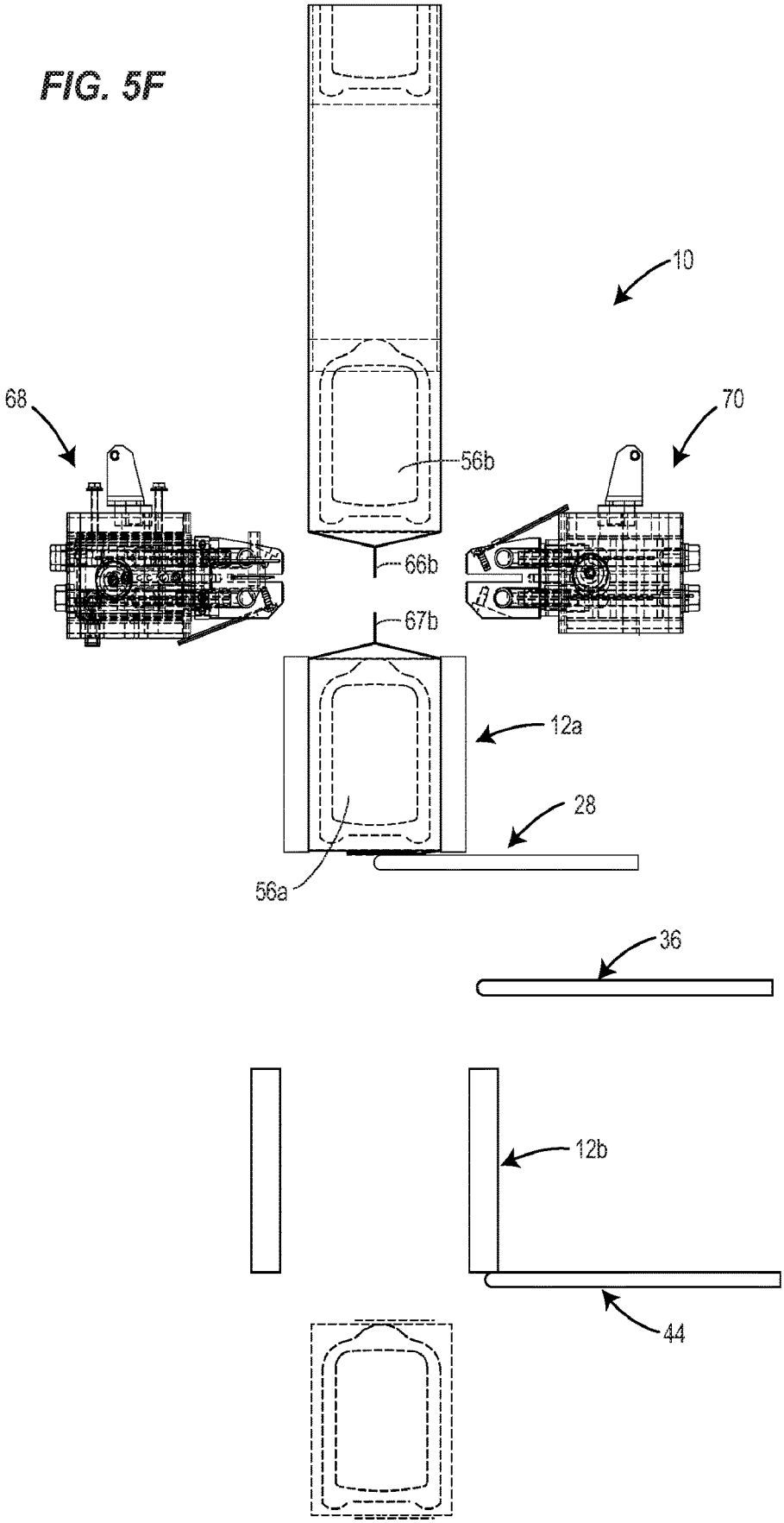

After (or as) the at least one of the two or more walls 20*a* displaces towards the transport axis 14, each of the first seal bar 68 and the second seal bar 70 displaces towards the transport axis 14 to seal a portion of the first end 80 of the first package 56*a* to form the second transverse seal 67 (i.e., the top flap) formed on the upper portion of the first package 56*a*, as illustrated in FIGS. 5A and 5B. The first seal bar 68 and the second seal bar 70 may then longitudinally displace downstream while sealing the portion of the first end 80 of the first package 56*a*, as illustrated in FIGS. 5B to 5E. The first seal bar 68 and the second seal bar 70 may then displace away from the transport axis 14, as illustrated in FIGS. 5E and 5F. As illustrated in FIGS. 5E and 5F, a cutting operation may transversely cut a transverse portion of the second transverse seal 67*a* to form a separate and fully-formed first package 56*a*. The cutting operation may occur as, after, or before the first seal bar 68 and the second seal bar 70 displace towards the transport axis 14 (or as, after, or before the first seal bar 68 and the second seal bar 70 form the second transverse seal 67*a*.

Prior to or as the first seal bar 68 and the second seal bar 70 translate towards the transport axis 14 to form the second transverse seal 67*a*, the first folding box 12*a* and the first downstream folding bar 28 may longitudinally displace upstream to properly align the first package 56*a*, as illustrated in FIGS. 5A and 5B. While the first seal bar 68 and the second seal bar 70 form the second transverse seal 67 and longitudinally translate downstream, the first folding box 12*a* and the first downstream folding bar 28 may longitudinally displace downstream at the same rate of speed as the first seal bar 68 and the second seal bar 70, as illustrated in FIGS. 5B to 5E.

During (or after) any or both of the cutting operation or the first seal bar 68 and the second seal bar 70 form the second transverse seal 67, the first downstream folding bar 28 may transversely displace (or may begin to displace)

from the second position 34 to the first position 32. When the first downstream folding bar 28 reaches the first position 32, the first package 56*a* may displace or begin to displace (under the influence of gravity, and optionally through one or more guides, which are not shown) towards the second folding box 12*b*.

As or before the first package 56*a* displaces or begins to displace out of the first folding box 12*a* and towards the second folding box 12*b*, the first upstream folding bar 36 may be in the second position 42 (or may displace from the first position 40 to the second position 42), as illustrated in FIG. 5A to 5C and 5J to 5L. In addition, as or before the first package 56*a* displaces or begins to displace towards the second folding box 12*b*, the second downstream folding bar 44 may be in the second position 50 (or may displace from the first position 48 to the second position 50), as illustrated in FIGS. 5B to 5C and 5G to 5M.

Figure 5G:
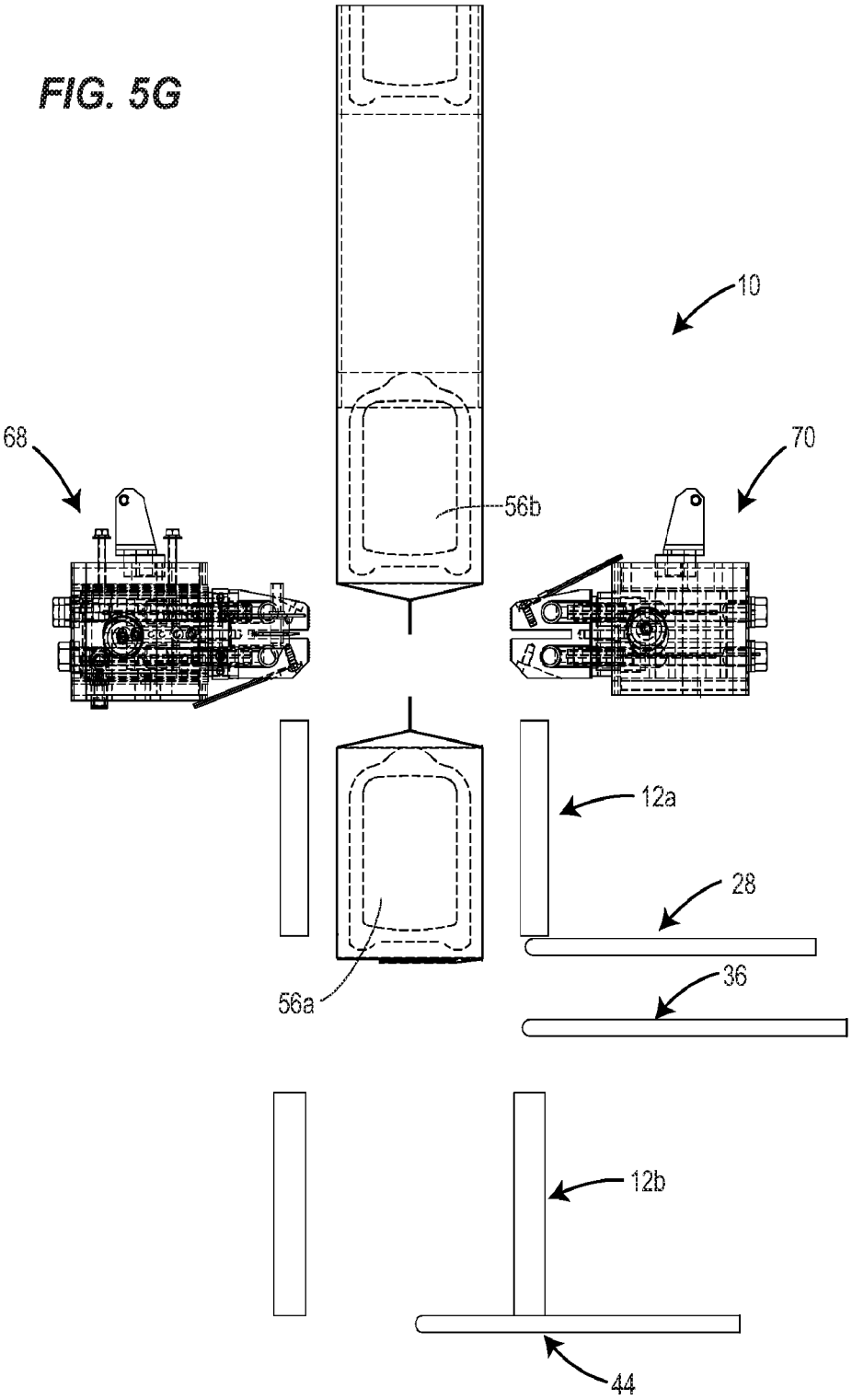
Figure 5H:
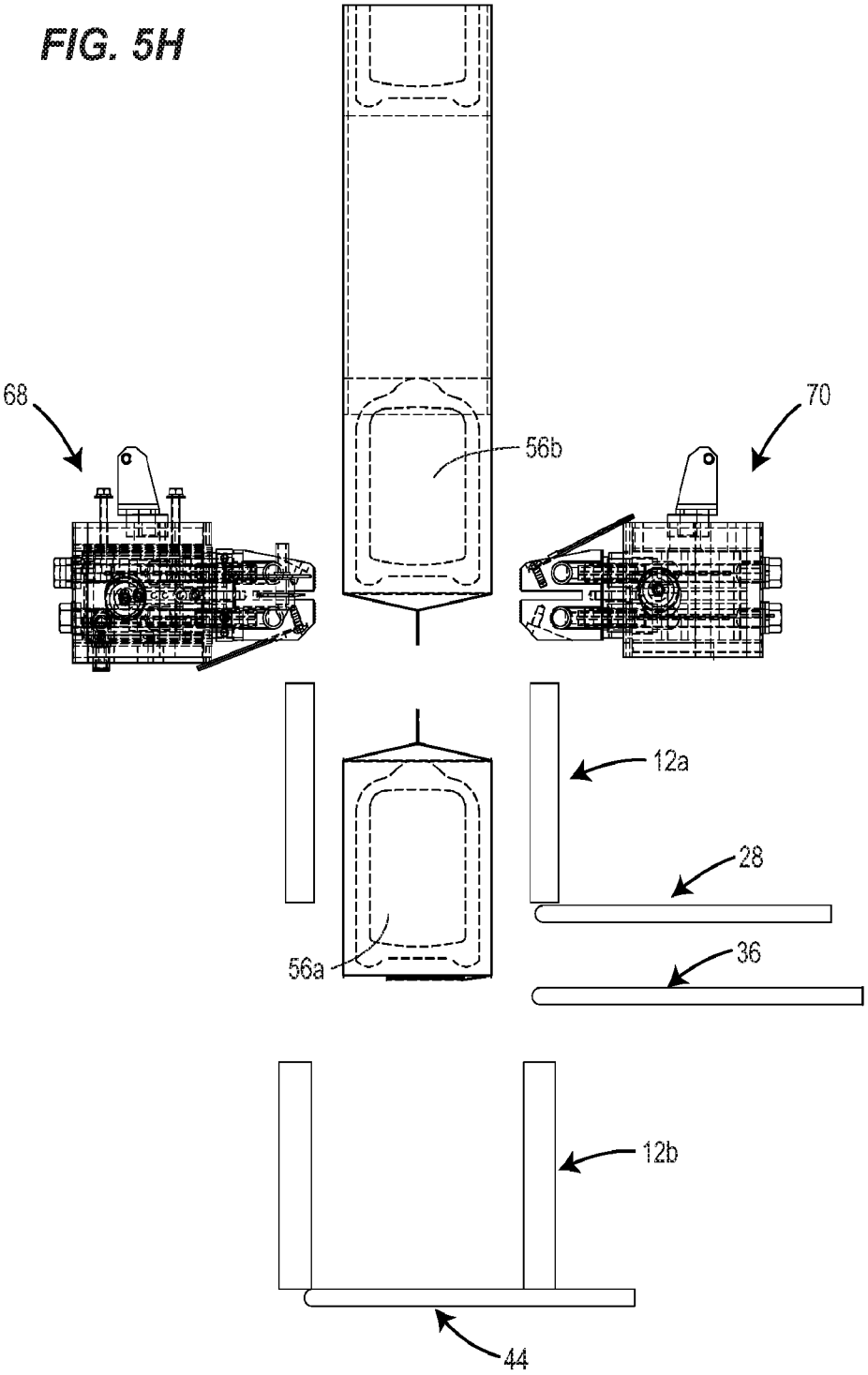
Figure 5I:
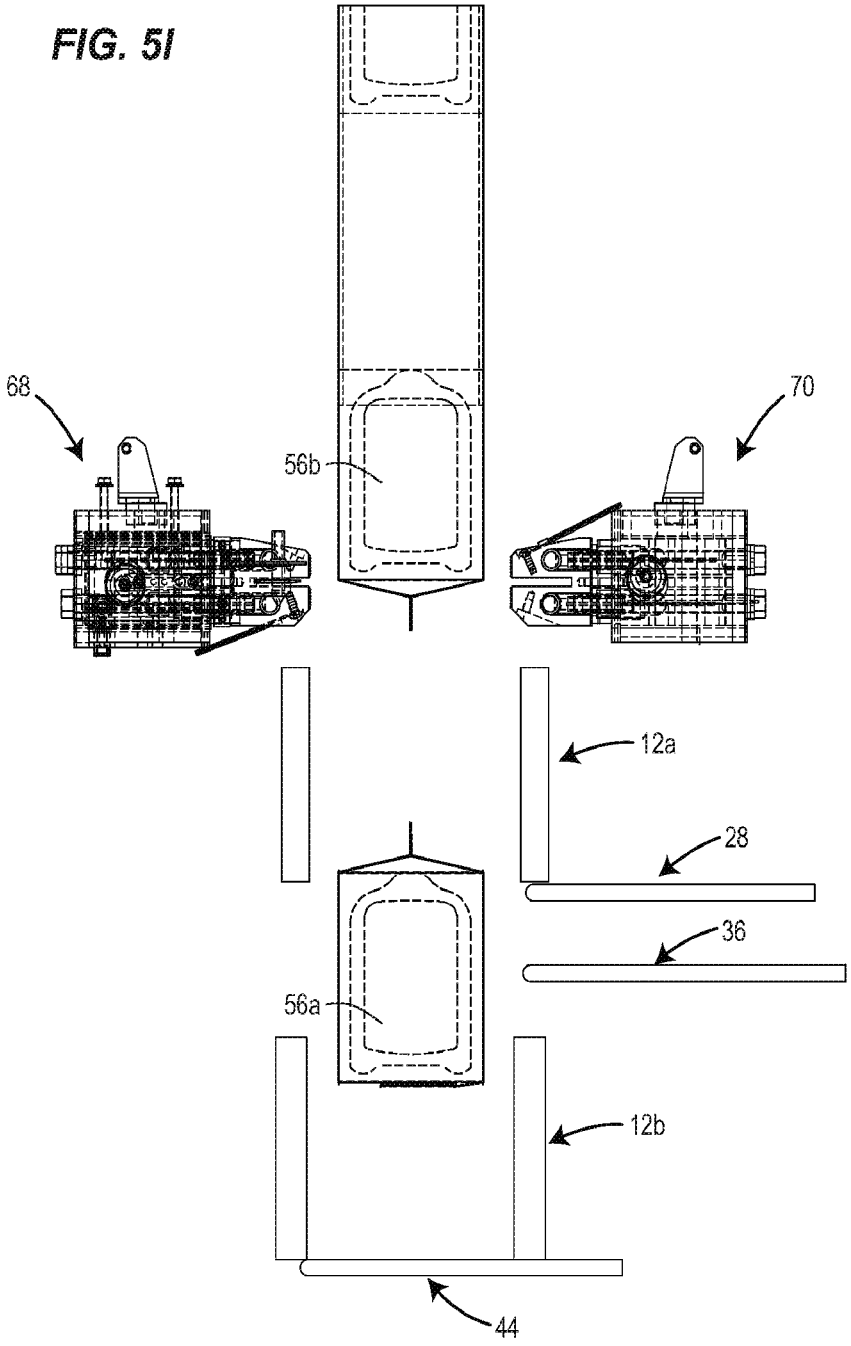

After (or as) the second downstream folding bar 44 translates from the first position 48 to the second position 50, and after or as the first upstream folding bar 36 is in the first position 40, at least one of the two or more walls 20*b* that cooperate to form the lateral enclosure 22*b* of the second forming box 12*b* may displace away from the transport axis 14 such that the at least one of the two or more walls 20*b* are adapted to receive the first package 56*a*, as Illustrated in FIG. 5H. In some embodiments, at least two of the two or more walls 20*a* displace away from the transport axis 14. In some embodiments, each of the first wall 52*a*, the second wall 53*a*, the third wall 54*a*, and the fourth wall 55*a* displaces away from the transport axis 14.

Figure 5J:
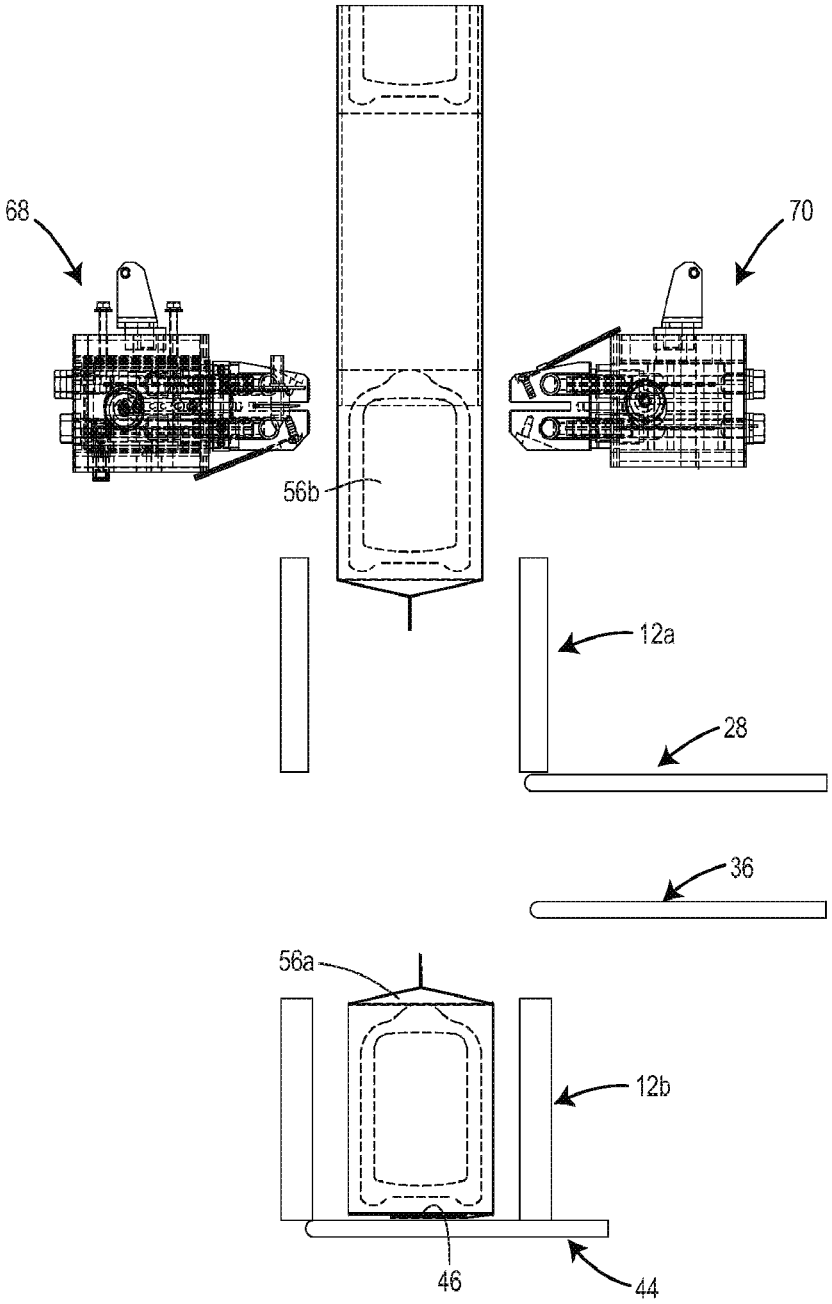
Figure 5K:
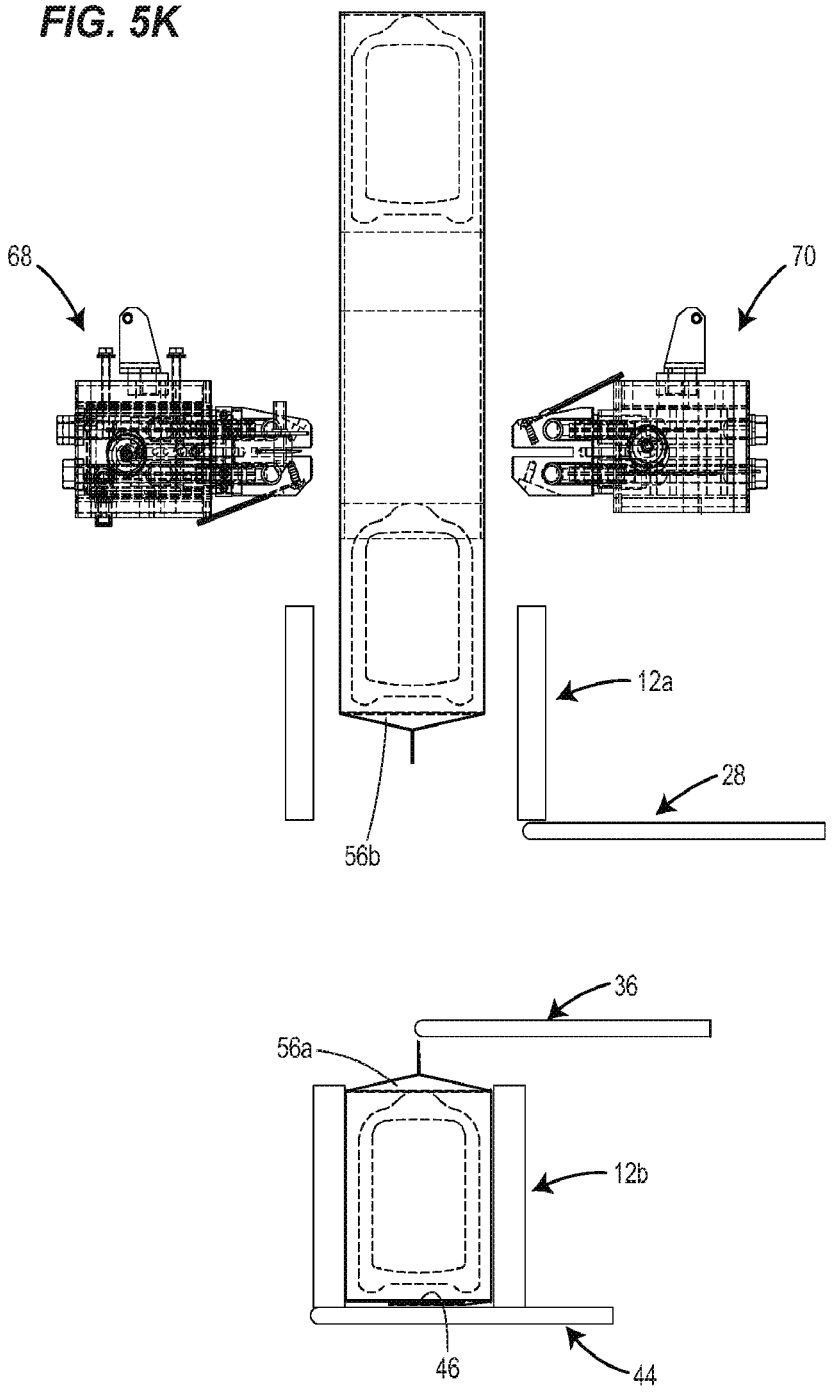

After (or as) the first downstream folding bar 28 translates from the second position 34 to the first position 32, the first package 54 may then longitudinally translate downstream such that the first package 56*a* is at least partially disposed within the lateral enclosure 22*b* of the second forming box 12*b*, as illustrated in FIG. 5G to 5J. After or as the second end 82 of the first package 56*a* engages the contact portion 46 of the second downstream folding bar 44 (which is in the second position 50), at least one of the two or more walls 20*b* that cooperate to form the lateral enclosure 22*b* of the second forming box 12*b* may displace towards the transport axis 14 such that the at least one of the two or more walls 20*b* contacts a lateral portion of the first package 56*a*, as illustrated in FIGS. 5J and 5K. In some embodiments, at least two of the two or more walls 20*b* (e.g., each of the first wall 52*b* and the second wall 53*b*) contact corresponding portions of the first package 56*a*, such as a first circumferential and/or lateral portion of the first package 56*a* and a second circumferential and/or lateral portion of the first package 56*a*. In some embodiments, each of the first wall 52*b*, the second wall 53*b*, the third wall 54*b*, and the fourth wall 55*b* contacts corresponding portions of the first package 56*a*, such as a first circumferential and/or lateral portion of the first package 56*a*, a second circumferential and/or lateral portion of the first package 56*a*, a third circumferential and/or lateral portion of the first package 56*a*, and a fourth circumferential and/or lateral portion of the first package 56*a*, respectively.

After or as the first package 56*a* is at least partially disposed within the lateral enclosure 22*b*, the first upstream folding bar 36 may be displaced from the first position 40 to the second position 42 in which the contact surface 38 of the first upstream folding bar 36 (or in which the reference point 86 of the contact portion 38 of the first upstream folding bar 36) may be adjacent to the first end 16*b* of the second forming box 12*b*. The first upstream folding bar 36 may also longitudinally translate downstream (from the second position 101 to the first position 100 of FIGS. 10A and 10B) after or as the first upstream folding bar 36 is displaced from the first position 40 to the second position 42, as illustrated in FIGS. 5K and 5L. As such, the contact surface 38 of the first upstream folding bar 36 longitudinally travels to come into contact with the top flap 67*a* disposed at the first end 80*a* of the first package 56*a*. In the second position 42, the contact portion 38 (at or adjacent to the reference point 86) applies pressure to the top flap 67*a* disposed at the first end 80*a* of the first package 56*a*. This pressure, in conjunction with residual heat in the material of the second transverse seal 67 transferred by the first and second seal bars 68, 70, folds the seal over and attaches the second transverse seal 67 to the material of the upper portion of the first package 56*a*.

As illustrated in FIG. 5L, and as the first package 56*a* is at least partially disposed within the lateral enclosure 22*b* of the second forming box 12*b*, and as the first upstream folding bar 36 is in the second position 42, the second downstream folding bar 44 may be in the second position 50, in which the contact portion 46 of the second downstream folding bar 44 (or in which the reference point 89 of contact portion 46) is the second transverse distance 90 from the transport axis 14 and may be adjacent to the second end 18*b* of the second forming box 12*b*. In the second position 50, the contact portion 46 (at or adjacent to the reference point 89) applies pressure to the bottom flap 66*a* disposed at the second end 82 of the first package 56*a*, which can aid in further setting a crease in the folded second transverse seal and in various embodiment setting a heat seal between the flexible material of the corresponding panel and the second transverse seal imparted when the first downstream folding bar 28 folds the second transverse seal over. The second downstream folding bar 44 also supports the weight of the package during actuation of the first upstream folding bar 36. The first upstream folding bar 36 actuates to a second position to engage the first transverse seal and apply a pressure to the package. This pressure, in conjunction with residual heat in the material of the first transverse seal 66 transferred by the first and second seal bars 68, 70, folds the seal 66 over toward the panel from which it extends and, in some embodiments, attaches the first transverse seal 66 to the material of the lower portion of the first package 56*a*.

After the second downstream folding bar 44 is in the second position 50 and applies pressure to the bottom flap 66 disposed at the second end 82 of the first package 56*a*, the second downstream folding bar 44 then translates to the first position 48, as illustrated in 5B to 5D. When the second downstream folding bar 44 reaches the first position 48, the first package 56*a* may displace or begin to displace (under the influence of gravity, and optionally through one or more guides, which are not shown) towards a conveyor 108 (illustrated in FIG. 6) or other take-away device for further processing or packaging.

As the cutting operation or the first seal bar 68 and the second seal bar 70 form the second transverse seal 67*a* of the first package 56*a*, the first seal bar 68 and the second seal bar 70 may form the first transverse seal 66*b* of the second package 56*b*, as illustrated in FIGS. 5E and 5F. After or as the first package 56*a* translates from the retaining structure 12*a* towards the second forming box 12*b* (e.g., as the first end 80 of the first package 56*a* is downstream of the second end 18*a* of the retaining structure 12*a*) as previously described and as illustrated in FIG. 5G, the first downstream folding bar 28 may translate (or may begin to translate) from the first position 32 to the second position 34, as illustrated in FIGS. 5A and 5B.

While the first downstream folding bar 28 is in the first position 32, the fully-formed (or at least partially-formed) second package 56*b* may be at least partially disposed within the lateral enclosure 22*a* of the retaining structure 12*a*, as illustrated in FIG. 5J to 5M. With reference to FIGS. 4A and 4B, the partially-formed second package 56*b* may include the formed lateral or circumferential portion of the second package 56*b* (which may be formed and longitudinally sealed along the forming tube 74 in a known manner) as well as the first transverse seal 66*b* (or flap) formed on the lower portion of the second package 56*b*. The first transverse seal 66*b* (or flap) of the second package 56*b* may be formed by the first and second seal bars 68, 70. The second package 56*b* may extend along a first package axis 78 from a first end 80 to a second end 82 opposite to the first end 80, and the first transverse seal 66 (or flap) may be disposed at or adjacent to the second end 82. When the second package 56*b* is at least partially disposed within the lateral enclosure 22*a*, the second end 82 of the second package 56*b* may be adjacent to the second end 18*a* of the retaining structure 12*a*. In some embodiments, the package axis 78 of the second package 56*b* may be parallel to or aligned with the transport axis 14.

Prior to or as the second package 56*b* may be at least partially disposed within the lateral enclosure 22*a* of the retaining structure 12*a*, at least one of the two or more walls 20*a* that cooperate to form the lateral enclosure 22*a* of the retaining structure 12*a* displaces away from the transport axis 14 as previously described and as illustrated with reference to the first package 56*a* in FIGS. 5F and 5G. The first downstream folding bar 28 may subsequently transversely displace from the first position 32 to the second position 34 (as previously described and as illustrated with reference to the first package 56*a* FIGS. 5A and 5B).

As or after the first downstream folding bar 28 transversely displaces from the first position 32 to the second position 34 and/or as or after the second end 82 of the second package 56*b* contacts the contact portion 30 of the first downstream folding bar 28, at least one of the two or more walls 20*a* that cooperate to form the lateral enclosure 22*a* of the retaining structure 12*a* displaces towards the transport axis 14 such that the at least one of the two or more walls 20 contacts a lateral portion of the second package 56*b* (in a manner substantially identical to the first package 56*a* illustrated in FIGS. 5A and 5B). In some embodiments, at least two of the two or more walls 20*a* (e.g., each of the first wall 52*a* and the second wall 53*a*) contact corresponding portions of the second package 56*b*, such as a first circumferential and/or lateral portion of the second package 56*b* and a second circumferential and/or lateral portion of the second package 56*b*. In some embodiments, each of the first wall 52*a*, the second wall 53*a*, the third wall 54*a*, and the fourth wall 55*a* contacts corresponding portions of the second package 56*b*, such as a first circumferential and/or lateral portion of the second package 56*b*, a second circumferential and/or lateral portion of the second package 56*b*, a third circumferential and/or lateral portion of the package 56, and a fourth circumferential and/or lateral portion of the package 56, respectively.

After (or as) the at least one of the two or more walls 20*a* displaces towards the transport axis 14, each of the first seal bar 68 and the second seal bar 70 displaces towards the transport axis 14 to seal a portion of the first end 80 of the second package 56*b* to form the second transverse seal 67*b* (i.e., the top flap) formed on the upper portion of the second package 56*b* (in a manner identical to the first package 56*a* illustrated in FIGS. 5A and 5B). The first seal bar 68 and the second seal bar 70 may then displace transversely away from the transport axis 14. Prior to or as the first seal bar 68 and the second seal bar 70 translate towards the transport axis 14 to form the second transverse seal 67*b*, the first folding box 12*a* and the first downstream folding bar 28 may longitudinally displace upstream to properly align the second package 56*b* (in a manner substantially identical to the first package 56*a* illustrated in FIGS. 5A and 5B). While the first seal bar 68 and the second seal bar 70 form the second transverse seal 67*b* and longitudinally translate downstream, the first folding box 12*a* and the first downstream folding bar 28 may longitudinally displace downstream at the same rate of speed as the first seal bar 68 and the second seal bar 70, as illustrated in FIGS. 5B to 5E (in a manner identical to FIGS. 5B to 5E). A cutting operation may transversely cut a transverse portion of the second transverse seal 67 to form a separate and fully-formed second package 56*b*, (in a manner identical to the first package 56*a* illustrated in FIG. 5F). The cutting operation may occur as, after, or before the first seal bar 68 and the second seal bar 70 displace towards the transport axis 14 (or as, after, or before the first seal bar 68 and the second seal bar 70 form the second transverse seal 67.

During (or after) any or both of the cutting operation or the first seal bar 68 and the second seal bar 70 form the second transverse seal 67*b*, the first upstream folding bar 36 may also longitudinally translate upstream (from the first position 100 to the second position 101 of FIGS. 10A and 10B) after or as the first upstream folding bar 36 is displaced from the second position 42 to the first position 40, as illustrated in FIGS. 5E and 5F. Also, during (or after) any or both of the cutting operation or the first seal bar 68 and the second seal bar 70 form the second transverse seal 67*b*, the first downstream folding bar 28 may transversely displace (or may begin to displace) from the second position 34 to the first position 32, as illustrated in FIGS. 5E to 5G. When the first downstream folding bar 28 reaches the first position 32, the second package 56*b* may displace or begin to displace (under the influence of gravity, and optionally through one or more guides, which are not shown) towards the second folding box 12*b* (in a manner identical to the first package 56*a* illustrated in FIG. 5G). Once the second package 56*b* is at least partially disposed within the lateral enclosure 22*b* of the second folding box 12*b*, the process is substantially identical to that when the first package 56*a* was at least partially disposed within the lateral enclosure 22*b* of the second folding box 12*b*.

The skilled person would recognize that as the cutting operation or the first seal bar 68 and the second seal bar 70 form the second transverse seal 67 of the second package 56*b*, the first seal bar 68 and the second seal bar 70 may form the first transverse seal 66 of a third package 56*c*. As the second package 56*b* translates from the first folding box 12*a* towards the second forming box 12*b* (e.g., as the first end 80 of the second package 56*b* is downstream of the second end 18*a* of the retaining structure 12*a*) as previously described, the first downstream folding bar 28 may translate (or may begin to translate from the first position 32 to the second position 34. As or after the first downstream folding bar 28 is in the second position 34, the third package 56*c* may be at least partially disposed within the lateral enclosure 22*a* of the retaining structure 12*a*, and the process is that same for that of the second package 56*b* previously described.

The skilled person would recognize that the apparatus 10 provides a high-velocity, mobile sealing machine that, as previously described, uses internal package pressure generated when the package is compressed by the folding bar, in conjunction with residual heat in the material of the first transverse seal 66*a* and/or the second transverse seal 67*a* transferred by, for example, the first and second seal bars 68, 70, to fold the seal over and optionally attach the first and second transverse seal 66*a*, 67*a* to the material of the lower and/or upper portions of the first package 56*a*. Because the transverse seals 66*a*, 67*a* are secured to the body of the package 56*a*, the transverse seals 66*a*, 67*a* lie substantially flat on—and not perpendicular or oblique to—the body of the package 56*a*, the top and bottom transverse seals 66*a*, 67*a* are not damaged or deformed when being boxed for shipment and do not cause spacing issues while being boxed.

Apparatus with Interface

Figure 12:
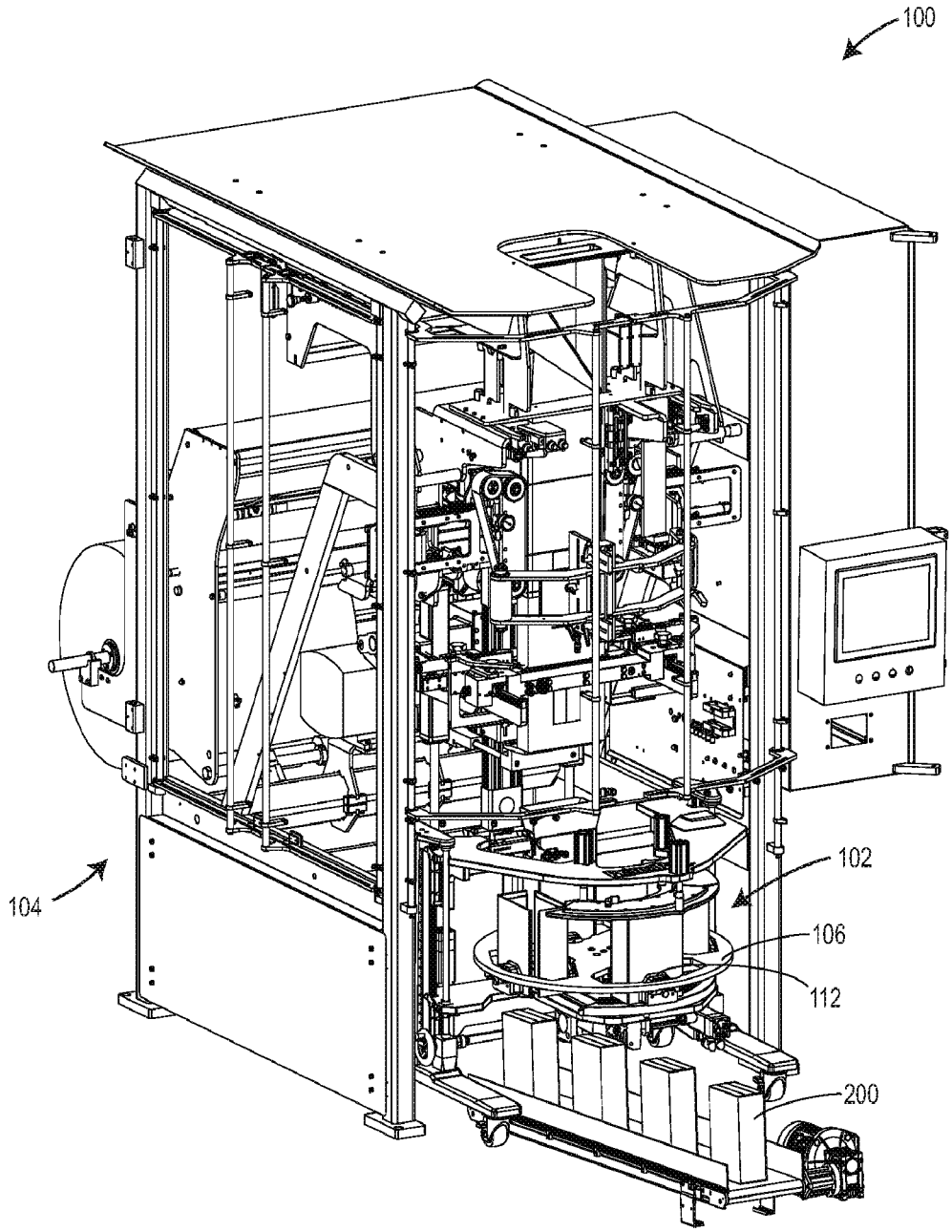
FIG. 12 is a perspective view of an apparatus in accordance with an embodiment of the disclosure including a packaging machine and an interface for further processing of the package into a cubed or cuboid shape.
Figure 13:
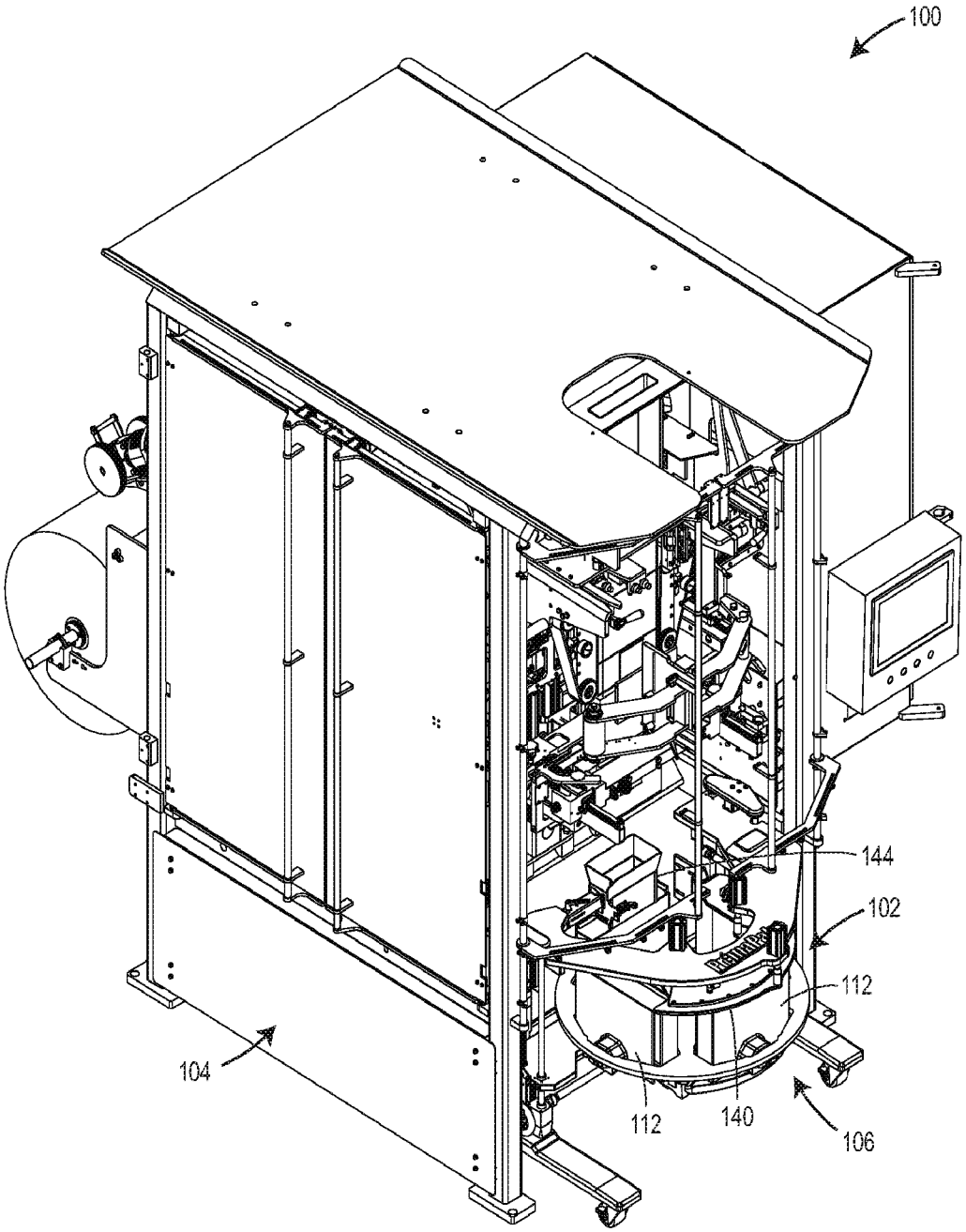
FIG. 13 is a perspective view of an apparatus in accordance with an embodiment of the disclosure including a packaging machine and an interface for further processing of the package into a cubed or cuboid shape.

Referring to FIGS. 12 and 13, in accordance with an embodiment, the apparatus 100 for forming a package can include an interface 102 for generating a package having a cube or cuboid shape. The interface 102 can be configured to be used in connection with known packaging machines 104, including, for example, continuous motion vertical form fill seal packaging machines. One example of a continuous motion vertical form fill seal packaging machine is Triangle Model XYT15 Vertical-Form-Fill Seal Bagging Machine. Such conventional bagging machines can conventionally produce, for example, gable top packages in which the bottom of the package is substantially flat. Such conventional packing machines, however, are incapable of forming a cube or cuboid package. The interface 102 in accordance with embodiments of the description can be adapted to work in connection with such conventional machines to form cuboid packages. The conventional packaging machine can be modified in various embodiments to include a flap folding bar that actuates in two axes as opposed to a single axis as is conventional. In any of the foregoing embodiments, a two axis motion, such as described for the flap folding plate 130 of the interface, can be used for any of the described flap folding mechanisms of the packaging machines of the disclosure. In various embodiments, the two axis motion can be controlled by an actuator that allows for independent control of the axes independently. This can allow for more flexibility when folding, which can improve the forming process and ultimately the package shape/structure.

In accordance with an embodiment, as illustrated in FIGS. 12 and 13, the interface 102 can be configured to reside beneath a conventional packaging machine 104, such that the package is seamlessly transferred from the conventional bagging machine to the interface. Embodiments in which the interface 102 is disposed beneath the packaging machine advantageously allow for the package to be dropped from the last stage of the packaging machine 104 into the interface 102 without the need for additional devices or transfer steps. However, other placements of the interface are contemplated herein, including arrangements in which conveyors or other transfer devices are utilized to transfer the package from the packaging machine to the interface. It is also contemplated that the interface can be made integral with the packaging machine to provide a single, non-separable packaging machine unit.

Figure 14:
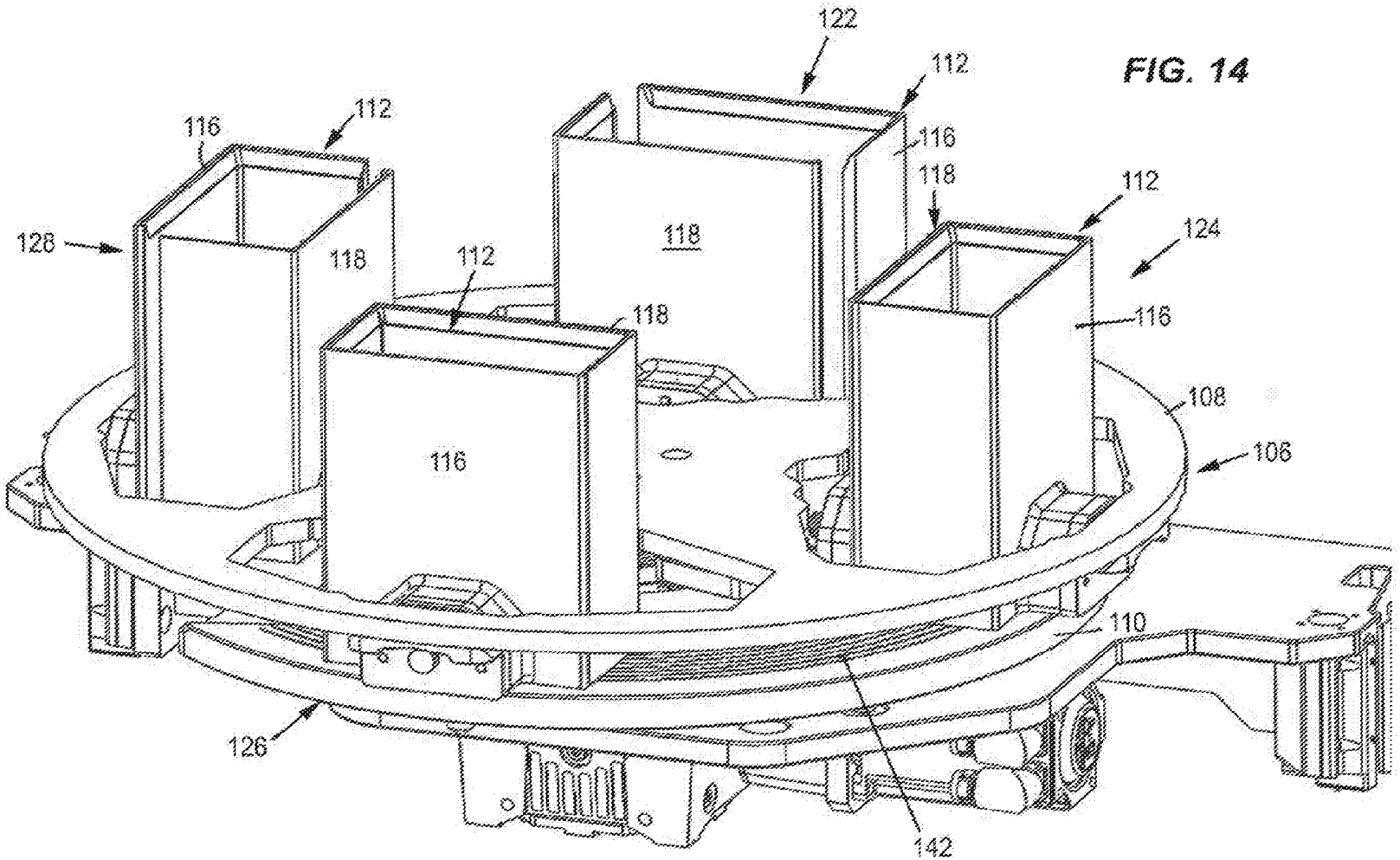
FIG. 14 is a perspective view of a portion of the interface of FIG. 12, showing a rotary unit of an interface in accordance with an embodiment of the disclosure.

Referring to FIG. 14, in accordance with an embodiment, the interface can include a rotary unit 106 that contains a plurality of forming boxes 112 disposed on a rotating axis to allow for translation in a generally circular motion of the forming boxes 112 through multiple stations of the interface 102. In various embodiments, the forming boxes 112 can be attached to a rotating plate 108 that rotates the forming boxes in a circular motion. Any suitable means for rotating the plate 108 can be used. For example, the rotating plate can be servo driven. In such embodiments, the rotating plate 108 can include or be attached to a drive shaft that is connected to a servo motor gearbox for connection to the servo motor.

Figure 15:
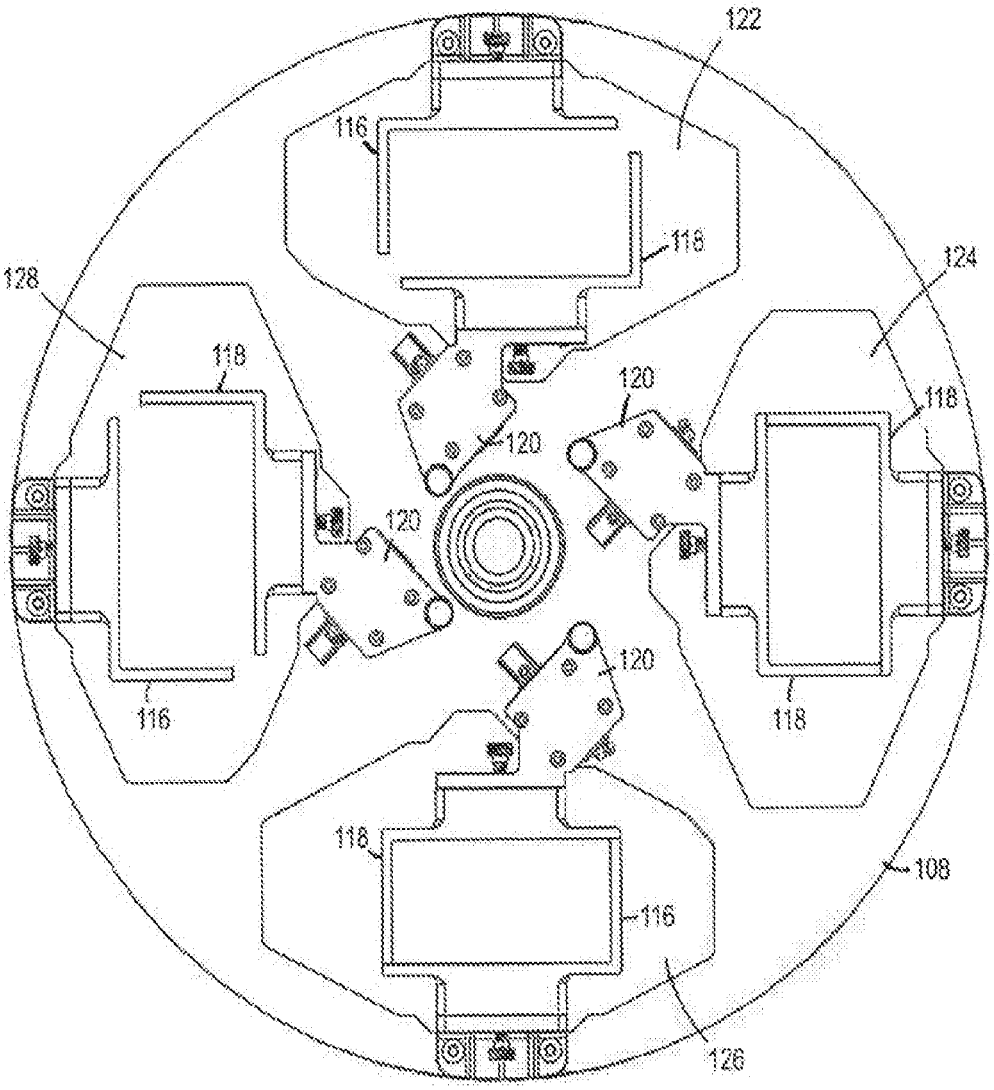
FIG. 15 is a top cut-away view of the rotary unit of the interface of FIG. 14, showing the forming boxes and internal rotation apparatuses for rotating the rotary plate and the forming boxes.

Any of the forming box configurations described above can be used in the interface. Referring to FIG. 15, in one embodiment, the forming boxes 112 include first and second separable portions 116, 118. The portions 116, 118 can both be movable or only one of the portions can be moveable. For example, the first portion 116 can be in a fixed position and rotate with the movement of the rotating plate 108, while the second portion 118 is moveable into and out of engagement with the first portion 116 as well as rotating with the motion of the rotating plate 108. Referring to FIG. 15, in an embodiment, the second portion 118 of the forming boxes 112 can be connected to a cam assembly 120 that guides the second portion 118 in a secondary motion into and out of engagement with the first portion 116.

Figure 16:
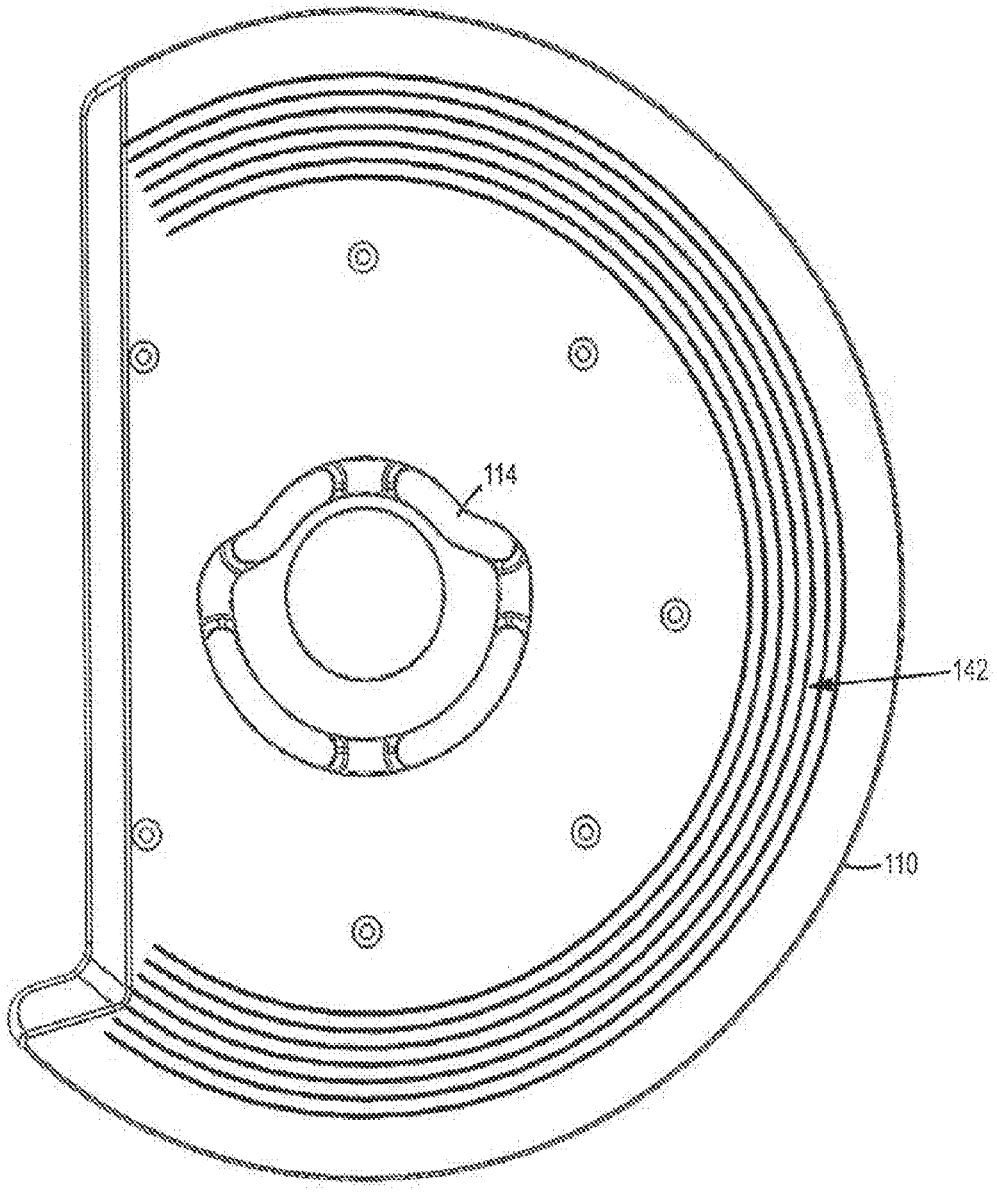
FIG. 16 is a top view of a dead plate of an interface in accordance with an embodiment of the disclosure.

The cam assembly 120 includes a cam follower that resides in a guide disposed beneath the rotating plate 108. For example, in an embodiment, the rotary unit 106 can include a dead plate 110 that resides beneath at least some of the forming boxes 112 and defines a bottom wall of the forming boxes 112. Referring to FIG. 16, the dead plate 110 can include the guide 114 in which the cam follower resides, thereby defining the secondary motion of the forming boxes 112 around the rotary unit 106. As the forming boxes approach different stations, the position of the second portion 118 is adjusted as the cam follower proceeds along the guide 114. The path of the guide 114 can be used to define the position of the second portion 118 of the forming box at a given station of the rotary unit 106. For example, in the first station 122, the package can be received in the forming box 112 from the packaging machine. The forming box 112 can be in a package receiving or open position in which the first and second portions are separated in order to allow the package to drop within the forming box 112. As the forming box 112 transfers to the second position 124, the second portion 118 can be guided into engagement with the first portion 116 to provide a tight fight around the package during subsequent processing. When the forming box 112 approaches the final station (shown as a fourth station 128 in the figures), the second portion 118 can again be guided away from the first portion 116 to allow the forming box 112 to open and the package to exit the rotary unit 106. Referring to FIG. 15, the forming box at the first station 122 is shown in an open position, while the forming box 112 at the second station 124 is shown in a closed position.

The path of the guide 114 can be any suitable shape depending on the number of stations and the desired position of the forming box 112 at a given station. The forming box 112 portions 116, 118 can be actuated to any suitable number of positions. In one embodiment, the forming box is actuated between an open position and a closed position. In another embodiment, the forming box 112 portions 116, 118 can be actuated between a package receiving position in which the portions are slightly separated, a package retaining position, in which the portions are held together to tightly retain the package, and a package ejection position in which the portions are more widely separated than the packaging receiving position.

Generally, the forming boxes 112 will have a size and shape corresponding to the package 200 to be formed. In various embodiments, the forming boxes 112 can be readily removed from the rotary unit 106 to allow the forming boxes 112 to be easily changed for forming boxes of another size and/or shape to accommodate formation of a different sized or shaped package.

Figure 17:
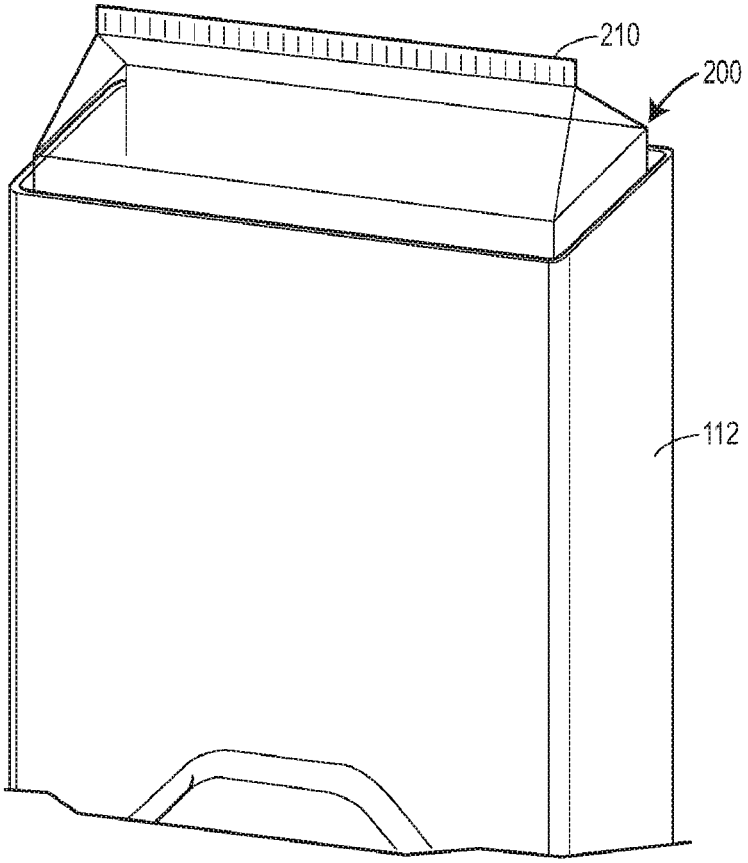
FIG. 17 is a schematic illustration of a package residing in the forming box at the first station of an interface in accordance with an embodiment of the disclosure.

In accordance with various embodiments, the forming box will be sized to a have an internal volume that is 70% to 120% of the internal volume of the final cuboid package. Other suitable percentages include about 85% to about 100%, about 80% to about 90%, about 80% to about 95%, about 90% to about 100%, and about 80% to about 110%. By so configuring the internal volume of the forming box, the package once resided in the forming box can be pressurized by the application of the folding plate 130 compressing the package. Because the forming box 112 is sized to tightly retain the package, the forming box 112 reduces or prevents deformation of the flexible film beyond the predetermined internal package volume, thereby allowing the internal pressure within the package to act against the force of the flap folding plate, which can aid in achieving the cuboid shape of the package. As discussed in detail below, the package can be configured to a have predetermined internal package volume during sealing of the package on the packaging machine. The internal package volume can be adjusted by the amount of product and/or the amount of gas allowed in or removed from the package just prior to sealing. The forming box 112 is also sized to account for the presence of quad seals on one or more panels of the package, as the presence of the quad seal can affect the width the forming box needed so not to deform or damage the one or more quad seals. Referring to FIG. 17, the forming box 112 is also configured such that at least a portion of the panel of the package 200 having the trailing seal 210 will be disposed above the top edge of the walls of the forming box such that the trailing seal can be engaged by the folding plate or flap. In some embodiments, the forming boxes 112 can include a volume adjuster that allows the internal volume of the box 112 to be adjusted during processing to accommodate packages that may be over or under filled with gas during the package sealing steps performed upstream of the interface 102.

Alternatively or additionally, the packaging machine 104 can be adapted to include a volume-adjusting box that includes an actuating plate that squeezes the package to adjust the volume to the desired value just prior to sealing the package. The interface can be provided with the volume-adjusting box as a separate unit to be installed on the packaging machine. Providing the package with a sufficient internal volume (resulting from the presence of product and entrapped air or gas) within the package, as well as providing properly sized forming boxes aids in achieving well defined folds and creases in the package during processing on the interface, which in turn can allow for improved cuboid shaping and retention of the cuboid shape. Various conditions can be adjusted to control the internal package volume to achieve a targeted (predetermined) internal package volume. For example, the volume-adjusting box can be used to remove gas from the package by slightly squeezing the package. This can be done with or without a gas flushing operation that adds gas to the package to further expand the package after filling with product. Gas flushing operations are known in the art and any known rates of fill, times of fill, and types of gasses can be used depending on the product contained therein. The speed of the seal jaws of the packaging machine can also be used to control the internal package volume. Actuation of the seal jaw more quickly can result in more gas being trapped within the package, while actuation of the seal jaw more slowly allows for the package to equilibrate and have less trapped gas.

The forming box 112 can also include gas channels and/or other heating and cooling elements to facilitate folding and/or shaping of the package while the package resides in the forming box. Heating of portions of the forming box 112 can aid in forming defined edges of the package, while cooling can aid in setting any folds or seals in the package.

Further discussion of the interface 102 will be made to an apparatus having four forming boxes 112 as illustrated in the figures. However, it is contemplated that additional or fewer forming boxes can be utilized. The number of forming boxes 112 included in the interface 102 can be determined based on a number of factors, including, but not limited to, the type and/or thickness of film used and ease of heat sealing and creasing, the desired speed of packages to be produced in a unit of time, the size of the interface and corresponding size of the packaging machine to which the interface is to be adapted, as well as the size of the forming boxes (which in turn relates to the size of the packages) and the number of secondary operations (such as heat setting edges) that are to be performed. For example, the interface can include 2, 3, 4, 5, 6, 7, 8, 9, or 10 forming boxes.

Figure 23B:
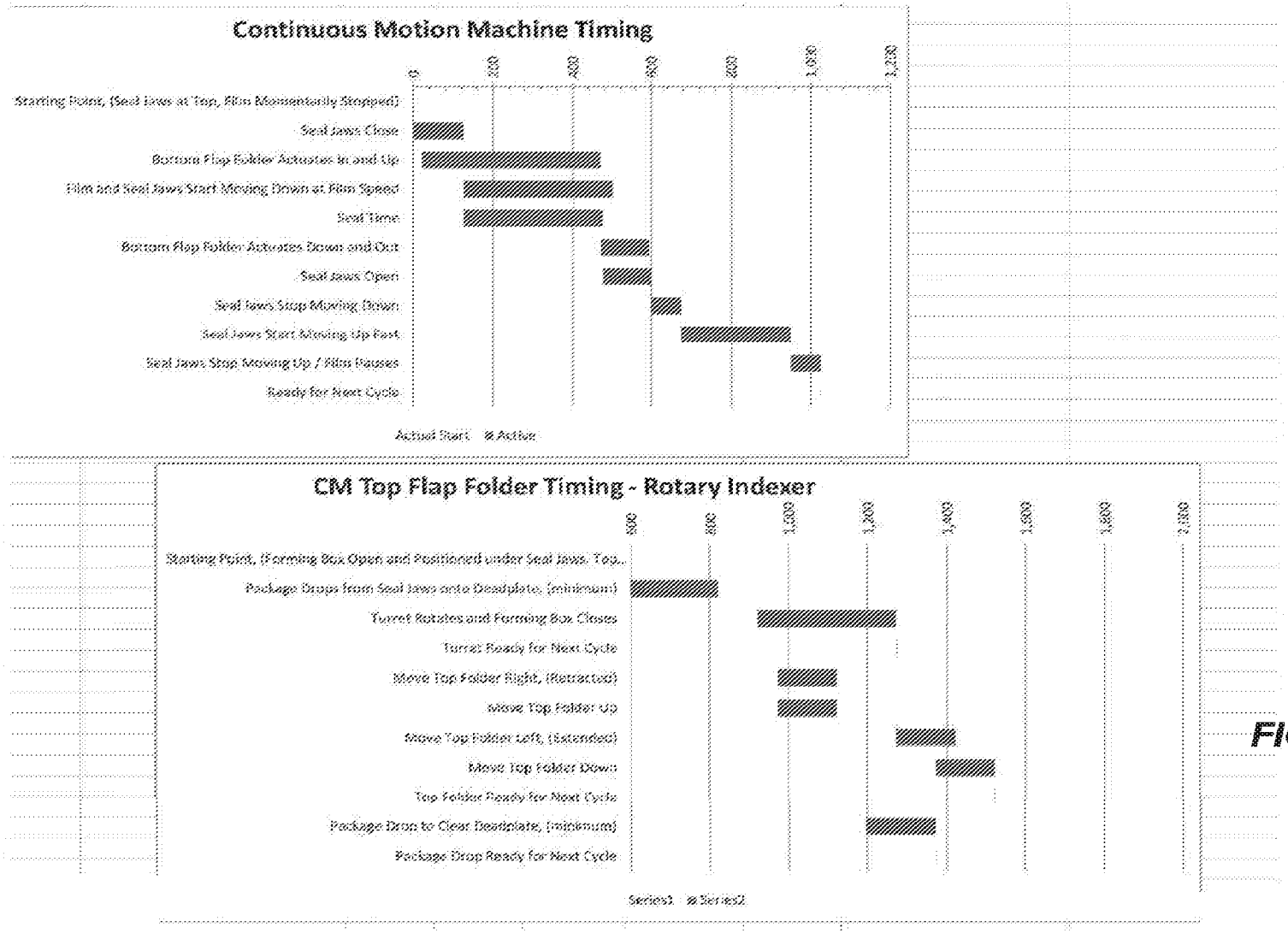
FIG. 23B is a graphical representation of the chart of FIG. 23A.

For ease of reference, the operation of the interface 106 will be described with reference to the progression of a single forming box. FIGS. 23A and 23B illustrate a timing chart for forming a package in accordance with an embodiment of the disclosure using the interfaces. As one forming box leaves a station, the next forming box enters that station. For example, as a forming box at the first station 122 leaves the first station, the forming box disposed at the fourth station 128 rotates to enter the first station. In various embodiments, the forming boxes can move continuously through the stations. The forming boxes can be arranged a fixed distance between each forming box or can be disposed at variable distances. For example, the rotary unit can be provided in a race-track configuration as opposed to the rotating disc as shown in the figures. In such embodiments, motor driven chain drive or other actuating devices can be used to transport the forming boxes between the stations. Linear motor technology can allow for independent control of the distance between forming boxes and the timing of the forming boxes at a given station.

In the embodiment shown and described in detail below, the interface includes four stations and four forming boxes, with the forming boxes rotating in a clockwise direction. Counter-clockwise rotation is also contemplated herein. Further, as noted above, fewer or more forming boxes are also within the contemplation of the disclosure. Fewer or more stations are also contemplated herein. The rotary motion of the interface and processing of the package in multiple stations using multiple forming boxes allows for the interface to perform the cubing function with sufficient timing to define the edges of the package and, in particular, in part substantially flat panels to the sides of the package having the leading and trailing seals, while keeping up with the rate of the continuous motion packaging machine.

The interface can be rotated at various speeds and configurations. For example, the interface can run in an intermittent mode where the rotation is stopped for a duration of time before rotating the forming boxes to the next station. Stopping of the rotation can aid in transferring the package from the packaging machine to the forming box at the first station of the interface. This can be particularly useful when the package is transferred to the forming box at the first station by gravity after the seal of the package is cut from the continuous tube of flexible film in the packaging machine. In other embodiments, the rotary unit 106 can be rotated continuously through the stations. The rotary unit 106 can be rotated at a continuous speed or a variable speed. For example, in an embodiment utilizing variable speed, the rotary unit 106 can slow as a forming box is approaching and or at the first station to receive a package and then speed up in the distance between stations. Any suitable rotating speed configuration can be used.

In operation, a package is transferred from the packaging machine to the interface such that the panel of the package 200 having the trailing seal 210 is disposed near the top of the forming box 112 with the trailing seal 210 extending above the top edge of the forming box 112. On the packaging machine, the package is oriented such that the leading and trailing seals extend outwardly from a panel of the package in a direction that is parallel to the transport direction of the film. The packaging machine can include a flap folding apparatus for folding a leading seal of the package over such that it is disposed substantially in the plane of the panel of the package and, in some embodiments, attached to the respective panel of the package. The trailing seal 210 of the package 200, however, may remain substantially extended in an upright position after processing in the packaging machine.

Referring again to FIG. 14, the package can then be transferred to the first station 122 of the interface into a forming box 112 disposed in the first station 122. In an embodiment, the packaging machine can form a combination leading and trailing seal in which a trailing seal of first package is formed in combination with the leading seal of the upstream package. At substantially the same time, the leading seal of the first package can be folded over by a flap folding bar that actuates across the package to engage the seal and fold it over to towards the panel of the package from which it extends. The combination leading and trailing seal can then be cut, which results in dropping of the package to the interface. In some embodiments, the packaging machine can be modified to include a flap folding bar that can be raised in a coordinated manner with the operation of the seal jaws.

Guide boxes or other guiding devices may be included on the interface and/or the packaging machine above the forming box at the first station 122 to facilitate transfer of the package in the proper orientation into the forming box 112. Referring to FIG. 17, in the proper orientation, the package will reside with the folded leading seal disposed against a bottom wall of the forming box 112, if present, or on a dead plate and the trailing seal will be disposed in an upright position extending at least slightly above the top edge of the walls of the forming box 112.

At the first station 122, the forming box 112 can be disposed in the package receiving position to receive the package. As shown in FIG. 14, the package receiving position can be a separation of first and second portions 116, 118 of the forming box as described in detail above. Once the package is received, the forming box 112 can be rotated to the second station. As described above, the rotary unit can rotate the forming boxes continuously with continuous or variable speed, or intermittently where the forming boxes stop for a preset delay.

Figure 18A:
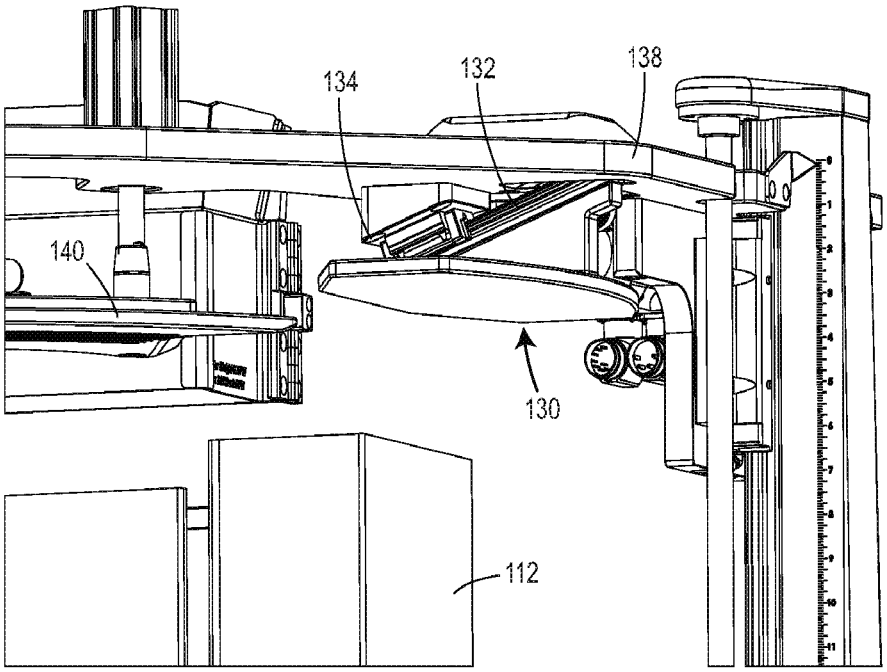
FIG. 18A is a close-up view of the flap folding plate at the second station of an interface in accordance with an embodiment of the disclosure, showing the flap folding plate in the first (up) position.
Figure 18B:
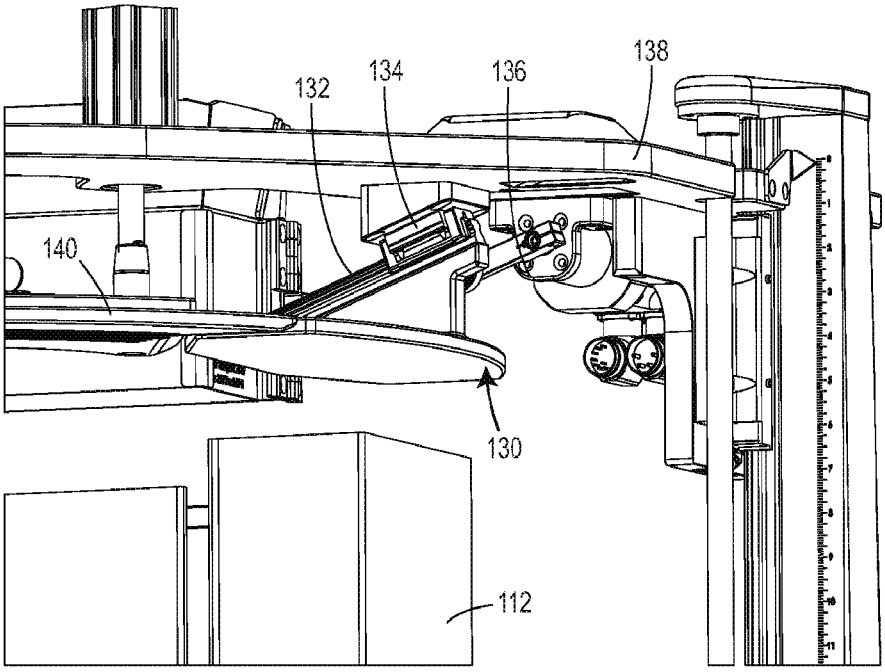
FIG. 18B is a close-up view of the flap folding plate of FIG. 18A, showing the flap folding plate in the second (down) position.

Referring to FIGS. 18A and 18B, the forming box is rotated to the second station 124, the package is engaged by a flap folding plate 130. The flap folding plate 130 actuates from a first (up) position (shown in FIG. 18A) downward towards and across the package to a second (down) position (shown in FIG. 18B) in which it engages and folds the trailing seal 210 over towards the panel of the package from which it extends and applies a force to the panel of the package to flatten the panel of the package. In other embodiments, the flap folding plate 130 can actuate linearly perpendicular to the top of the forming box between the first and second positions. Various types of movement of the flap folding plate 130 can be accomplished in any embodiment of the disclosure. For example, the flap folding plate 130 can be actuated in an angled linear motion as shown in the FIGS. 18A and 18B. The flap folding plate 130 can be coupled to an actuator or motor that allows for independent control of the flap folding plate 130 position in each of the two axis of movement. Other embodiments, include the flap folding plate 130 may be actuated along two axes by a pre-configured cam path or using a programmable path on independent axes.

The force applied by the flap folding plate 130 also translates to an applied force against the panel of the package having the leading seal, forcing the panel against the bottom wall of the forming box 112, if present, or dead plate 110, which can aid in further defining a flat, cube-like shape to that panel of the package, as well. FIG. 18B illustrates a gap between the top of the folding box 112 and the flap folding plate 130 when the flap folding plate is in the second, downward, position. The size of the gap can be varied depending on the package size and the internal volume of the package that is present to act against the force of the flap folding plate and aid in forming the side into a flat or flatter shape. In some embodiments, the flap folding plate 130 can be disposed just above the top of the forming box 112 when it is in the second, downward, position. The flap folding plate 130 can be configured to begin actuating when the forming box 112 is at a pre-set distance from the first station 124, but prior to the forming box 112 reaching the second station 126. For example, the flap folding plate 130 can begin to actuate when the forming box is 0° to 30° prior to the second station 124. For example, the flap folding plate 130 can actuate when the forming box has positioned the package a sufficient distance towards the second station to allow the flap folding plate 130 to engage substantially all of the trailing seal substantially perpendicularly to the trailing seal.

In various embodiments, the flap folding plate 130 has actuated to the second (down) position in which it is disposed over the forming box and applies a pressure to the package to hold the trailing seal in the folded over position by the time the forming box reaches the second station. In other embodiments, for example, in an intermittent motion configuration, the flap folding plate 130 can actuate while the forming box 112 is stopped at the second station.

As noted above, the forming box is sized such that the internal volume with the flap folding bar 130 in the down position allows for the internal package to be slightly pressurized. This internal pressure presses against the film, opposing the force of the flap folding bar 130, which aids in defining the package to have the cuboid shape. Without sufficient internal pressure or a properly sized forming box, packages having less defined and sharp edges may be produced. The size of the forming box 112 can affect how the internal pressure against the force of the flap folding plate 130. For example, if the package has sufficient internal pressure, but is not held tightly in the forming box, the force of the flap folding plate 130 may cause the faces of the package to deform outwardly until they contact the walls of the forming box, thereby compressing the side panels having the leading and trailing seals towards each other rather than flattening against a resistant internal pressure. Similarly, if the forming box is properly size for a given predicted internal final package volume, but the package is under pressurized during sealing, there will be insufficient force to oppose the force of the flap folding plate to maintain and define the package shape. As with an improperly size forming box 112, the under pressurized package may result in deformation of the package within the forming box, leading to a less defined cuboid shape, for example, a trapezoidal shape.

Figure 19A:
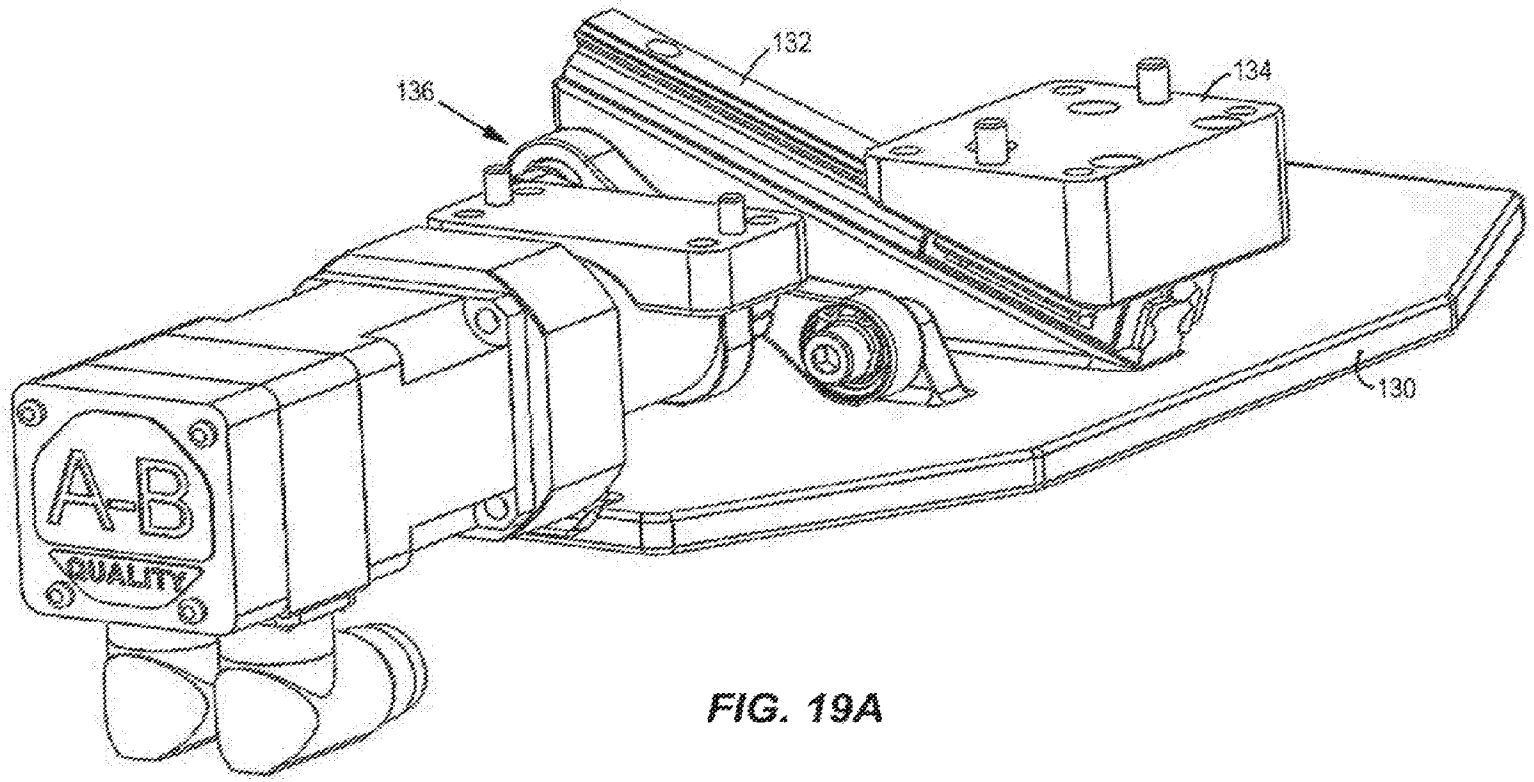
FIG. 19A is an isolated view of the flap folding plate in the first (up) position.
Figure 19B:
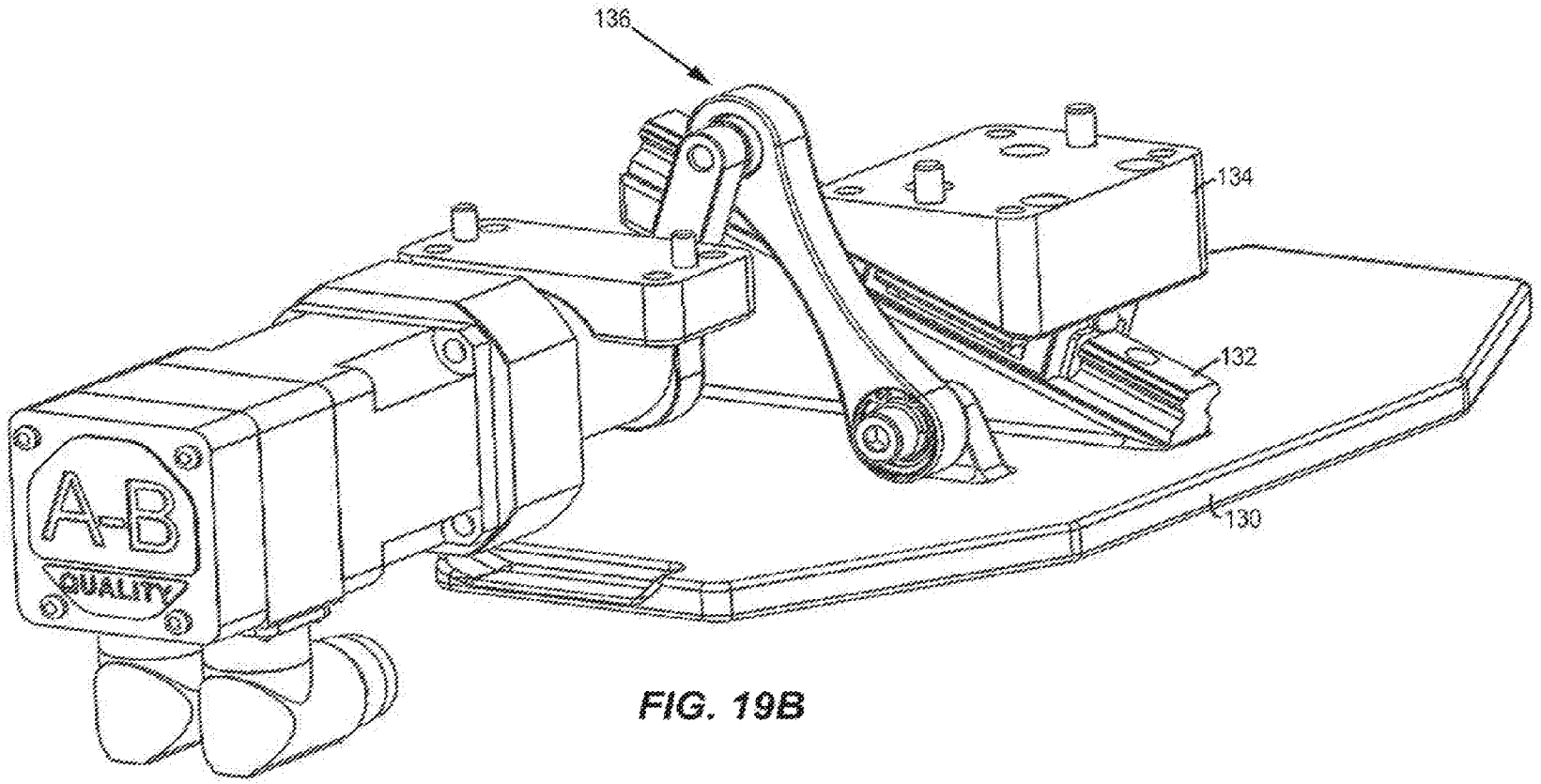
FIG. 19B is an isolated view of the flap folding plate in an intermediate position.
Figure 19C:
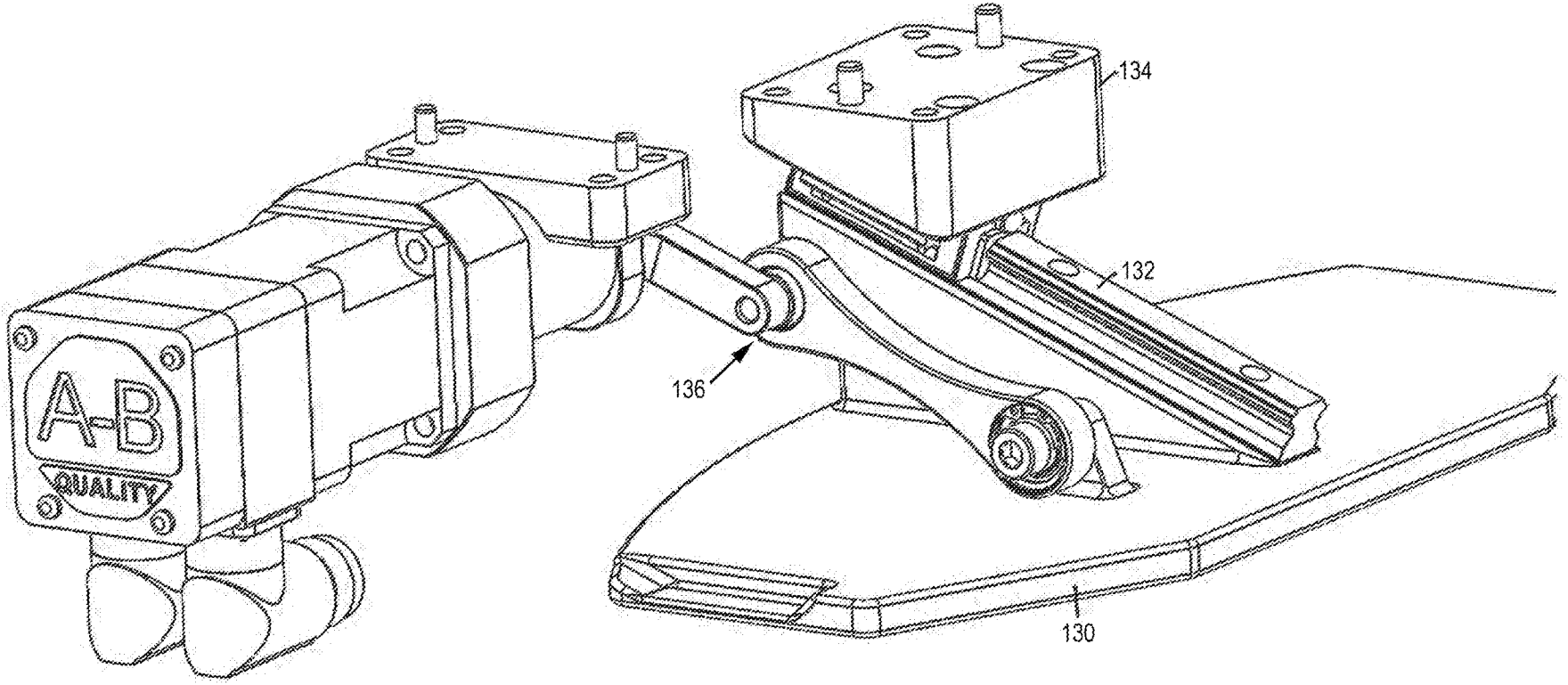
FIG. 19C is an isolated view of the flap folding plate in the second (down) position.

The flap folding plate 130 can actuate using any known actuator or combinations of actuators. Further, as noted above, while the figures illustrate motion of the flap folding bar 130 in an angled linear motion, non-linear motion in two axes or single axis motion are contemplated herein. Referring to FIGS. 19A-19C, in one embodiment, the flap folding plate 130 can include a rail 132 disposed on the plate 130 and can be connected to an actuating arm 136, which in turn can be actuated by any suitable means such as motor or servo. A carriage assembly 134 or other rail connecting device can engage the rail 132. Referring again to FIGS. 18A and 18B, the carriage assembly or rail connecting device can be attached to the interface, for example, at a bracket 138, to retain the flap folding plate 130 in the proper position above the second station 124. FIG. 19A shows the flap folding plate 130 in the first position in which it is disposed up and away from the forming box. FIG. 19B shows the flap folding plate 130 in an intermediate position. FIG. 19C shows the flap folding plate 130 in the second position in which it is positioned downward towards the forming box and engaging the package. The rail 132 can be angled such that the flap folding bar 130 is actuated both down and across the panel of the package exposed above the forming box 112. For example, the rail can be angled about 15° to about 70°, about 20° to about 30°, about 20° to about 45°, or about 15° to about 30°, and other suitable ranges therein. In other embodiments, the flap folding plate 130 can have a two-axis motion that is not constrained by a rail or guide angle as the embodiment shown in FIGS. 18A and 18B. Various known two-axis actuators can be used giving free motion in both axes. In various embodiments, two-axis motion can be defined by a cam track that guides a cam follower and along with it the flap folding bar in a desired motion. Other embodiment can include systems for providing a programmable motion profile.

Figure 21:
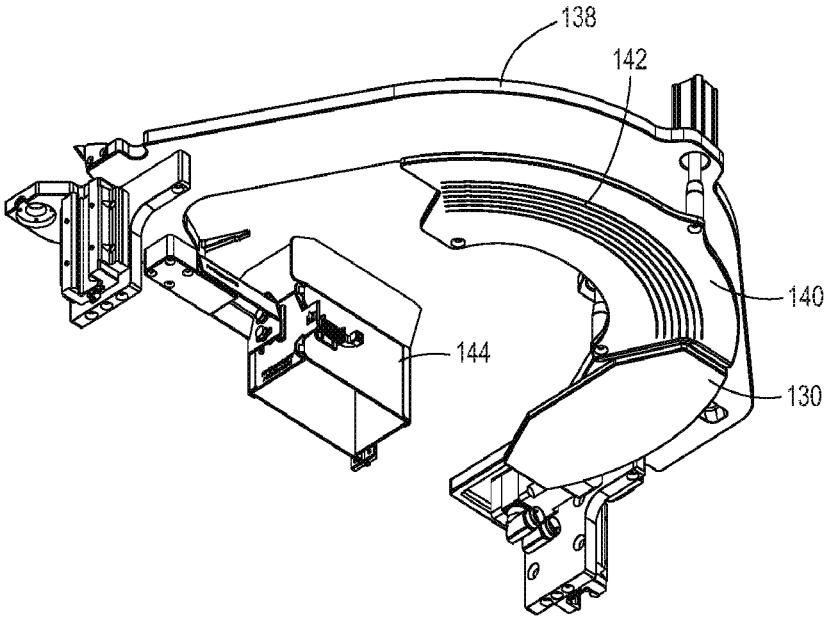
FIG. 21 is a bottom perspective view of a bracket of the interface in accordance with an embodiment of the disclosure.

The flap folding plate 130 can have any size or shape. In various embodiments, the flap folding plate is sized such that when actuated to the second (down) position, the plate covers the entire width of the forming box 112. Where the interface is contemplated for use with different sized forming boxes, the flap folding plate can be sized to have a width that is at least as wide as the widest forming box to be used. The flap folding plate 130 can have a length such that it is capable of engaging all or at least a portion of the package prior to the forming box being positioned in the second station 124. Additionally or alternatively, the flap folding plate 130 can have a length such that it is also capable of remaining in contact with the package when the forming box 112 leaves the second station. As illustrated in FIG. 21 and discussed in detail below, the flap folding plate 130 can be sized so that it resides in the path between the second and third stations and is next to and optionally in contact with the holding plate 140 when in the second down position.

Figure 20:
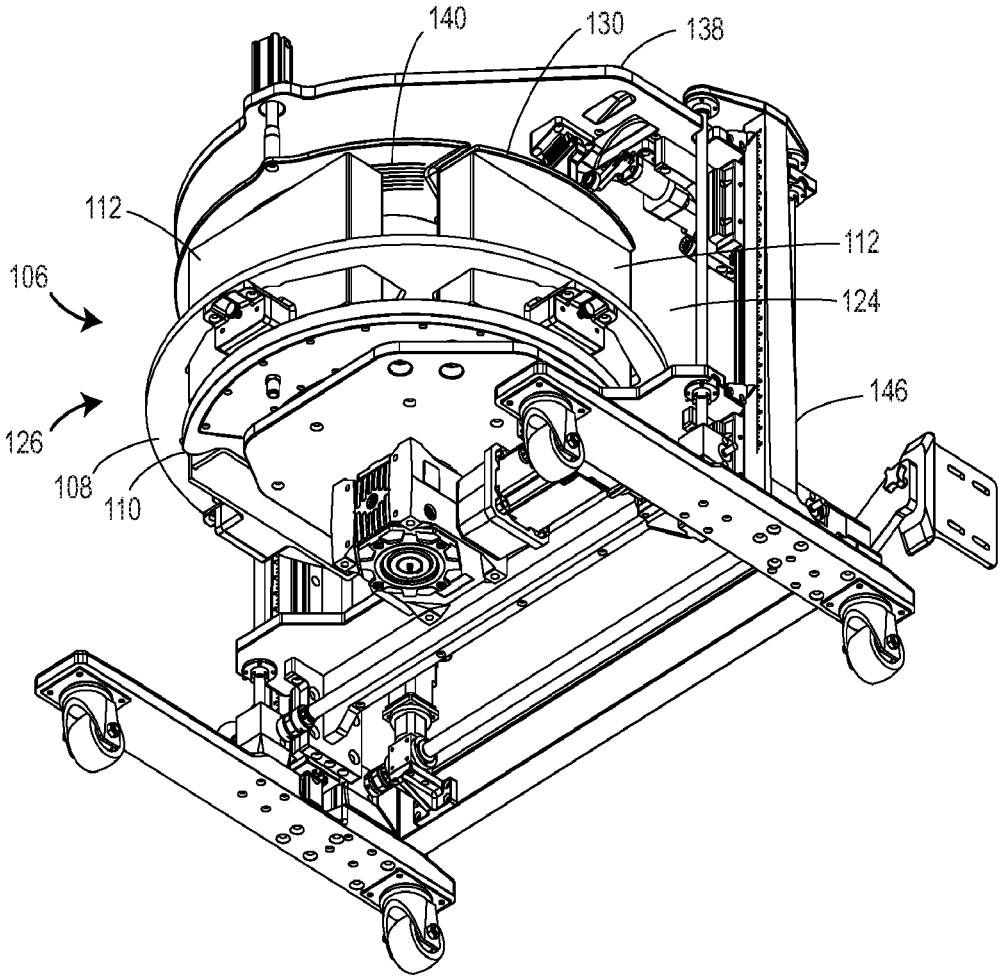
FIG. 20 is a bottom perspective view of an interface in accordance with an embodiment of the disclosure.

Referring to FIG. 20, the forming box can optionally transition to a third station 126 that includes a holding plate 140 for providing additional dwell time to the folded trailing seal. Alternatively, the forming box can be transitioned to a final station (shown in the figures as a fourth station 128) for release of the package to a take-away device. As the forming box transitions from the second station 124 to the third station 126 or final station 128 where no third station 126 is present, the flap folding plate 130 moves back to the first position to reset for receipt of the next forming box into the second station 124. After transition out of the second station 124, the package at the trailing seal and associated panel engages with a holding plate 140 disposed above the third station. Referring to FIG. 20, the holding plate 140 can be configured to extend up to the end of the second station 124, such that there is substantially no gap between the flap folding plate 130 (when in the second position) and the holding plate 140. For example, the holding plate can extend such that at least a portion of the holding plate covers substantially all of the top of the forming box when the forming box is 0° to about 70° after the end of the second station 124 or any point therebetween.

FIG. 21 is an isolated view of the flap folding plate 130 and holding plate 140 in accordance with an embodiment of the disclosure. The flap folding plate 130 and the holding plate 140 can be attached to a bracket 138. The flap folding plate 130 and holding plate 140 can be configured so they are directly adjacent each other and there is substantially no gap between the end of the flap folding plate 130 and the end of the holding plate 140. The transition from the flap folding plate 130 to the holding plate 140 can be disposed at the edge of the forming box located in the second station 124 or at a distance past the second station 124, between the second and third stations, 124, 126. The holding plate 140 can be in a stationary position at a height for engaging the package in the forming box as it rotates from the flap folding plate 130 to the holding plate 140. In other embodiments, the holding plate 140 can actuate in a linear (up and down) position to engage the package as it rotates to a predetermined position. For example, the holding plate 140 can actuate from a first (up) position to a second (down) position when the forming box is 0° to 70° past the end of the second station 124 and then actuate from the second (down) position to the first (up) position when the forming box is 0° to 70° past the end of the third station.

In various embodiments, the transition between the folding plate 130 and the holding plate 140 occurs at the edge of the forming box at the second station 124 so that the package transfers quickly to the stationary 140 and the flap folding plate 130 can be withdrawn to the first position as the forming box transitions out of the second station to reset for the next forming box. The holding plate 140 can also be disposed such that it is in line with the flap folding bar 130 when it is disposed in the second (downward) position and engaging the package. So configured, once the forming box begins to transition out of the second station, the package immediately or substantially immediately engages the holding plate 140. For example, in one embodiment, the package can be engaged with the flap folding plate 130 and the holding plate 140 at the same time. Thus, pressure is maintained on the trailing seal 210 and associated panel of the package through the entire transition between the second and third stations, despite release of the flap folding plate 130 when the package is disposed out of the second station 124. The holding plate 140 can also extend past the third station 126 through the transition between the third and fourth stations 126, 128 or even above the fourth station as well. In other embodiments, the holding plate 140 terminates at the third station or at a transition point between the third and fourth stations.

The holding plate 140 applies continued dwell pressure to the panel of the package and the folded trailing seal. This added dwell time can allow for the additional time needed for attaching the trailing seal to the panel of the package or imparting a strong fold in the trailing seal so that it resides in the substantially the same plane as the panel of the package and does not unfold during use. When it is desired to attach the trailing seal to the panel of the package, any number of processes can be used including heat sealing and/or the application of an adhesive. Advantageously, the interface with the added dwell time provided by the holding plate 140 can allow for attachment of the trailing seal using the residual heat remaining in the trailing seal during the seal forming process to heat seal the trailing seal to the film at the panel of the package.

Figure 22:
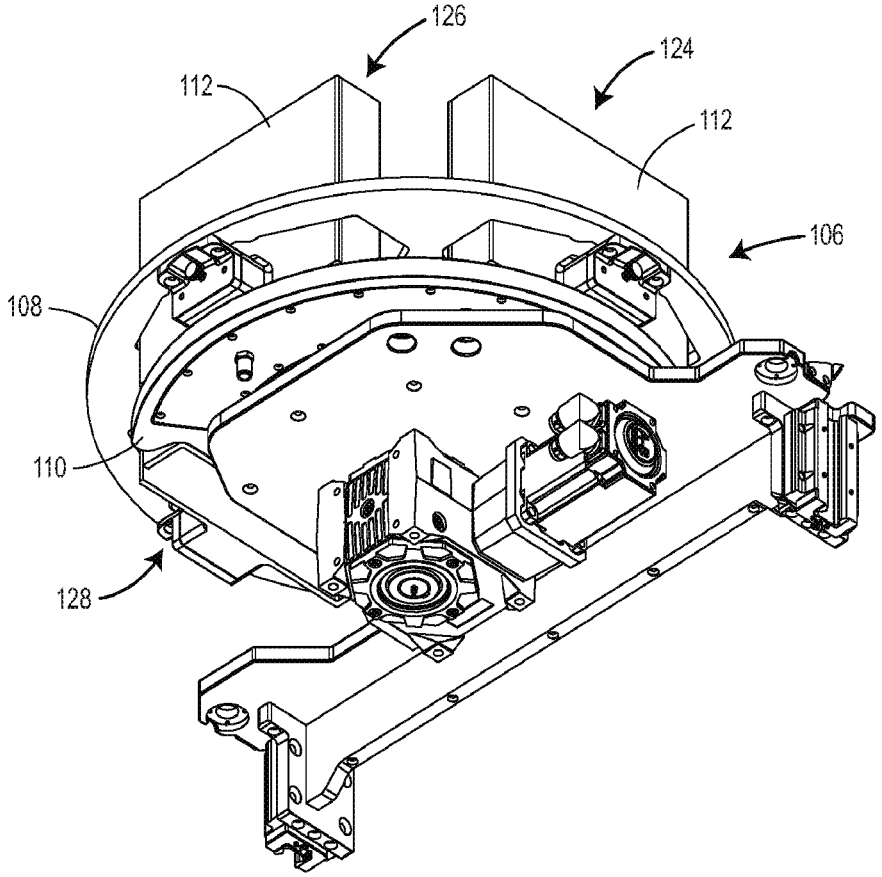
FIG. 22 is a bottom perspective view of the rotary plate, dead plate, and forming boxes of an interface in accordance with an embodiment of the disclosure.

Referring to FIG. 22, the forming box 112 then transitions to the final (fourth) station 128 where the package is released from the forming box 112. While reference is made herein to a fourth station, it should be understood that the number of the stations will change depending on the number of stations included in the interface. At a minimum the interface will include a package receiving station (first station 122 of the Figures), a flap folding station (second station 124 of the figures) and a final package release station (fourth station 126 of the figures). The interface can optionally include a dwell time station where a holding plate 140 applies pressure to the trailing seal after flap folding as added dwell time. Additional stations, such as edge heating stations, can also be included in the interface as desired.

Referring to FIGS. 14 and 15, at the fourth station 128, the forming box can open slightly to release the package. Referring again to FIG. 22, in various embodiments, the forming box does not include a bottom wall and instead is positioned adjacent to a dead plate 110. The dead plate can be sized and shaped to be disposed in the first, second, and third stations, but not in the fourth station. Thus, when the forming box with the package reaches the fourth station, the package drops through the opening in the bottom of the forming box onto a take away system, such as a conveyor. FIG. 16 illustrates the dead plate 110 in isolation showing an embodiment in which the dead plate is shaped as a truncated disc. The truncation of the disc corresponds to the location of the fourth station 128, which allows the package to fall through the forming box 112 past the dead plate 110 and onto a take away system, such as a conveyor. Other configurations of the dead plate can be used. For example, the dead plate can be a complete disc having an aperture disposed in the location of the fourth station that is sized to allow the package to fall through the aperture to the take away system. FIG. 12 illustrates an embodiment in which the package is released from the fourth station 128 onto a conveyor.

In other embodiments, the forming box can include a bottom wall that actuates out of position to provide an opening in the bottom of the forming box through which the package can drop. In yet further embodiments, the forming box can actuate to an opening position in which the package can be ejected from a side of the forming box as opposed to through the bottom.

Referring to FIGS. 16 and 21, the dead plate 110 and/or the holding plate 140 can include one or more groves 142 housing outlets of gas or air passageways to allow for heated and/or cooled air to be directed onto the package. While reference herein is made to air outlets and passages, it should be understood that other gasses can be suitably used and flowed through these structures as an alternative to air. For example, in an embodiment, the dead plate can direct heated air or other gas toward the panel of the package having the leading seal (residing at the bottom of the forming box) to aid in further defining the shape of the package at that end while it is constrained in the forming box. For example, the heated air can be directed to the package for a first portion of the rotary cycle. The first portion can be, for example, through the first and second stations. The dead plate can then be configured to direct cooled air to set the panel of the package at the bottom of the forming box through a second portion of the rotary cycle, for example, through the transition of the forming box from the second to the fourth stations.

In an embodiment, the holding plate 140 can include grooves 142 and air passages to direct cooled or heated air to the trailing seal panel of the package. For example, in an embodiment, the holding plate 140 can direct heated air to the panel of the package with the trailing seal when the package initially transitions from the second station to the third station and then direct cooled air to the panel of the package when it is in the third station and through transition to the end of the holding plate 140. Any timing or configuration of cooled or heated air can be used in either the dead plate or the holding plate 140. It is also contemplated herein that no heating or cooling using air directed to the package is used.

Referring to FIG. 21, in an embodiment, the interface can include an upper bracket 138 that may include a transition guide box 144 that guides the package from the packaging machine into the forming box at the first station. As described above, the holding plate 140 and the flap folding plate 130 can be attached to the bracket 138. Referring to FIG. 20, the bracket 138 can be attached to a frame 146 of the interface. The frame can house the rotary unit 106 having rotating plate 108, the forming boxes 112, the dead plate 110, and various actuating mechanisms needed for rotation of the forming boxes 112 and/or the rotary plate 108. The bracket 138 can be adjustable on the frame 146 such that the position of the holding plate 140 and the flap folding plate 130 can be adjusted relative to the top of the forming boxes to accommodate changes in package and/or forming box size. The frame 146 can also be adjustable such that the entire height of the interface can be adjusted to accommodate packaging machines having different heights. Adjustment of the frame and/or bracket on the frame can be accomplished manually. Alternatively actuators can be provided to aid in adjustment of either or both of the frame and/or the bracket.

While various embodiments have been described above, the disclosure is not intended to be limited thereto. Variations can be made to the disclosed embodiments that are still within the scope of the appended aspects.

ASPECTS OF THE DISCLOSURE

Aspect 1. A method of forming a plurality of packages using an apparatus that includes a retaining structure and at least one forming box, each of the retaining structure and at least one forming box each extending along a transport axis from a first end to a second end, and each of the retaining structure and at least one forming box having two or more walls that cooperate to form a lateral enclosure, the method comprising:

(a) positioning a first package of the plurality of packages at least partially within the lateral enclosure of the retaining structure, the first package extending along a first package axis from a first end and a second end opposite to the first end, and wherein the second end of the first package is adjacent to the second end of the retaining structure, the first package having a bottom flap;

(b) displacing a first downstream folding bar in a direction normal to the transport axis from a first position in which a contact portion of the first downstream folding bar is a first transverse distance from the transport axis to a second position in which the contact surface of the first downstream folding bar is a second transverse distance from the transport axis and adjacent to the second end of the retaining structure, wherein the first transverse distance is greater than the second transverse distance, and wherein in the second position, the contact portion applies pressure to a bottom flap disposed at the second end of the first package;

(c) optionally displacing at least one of the two or more walls that cooperate to form the lateral enclosure of the retaining structure towards the transport axis such that the at least one of the two or more walls contacts a portion of the first package;

(d) displacing each of a first seal bar and a second seal bar towards the transport axis to seal a portion of the first end of the first package to form a top flap of the first package;

(e) displacing the first downstream folding bar in a direction normal to the transport axis from the second position to the first position;

(f) displacing at least one of the two or more walls that cooperate to form the lateral enclosure of the retaining structure away from the transport axis such that the at least one of the two or more walls disengages the portion of the first package;

(g) displacing each of the first seal bar and the second seal bar away from the transport axis after sealing the portion of the first end of the first package to form the top flap of the first package;

(h) displacing a second downstream folding bar in a direction normal to the transport axis from a first position in which a contact portion of the second downstream folding bar is a first transverse distance from the transport axis to a second position in which the contact surface of the second downstream folding bar is a second transverse distance from the transport axis and adjacent to the second end of the at least one forming box, wherein the first transverse distance is greater than the second transverse distance;

(i) positioning the first package at least partially within the lateral enclosure of the at least one forming box, wherein the second end of the first package is adjacent to the second end of the at least one forming box and the second end of the first package is in contact with the contact portion of the second downstream folding bar;

(j) displacing at least one of the two or more walls that cooperate to form the lateral enclosure of the at least one forming box towards the transport axis such that the at least one of the two or more walls contacts a portion of the first package;

(k) displacing a first upstream folding bar in a direction normal to the transport axis from a first position in which a contact portion of the first upstream folding bar is a first transverse distance from the transport axis to a second position in which the contact surface of the first upstream folding bar is a second transverse distance from the transport axis and adjacent to the first end of the at least one forming box, wherein the first transverse distance is greater than the second transverse distance, and wherein in the second position, the contact portion applies pressure to a top flap disposed at the first end of the first package;

(l) displacing at least one of the two or more walls that cooperate to form the lateral enclosure of the at least one forming box away from the transport axis such that the at least one of the two or more walls disengages the portion of the first package;

(m) displacing the second downstream folding bar in a direction normal to the transport axis from the second position to the first position; and (n) displacing the first upstream folding bar in a direction normal to the transport axis from the second position to the first position.

Aspect 2. The method of aspect 1, wherein (b) displacing the first downstream folding bar from the first position to the second position occurs at the same time as (c) displacing at least one of the two or more walls that cooperate to form the lateral enclosure of the retaining structure towards the transport axis.

Aspect 3. The method of aspect 1, wherein (b) displacing the first downstream folding bar from the first position to the second position occurs after (c) displacing at least one of the two or more walls that cooperate to form the lateral enclosure of the retaining structure towards the transport axis and/or before (d) displacing each of the first seal bar and the second seal towards the transport axis to seal a portion of the first end of the first package to form the top flap of the first package.

Aspect 4. The method of aspect 1, wherein (c) displacing the at least one of the two or more walls that cooperate to form the lateral enclosure of the retaining structure towards the transport axis occurs at the same time as (d) displacing each of the first seal bar and the second seal bar towards the transport axis.

Aspect 5. The method of aspect 1, wherein (c) displacing the at least one of the two or more walls that cooperate to form the lateral enclosure of the retaining structure towards the transport axis occurs before (d) displacing each of the first seal bar and the second seal bar towards the transport axis.

Aspect 6. The method of aspect 1, wherein (e) displacing the first downstream folding bar from the second position to the first position occurs after (c) displacing the at least one of the two or more walls that cooperate to form the lateral enclosure of the retaining structure towards the transport axis.

Aspect 7. The method of aspect 1, wherein (e) displacing the first downstream folding bar from the second position to the first position occurs at the same time as (c) displacing the at least one of the two or more walls that cooperate to form the lateral enclosure of the retaining structure towards the transport axis.

Aspect 8. The method of aspect 1, wherein the first package axis is parallel to or aligned with the transport axis.

Aspect 9. The method of aspect 1, wherein (e) displacing the first downstream folding bar from the second position to the first position occurs after (g) displacing each of the first seal bar and the second seal bar away from the transport axis after sealing the portion of the first end of the first package to form the top flap of the first package.

Aspect 10. The method of aspect 1, wherein (e) displacing the first downstream folding bar from the second position to the first position occurs while (g) displacing each of the first seal bar and the second seal bar away from the transport axis after sealing the portion of the first end of the first package to form the top flap of the first package.

Aspect 11. The method of aspect 1, wherein (h) displacing the second downstream folding bar from the first position to the second position occurs before (e) displacing the first downstream folding bar from the second position to the first position.

Aspect 12. The method of aspect 1, wherein (h) displacing the second downstream folding bar from the first position to the second position occurs while (e) displacing the first downstream folding bar from the second position to the first position.

Aspect 13. The method of aspect 1, wherein (h) displacing the second downstream folding bar from the first position to the second position occurs before (i) positioning the first package at least partially within the lateral enclosure of the at least one forming box, wherein the second end of the first package is adjacent to or above the second end of the at least one forming box.

Aspect 14. The method of aspect 1, wherein (h) displacing the second downstream folding bar from the first position to the second position occurs while (i) positioning the first package at least partially within the lateral enclosure of the at least one forming box, wherein the second end of the first package is adjacent to or above the second end of the at least one forming box.

Aspect 15. The method of aspect 1, wherein (j) displacing the first upstream folding bar from the first position to the second position occurs after (i) positioning the first package at least partially within the lateral enclosure of the at least one forming box, wherein the second end of the first package is adjacent to or above the second end of the at least one forming box.

Aspect 16. The method of aspect 1, wherein (a) positioning a first package at least partially within the lateral enclosure of the retaining structure occurs after (b) displacing the first downstream folding bar from the first position to the second position.

Aspect 17. The method of aspect 1, wherein (a) positioning a first package at least partially within the lateral enclosure of the retaining structure occurs while (b) displacing the first downstream folding bar from the first position to the second position.

Aspect 18. The method of aspect 1, wherein (k) displacing the first upstream folding bar from the first position to the second position occurs while (j) displacing at least one of the two or more walls that cooperate to form the lateral enclosure of the at least one forming box towards the transport axis.

Aspect 19. The method of aspect 1, wherein (k) displacing the first upstream folding bar from the first position to the second position occurs after (j) displacing at least one of the two or more walls that cooperate to form the lateral enclosure of the at least one forming box towards the transport axis.

Aspect 20. The method of aspect 1, wherein (l) displacing at least one of the two or more walls that cooperate to form the lateral enclosure of the at least one forming box away from the transport axis occurs at the same time as (m) displacing the second downstream folding bar from the second position to the first position.

Aspect 21. The method of aspect 1, wherein (l) displacing at least one of the two or more walls that cooperate to form the lateral enclosure of the at least one forming box away from the transport axis occurs after (m) displacing the second downstream folding bar from the second position to the first position.

Aspect 22. The method of aspect 1, wherein (n) displacing the first upstream folding bar in a direction normal to the transport axis from the second position to the first position occurs after (m) displacing the second downstream folding bar from the second position to the first position.

Aspect 23. The method of aspect 1, wherein (n) displacing the first upstream folding bar in a direction normal to the transport axis from the second position to the first position occurs after (1) displacing at least one of the two or more walls that cooperate to form the lateral enclosure of the at least one forming box away from the transport axis.

Aspect 24. The method of aspect 1, wherein (n) displacing the first upstream folding bar in a direction normal to the transport axis from the second position to the first position occurs while (1) displacing at least one of the two or more walls that cooperate to form the lateral enclosure of the at least one forming box away from the transport axis.

Aspect 25. The method of aspect 1, further comprising:

(o) positioning a second package of the plurality of packages at least partially within the lateral enclosure of the retaining structure, the second package extending along a second package axis from a first end to a second end opposite to the first end, and wherein the second end of the second package is adjacent to the second end of the retaining structure.

Aspect 26. The method of aspect 25, wherein (o) positioning a second package at least partially within the lateral enclosure of the retaining structure occurs before (m) displacing the second downstream folding bar in a direction normal to the transport axis from the second position to the first position.

Aspect 27. The method of aspect 25, further comprising:

(p) displacing the first downstream folding bar in a direction normal to the transport axis from the first position in which the contact portion of the first downstream folding bar is remote from the second end of the retaining structure to the second position in which the contact surface of the first downstream folding bar is adjacent to the second end of the retaining structure, wherein in the second position, the contact portion applies pressure to a bottom flap disposed at the second end of the second package.

Aspect 28. The method of aspect 25, wherein (p) displacing the first downstream folding bar from the first position to the second position occurs before (m) displacing the second downstream folding bar in a direction normal to the transport axis from the second position to the first position.

Aspect 29. The method of aspect 27, further comprising:

(q) displacing at least one of the two or more walls that cooperate to form the lateral enclosure of the retaining structure towards the transport axis such that the at least one of the two or more walls contacts a portion of the second package.

Aspect 30. The method of aspect 25, wherein (q) displacing at least one of the two or more walls that cooperate to form the lateral enclosure of the retaining structure towards the transport axis occurs before (m) displacing the second downstream folding bar in a direction normal to the transport axis from the second position to the first position.

Aspect 31. An apparatus for forming a flexible package, comprising:

a retaining structure that extends along a transport axis from a first end to a second end opposite the first end, wherein the retaining structure comprises two or more walls that cooperate to form a lateral enclosure, wherein each of the two or more walls extend from the first end to the second end of the retaining structure, wherein at least a first one of the two or more walls displaces relative to a second one of the two or more walls, and wherein the flexible package is adapted to be disposed at least partially within the lateral enclosure;

an elongated first downstream folding bar disposed downstream of the retaining structure, wherein the first downstream folding bar includes a contact portion and is displaceable between a first position in which the contact portion is a first transverse distance from the transport axis to a second position in which the contact surface of the first downstream folding bar is a second transverse distance from the transport axis and adjacent to the second end of the retaining structure, wherein the first transverse distance is greater than the second transverse distance, and wherein in the second position, the contact portion is adapted to apply pressure to a bottom flap disposed at the second end of the flexible package;

a forming box longitudinally-offset from the retaining structure and downstream of both the retaining structure and the first downstream folding bar, the forming box extending along the transport axis from a first end to a second end opposite the first end, wherein the forming box comprises two or more walls that cooperate to form a lateral enclosure, and wherein when the first downstream folding bar is in the first position, the contact portion of the first downstream folding bar is disposed between the second end of the retaining structure and the first end of the folding box, and wherein the flexible package is adapted to be disposed at least partially within the lateral enclosure;

a first upstream folding bar disposed upstream of the forming box and adjacent the first end of the forming box, wherein the first upstream folding bar has a contact portion and is displaceable between a first position in which the contact portion is a first transverse distance from the transport axis to a second position in which the contact surface of the first upstream folding bar is a second transverse distance from the transport axis and adjacent to the first end of the forming box, wherein the first transverse distance is greater than the second transverse distance, and wherein in the second position, the contact portion is adapted to apply pressure to a top flap disposed at the first end of the flexible package; and a second downstream folding bar disposed downstream of the forming box and adjacent the second end of the forming box, wherein the second downstream folding bar includes a contact portion and is displaceable between a first position in which a contact portion of the second downstream folding bar is a first transverse distance from the transport axis to a second position in which the contact surface of the second downstream folding bar is a second transverse distance from the transport axis and adjacent to the second end of the second forming box, wherein the first transverse distance is greater than the second transverse distance, and wherein in the second position, the contact portion is adapted to apply pressure to the bottom flap disposed at the first end of the flexible package.

Aspect 32. The apparatus of aspect 31, wherein each of the two or more walls of the retaining structure and the forming box extends from the first end to the second end of the retaining structure and the forming box.

Aspect 33. The apparatus of aspect 31, wherein the two or more walls of one or both of the retaining structure and the forming box includes first, second, third, and fourth walls.

Aspect 34. The apparatus of aspect 31, further comprising one or more retaining structure actuators operatively coupled to the retaining structure to actuate the retaining structure between a first position for receiving a package, a second position for retaining a package, and a third position for releasing the package; and one or more forming box actuators operatively coupled to the forming box to actuate the forming box between a first position for receiving a package, a second position for retaining a package, and a third position for releasing the package.

Aspect 35. The apparatus of aspect 31, further comprising one or more first downstream folding bar actuators operatively coupled to the first downstream folding bar to actuate the first downstream folding bar in a direction substantially transverse to a transport path of a flexible material between the first position and the second position.

Aspect 36. The apparatus of aspect 31, wherein the two or more walls that cooperate to form the lateral enclosure of each of the retaining structure and the forming box extend along the transport axis.

Aspect 37. A system for making a flexible package, comprising:

a packaging machine comprising a forming tube and at least one seal bar, the seal bar adapted to form at least one of a top flap disposed at a first end of the flexible package or a bottom flap disposed at a second end of the flexible package; and a modular apparatus for forming a flexible package, the modular apparatus comprising:

a retaining structure disposed downstream of the at least one seal bar, the retaining structure extending along a transport axis from a first end to a second end opposite the first end, wherein the retaining structure comprises two or more walls that cooperate to form a lateral enclosure, wherein each of the two or more walls extend from the first end to the second end of the retaining structure;

an elongated first downstream folding bar disposed downstream of the retaining structure, wherein the first downstream folding bar includes a contact portion and is displaceable between a first position in which the contact portion is a first transverse distance from the transport axis to a second position in which the contact surface of the first downstream folding bar is a second transverse distance from the transport axis and adjacent to the second end of the retaining structure, wherein the first transverse distance is greater than the second transverse distance, and wherein in the second position, the contact portion is adapted to apply pressure to the bottom flap disposed at the second end of the flexible package;

a forming box longitudinally-offset from the retaining structure and downstream of both the retaining structure and the first downstream folding bar, the forming box extending along the transport axis from a first end to a second end opposite the first end, wherein the forming box comprises two or more walls that cooperate to form a lateral enclosure, and wherein when the first downstream folding bar is in the first position, the contact portion of the first downstream folding bar is disposed between the second end of the retaining structure and the first end of the folding box, and wherein the flexible package is adapted to be disposed at least partially within the lateral enclosure;

a first upstream folding bar disposed upstream of the forming box and adjacent the first end of the forming box, wherein the first upstream folding bar has a contact portion and is displaceable between a first position in which the contact portion is a first transverse distance from the transport axis to a second position in which the contact surface of the first upstream folding bar is a second transverse distance from the transport axis and adjacent to the first end of the forming box, wherein the first transverse distance is greater than the second transverse distance, and wherein in the second position, the contact portion is adapted to apply pressure to the top flap disposed at the first end of the flexible package; and a second downstream folding bar disposed downstream of the forming box and adjacent the second end of the forming box, wherein the second downstream folding bar includes a contact portion and is displaceable between a first position in which a contact portion of the second downstream folding bar is a first transverse distance from the transport axis to a second position in which the contact surface of the second downstream folding bar is a second transverse distance from the transport axis and adjacent to the second end of the forming box, wherein the first transverse distance is greater than the second transverse distance, and wherein in the second position, the contact portion is adapted to apply pressure to the bottom flap disposed at the first end of the flexible package.

Aspect 38. The system of aspect 37, wherein each of the two or more walls of the retaining structure and/or the forming box extends from the first end to the second end of the retaining structure and the forming box.

Aspect 39. The system of aspect 37, wherein the two or more walls of one or more of the retaining structure and/or the forming box includes first, second, third, and fourth walls.

Aspect 40. The system of aspect 37, wherein any one of the forming bars can actuate in a direction parallel to the transport axis, optionally in coordinated manner with the seal jaws.

Aspect 41. The system of aspect 37, further comprising one or more retaining structure actuators operatively coupled to the retaining structure to actuate the retaining structure between a first position for receiving a package, a second position for retaining a package, and a third position for releasing the package; and/or one or more forming box actuators operatively coupled to the forming box to actuate the forming box between a first position for receiving a package, a second position for retaining a package, and a third position for releasing the package.

Aspect 42. The system of aspect 37, further comprising one or more retaining structure actuators operatively coupled to the retaining structure to actuate the retaining structure between a first position for receiving or releasing a package and a second position for retaining a package; and/or one or more forming box actuators operatively coupled to the forming box to actuate the forming box between a first position for receiving or releasing a package and a second position for retaining a package.

Aspect 43. The system of aspect 37, further comprising one or more first downstream folding bar actuators operatively coupled to the first downstream folding bar to actuate the first downstream folding bar in a direction substantially transverse to a transport path of a flexible material between the first position and the second position.

Aspect 44. The system of aspect 37, wherein the two or more walls that cooperate to form the lateral enclosure of each of the retaining structure and the forming box extend along the transport axis.

Aspect 45. An apparatus for forming a package, comprising:

one or more forming boxes coupled to a rotating plate that rotates the forming boxes through that least first, second, and third stations of the apparatus, wherein the forming boxes each include a plurality of walls that cooperate to define an internal volume and are each open on opposed first and second ends;

a dead plate disposed beneath the second ends of the forming boxes in at least the first and second stations; and a flap folding plate disposed above the forming box at the second station and coupled to an actuator that actuates the flap folding plate towards the forming box as the forming box transitions from the first station to the second station or when the forming box is positioned at the second station.

Aspect 46. An apparatus for forming a package, comprising:

one or more forming boxes coupled to a rotating plate that rotates the forming boxes through at least first, second, third, and fourth stations of the apparatus, wherein the forming boxes each include a plurality of walls that cooperate to define an internal volume and are each open on opposed first and second ends;

a dead plate disposed beneath the second ends of the forming boxes disposed at the first, second, and third stations;

a flap folding plate disposed above the forming box at the second station and coupled to an actuator that actuates the flap folding plate towards the forming box as the forming box transitions from the first station to the second station or when the forming box is positioned at the second station; and a holding plate disposed over the forming box disposed at the third station.

Aspect 47. The apparatus of aspect 45 or 46, further comprising a transition guide box disposed above the forming box at the first station.

Aspect 48. The apparatus of any one of aspects 45 to 47, wherein each forming box includes a first portion and a second portion, the second portion being separable from the first portion.

Aspect 49. The apparatus of aspect 48, wherein the second portion is coupled to a cam assembly comprising a cam follower, the dead plate includes a guide in which the cam follower resides, the guide defining a path for the cam follower that controls the position of the second portion such that the forming box can be actuated between an open to a closed position.

Aspect 50. The apparatus of any one of aspects 45 to 49, wherein the forming boxes have an internal volume as defined by the plurality of walls, the dead plate, and the flap folding plate in the actuated position that is about 70% to about 120% of a predetermined internal package volume.

Aspect 51. The apparatus of aspect 50, wherein the forming boxes have an internal volume of 80% to 90% of the predetermined internal package.

Aspect 52. The apparatus of any one of aspects 46 to 51, wherein the flap folding plate and the holding plate are coupled to a bracket.

Aspect 53. The apparatus of any one of aspects 46 to 51, wherein the flap folding plate is coupled to a bracket.

Aspect 54. The apparatus of any one of aspects 46 to 53, wherein the flap folding plate extends a distance between the first and second stations to at least an end of the second station.

Aspect 55. The apparatus of any one of aspects 46 to 54, wherein the holding plate extends a distance between the second and third stations to a distance past the third station.

Aspect 56. The apparatus of any one of aspects 46 to 55, wherein the holding plate is adjacent to the flap folding plate when the flap folding plate is actuated.

Aspect 57. The apparatus of any one of aspects 46 to 56, wherein the holding plate includes air passageways and outlets to direct heated and/or cooled air onto the package.

Aspect 58. The apparatus of any one of aspects 46 to 57, wherein the holding plate is stationary.

Aspect 59. The apparatus of any one of aspects 46 to 58, wherein the holding plate is coupled to an actuator that linearly actuates the holding plate between first and second positions.

Aspect 60. The apparatus of any one of aspects 45 to 59, wherein the dead plate includes air passageways and outlets to direct heated and/or cooled air onto the package.

Aspect 61. The apparatus of any one of aspects 45 to 60, wherein the flap folding plate comprises a rail defining an angled path along which a carriage assembly travels, and an actuating arm that actuates the flap folding plate from a first position disposed away from the forming box to a second position disposed over the forming box at the second station, the carriage assembly being coupled to a frame of the apparatus to position the flap folding plate at the second station, wherein the carriage assembly travels along the rail when the actuating arm actuates the flap folding plate.

Aspect 62. The apparatus of any one of aspects 45 and 47 to 61, further comprising a conveyor disposed beneath the third station such that the package is released from the forming box at the third station and is transferred to the conveyor.

Aspect 63. The apparatus of any one of aspects 46 to 62, further comprising a conveyor disposed beneath the fourth station such that the package is released from the forming box at the fourth station and is transferred to the conveyor.

Aspect 64. The apparatus of any one of aspects 45 to 63, wherein the apparatus comprises four forming boxes.

Aspect 65. The apparatus of any one of aspects 45 to 63, wherein the apparatus comprises six forming boxes.

Aspect 66. The apparatus of any one of aspects 45 to 65, wherein the apparatus comprises at least two forming boxes.

Aspect 67. A system for forming a package, comprising:

a continuous motion packaging machine; and the apparatus of any one of aspects 45 to 66.

Aspect 68. The system of aspect 67, further comprising a volume adjusting box disposed on the continuous motion packaging machine downstream of a seal jaw of the packaging machine for sealing a trailing seal of the package.

Aspect 69. The system of aspect 67 or 68, wherein the continuous motion packaging machine comprises a flap folding bar coupled to an actuator that actuates the flap folding bar in two directions.

Aspect 70. A method for forming a package, comprising:

receiving, in an interface apparatus, a package having a trailing seal extending outwardly from a panel of a package in a forming box positioned at a first station of the interface, wherein the package is received in the forming box with the trailing seal extending outwardly from an open top end of the forming box;

rotating the forming box to a second station of the interface;

actuating a flap folding plate from a first position to a second position in which the flap folding plate extends downwardly and across the package to engage the trailing seal and apply a pressure to the panel of the package from which the trailing seal extends, wherein the flap folding plate is actuated when the forming box is rotated to a predetermined distance between the first and second stations or at the second station; and rotating the forming box to a third station of the interface, wherein the forming box does not have a bottom surface at the third station and the package is transferred from the forming box through the open bottom surface to a take away device.

Aspect 71. A method for forming a package, comprising:

receiving, in an interface apparatus, a package having a trailing seal extending outwardly from a panel of a package in a forming box positioned at a first station of the interface, wherein the package is received in the forming box with the trailing seal extending outwardly from an open top end of the forming box;

rotating the forming box to a second station of the interface;

actuating a flap folding plate from a first position to a second position in which the flap folding plate extends downwardly and across the package to engage the trailing seal and apply a pressure to the panel of the package from which the trailing seal extends, wherein the flap folding plate is actuated when the forming box is rotated to a predetermined distance between the first and second stations;

rotating the forming box to a third station of the interface, wherein the third station comprises a holding plate disposed above the forming box, the holding plate disposed to engage the folded trailing seal and panel of the package; and rotating the forming box to a fourth station of the interface, wherein the forming box does not have a bottom surface at the fourth station and the package is transferred from the forming box through the open bottom surface to a take away device.

Aspect 72. The method of aspect 70, wherein a bottom surface of the forming box in the first and second third stations is provided by a dead plate, wherein the dead plate is not disposed in the third station such that the bottom surface of the forming box in the third station is open.

Aspect 73. The method of aspect 71, wherein a bottom surface of the forming box in the first, second, and third stations is provided by a dead plate, wherein the dead plate is not disposed in the fourth station such that the bottom surface of the forming box in the fourth station is open.

Aspect 74. The method of any one of aspects 70 to 73, wherein the flap folding plate actuates when the forming box is rotated 0° to 30° prior to the second station.

Aspect 75. The method of any one of aspects 71 to 74, wherein the holding plate extends to an end of the second station and abuts the flap folding plate when the flap folding plate is in the second position, and the flap folding plate is actuated from the second position to the first position once the forming box rotates 0° to 70° away from the second station.

Aspect 76. The method of any one of aspects 71 to 75, wherein the holding plate extends up to the fourth station.

Aspect 77. The method of any one of aspects 71 to 76, wherein the holding plate is stationary.

Aspect 78. The method of any one of aspects 71 to 77, further comprising actuating the holding plate from a first position in which it is disposed away from the forming box at the third station to a second position in which the holding plate is disposed over the forming box at the third station and contacts the package when the forming box is at least partially disposed under the holding plate.

Aspect 79. The method of aspect 78, wherein the holding plate extends to a distance between the second and third stations such that at least a portion of the holding plate substantially completely covers the forming box when the forming box is 0° to 70° past the second station.

Aspect 80. The method of any one of aspects 70 to 79, wherein the forming box is in a first position at the first station with first and second portions of the forming box separated to receive the package.

Aspect 81. The method of aspect 80, wherein the first and second portions of the forming box actuate to a second position in which the first and second portions are closed to retain the package in the forming box once the forming box rotates out of the first station and before the forming box reaches the pre-determined distance between the first and second stations.

Aspect 82. The method of any one of aspects 70 to 81, further comprising adjusting an internal volume of the package to a predetermined internal volume prior to receiving the package in the interface.

Aspect 83. The method of aspect 82, wherein the internal volume of the package is adjusted by filling the package with a gas prior to sealing the package.

Aspect 84. The method of aspect 82, wherein the internal volume of the package is adjusted by receiving the package in a volume adjusting box prior to sealing the package, actuating a volume adjusting plate to contact the package and apply a pressure to the package to adjust the internal volume of the package.

Aspect 85. The method of aspect 84, further comprises filling the package with a gas prior to adjusting the internal volume in the volume adjusting box.

Aspect 86. The method of any one of aspects 70 to 85 wherein the package has a predetermined internal volume, the forming box has an internal volume when the top wall is defined by the flap folding plate actuated in the second position, is about 70% to about 120% of the predetermined internal volume of the package.

Aspect 87. The method of aspect 86, wherein the internal volume of the forming box is about 80% to about 90% of the predetermined internal volume of the package.

Aspect 88. The method of any one of aspects 70 to 87, wherein the forming box rotates between the stations continuously.

Aspect 89. The method of aspect 88, wherein the forming box rotates at a uniform speed.

Aspect 90. The method of aspect 88, wherein the forming box rotates at variable speed.

Aspect 91. The method of any one of aspects 70 to 87, wherein the forming box rotates with intermittent motion stopping for a pre-set delay when a forming box is positioned at a station.

What is claimed:

1. An apparatus for forming a package, comprising:

one or more forming boxes coupled to a rotating plate that rotates the forming boxes through at least first, second, and third stations of the apparatus, wherein the forming boxes each include a plurality of walls that cooperate to define an internal volume and are each open on opposed first and second ends;

a dead plate disposed beneath the second ends of the forming boxes in at least the first and second stations;

a flap folding plate disposed above the forming box at the second station and coupled to an actuator that actuates the flap folding plate towards the forming box as the forming box transitions from the first station to the second station or when the forming box is positioned at the second station; and a holding plate disposed over the forming box disposed at the third station, wherein the flap folding plate extends a distance between the first and second stations to at least an end of the second station.

2. The apparatus of claim 1, further comprising a transition guide box disposed above the forming box at the first station.

3. The apparatus of claim 1, wherein each forming box includes a first portion and a second portion, the second portion being separable from the first portion.

4. The apparatus of claim 3, wherein the second portion is coupled to a cam assembly comprising a cam follower, the dead plate includes a guide in which the cam follower resides, the guide defining a path for the cam follower that controls the position of the second portion such that the forming box can be actuated between an open to a closed position.

5. The apparatus of claim 1, wherein the holding plate extends a distance between the second and third stations to a distance past the third station.

6. The apparatus of claim 1, wherein the holding plate is adjacent to the flap folding plate when the flap folding plate is actuated.

7. The apparatus of claim 1, wherein the holding plate includes air passageways and outlets to direct heated and/or cooled air onto the package.

8. The apparatus of claim 1, wherein the holding plate is stationary.

9. The apparatus of claim 1, wherein the flap folding plate comprises a rail defining an angled path along which a carriage assembly travels, and an actuating arm that actuates the flap folding plate from a first position disposed away from the forming box to a second position disposed over the forming box at the second station, the carriage assembly being coupled to a frame of the apparatus to position the flap folding plate at the second station, wherein the carriage assembly travels along the rail when the actuating arm actuates the flap folding plate.

10. The apparatus of claim 1, wherein the apparatus comprises four forming boxes.

11. A system for forming a package, comprising:

a continuous motion packaging machine; and the apparatus of claim 1.

12. The system of claim 11, wherein the continuous motion packaging machine comprises a flap folding bar coupled to an actuator that actuates the flap folding bar in two directions.

13. A method for forming a package, comprising:

receiving, in the apparatus of claim 1, a package having a trailing seal extending outwardly from a panel of a package in a forming box positioned at the first station of the apparatus, wherein the package is received in the forming box with the trailing seal extending outwardly from the open first end of the forming box;

rotating the forming box to the second station of the apparatus;

actuating the flap folding plate from a first position to a second position in which the flap folding plate extends downwardly and across the package to engage the trailing seal and apply a pressure to the panel of the package from which the trailing seal extends, wherein the flap folding plate is actuated when the forming box is rotated to a pre-determined distance between the first and second stations or at the second station; and rotating the forming box to the third station of the apparatus, wherein the forming box does not have a bottom surface at the third station and the package is transferred from the forming box through the open second end to a take away device.

14. The method of claim 13, further comprising:

rotating the forming box to a fourth station of the apparatus, wherein the forming box does not have a bottom surface at the fourth station and the package is transferred from the forming box through the open second end to a take away device.

15. The method of claim 14, wherein a bottom surface of the forming box in the first, second, and third stations is provided by the dead plate, wherein the dead plate is not disposed in the fourth station such that the second end of the forming box in the fourth station is open and has no bottom surface.

16. The method of claim 14, wherein the holding plate extends to an end of the second station and abuts the flap folding plate when the flap folding plate is in the second position, and the flap folding plate is actuated from the second position to the first position once the forming box rotates 0° to 70° away from the second station.

17. The method of claim 14, wherein the holding plate extends up to the fourth station.

18. The method of claim 14, further comprising actuating the holding plate from a first position in which it is disposed away from the forming box at the third station to a second position in which the holding plate is disposed over the forming box at the third station and contacts the package when the forming box is at least partially disposed under the holding plate.

19. The method of claim 13, wherein a bottom surface of the forming box in the first and second third stations is provided by the dead plate, wherein the dead plate is not disposed in the third station such that the second end of the forming box in the third station is open and has no bottom surface.

20. The method of claim 13, wherein the flap folding plate actuates when the forming box is rotated 0° to 30° prior to the second station.

21. The method of claim 13, wherein the forming box is in a first position at the first station with first and second portions of the forming box separated to receive the package.

22. The method of claim 21, wherein the first and second portions of the forming box actuate to a second position in which the first and second portions are closed to retain the package in the forming box once the forming box rotates out of the first station and before the forming box reaches the pre-determined distance between the first and second stations.

23. The method of claim 13, wherein the forming box rotates between the stations continuously.

24. The method of claim 13, wherein the forming box rotates with intermittent motion stopping for a pre-set delay when a forming box is positioned at a station.

25. An apparatus for forming a package, comprising:

one or more forming boxes coupled to a rotating plate that rotates the forming boxes through at least first, second, and third stations of the apparatus, wherein the forming boxes each include a plurality of walls that cooperate to define an internal volume and are each open on opposed first and second ends;

a dead plate disposed beneath the second ends of the forming boxes in at least the first and second stations;

a flap folding plate disposed above the forming box at the second station and coupled to an actuator that actuates the flap folding plate towards the forming box as the forming box transitions from the first station to the second station or when the forming box is positioned at the second station; and a holding plate disposed over the forming box disposed at the third station, wherein the holding plate is coupled to an actuator that linearly actuates the holding plate between first and second positions.

* * * * *